US008674616B2

(12) United States Patent
Holman et al.

(10) Patent No.: US 8,674,616 B2
(45) Date of Patent: Mar. 18, 2014

(54) DISTRIBUTED ILLUMINATION SYSTEM

(75) Inventors: Robert L. Holman, Evanston, IL (US); Matthew B. Sampsell, Chicago, IL (US); Jeffrey B. Sampsell, Pueblo West, CO (US)

(73) Assignee: QUALCOMM MEMS Technologies, Inc., San Diego, CA (US)

( * ) Notice: Subject to any disclaimer, the term of this patent is extended or adjusted under 35 U.S.C. 154(b) by 86 days.

(21) Appl. No.: 13/074,927

(22) Filed: Mar. 29, 2011

(65) Prior Publication Data

US 2011/0175533 A1 Jul. 21, 2011

Related U.S. Application Data

(63) Continuation of application No. PCT/US2009/005555, filed on Oct. 8, 2009.

(60) Provisional application No. 61/104,606, filed on Oct. 10, 2008.

(51) Int. Cl.
*H05B 37/02* (2006.01)
*G05F 1/00* (2006.01)

(52) U.S. Cl.
USPC ..... 315/224; 315/307

(58) Field of Classification Search
USPC ..... 315/307, 224, 291, 294, 299, 295, 308, 315/309, 312, 322; 362/294, 153, 404, 405, 362/406, 407, 408, 410, 411, 414
See application file for complete search history.

(56) References Cited

U.S. PATENT DOCUMENTS 4,282,862 A 8/1981 Soleau
4,375,312 A 3/1983 Tangonan
4,850,682 A 7/1989 Gerritsen (Continued)

FOREIGN PATENT DOCUMENTS

CN 2056903 5/1990
CN 1739317 A 2/2006

(Continued)

OTHER PUBLICATIONS

International Search Report and Written Opinion dated Jun. 1, 1010 in PCT/US2009/005555.

(Continued)

*Primary Examiner* — Minh D A
(74) *Attorney, Agent, or Firm* — Knobbe Martens Olson & Bear LLP

(57) ABSTRACT

The present invention introduces a new class of lightweight tile-based illumination systems for uses wherein thin directionally-illuminating light distributing engines are embedded into the body of otherwise standard building materials like conventional ceiling tiles along with associated means of electrical control and electrical power interconnection. As a new class of composite light emitting ceiling materials, the present invention enables a lighter weight more flexibly distributed overhead lighting system alternatives for commercial office buildings and residential housing without changing the existing materials. One or more spot lighting, task lighting, flood lighting and wall washing elements having cross-sectional thickness matched to that of the building material or tile into which they are embedded, are contained and interconnected within the material body's cross-section. Embedded power control devices interconnected to each lighting element in the distributed system communicate with a central switching center that thereby controls each light-emitting element in the system.

45 Claims, 96 Drawing Sheets

(56) References Cited

U.S. PATENT DOCUMENTS 4,947,291 A 8/1990 McDermott
5,422,683 A 6/1995 Tanigaki
5,467,417 A 11/1995 Nakamura et al.
5,506,929 A 4/1996 Tai et al.
5,515,184 A 5/1996 Caulfield et al.
5,544,268 A 8/1996 Bischel et al.
5,555,160 A 9/1996 Tawara et al.
5,592,332 A 1/1997 Nishio et al.
5,594,830 A 1/1997 Winston et al.
5,650,865 A 7/1997 Smith
5,659,410 A 8/1997 Koike et al.
5,671,994 A 9/1997 Tai et al.
5,703,667 A 12/1997 Ochiai
5,712,694 A 1/1998 Taira et al.
5,735,590 A 4/1998 Kashima et al.
5,777,589 A 7/1998 Gale et al.
5,808,708 A 9/1998 Oyama et al.
5,810,464 A 9/1998 Ishikawa et al.
5,854,872 A 12/1998 Tai
5,883,684 A 3/1999 Millikan et al.
5,913,594 A 6/1999 Iimura
5,982,540 A 11/1999 Koike et al.
6,002,829 A 12/1999 Winston et al.
6,014,192 A 1/2000 Lehureau et al.
6,021,007 A 2/2000 Murtha
6,040,937 A 3/2000 Miles
6,048,071 A 4/2000 Sawayama
6,094,285 A 7/2000 Wickham et al.
6,151,089 A 11/2000 Yang et al.
6,196,691 B1 3/2001 Ochiai
6,199,989 B1 3/2001 Maeda et al.
6,259,854 B1 7/2001 Shinji et al.
6,273,577 B1 8/2001 Goto et al.
6,369,947 B1 4/2002 Staub et al.
6,392,368 B1 5/2002 Deller et al.
6,402,325 B1 6/2002 Yamamoto
6,412,969 B1 7/2002 Torihara et al.
6,421,103 B2 7/2002 Yamaguchi
6,424,660 B2 7/2002 Jacobson
6,592,234 B2 7/2003 Epstein et al.
6,598,987 B1 7/2003 Parikka
6,608,453 B2 8/2003 Morgan et al.
6,630,968 B1 10/2003 Tsuchihashi et al.
6,657,683 B2 12/2003 Richard
6,667,782 B1 12/2003 Taira et al.
6,669,350 B2 12/2003 Yamashita et al.
6,674,562 B1 1/2004 Miles et al.
6,773,126 B1 8/2004 Hatjasalo et al.
6,871,982 B2 3/2005 Holman et al.
6,883,924 B2 4/2005 Maeda et al.
6,891,530 B2 5/2005 Umemoto et al.
6,951,401 B2 10/2005 Van Hees et al.
6,967,779 B2 11/2005 Fadel et al.
6,972,753 B1 12/2005 Kimura et al.
6,998,196 B2 2/2006 Rich et al.
7,010,212 B2 3/2006 Emmons et al.
7,014,349 B2 3/2006 Shinohara et al.
7,018,088 B2 3/2006 Yu et al.
7,041,344 B2 5/2006 Kusume et al.
7,072,096 B2 7/2006 Holman et al.
7,123,216 B1 10/2006 Miles
7,125,137 B2 * 10/2006 Kitajima et al. ..... 362/153
7,161,556 B2 1/2007 Morgan et al.
7,178,941 B2 2/2007 Roberge et al.
7,202,613 B2 * 4/2007 Morgan et al. ..... 315/312
7,210,806 B2 5/2007 Holman et al.
7,218,812 B2 5/2007 Maxwell et al.
7,221,104 B2 * 5/2007 Lys et al. ..... 315/291
7,223,010 B2 5/2007 Min et al.
7,262,916 B2 8/2007 Kao et al.
7,278,774 B2 10/2007 Chang
7,309,965 B2 * 12/2007 Dowling et al. ..... 315/318
7,311,423 B2 12/2007 Frecska et al.
7,327,510 B2 2/2008 Cummings et al.
7,360,899 B2 4/2008 McGuire et al.
7,360,939 B2 4/2008 Sugiura
7,376,308 B2 5/2008 Cheben et al.
7,380,970 B2 6/2008 Hwang et al.
7,400,439 B2 7/2008 Holman et al.
7,427,840 B2 * 9/2008 Morgan et al. ..... 315/295
7,520,642 B2 4/2009 Holman et al.
7,573,631 B1 8/2009 Amm
7,656,391 B2 2/2010 Kimura et al.
7,663,714 B2 2/2010 Haga et al.
7,748,878 B2 7/2010 Lee
7,766,531 B2 8/2010 Anderson et al.
8,079,743 B2 12/2011 Bailey et al.
2001/0019479 A1 9/2001 Nakabayashi et al.
2001/0022636 A1 9/2001 Yang et al.
2001/0030861 A1 10/2001 Oda et al.
2001/0055076 A1 12/2001 Ochi et al.
2002/0044445 A1 4/2002 Bohler et al.
2002/0054258 A1 5/2002 Kondo et al.
2002/0106182 A1 8/2002 Kawashima
2002/0113241 A1 8/2002 Kubota et al.
2002/0172039 A1 11/2002 Inditsky
2002/0180910 A1 12/2002 Umemoto et al.
2003/0016930 A1 1/2003 Inditsky
2003/0026536 A1 2/2003 Ho
2003/0030764 A1 2/2003 Lee
2003/0034445 A1 2/2003 Boyd et al.
2003/0067760 A1 4/2003 Jagt et al.
2003/0071947 A1 4/2003 Shiraogawa et al.
2003/0086030 A1 5/2003 Taniguchi et al.
2003/0086031 A1 5/2003 Taniguchi et al.
2003/0090887 A1 5/2003 Igarashi et al.
2003/0103344 A1 6/2003 Niida et al.
2003/0123245 A1 7/2003 Parker
2003/0128538 A1 7/2003 Shinohara et al.
2003/0160919 A1 8/2003 Suzuki et al.
2003/0165067 A1 9/2003 Imamura et al.
2003/0169385 A1 9/2003 Okuwaki
2003/0184989 A1 10/2003 Matsumoto et al.
2003/0210222 A1 11/2003 Ogiwara et al.
2004/0032659 A1 2/2004 Drinkwater
2004/0080938 A1 4/2004 Holman et al.
2004/0090765 A1 5/2004 Yu et al.
2004/0135494 A1 7/2004 Miyatake
2004/0141321 A1 7/2004 Dowling et al.
2004/0170373 A1 9/2004 Kim
2004/0207995 A1 10/2004 Park et al.
2004/0228112 A1 11/2004 Takata
2004/0246743 A1 12/2004 Lee et al.
2005/0002175 A1 1/2005 Matsui et al.
2005/0024890 A1 2/2005 Yamamoto et al.
2005/0069254 A1 3/2005 Schultheis et al.
2005/0116667 A1 * 6/2005 Mueller et al. ..... 315/312
2005/0117190 A1 6/2005 Iwauchi et al.
2005/0133761 A1 6/2005 Thielemans
2005/0141065 A1 6/2005 Masamoto
2005/0185416 A1 8/2005 Lee et al.
2005/0231981 A1 10/2005 Hoelen et al.
2005/0259302 A9 11/2005 Metz et al.
2005/0259939 A1 11/2005 Rinko
2005/0270798 A1 12/2005 Lee et al.
2005/0271325 A1 12/2005 Anderson et al.
2006/0002675 A1 1/2006 Choi et al.
2006/0022212 A1 2/2006 Waitl et al.
2006/0022214 A1 2/2006 Morgan et al.
2006/0024017 A1 2/2006 Page et al.
2006/0044523 A1 3/2006 Teijido et al.
2006/0061705 A1 3/2006 Onishi
2006/0181903 A1 8/2006 Okuwaki
2006/0187676 A1 8/2006 Ishikura
2006/0193120 A1 8/2006 Huang
2006/0215958 A1 9/2006 Yeo et al.
2006/0265919 A1 11/2006 Huang
2006/0268574 A1 11/2006 Jung et al.
2006/0274243 A1 12/2006 Iijima et al.
2006/0279558 A1 12/2006 Val Delden et al.
2007/0001187 A1 1/2007 Kim
2007/0007898 A1 1/2007 Bruning
2007/0116424 A1 5/2007 Ting et al.
2007/0133226 A1 6/2007 Mi

(56) References Cited

U.S. PATENT DOCUMENTS

| | | | | |
|---|---|---|---|---|
| 2007/0147087 | A1 | 6/2007 | Parker et al. | |
| 2007/0187852 | A1 | 8/2007 | Parker et al. | |
| 2007/0189036 | A1 | 8/2007 | Chen et al. | |
| 2007/0211457 | A1* | 9/2007 | Mayfield et al. | 362/223 |
| 2007/0247842 | A1* | 10/2007 | Zampini et al. | 362/227 |
| 2007/0247872 | A1 | 10/2007 | Lee et al. | |
| 2007/0292091 | A1 | 12/2007 | Fujii et al. | |
| 2008/0018617 | A1 | 1/2008 | Ng et al. | |
| 2008/0054821 | A1 | 3/2008 | Busby | |
| 2008/0071391 | A1 | 3/2008 | Busby et al. | |
| 2008/0094853 | A1 | 4/2008 | Kim et al. | |
| 2008/0137004 | A1 | 6/2008 | Iwasaki et al. | |
| 2008/0192458 | A1 | 8/2008 | Li | |
| 2008/0232135 | A1 | 9/2008 | Kinder et al. | |
| 2008/0278460 | A1 | 11/2008 | Arnett et al. | |
| 2008/0278663 | A1 | 11/2008 | Krishnan et al. | |
| 2008/0285307 | A1 | 11/2008 | Aylward et al. | |
| 2009/0015753 | A1 | 1/2009 | Ye | |
| 2009/0026978 | A1 | 1/2009 | Robinson | |
| 2009/0086466 | A1 | 4/2009 | Sugita et al. | |
| 2009/0096956 | A1 | 4/2009 | Uehara et al. | |
| 2009/0105856 | A1 | 4/2009 | Kurt et al. | |
| 2009/0241052 | A1 | 9/2009 | Ha et al. | |
| 2009/0244690 | A1 | 10/2009 | Lee | |
| 2010/0052939 | A1 | 3/2010 | Liang | |
| 2010/0053959 | A1 | 3/2010 | Ijzerman et al. | |
| 2010/0096718 | A1 | 4/2010 | Hynecek et al. | |
| 2010/0118563 | A1 | 5/2010 | Shen et al. | |
| 2010/0141153 | A1 | 6/2010 | Recker et al. | |
| 2010/0142226 | A1 | 6/2010 | Vogt et al. | |
| 2010/0177533 | A1 | 7/2010 | Griffiths et al. | |
| 2010/0187422 | A1 | 7/2010 | Kothari et al. | |
| 2010/0238529 | A1 | 9/2010 | Sampsell et al. | |
| 2010/0278480 | A1 | 11/2010 | Vasylyev | |
| 2011/0096570 | A1 | 4/2011 | Vissenberg et al. | |
| 2011/0101869 | A1 | 5/2011 | Pope | |
| 2011/0156911 | A1 | 6/2011 | Caglianone | |
| 2011/0175553 | A1 | 7/2011 | Sampsell | |

FOREIGN PATENT DOCUMENTS

| | | | |
|---|---|---|---|
| CN | 101050847 | | 10/2007 |
| DE | 3402746 | | 8/1985 |
| DE | 199 42 513 | | 3/2001 |
| EP | 0 362 993 | | 4/1990 |
| EP | 0 879 991 | | 11/1998 |
| EP | 0 907 050 | | 4/1999 |
| EP | 1 003 062 | | 5/2000 |
| EP | 1 122 586 | | 8/2001 |
| EP | 1174834 | A2 | 1/2002 |
| EP | 1 251 454 | | 4/2002 |
| EP | 1 279 892 | | 1/2003 |
| EP | 1 329 664 | | 7/2003 |
| EP | 1 336 876 | | 8/2003 |
| EP | 1 347 315 | | 9/2003 |
| EP | 1 389 775 | | 2/2004 |
| EP | 1 413 543 | | 4/2004 |
| EP | 1 437 610 | | 7/2004 |
| EP | 1 544 537 | | 6/2005 |
| EP | 1 577 701 | | 9/2005 |
| EP | 1 698 918 | | 9/2006 |
| EP | 1 734 401 | | 12/2006 |
| EP | 1 843 084 | | 10/2007 |
| EP | 1 975 651 | | 10/2008 |
| GB | 2 260 203 | | 4/1993 |
| GB | 2321532 | | 7/1998 |
| GB | 2 331 615 | | 5/1999 |
| GB | 2 336 933 | | 11/1999 |
| JP | 60-242408 | | 12/1985 |
| JP | 07-199829 | | 8/1995 |
| JP | 09-022012 | | 1/1997 |
| JP | 09-171111 | | 6/1997 |
| JP | 09-281917 | | 10/1997 |
| JP | 09-311333 | | 12/1997 |
| JP | 11-52887 | | 2/1999 |
| JP | 11-224524 | | 8/1999 |
| JP | 11-227248 | | 8/1999 |
| JP | 11-232919 | | 8/1999 |
| JP | 11-326898 | | 11/1999 |
| JP | 2000-314882 | | 11/2000 |
| JP | 2001-243822 | | 9/2001 |
| JP | 2001-297615 | | 10/2001 |
| JP | 2001-320092 | | 11/2001 |
| JP | 2002-090549 | | 3/2002 |
| JP | 2002-108227 | | 4/2002 |
| JP | 2002131443 | A | 5/2002 |
| JP | 2002-163907 | | 6/2002 |
| JP | 2002-174732 | | 6/2002 |
| JP | 2002170689 | A | 6/2002 |
| JP | 2002-245835 | | 12/2002 |
| JP | 2003-018669 | | 1/2003 |
| JP | 2003-045678 | | 2/2003 |
| JP | 2003-057652 | | 2/2003 |
| JP | 2003-057653 | | 2/2003 |
| JP | 2003-066451 | | 3/2003 |
| JP | 2003-140118 | | 5/2003 |
| JP | 2003-149642 | | 5/2003 |
| JP | 2004-149643 | | 5/2003 |
| JP | 2003-173713 | | 6/2003 |
| JP | 2004-012918 | | 1/2004 |
| JP | 2004-062099 | | 2/2004 |
| JP | 2004-087409 | | 3/2004 |
| JP | 2004-186024 | | 7/2004 |
| JP | 2004-212673 | | 7/2004 |
| JP | 2004247273 | A | 9/2004 |
| JP | 2005063859 | A | 3/2005 |
| JP | 2005135658 | A | 5/2005 |
| JP | 2005-259365 | | 9/2005 |
| JP | 2005-316178 | | 11/2005 |
| JP | 2006 107993 | | 4/2006 |
| JP | 2006092917 | A | 4/2006 |
| JP | 2006-185765 | | 7/2006 |
| JP | 2008-103110 | | 5/2008 |
| JP | 2008533669 | A | 8/2008 |
| KR | 10-0754400 | | 8/2007 |
| KR | 10-0776727 | | 11/2007 |
| KR | 10-2008-0088683 | | 10/2008 |
| WO | WO 95/01584 | | 1/1995 |
| WO | WO 95/14256 | | 5/1995 |
| WO | WO 98/19201 | | 5/1998 |
| WO | WO 98/32047 | | 7/1998 |
| WO | WO 99/63394 | | 12/1999 |
| WO | WO 01/57434 | | 8/2001 |
| WO | WO 01/84228 | | 11/2001 |
| WO | WO 01/84229 | | 11/2001 |
| WO | WO 02/06858 | | 1/2002 |
| WO | WO 02/25359 | | 3/2002 |
| WO | WO 02/097324 | | 12/2002 |
| WO | WO 03/032058 | | 4/2003 |
| WO | WO 03/038509 | | 5/2003 |
| WO | WO 03/056876 | | 7/2003 |
| WO | WO 03/062912 | | 7/2003 |
| WO | WO 2004/088372 | | 10/2004 |
| WO | WO 2005/011012 | | 2/2005 |
| WO | WO 2005/073622 | | 8/2005 |
| WO | WO 2005/088367 | | 9/2005 |
| WO | WO 2007/064133 | | 6/2007 |
| WO | WO 2008/038754 | | 4/2008 |
| WO | WO 2008/062363 | | 5/2008 |
| WO | WO 2009/011922 | | 1/2009 |
| WO | WO 2011/033429 | | 3/2011 |
| WO | WO 2011/039688 | | 4/2011 |

OTHER PUBLICATIONS

Extended European Search Report dated Mar. 20, 2012 in App. No. 09819579.5.

Office Action dated Aug. 22, 2012 in Chinese App. No. 200980140411.8.

Notice of Reasons for Rejection dated Nov. 13, 2012 in Japanese patent application No. 2011-531026.

* cited by examiner

| LEVEL | % ON | R(TOTAL) | BRANCHES |
|---|---|---|---|
| 1 | 0.0% | ∞ | 0 |
| 2 | 18.2% | 45.00 | $R_{T3}$ |
| 3 | 27.3% | 30.00 | $R_{T2}$ |
| 4 | 45.5% | 18.00 | $R_{T2} \parallel R_{T3}$ |
| 5 | 54.5% | 15.00 | $R_{T1}$ |
| 6 | 72.7% | 11.25 | $R_{T1} \parallel R_{T3}$ |
| 7 | 81.8% | 10.00 | $R_{T1} \parallel R_{T2}$ |
| 8 | 100.0% | 8.18 | $R_{T1} \parallel R_{T2} \parallel R_{T3}$ |

DISTRIBUTED ILLUMINATION SYSTEM

CROSS-REFERENCE TO RELATED APPLICATIONS

This application is a continuation of International Application No. PCT/US2009/005555, filed Oct. 8, 2009, which claims the benefit of U.S. Provisional Application No. 61/104,606, filed Oct. 10, 2008. The disclosures of all of the above-referenced prior applications are considered part of, and are incorporated by reference in, this disclosure.

BACKGROUND OF THE INVENTION

This section is intended to provide a background or context to the invention that is, inter alia, recited in the claims. The description herein may include concepts that could be pursued, but are not necessarily ones that have been previously conceived or pursued. Therefore, unless otherwise indicated herein, what is described in this section is not prior art to the description and claims in this application and is not admitted to be prior art by inclusion in this section.

For industrial, commercial, and residential applications, consumers demand more complicated lighting systems, while also desiring flexibility and adaptability. However, the general look, feel and physical construction of overhead ceiling lighting systems around the world have not changed appreciably in the last 50 years. Industrial overhead lighting, whether in high-rise office buildings, factories, or industrial office parks has been and still is typified by regular lines of cumbersome high power down lighting fixtures mounted within (or hanging through) openings or clearances made in the lightweight decorative (sound absorbing) ceiling panels surrounding them. Each present day down lighting fixture is typically designed to illuminate about 36 square feet on the floor below, which requires about 4000 lumens to do so to general standards (500-1000 Lux illuminance). High voltage (ac) electrical power is applied to large groups of these high light output lighting fixtures at the same time using expensive high voltage cabling and conduits. The fixtures appear from below as physically bright areas of light and glare. Energy waste due to fixture inefficiency and their substantial amounts of misdirected light is enormous. Dimming the conventional light bulb types that are in common practice is inefficient, and not generally applied, cutting off an attractive means of energy conservation. Floor and wall areas not needing light are often lighted anyway, and areas only needing partial lighting are often lighted fully.

No remotely similar system is deployable using conventional lighting practices and conventional lighting hardware. Ceiling panel materials are typically 0.5-0.75 inches thick and quite fragile in their construction. Classical lighting fixtures and luminaires are simply too thick and too heavy to be embedded in such materials, whether at time of manufacture or installation. Embedding high voltage power lines in conventional ceiling material is discouraged by Governmental safety regulations and by incompatibilities in the way the classical lighting fixtures are installed and mounted.

Low voltage lighting fixtures based on the semiconductor light emitting diode (LED) have been attracting market interest lately primarily because of their potential for improved energy efficiency, their low voltage DC operation, their freedom from hazardous materials like Hg, their lack of infrared and UV radiation, their ease of dimming, their ease of color adjustment, and their long service life. For a variety of reasons, almost all early commercial emphasis is being placed on LED lighting treatments that directly replace (and imitate) existing light bulbs, whether as screw-in bulb alternatives, or in fixture formats that even more deliberately imitate and thereby substitute for the existing fluorescent troffers and recessed down-lighting can form factors. As it's turning out, however, the early LED fixture substitutions are only somewhat lighter in weight and only somewhat more compact than their traditionally cumbersome light bulb counterparts.

Semiconductor LEDs are chosen for all practical examples of embedded luminaires in the present invention for much the same reasons, but more relevantly to the invention herein for the need to exploit their intrinsic compactness. Over time, other suitable luminaire types may emerge based on organic LEDs (referred to as OLED), thin flat fluorescent sources, flat micro plasma discharge sources and electron stimulated luminescence (referred to as ESL), to mention a few.

While LEDs generally satisfy the present invention's need for thinness, in one embodiment, applying LED light sources in accordance with the present invention requires a degree of adaptation from prior art LEDs. Preferable luminaire configurations need fit substantially within the prevailing ceiling tile cross-section, mated with interconnected low-voltage DC power conducting busses, electronic power control components and light sensing components. Power conducting busses and various integrated electronic component elements are typically thin in cross-section, but arranging comparably thin LED luminaires with acceptably distinct down-lighting illumination patterns has not previously been done.

Bare semiconductor LED emitters could be embedded in ceiling material bodies according to the present invention, but doing so would provide few advantages. Not only would light emission spread undesirably in all angular directions, but also LED brightness would simply be too high to risk human exposure to accidental direct view.

A number of prior art arrangements combining LEDs with secondary optics (e.g., lenses, reflectors and diffusers) could also be embedded in the body of ceiling materials according to the present invention. While doing so is described in some detail below, no known prior art arrangements adequately mask direct view of the LEDs' extraordinarily high brightness level (sometimes 200 times greater than the brightest commercially available light bulb fixture) without destroying the LEDs' corresponding energy efficiency, creating off-angle glare, or both.

A few new examples of embeddable luminaires adapting prior art LED combinations are introduced below that successfully dilute the LED brightness visible to observers, while also achieving more distinct illumination patterns, smaller loss of energy efficiency and reduced glare.

Exemplary embodiment of luminaires for the present invention are taken from U.S. Provisional Patent Application Ser. No. 61/024,814 (International Stage Patent Application Serial Number PCT/US2009/000575) entitled Thin Illumination System, and to a lesser extent from issued U.S. Pat. No. 7,072,096 (entitled Uniform Illumination System) and U.S. Pat. No. 6,871,982, U.S. Pat. No. 7,210,806, 2007-0211449 (entitled High Density Illumination System). These luminaire examples combine reduced viewing brightness and glare reduction with simple means for changing the luminaires beam pattern (shape and angular coverage). They apply new combinations of LEDs with efficient forms of angle transforming couplers, light guide plates with light redirecting films, and beam width adjusting films.

Embedding a thoughtful distribution of luminaires within the thin materials of an overhead lighting system has additional advantages in energy conservation, in enabling more sophisticated forms of lighting control, and in reductions in cost of ownership associated with simplified infrastructure.

Energy conservation opportunities are enabled in the present invention by its capacity to use and separately control the illumination from a larger number of lighting fixtures per unit area than is common practice. With more lighting sources under control, floor and wall areas may be illuminated according to need.

Lighting systems have previously been used that provide some minor level of control to a user. Prior art examples of commercial lighting systems embodying a form of implied networking and programmatic control may include those used in the switching of stage and theatrical lighting luminaires, and those used in keypad control of broader home management systems integrating control of security, heating and cooling, window shades, watering systems and home entertainment, in addition to indoor and outdoor lighting. Those particular networks interconnect and control discretely powered appliances mounted on a wide variety of supporting structures in a wide variety of locations with little reduction in wiring and infrastructure complexity.

Aside from these network-based attributes, the embedded nature of overhead lighting systems based on the present invention enable a distinctive new look or visual appearance to both lighted and unlighted ceilings. This distinctive look may be varied geometrically according to the artistic choices of lighting architects and building contractors involved, but is generally set forth by smaller square, rectangular and circular lighting apertures than has become traditional, each being less conspicuous, lower in glare and more finely distributed per unit ceiling area than is present practice. Lighting apertures are of similar appearance throughout the integrated ceiling systems whether providing general flood lighting, task lighting, spot lighting or wall washing as needed.

These unobtrusive lighting apertures resemble those drywall installations where conventional lighting fixture apertures are cemented to the drywall cutout right on the job site. Lighting fixtures that enable this practice are referred to as being mudded in. Significant on site finishing labor is required to match ceiling material to lighting fixture.

SUMMARY OF THE INVENTION

The present invention introduces common thin tile-like building materials that are embedded with thin tile-like and directionally illuminating lighting engines, the means to access power for this lighting and the means to control this lighting. While most examples of this invention are aimed at overhead lighting, usage extends to a wider range of thin-profile building materials commonly used in ceilings and walls. Such multifunctional lighting materials will be shown as introducing a new generation of energy conservation options especially for the commercial overhead lighting systems they replace, as extending the range of overhead lighting design options available to lighting architects, and as providing a more efficient means of overhead lighting manufacturing and installation. By embedding both lighting and the control of lighting within otherwise common building materials, the physical infrastructures in overhead lighting are significantly simplified, as are the corresponding commercial lighting distribution procedures. Moreover, rather than deploying only groups of large powerful lighting fixtures, the distributed approach described by the present invention enables some substantial improvements in the aesthetic qualities of overhead lighting not possible with standard practice.

Building materials, particularly ceiling materials, are manufactured with embedded lighting, light and motion detectors, power distribution and power controllers represent a new class of commercial lighting system products, while potentially streamlining the cumbersome steps taken today when installing commercial ceilings, providing electrical power conduits, installing traditional lighting fixtures, and installing the traditional light switches that control banks of installed lighting fixtures at the same time.

The present invention provides practical means for bringing about a substantial change in this inefficient and static lighting landscape. The present invention describes a new system of overhead ceilings in which a distribution of thin, directable and aesthetically pleasing down-lights has been combined with power transmitting electrical conductors, electrical connectors, power controlling circuit elements, and light sensing electronic elements, and collectively embedded into common lightweight decorative (and sound absorbing) ceiling materials themselves, creating an integrated lighting system that eliminates numerous sources of inefficiency (energy, human and material).

Embedding light fixtures, power delivery means, light sensing means and means of switching and control at the time of ceiling material manufacture, simplifies the installation of ceiling system lighting, reduces the infra-structural cost of that lighting, eliminates physical danger from falling ceilings and their fixtures in times of natural disasters, and greatly expands the range of illumination qualities that can be achieved.

More sophisticated forms of lighting control are enabled in the present invention by its capacity to incorporate different types of embedded down lights (spot, task, flood and wall wash) to illuminate any given floor or wall area than would be practical using traditional recessed ceiling fixtures. Because the extra functionality is embedded substantially into the ceiling materials at the time of their manufacture, prior to shipment to an installation site, the cost and time of installation of the implied complexity is negligible. The same advantages in energy conservation and lighting control are all but impractical to achieve with traditionally bulky fluorescent flood lighting troffers and recessed down-lighting cans, even if they were installed in a finer grid than usual. The dimming inefficiencies and objectionable visual artifacts of these classical light bulb sources nullify energy savings and diminish the quality of illumination, and installing extra lighting fixtures increases the infrastructure cost required for physical support and electrical interconnection.

Energy conservation and control advantages within the present invention stem from the ease with which networking principals are applied. Embedding interconnection, power distribution and control elements along with a distribution of co-embedded luminaires at time of manufacture, enables cost effective implementation of an intelligent communications and control network, with even more functionality achievable when feedback sensors are also embedded, including sensors such as light level meters, light color meters, power meters, and motion sensors.

A master network controller easily orchestrates beneficial energy efficiency strategies across the embedded network. Lighting levels on floors and walls may be adjusted in real-time according to local need. Embedded light sensors are deployable to monitor ambient lighting conditions locally to communicate local conditions to appropriate power controllers, enabling intelligent changes in the level of illumination being provided. With such intelligence, lighting systems developed according to the present invention may respond proportionally, raising illuminance in some areas, reducing it in others.

The master controller in the present invention may communicate with sensors embedded as a means of detecting human feedback throughout the ceiling system coverage area.

By this means, an office worker in an underlying work cubical may signal an embedded sensor above (either by motion, IR, RF or through a computer-based interface) to implement a lighting action taken by the network.

A remotely located master controller may provide a digital broadcast either as a signal superimposed directly on the low-voltage wiring used to provide electrical operating power to the embedded luminaires themselves, as a signal transcoded onto the low voltage wiring from the AC mains or wirelessly via an over-the-air digital broadcast, not only to be received and interpreted by each embedded luminaire in the ceiling system, but also using lower-level instruction sets to be interpreted by the individual light distributing engines contained within the luminaires embedded in a given tile, and even by the individual light emitting sources contained within each light distributing engine. In doing so, a much finer degree of autonomous lighting control is provided by the present invention, enabling the delivery of power control instructions that are much more sophisticated in their intent than the simple practice of turning a lighting fixture on and off, or dimming large groups of lighting fixtures to a common level.

The present networking invention applies to the unique aspects of directly powering and controlling a grid-work of unobtrusive luminaires embedded in the thickness of common ceiling materials. The network control algorithms and protocols employed are quite different and particular to the embedded nature of the application and do not require introduction of a redundant control infrastructure.

It is, therefore, an object of the invention to provide a distributed means of overhead LED illumination integrated and interconnected in various patterns and arrangements within the bodies of conventional building materials used in the construction of commercial and residential ceilings.

The present invention enables a simpler more efficient workflow that conserves both installation cost and material. According to the present invention, passive ceiling materials such as gypsum tiles are manufactured with precise cutouts facilitating the embedding of dedicated electrical wiring, dedicated down lighting elements and their associated electronic components. Once fitted with proper holes, indentations and surface finishing, the new form of ceiling tile material is embedded with the necessary components, those being as mentioned above. Such integrated assembly transforms otherwise common ceiling materials (and even other similar thin form building materials) into complete lighting system products. These products are delivered to the job site ready to be installed not only as ceiling surfaces, but also as active components in a working distributed lighting system.

In another form of the present invention, electricians on the job site may replace one preinstalled luminaire with one of a different performance characteristic, or may add snap in luminaires of their own choosing to ceiling tiles pre-manufactured with all other necessary-elements permanently embedded.

In most forms of the present invention, the output beam produced by the embeddable light distributing engines involved may be easily adjusted in angular qualities such as extent or pattern of illumination after installation simply by switching out optical film packs conveniently attached to the aperture of illumination and provided especially to widen the beam's illuminating coverage. In this manner, wide beams may be switched to narrow, square to circular, hard edge to soft edge, etc.

It is another object of the invention to provide conventional ceiling materials, such as ceiling tiles and dry wall panels, modified with various patterns of miniature and widely-spaced through holes, each through hole fitted with one or more miniature light distributing engines, each engine composed of LEDs and secondary optical elements designed to collect and redistribute the emitted light into a useful beam of circular or rectangular cross-section and particular angular range directed away from the ceiling surface towards objects on the floor or wall below.

It is a further object of the invention to provide within or on the upper surface of each modified ceiling material a thin means of electrical circuitry interconnecting each LED light engine contained within, and also one or more conductors routing electrical voltage and current from a remote source.

It is also an object of the invention to provide as part of the electrical circuitry contained within each modified ceiling material one or more electrical power dividing, modulating and switching means so that the remotely supplied source of voltage and current is applied as may be dictated to each miniature light distributing engine thereby setting the level of light emitted, whether full off, full on, or a light intensity level in between.

It is still another object of the invention to provide one or more remotely located central processor unit that broadcasts unique power-switching instructions for each miniature light distributing engine or group of miniature light distributing engines contained within each modified ceiling material (tile or panel), doing so by means of a coded signal designating the desired state of illumination to be provided, including the light level in lumens, the emitting color when a range of possible emitting colors are involved, and the beam angle emitted when light distributing engines having different beam angles are involved.

It is yet another object of the invention to provide a physically wired or wireless communications network connecting the remotely located central processors and the electrical power switching means on each modified ceiling material containing one or more miniature light distributing engines.

It is further an object of the invention to provide a physically wired or wireless interconnection means bridging between each modified ceiling tile in a given ceiling system using electrical connectors built into the surface of each modified ceiling tile, flexible circuit ribbons or cables of sufficient length with electrical connectors at their ends, or wireless transmitters and receivers that send and receive digitally encoded light signals or radio wave signals between corresponding units on adjacent modified ceiling tiles.

It is still an additional object of the invention to provide an overhead ceiling system comprised of modified ceiling materials, each ceiling panel containing one or more widely spaced miniature light distributing engines that collectively provide a uniform illumination field to physical objects on the floor below, while the light emitting regions themselves remain but a small fraction of the surface area of each modified ceiling material, and otherwise appear blended into the normal ceiling surface appearance perceived as being relatively inconspicuous when viewed from below.

It is yet one other object of the invention to provide a light producing ceiling panel compatible with conventional overhead suspension systems, so that the light from a panel or group of panels can be activated to limit its illumination pattern to a fixed area below as in work or task lighting.

It is additionally an object of the invention to provide a light producing ceiling panel (or tile) compatible with conventional overhead ceiling systems for such building materials, so that the light from a panel or group of panels can be activated to provide its illumination pattern on an oblique downwards angle to wide portions of a wall surface with generally even illumination from floor to ceiling, as in wall wash lighting.

It is yet an additional object of the invention to provide a light producing ceiling tile compatible with conventional overhead suspension systems, whose down directed light from a tile or group of tiles can be viewed generally from below and outside of its region of intended illumination as having weak or significantly reduced apparent brightness or glare, as an illuminating beam with sharply cutoff angular behavior.

It is one further object of the invention to provide a light producing ceiling panel compatible with conventional overhead ceiling systems, so that the light from a emitters within a panel or group of panels can be activated selectively to tailor the resulting composite illumination pattern to a general area below as in providing work or task lighting and flood or area lighting simultaneously in the desired proportions.

These and other advantages and features of the invention, together with the organization and manner of operation thereof, will become apparent from the following detailed description when taken in conjunction with the accompanying drawings, wherein like elements have like numerals throughout the several drawings described below.

BRIEF DESCRIPTION OF THE DRAWINGS

FIG. 99 is a perspective view identical in all respects to that of FIG. 98, except that optional airflow slots and their decorative covers have been eliminated from this embodiment.

FIG. 100 is a perspective view from the floor beneath of yet another illustrative embodiment of present tile illuminating system invention, this one embedding two separate two-segment light distributing engines of the type illustrated in FIGS. 82-99, both in the proximate center of an illustrative tile material.

Figure 100:
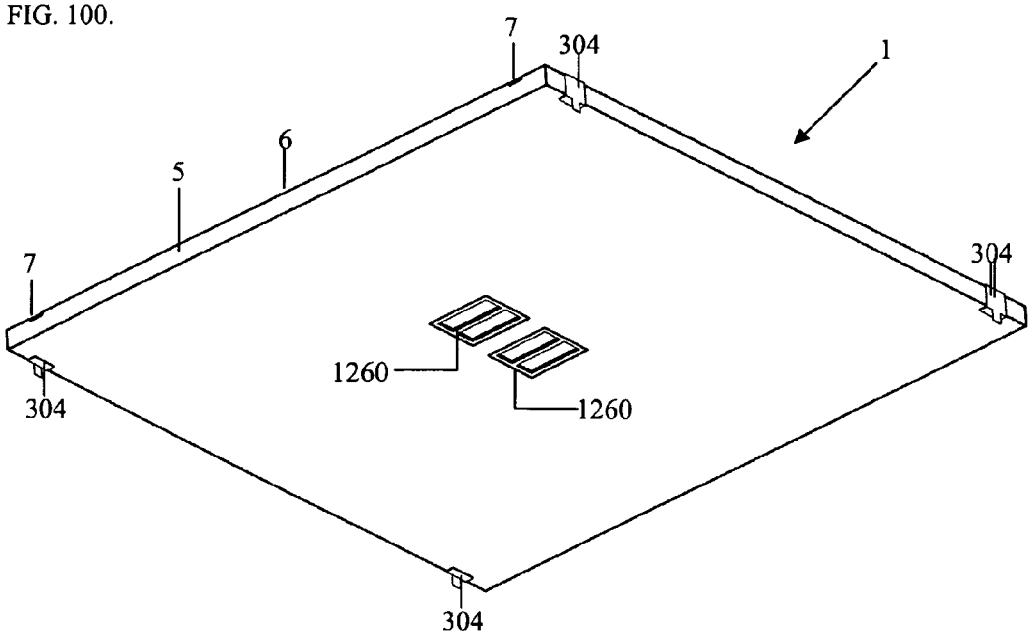
Figure 101:
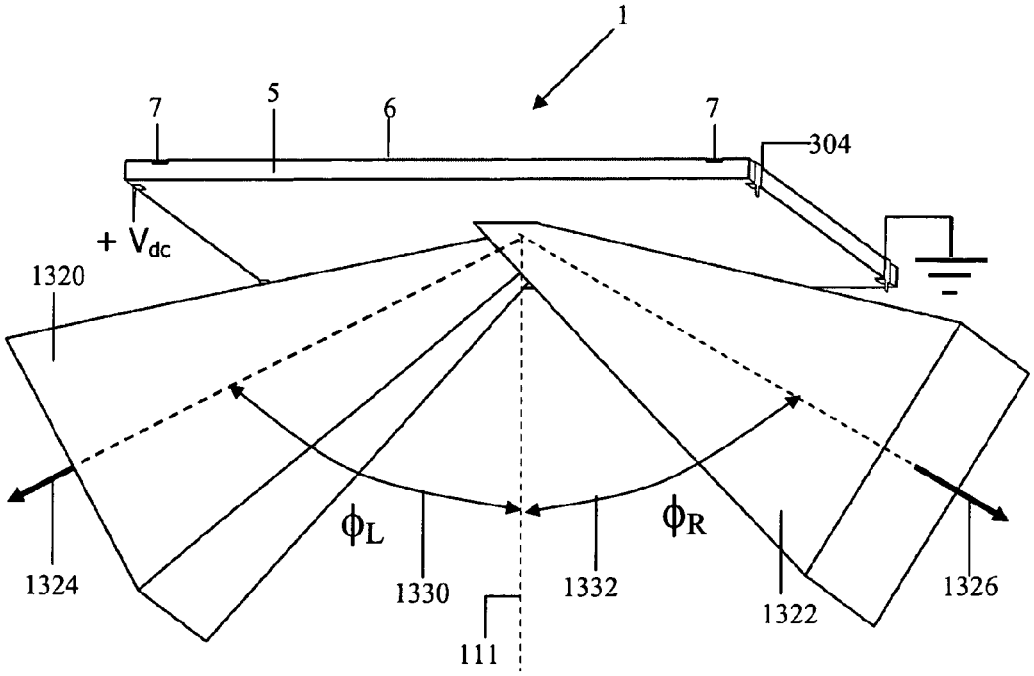

FIG. 101 provides a perspective view from the floor beneath the tile illumination system of FIG. 100, showing one example of its operation, two obliquely directed hallway wall washing beams.

Figure 102A:
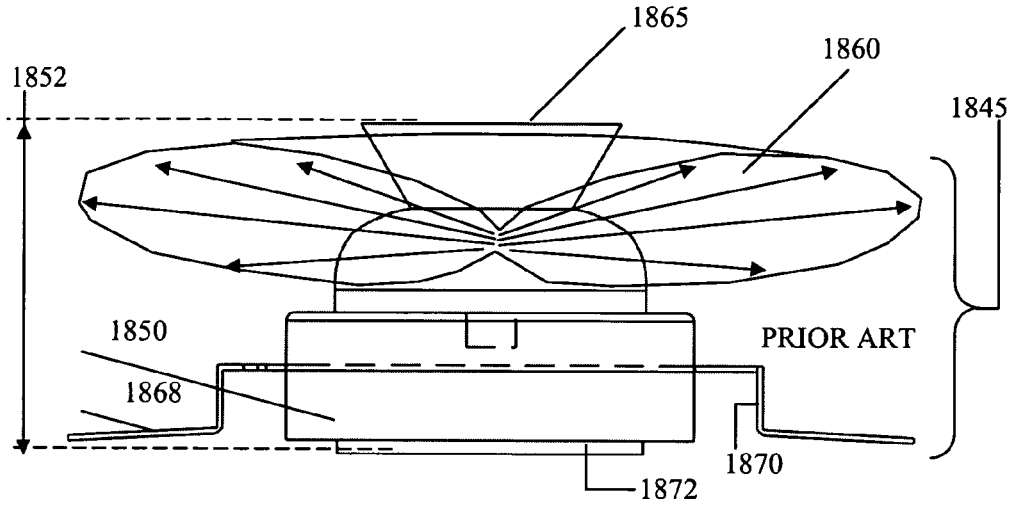

FIG. 102A is a schematic side view of a popular side-emitting (or Bat-wing styled) LED emitter used in large format LCD backlighting systems, the Luxeon III 1845 made by Philips LumiLeds.

Figure 102B:
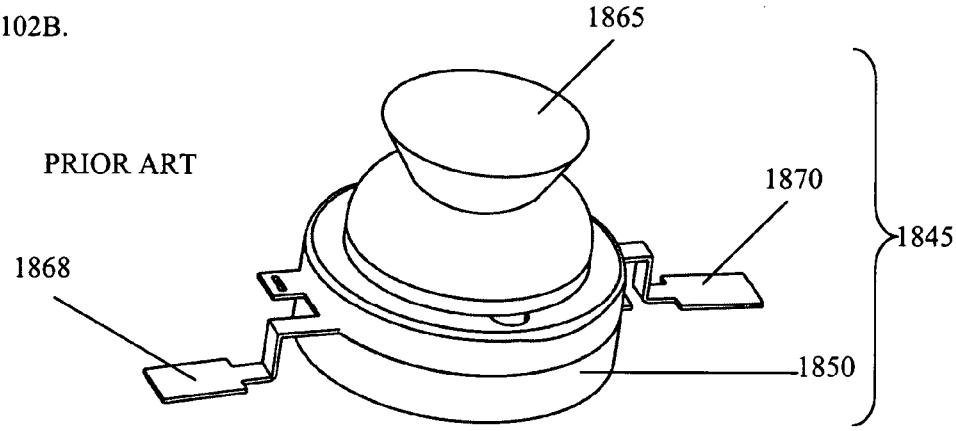

FIG. 102B is a perspective view of the side-emitting Luxeon LED emitter shown in the side view of FIG. 102A.

Figure 103A:
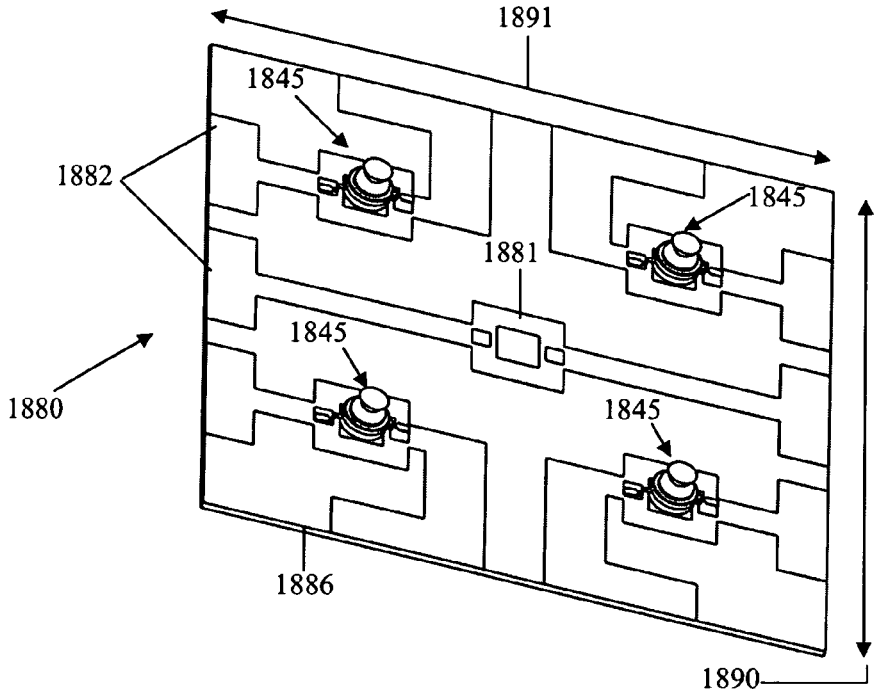

FIG. 103A is a perspective view of a suitable electrical circuit plate and four side-emitting LED emitters mounted on it, including means for electrical interconnection of the emitters to the remaining elements of an associated light-distributing engine.

Figure 103B:
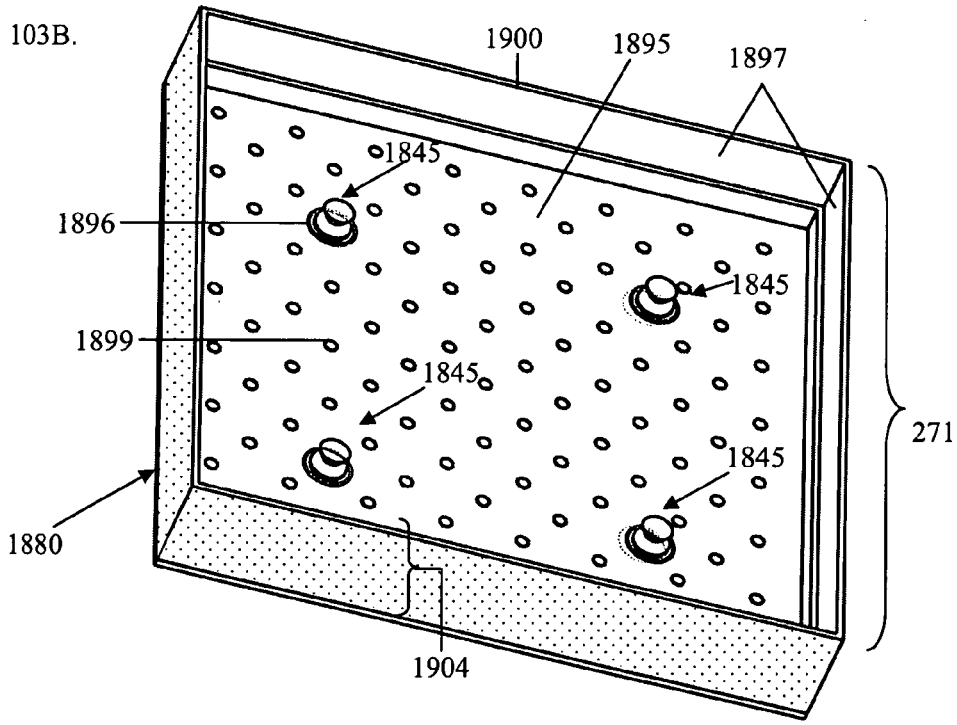

FIG. 103B is a perspective view of the complete LED light emitter as might be used within a vertically stacked light distributing engine embodiment in accordance with the present tile illumination system invention.

Figure 103C:
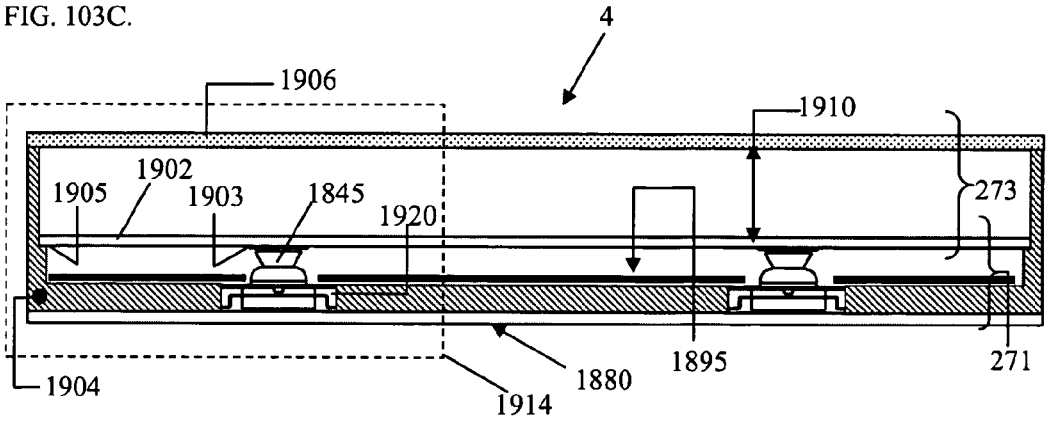

FIG. 103C is a cross-sectional side view showing the additional secondary optical elements comprising the light distributing optic portion of a vertically stacked light distributing engine collectively suited for embedding within the present tile illuminating system invention.

Figure 103D:
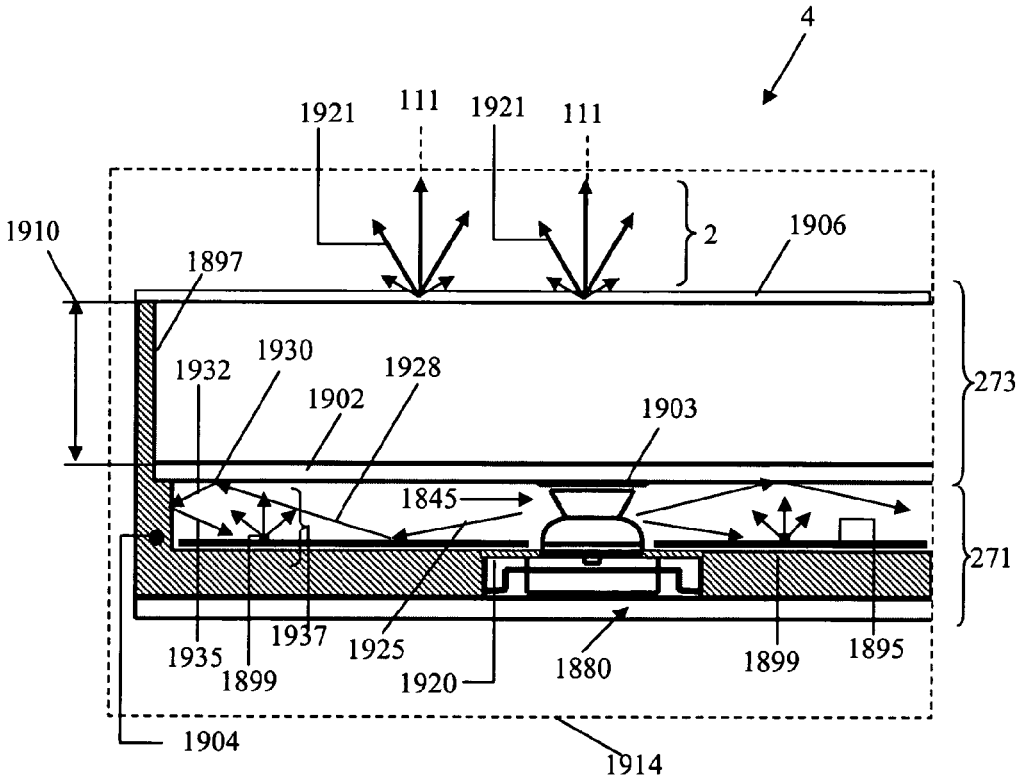

FIG. 103D is a magnified portion of the cross-sectional side view shown in FIG. 103C, also showing some illustrative light flow paths.

Figure 104:
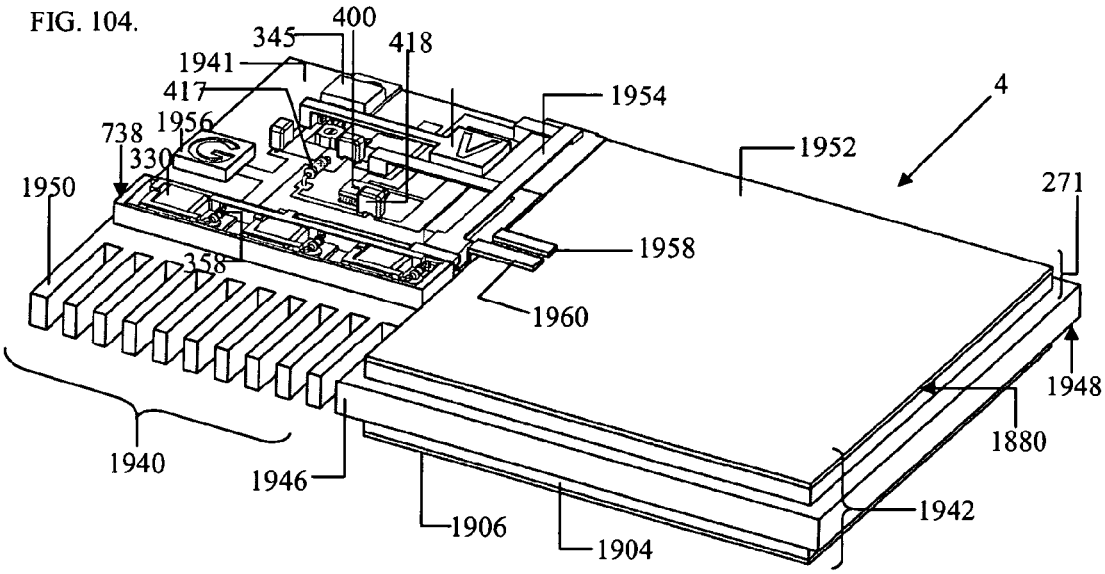

FIG. 104 is a perspective view shown from the backside of a 180.4 mm×110 mm×18.8 mm embeddable form of the illustrative vertically stacked light-distributing engine configured in accordance with the present tile illumination system invention.

Figure 105:
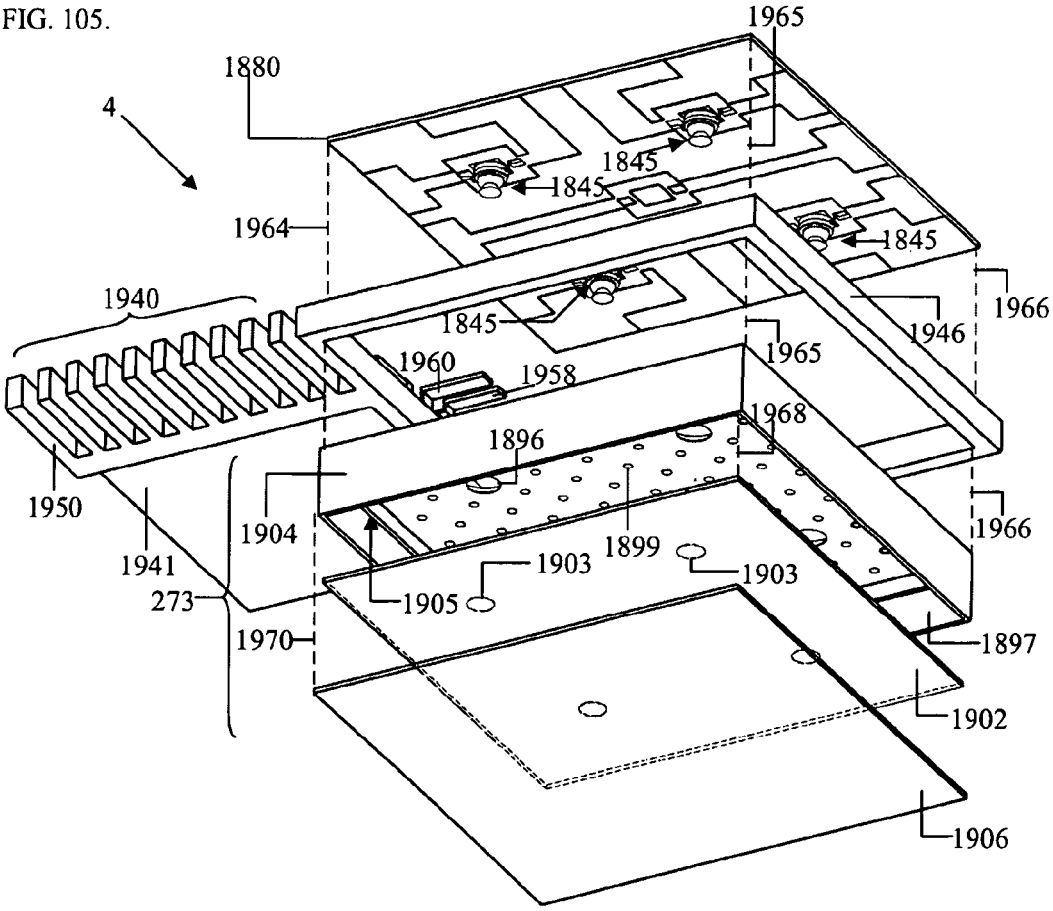

FIG. 105 is an exploded perspective view shown from the floor side of the vertically stacked light-distributing engine illustrated in FIG. 104, revealing the internal relationships between constituent parts.

Figure 106:
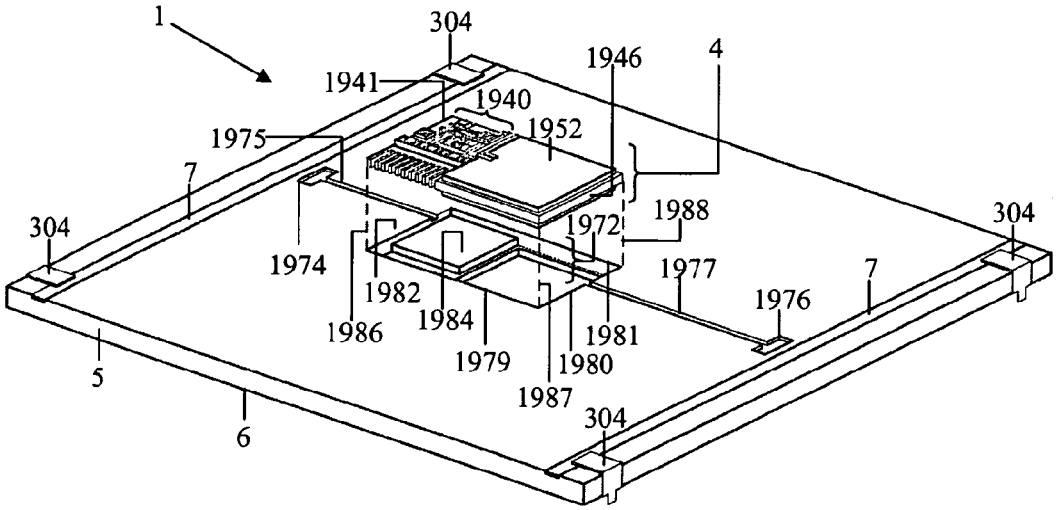

FIG. 106 is a perspective view showing the tile body details needed to embed the vertically-stacked form of light distributing engine shown in FIGS. 104-105 in the proximate center of an illustrative 24"×24" tile material suited to the present invention.

Figure 107:
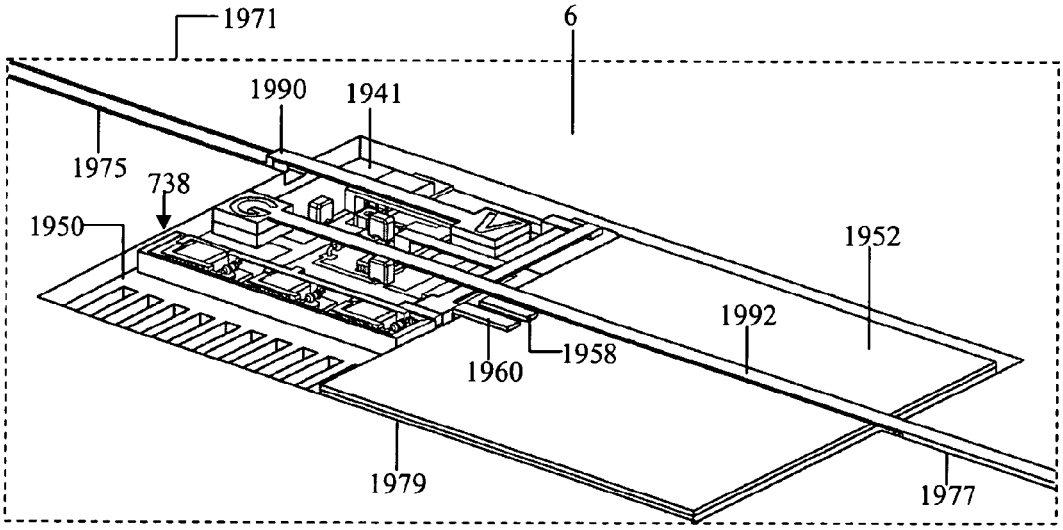

FIG. 107 is a magnified view showing the central portion of the tile illumination system of FIG. 106 just after completion of the embedding process.

Figure 108:
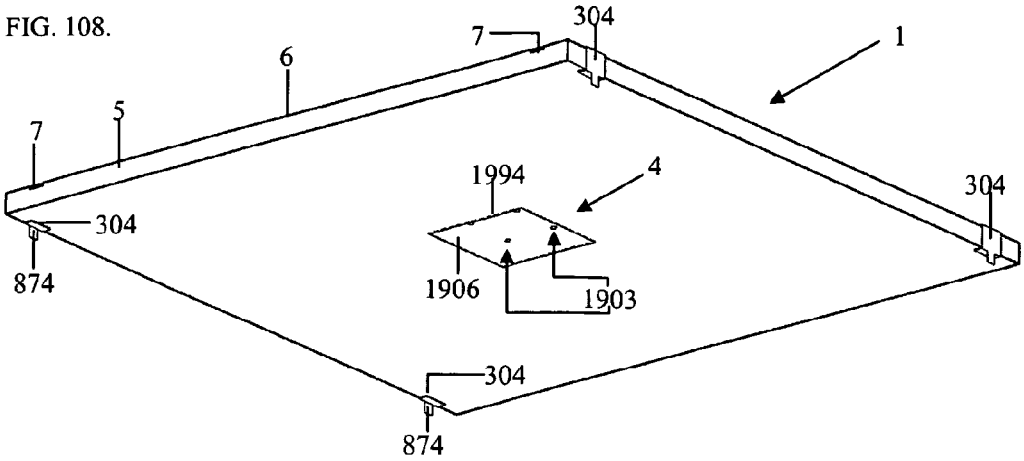

FIG. 108 is a perspective view of an illustrative tile illumination system according to the embodiments of FIGS. 102-107, seen from the floor beneath and showing a single 4"×4" illuminating aperture and its associated aperture cover.

Figure 109:
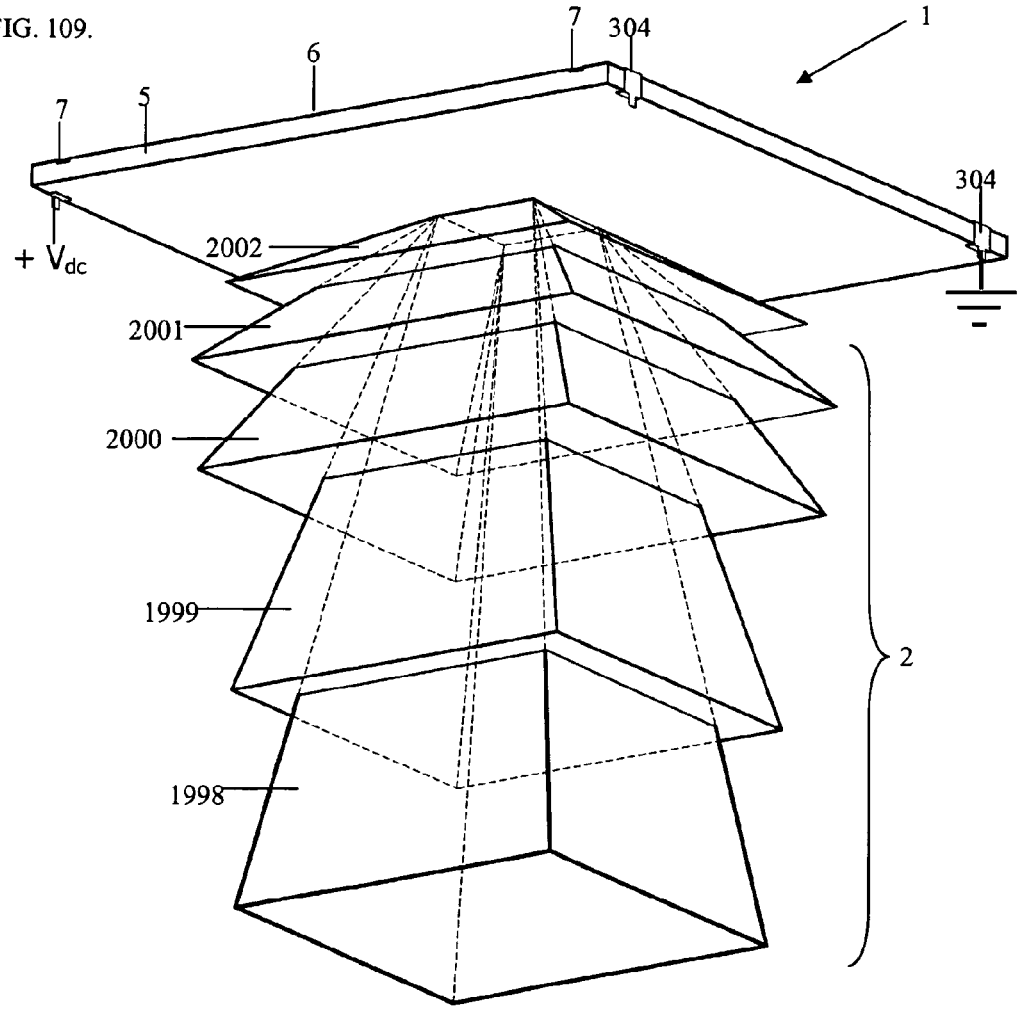

FIG. 109 is a perspective view of the tile illumination system of FIG. 108 showing the kind of angularly-diffuse directional illumination that results from applying DC voltage to one set of connectors and ground system access to another, combined with receipt of a power "on" signal from the system's master controller.

Figure 110A:
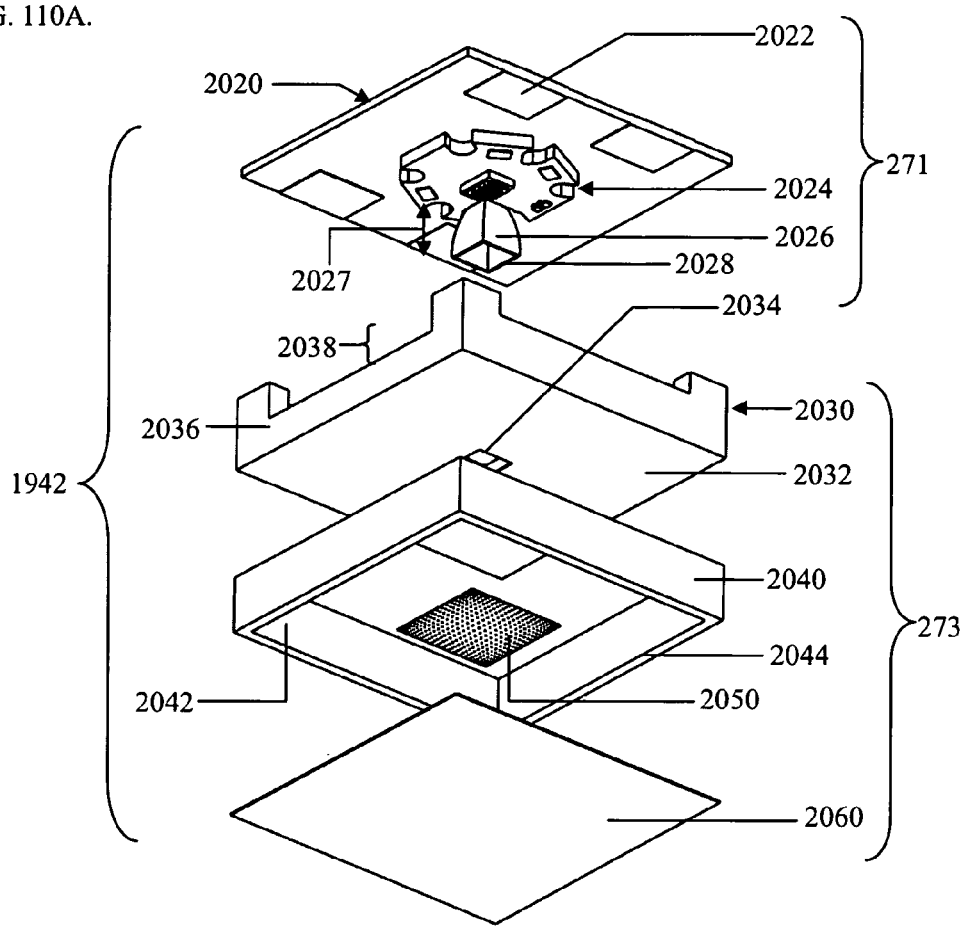

FIG. 110A is an exploded perspective view showing the principal working elements of the light generating portions of another vertically stacked light distributing engine embodiment embeddable in thin building tile materials according to the present invention.

Figure 110B:
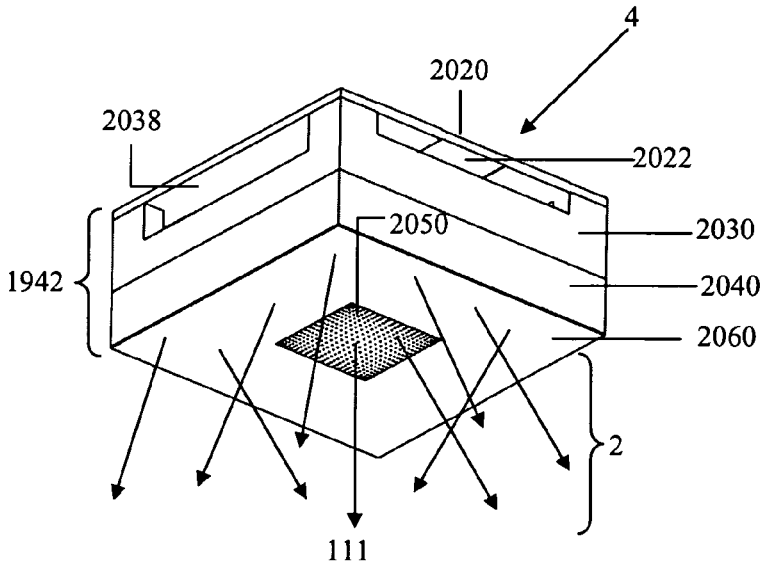

FIG. 110B is a perspective view showing the completed 18.8 mm thick final assembly of the light-generating portion of the vertically stacked light-distributing engine exploded in the perspective view of FIG. 110A.

Figure 110C:
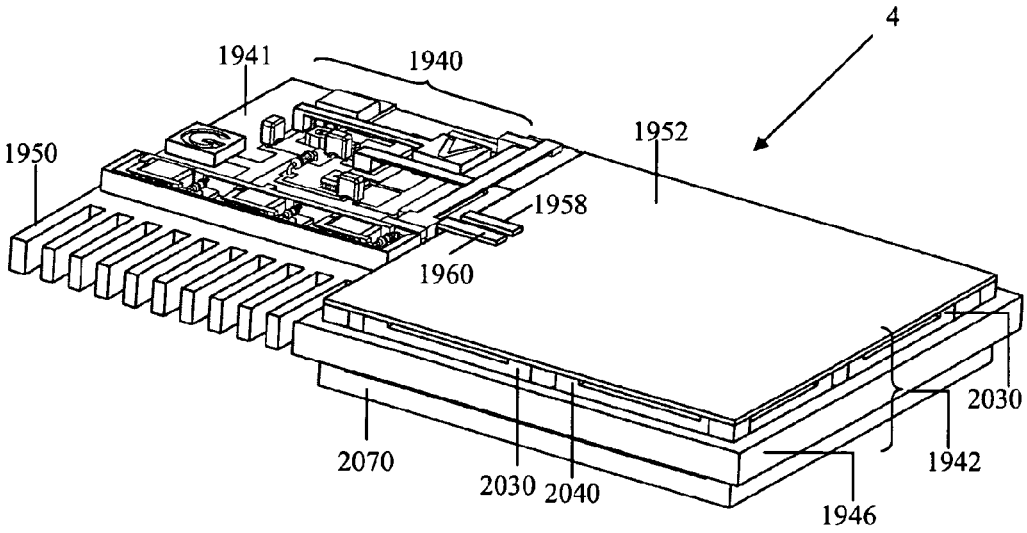

FIG. 110C is a fully assembled backside perspective view showing an example of an embeddable form of this type of vertically stacked light distributing engine, illustratively combining four of the light generating portions shown in FIG. 110B with the voltage regulating, controlling and detecting electronics described in previous examples.

Figure 110D:
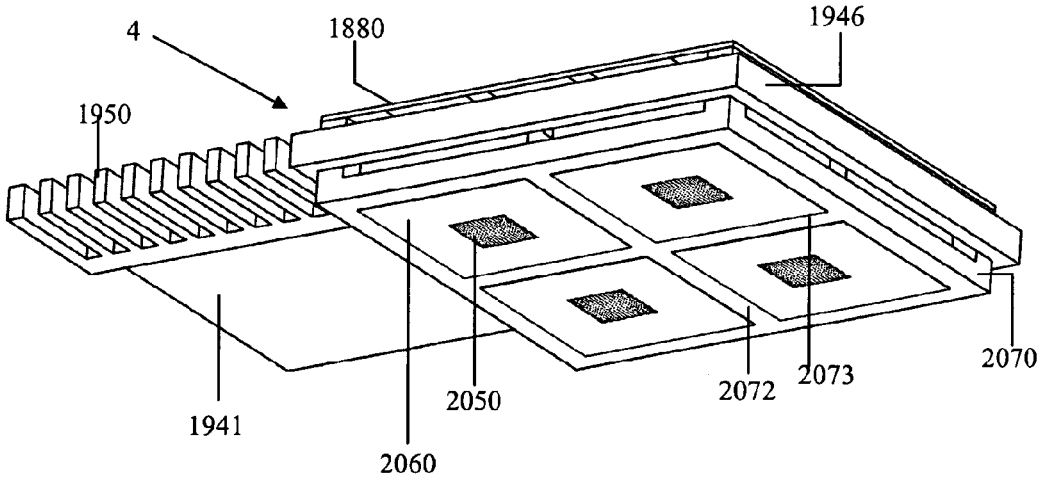

FIG. 110D is a front-side perspective view of the embeddable light-distributing engine of FIG. 110C, in its fully assembled form.

Figure 110E:
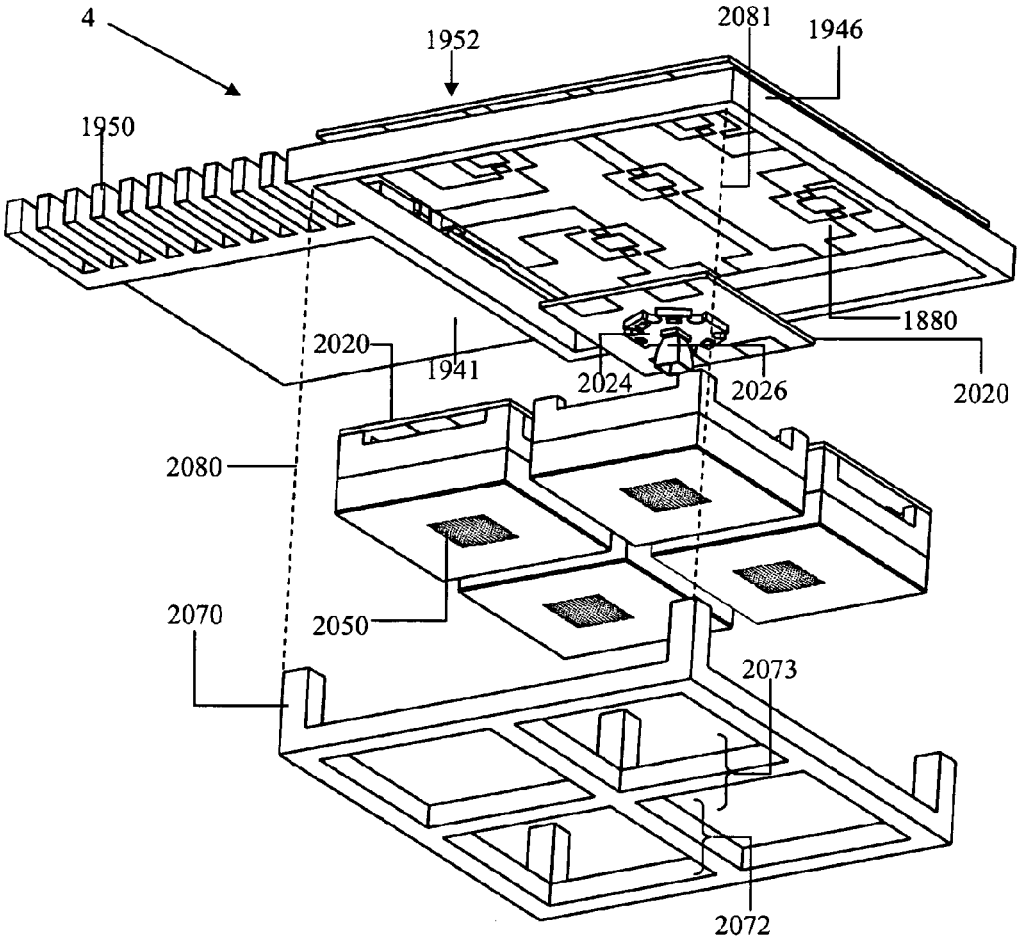

FIG. 110E is an exploded perspective view of the embeddable light-distributing engine as shown in FIG. 110C.

Figure 110F:
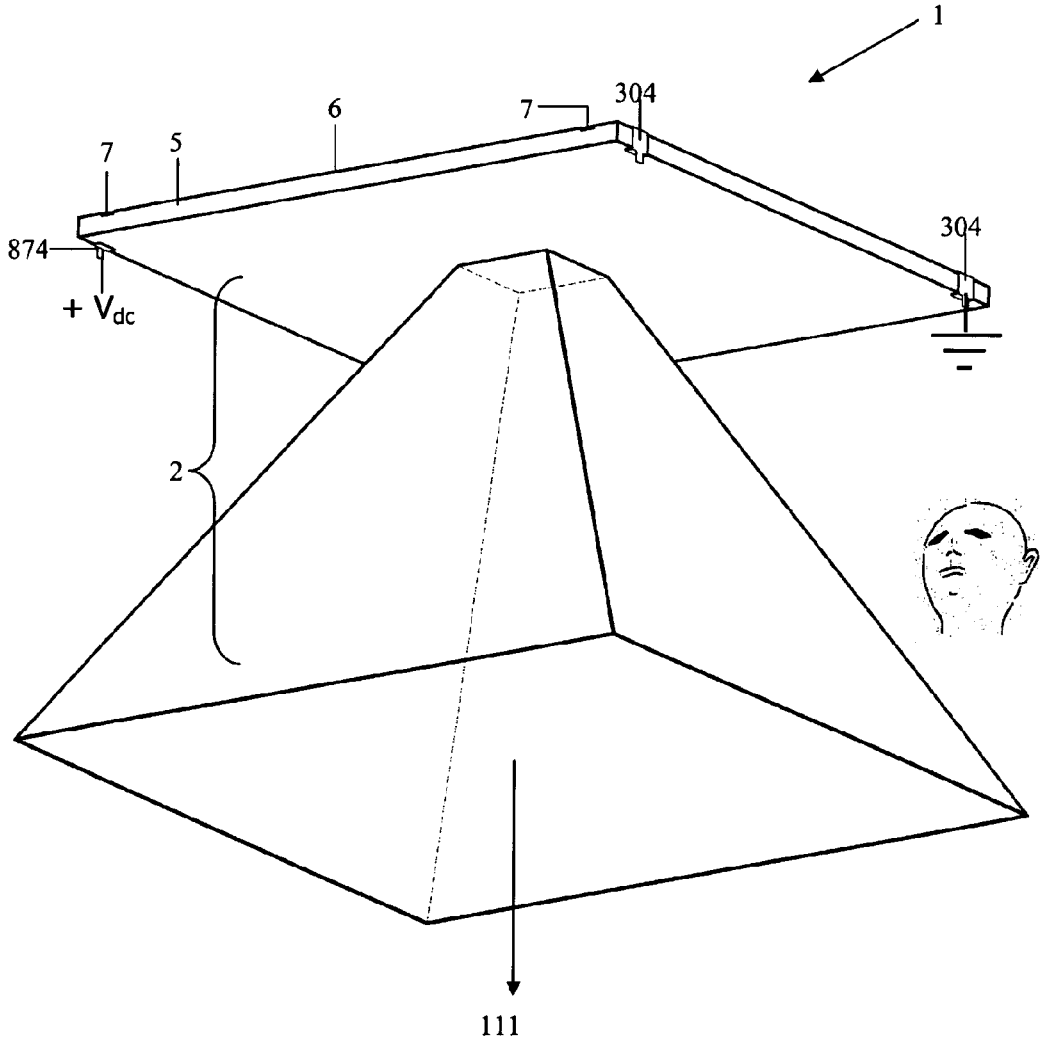

FIG. 110F is a perspective view of a tile illumination system including the vertically stacked embeddable light-distributing engine of FIGS. 110A-110E that shows both its sharply defined +/−30-degree illumination cone and it's significantly enlarged output aperture.

Figure 111A:
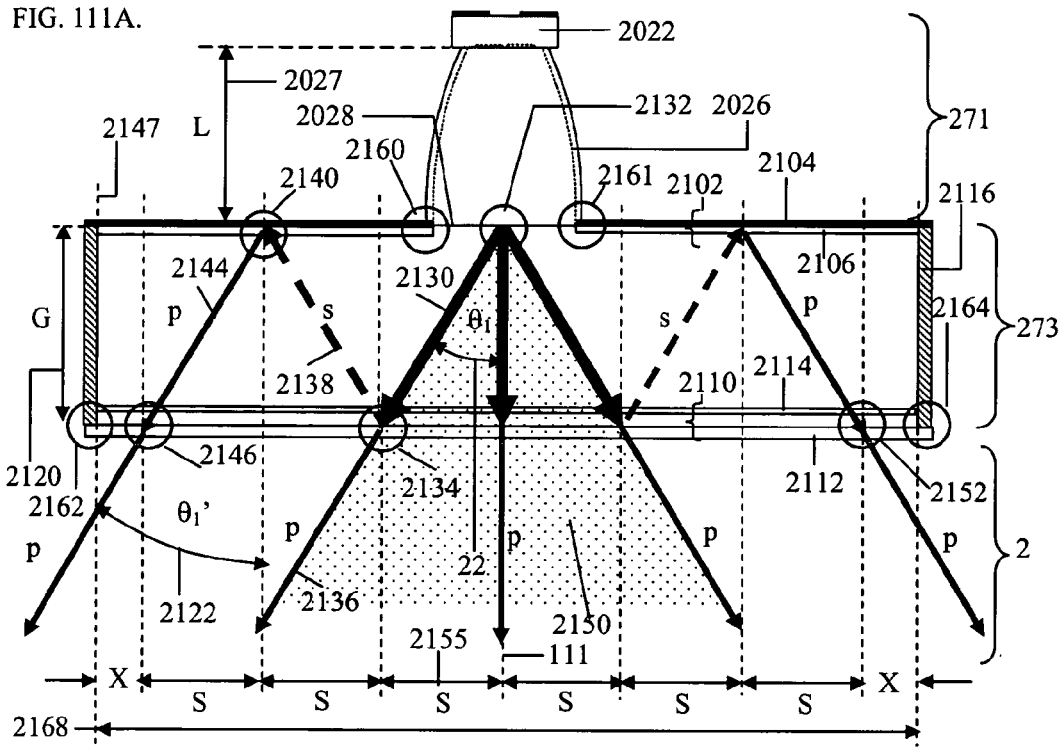

FIG. 111A is a schematic cross-sectional side view illustrating the reflective light spreading mechanism underlying another useful type of vertically stacked and embeddable light distributing engine useful to practice of the present invention that establishes the underlying physical relationships between constituent elements.

Figure 111B:
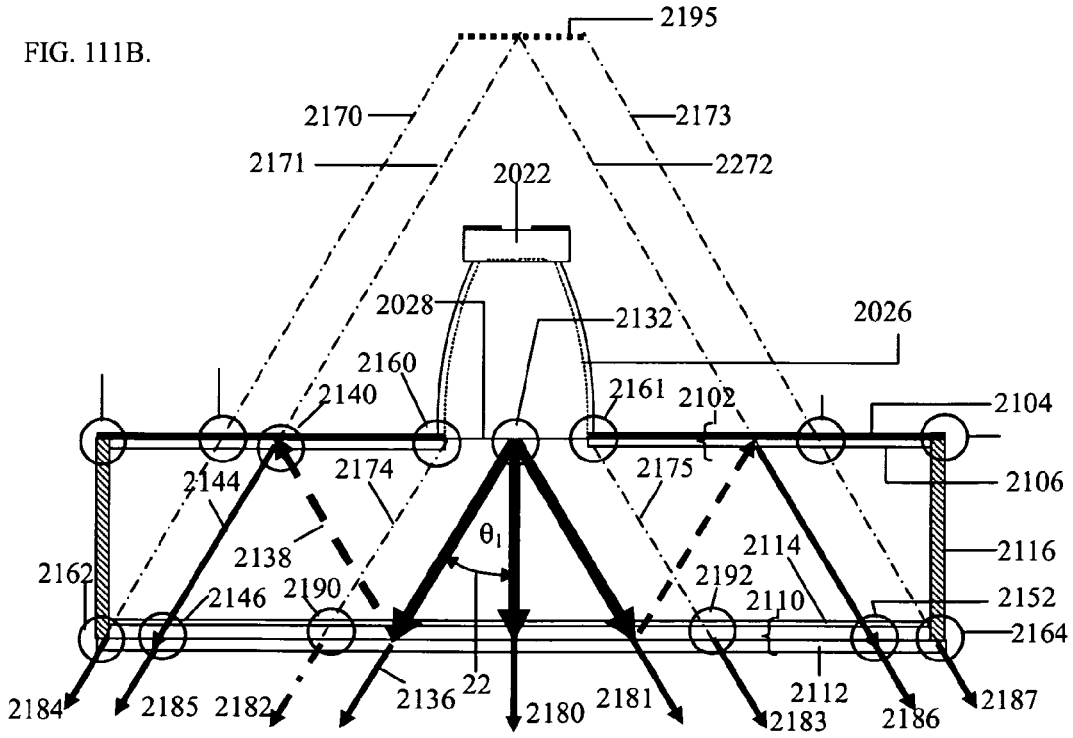

FIG. 111B is a schematic cross-sectional side view of the embeddable light-distributing engine shown in FIG. 111A revealing additional details of the geometric relationships between constituent elements.

Figure 112A:
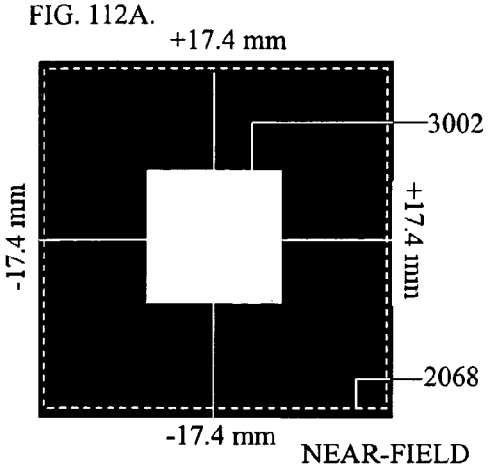

FIG. 112A is the near field pattern for p-polarized light of the thin-profile light-distributing engine of FIGS. 111A-111B with 100% output transmission.

Figure 112B:
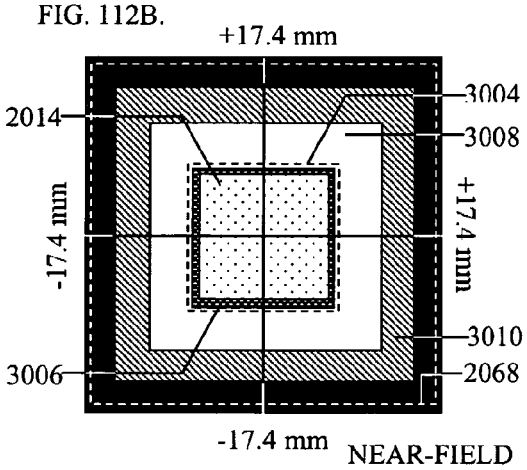

FIG. 112B is the near field pattern for p-polarized light of the thin-profile light-distributing engine of FIGS. 111A-111B with 80% net reflection exhibited by its partially reflecting output layer.

Figure 112C:
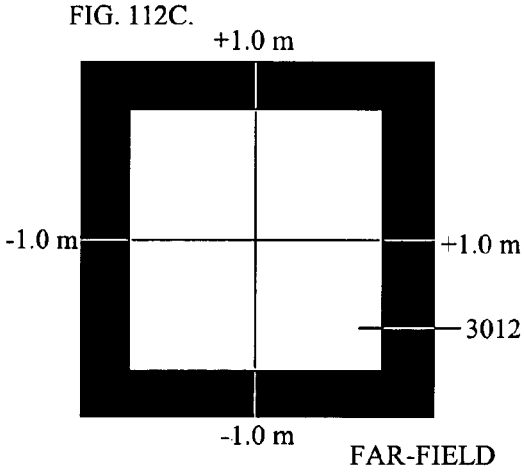

FIG. 112C is the p-polarized far field illumination pattern produced by the thin-profile light-distributing engine of FIGS. 111A-111B with 100% output transmission.

Figure 112D:
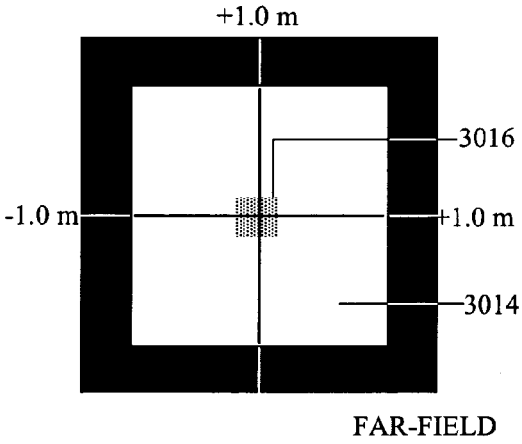

FIG. 112D is the p-polarized far field illumination pattern produced by the thin-profile light-distributing engine of FIGS. 111A-111B with 80% net reflection exhibited by its partially reflecting output layer.

Figure 112E:
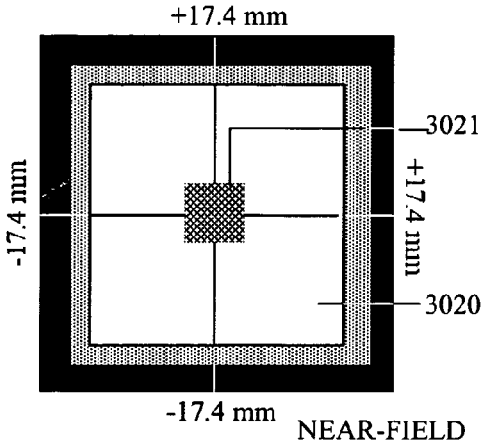

FIG. 112E shows the p-polarized near-field light distribution that results from the internally reflected s-polarized light portion within the light-distributing engine of FIGS. 111A-111B with 80% net reflection exhibited by its partially reflecting output layer.

Figure 112F:
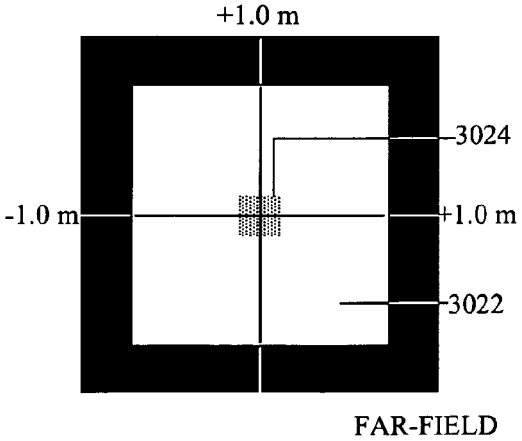

FIG. 112F shows the p-polarized far-field light pattern associated with reflectively converted s-polarized light when 80% net-reflection is achieved by the engine's partially reflecting output layer.

Figure 113A:
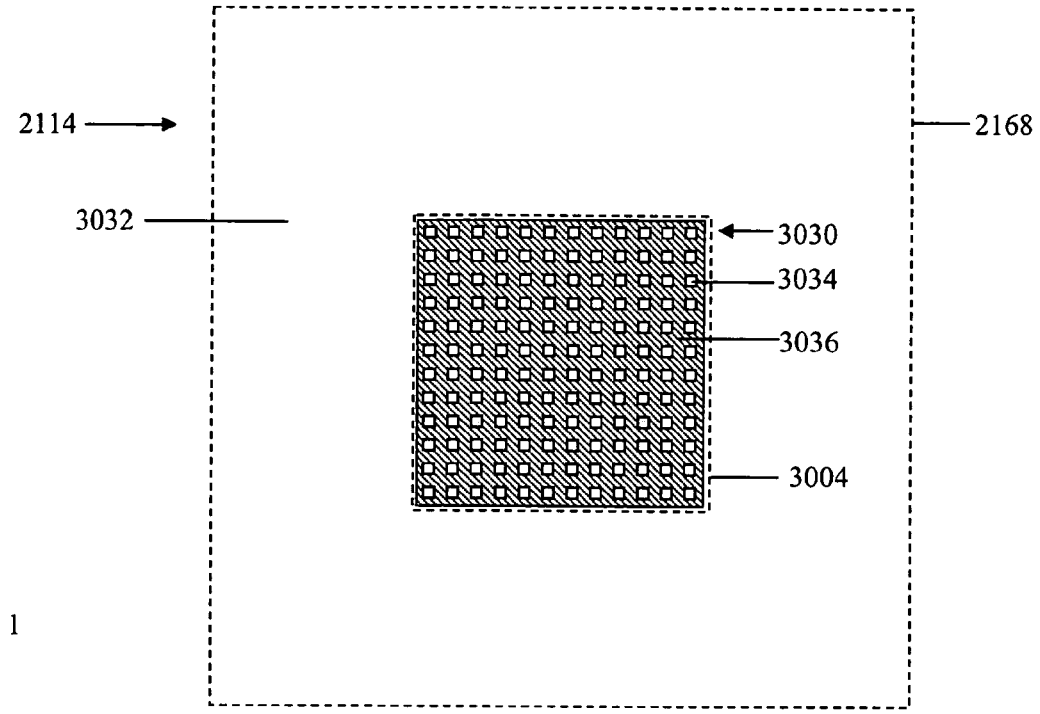

FIG. 113A shows one practical example of the central portion 3030 of a partially reflecting light spreading layer compatible with the vertically stacked light-distributing engine of FIGS. 111A-B.

Figure 113B:
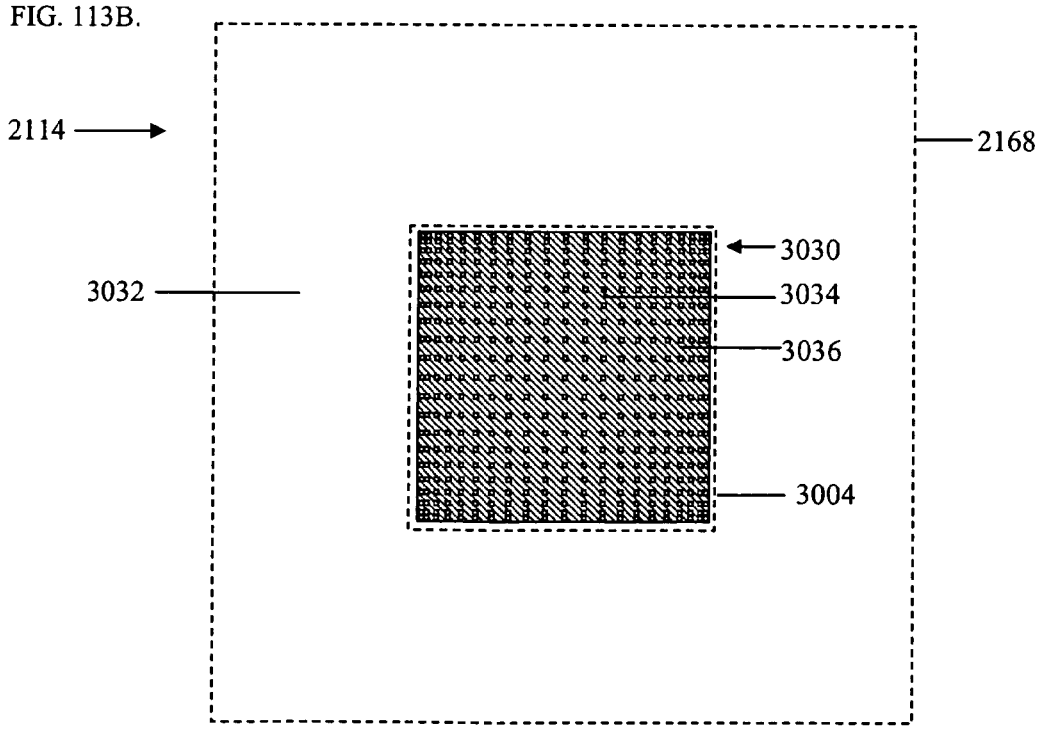

FIG. 113B shows another practical example of the central portion 3030 of a partially reflecting light spreading layer compatible with the vertically stacked light-distributing engine of FIGS. 111A-B.

Figure 114A:
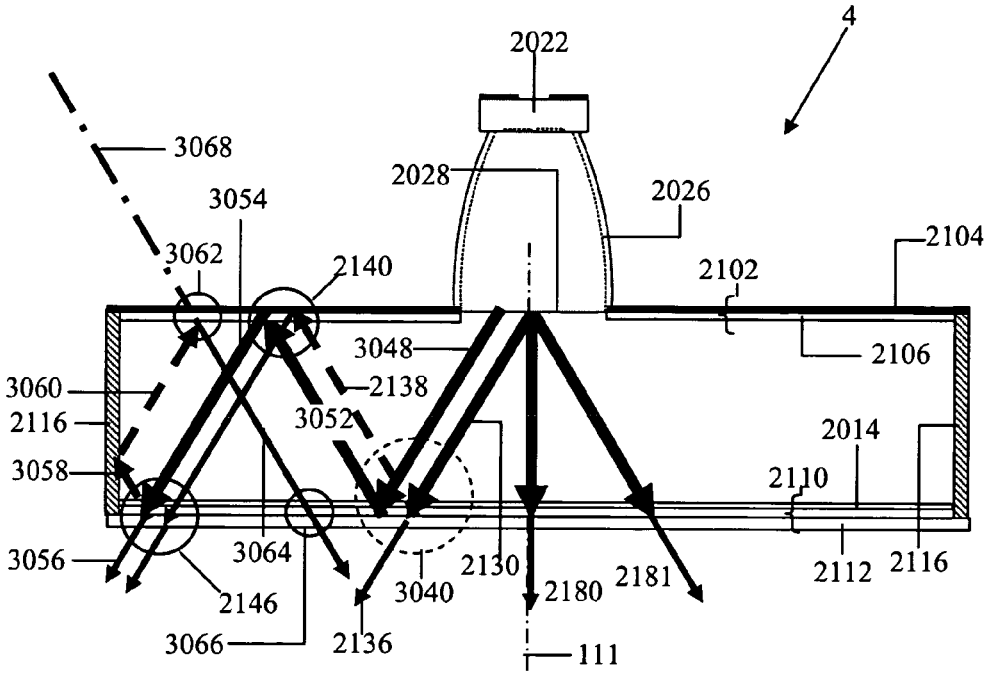

FIG. 114A is a schematic cross-sectional side view showing why there is a potential brightness reduction associated with the vertically-stacked light distributing engine of FIGS. 111A-111B when its partially reflecting light spreading output layer is modified with a mixture of metallic reflection and transmissive pinholes in its central region.

Figure 114B:
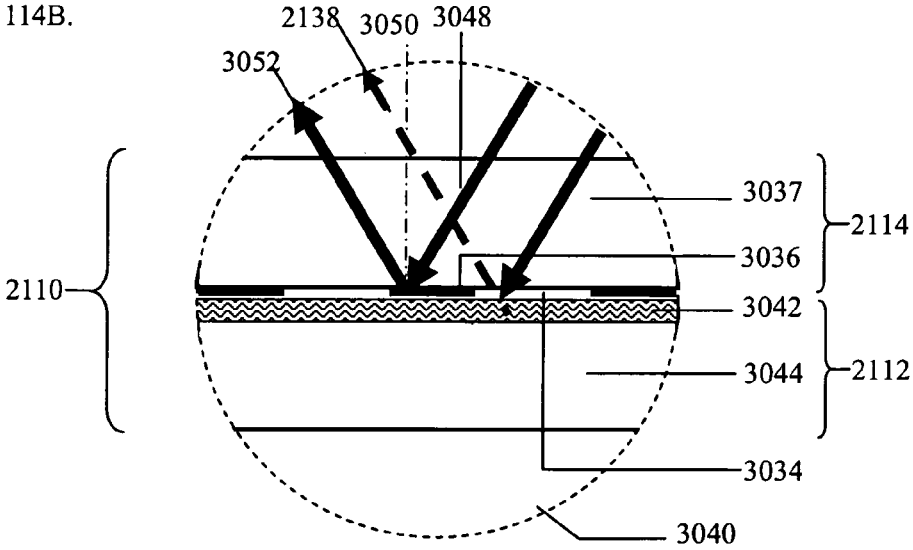

FIG. 114B provides magnified detail of a small region of illustrative reflection in the schematic cross-sectional side view of FIG. 114A.

Figure 115:
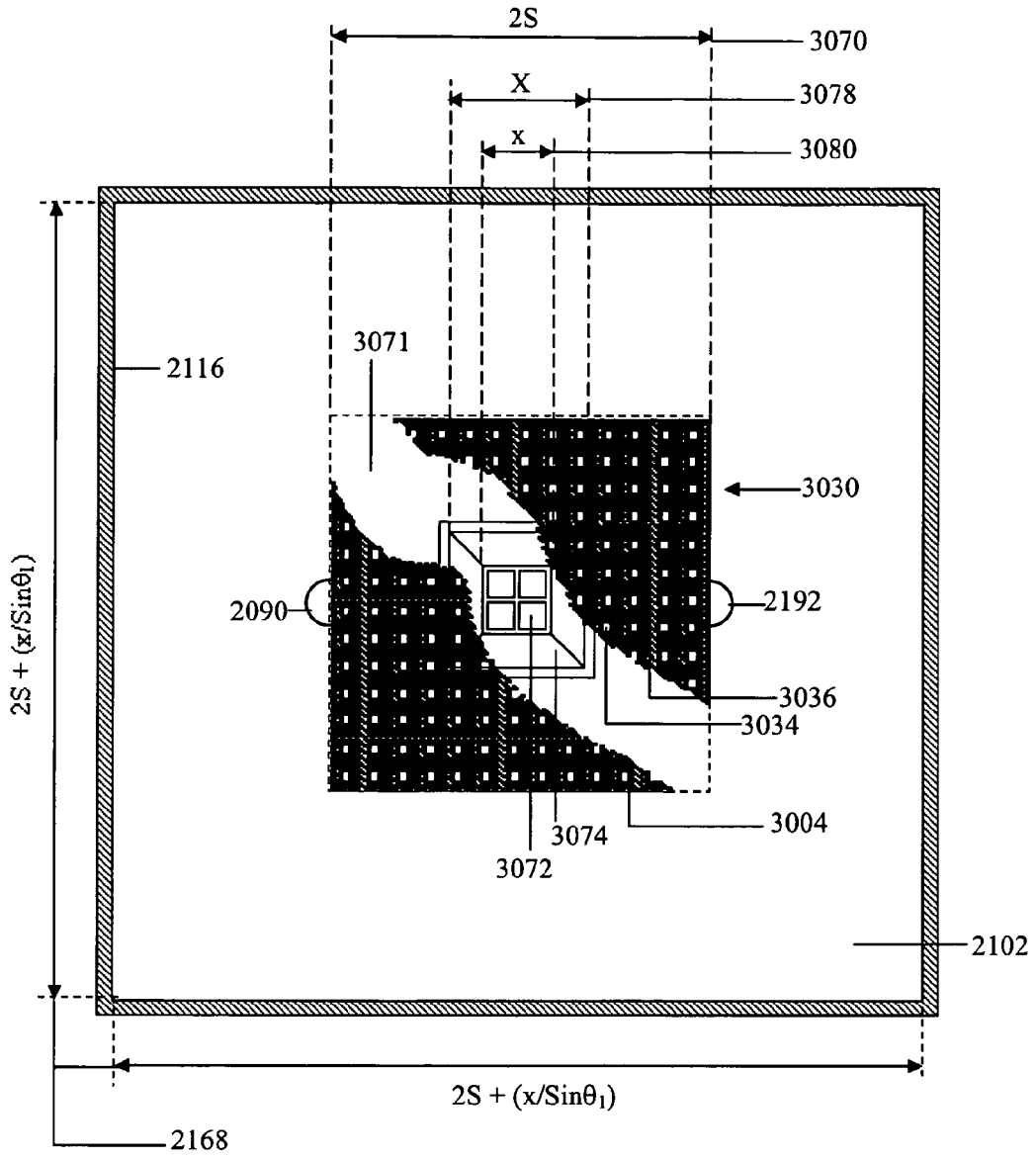

FIG. 115 shows a bottom-side view of the various output aperture regions in this version of the vertically stacked light-distributing engine illustrated in FIGS. 111A-111B, including an evenly spaced square-pinhole version of the central portion of partial reflecting output layer.

Figure 86:
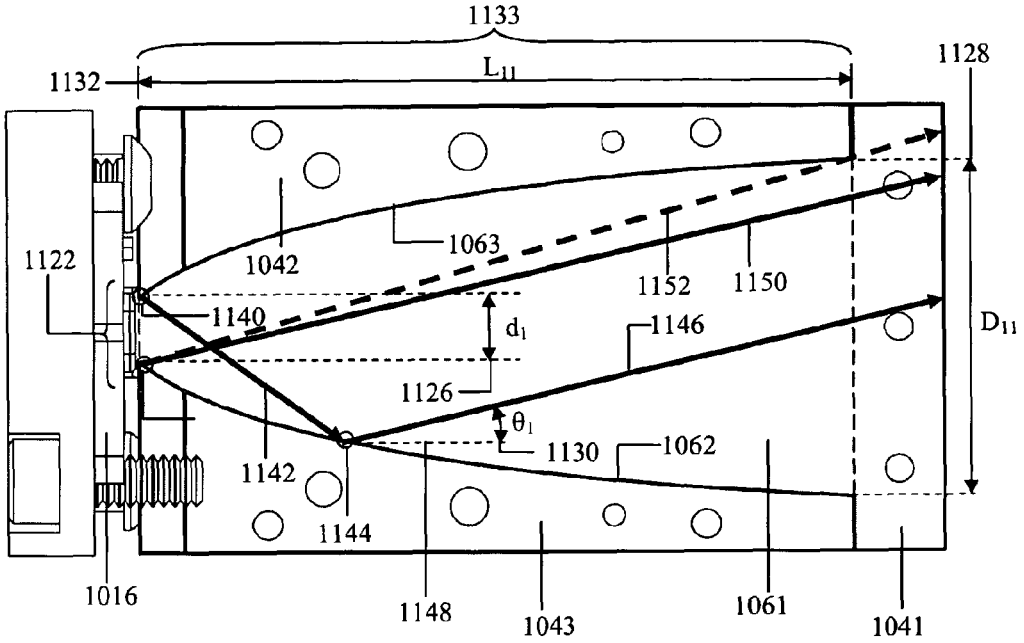
FIG. 86 is schematic a top cross-sectional view of the angle transforming reflector arrangement shown in FIG. 85.
Figure 116:
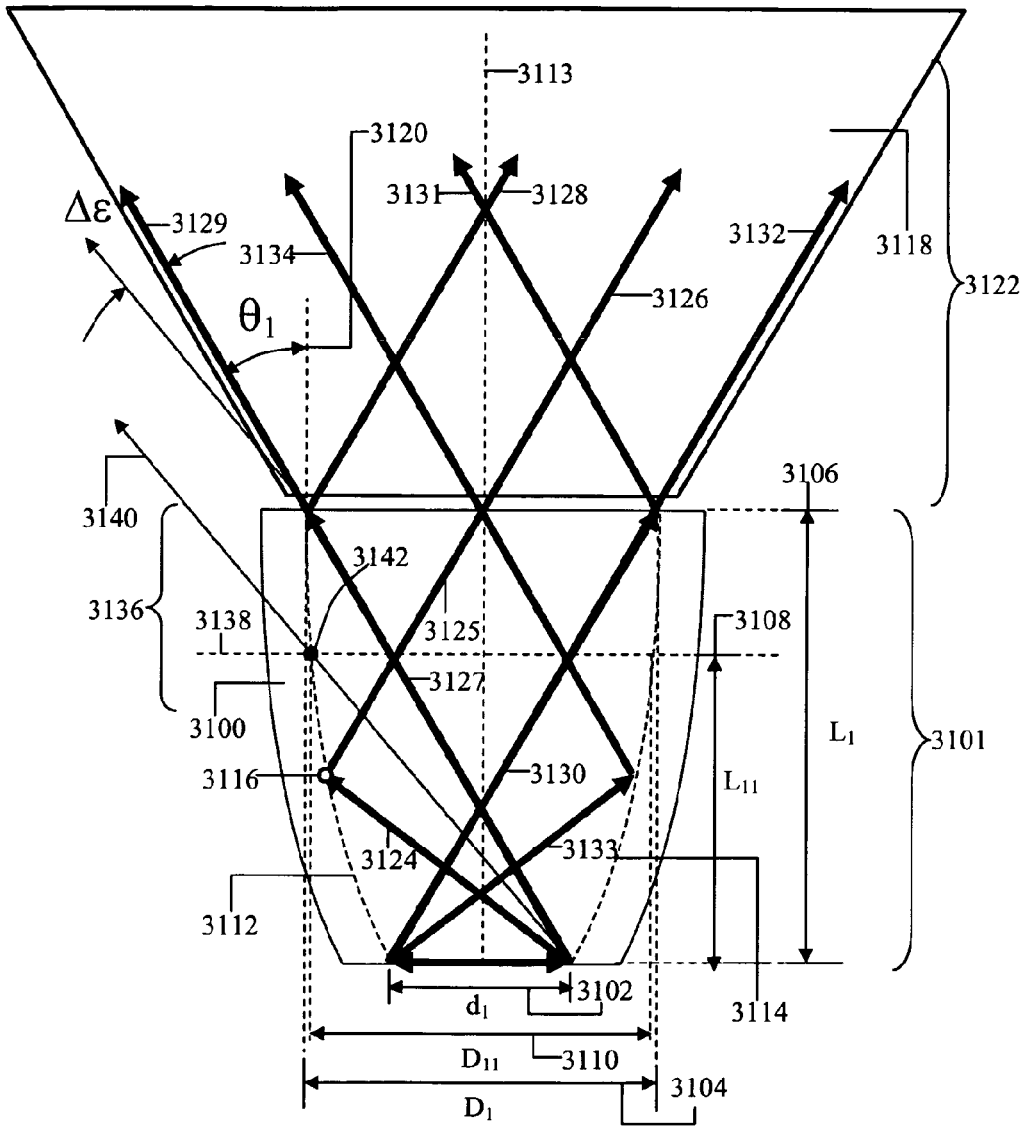

FIG. 116 is a cross-sectional side view of an illustratively generalized rectangular angle-transforming (RAT) reflector complimenting the geometric description provided in FIG. 86.

Figure 117:
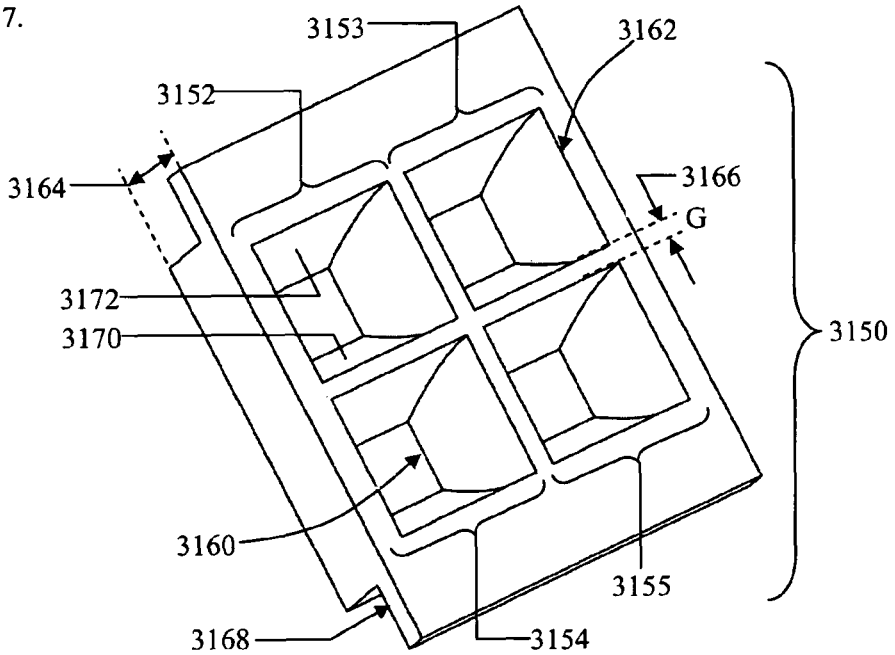

FIG. 117 is a perspective top view of a realistic quad-section RAT reflector pertinent to the present invention, each reflecting section having the same geometric form, and effective sidewall curvature, as the +/−30-degree RAT reflector from the generalized example of FIG. 116.

Figure 118:
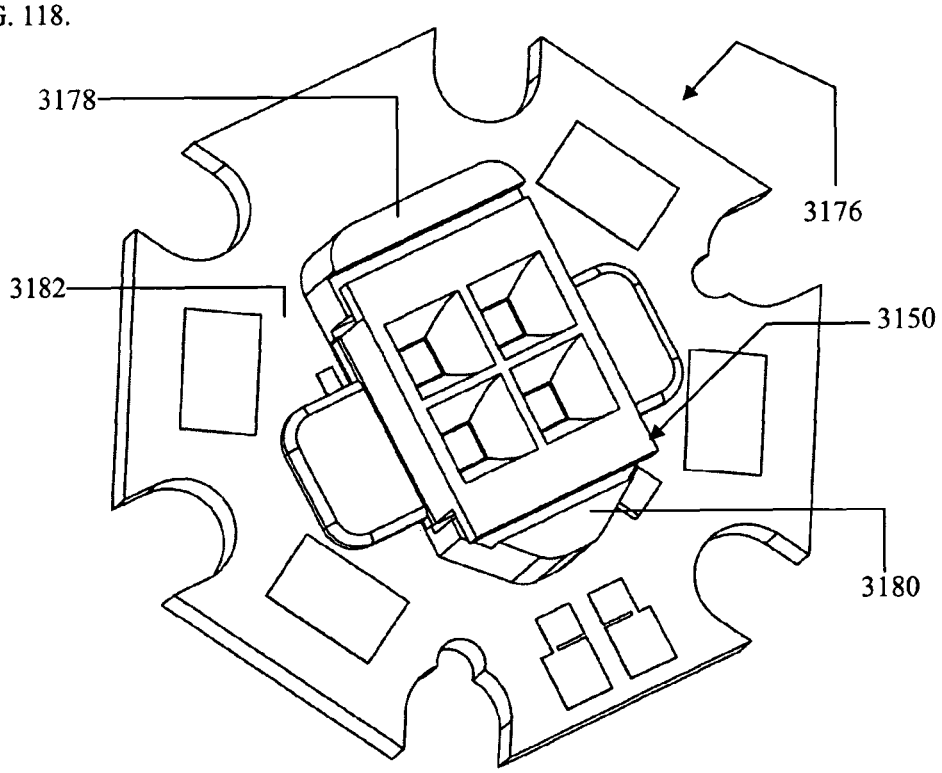

FIG. 118 is a perspective view showing one practical example integrating an illustrative quad-sectioned RAT reflector with a modified version of Osram's standard four-chip OSTAR™ LED emitter.

Figure 119:
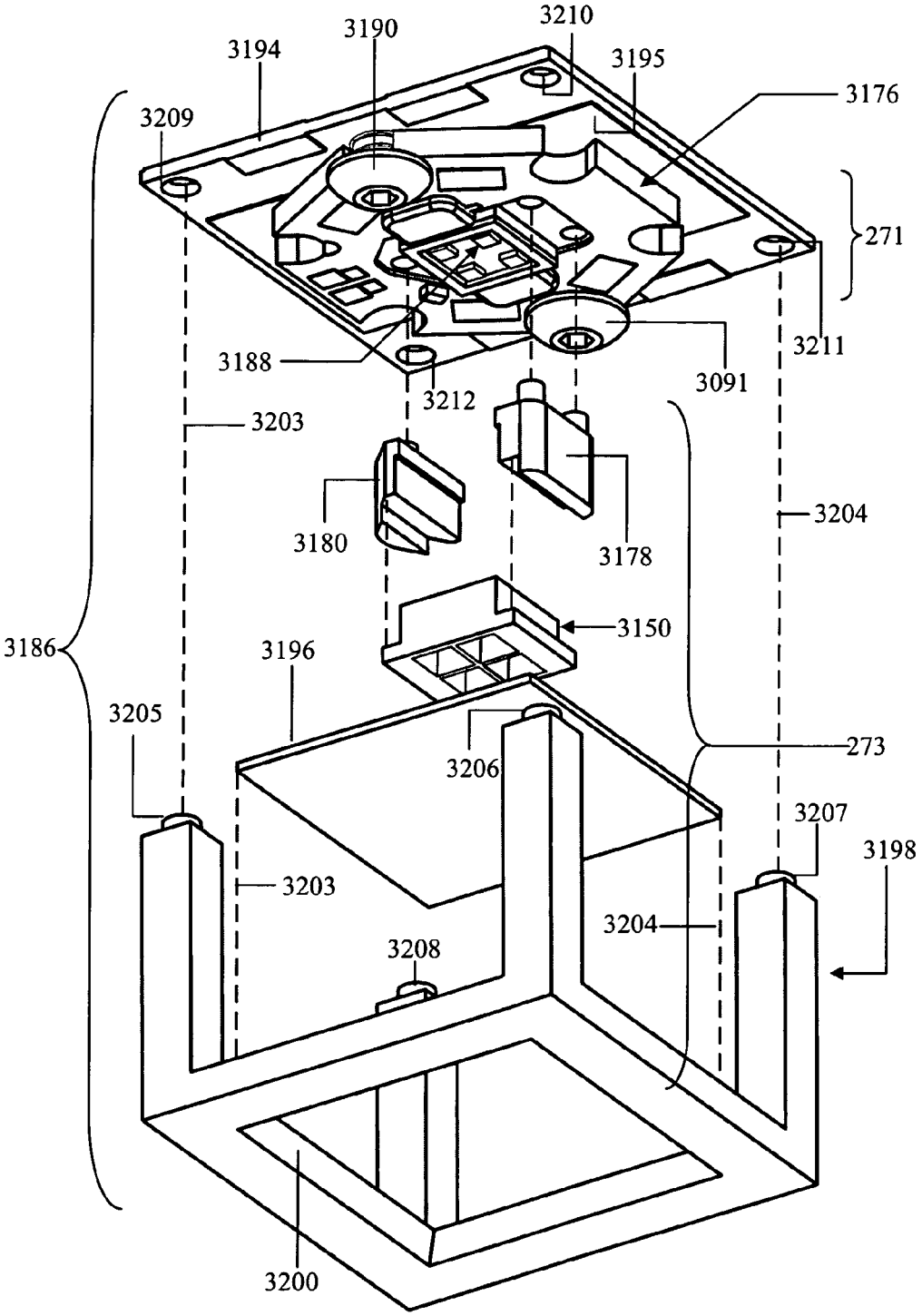

FIG. 119 is an exploded perspective view illustrating a complete light-generating portion of yet another embeddable vertically stacked light distributing engine in accordance with the present tile illumination system invention.

Figure 120A:
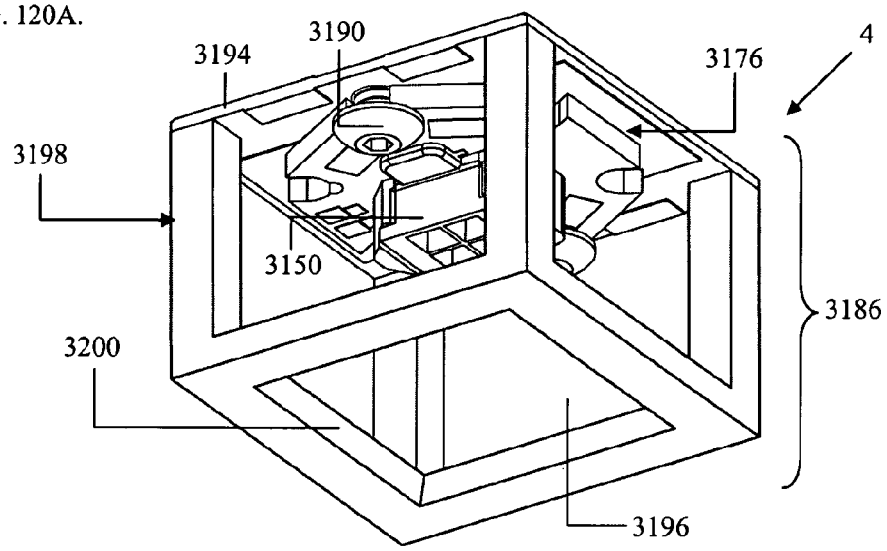

FIG. 120A is a perspective view of the fully assembled form of the illustrative vertically stacked RAT reflector-based light generating module 3186 illustrated in the exploded view of FIG. 119.

Figure 120B:
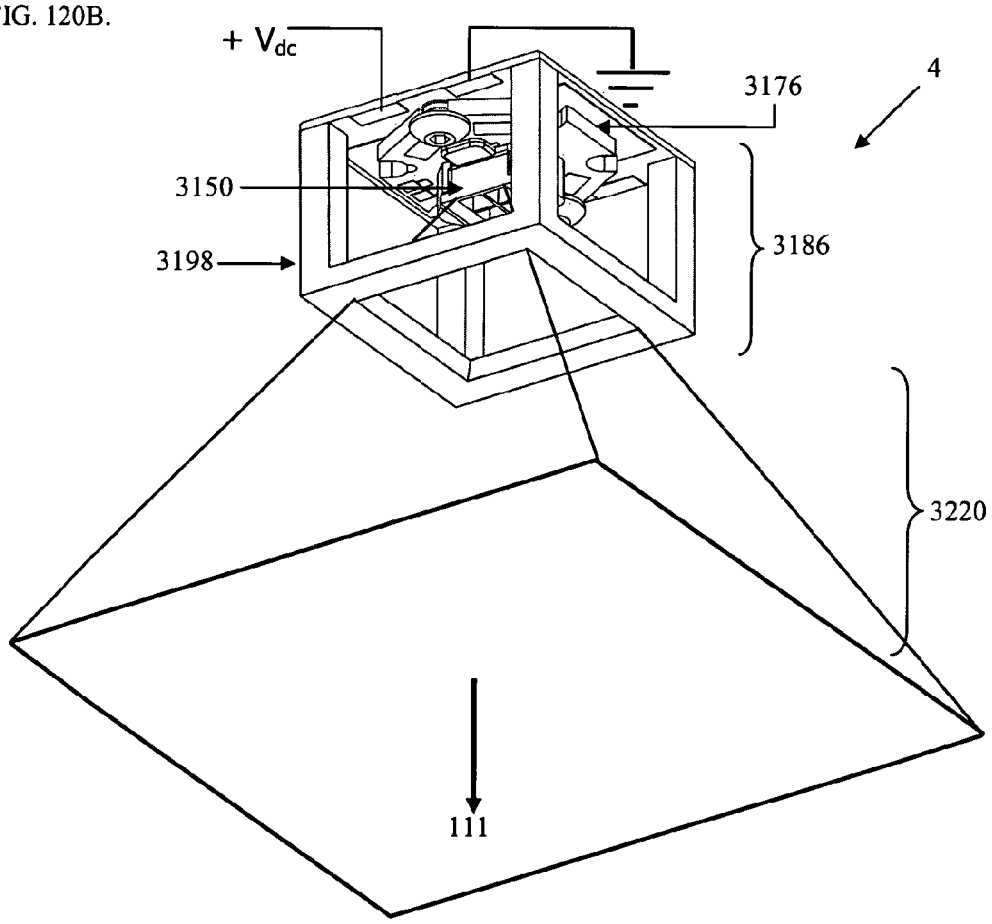

FIG. 120B is a perspective view showing the sharply defined output beam produced by the vertically stacked light-generating module illustrated in FIG. 120A when DC voltage is applied.

Figure 121A:
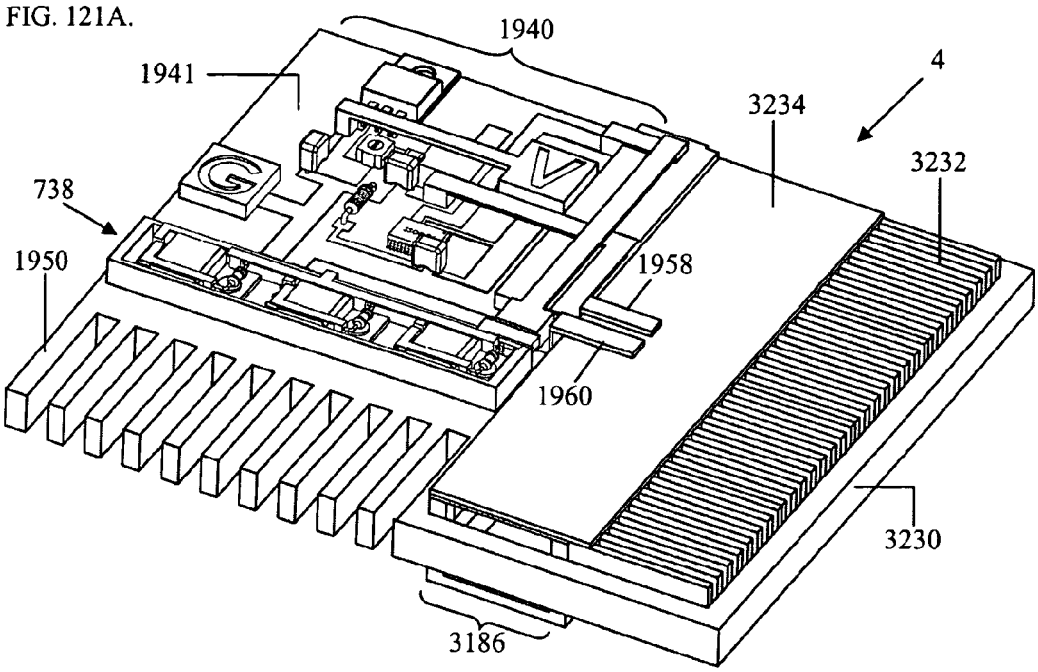

FIG. 121A is a perspective backside of one embeddable light distributing engine of the present vertically stacked form illustratively incorporating four light generating modules in a linear fashion with the same embedded electronic circuit portion 1940 (and embedding plate 1941) of previous examples (e.g., FIGS. 110C and 110D).

Figure 121B:
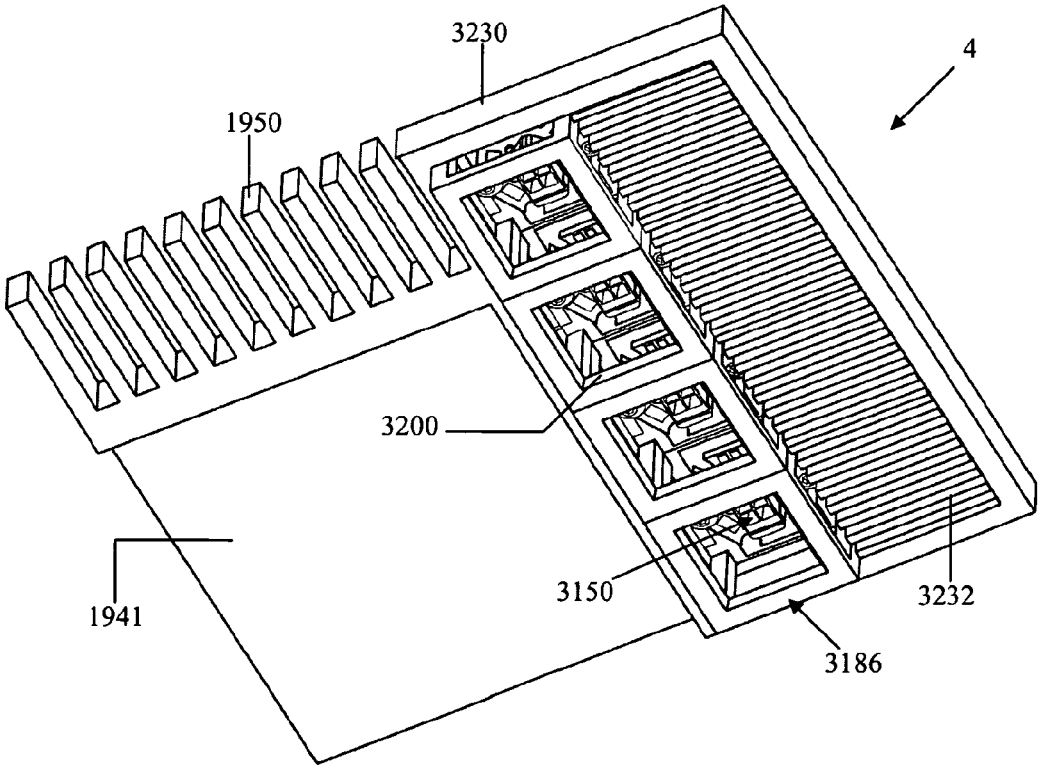

FIG. 121B is a perspective view as seen from the floor beneath of the embeddable light-distributing engine of the form shown in FIG. 121A.

Figure 122A:
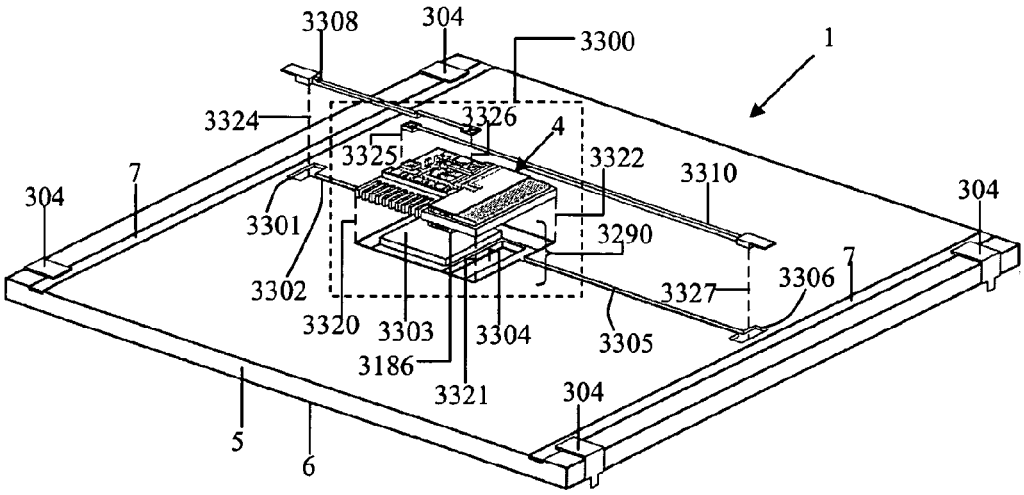

FIG. 122A is an exploded backside perspective view of a tile illuminating system 1 illustrating the embedding details 3290 needed to nest this smaller form of light distributing engine 4 in the proximate center (dotted region 3300) of an illustrative tile-based building material.

Figure 122B:
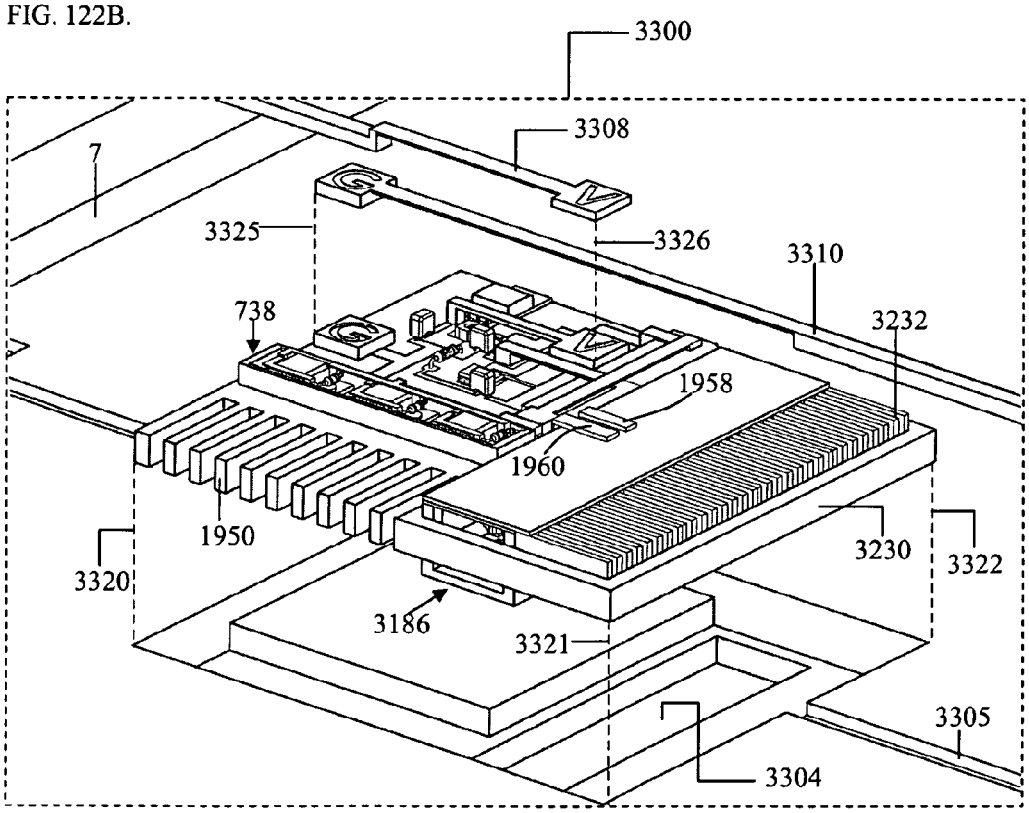

FIG. 122B is a magnified view of the embedding region shown in the perspective view of FIG. 122A, to be sure the illustrative embedding process is properly visualized for this more compact type of embeddable light distributing engine.

Figure 123A:
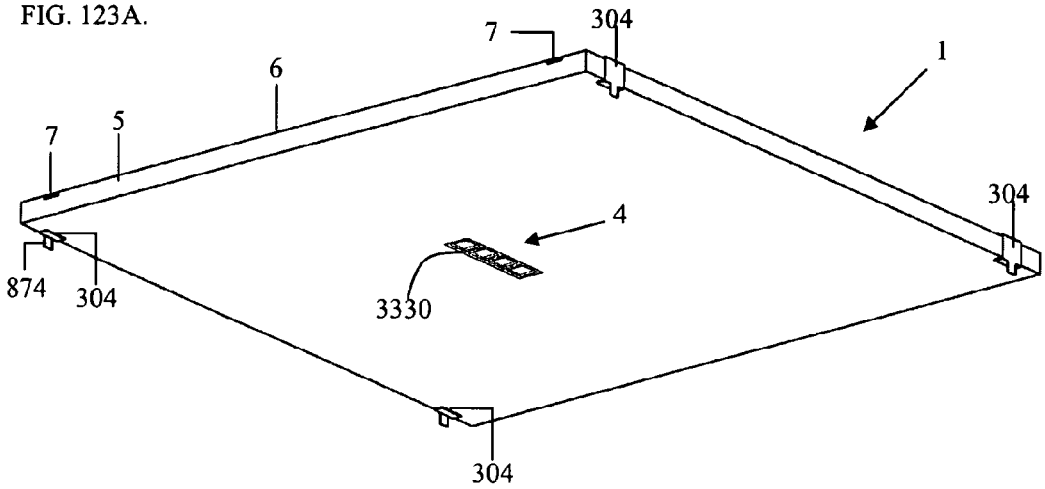

FIG. 123A is a perspective view from the floor beneath showing the 4"×¾" illuminating aperture of the +/−30-degree tile illumination system of FIGS. 122A-122B incorporating the single vertically stacked light distributing engine of FIGS. 121A-121B.

Figure 123B:
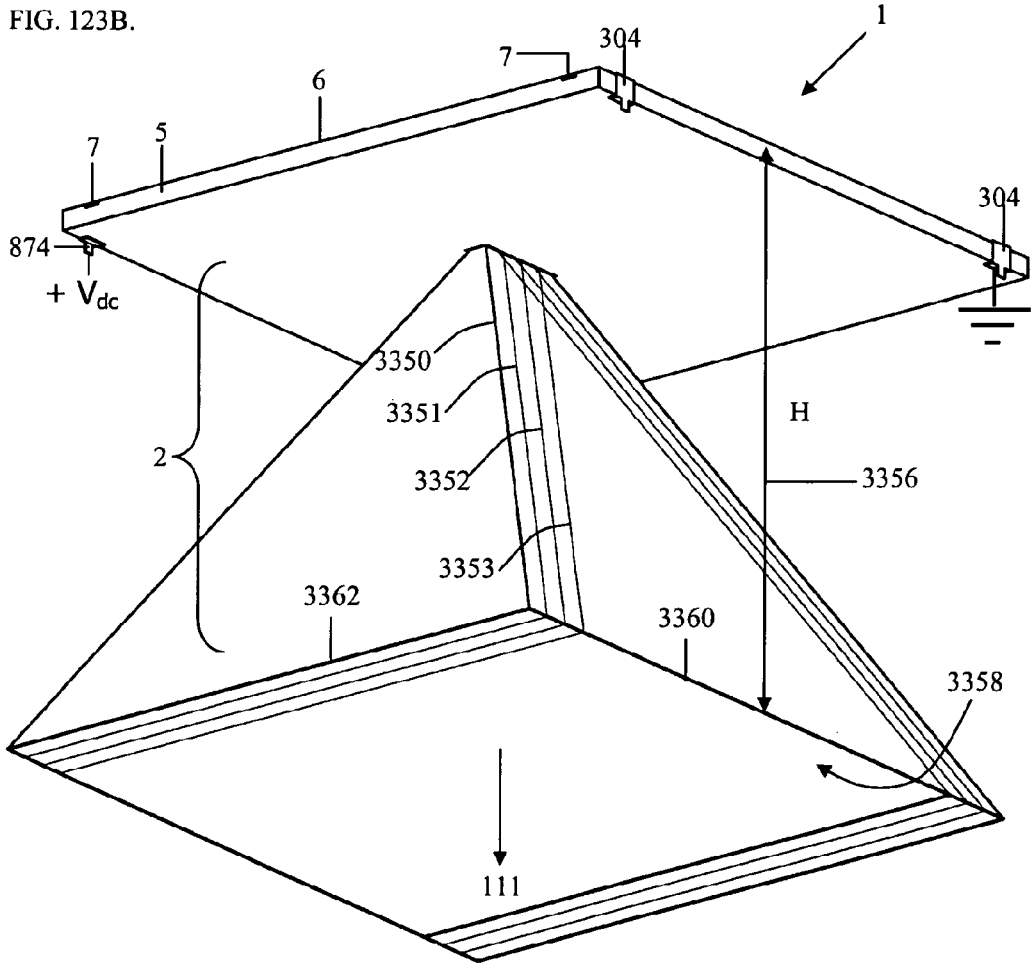

FIG. 123B is the perspective view of the illumination provided by the tile illumination system 1 of FIG. 123A when supplied with DC voltage, and when co-embedded electronic circuit portion receives an on-state control signal from the system's master controller.

Figure 124A:
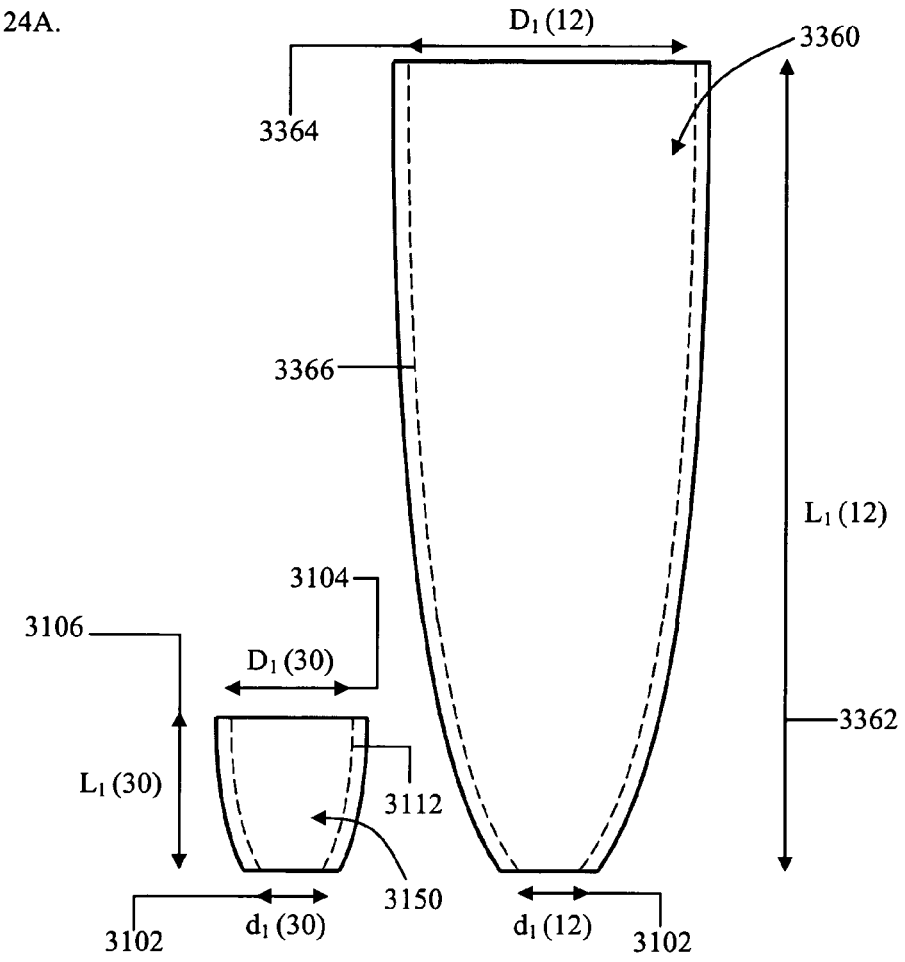

FIG. 124A is a side-by-side comparison of the ideal cross-sections of a +/−30-degree RAT reflector with that of a +/−12-degree RAT reflector, both for the illustrative case of a 1.2 mm input aperture.

Figure 124B:
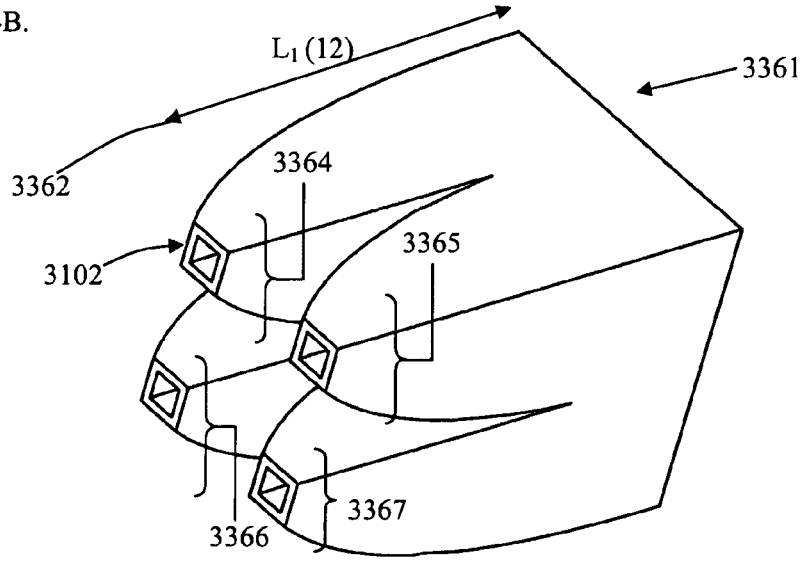

FIG. 124B is a perspective view showing the basic internal thin-walled form of the quad-sectioned version of +/−12-degree RAT reflector.

Figure 125A:
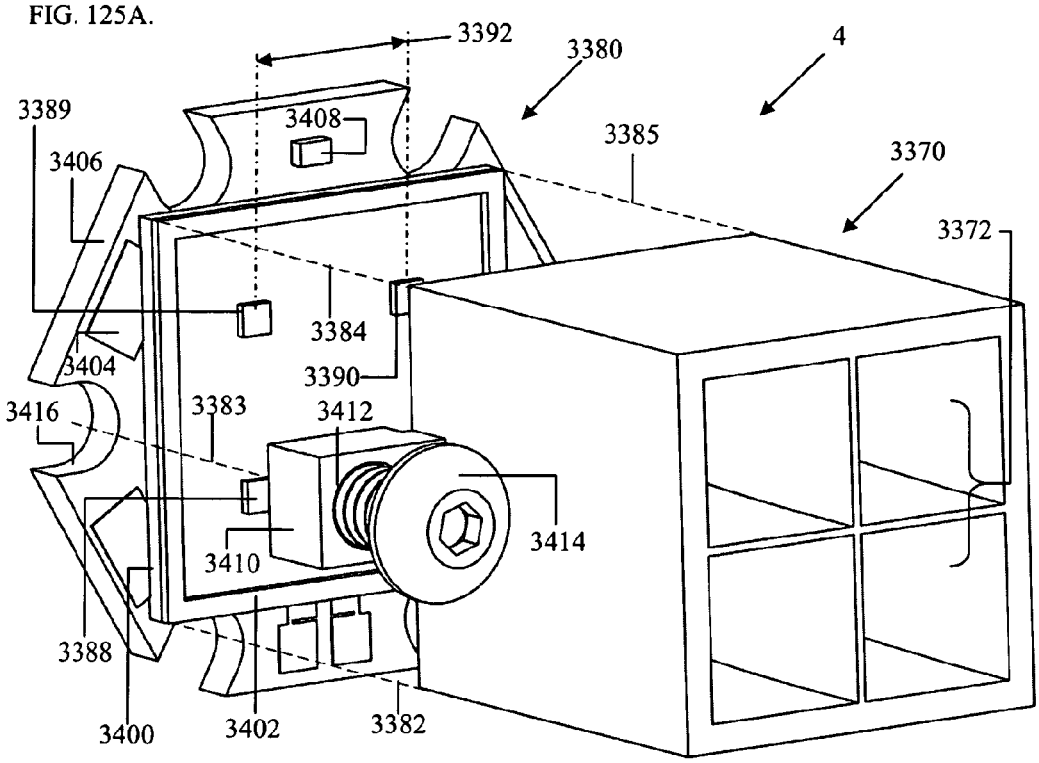

FIG. 125A is an exploded perspective view illustrating one quad-sectioned RAT reflector having +/−12-degree output, along with its counterpart LED emitter.

Figure 125B:
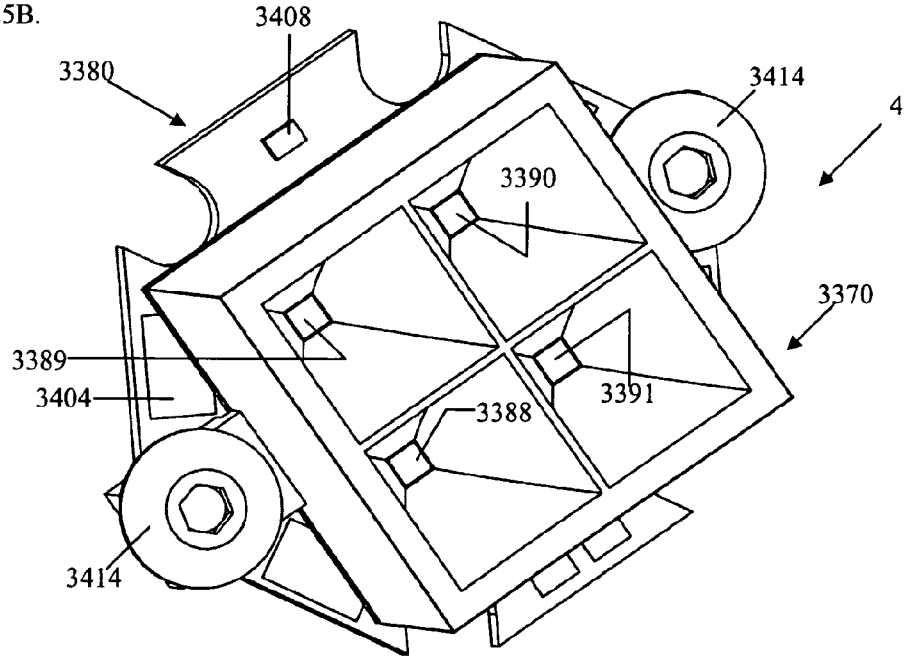

FIG. 125B is a perspective view from the output end of the assembled form of the light distributing engine example given in FIG. 125A, with the four illustrative LED chips shown centered within the corresponding four input apertures of the quad-sectioned RAT reflector.

Figure 125C:
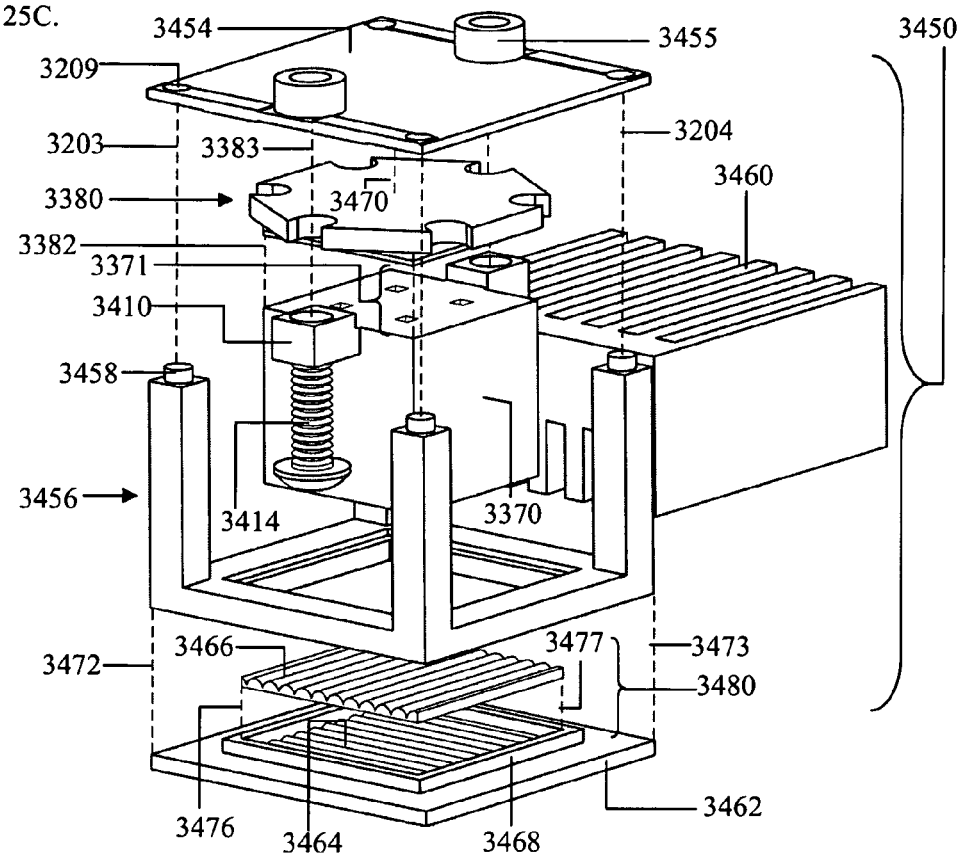

FIG. 125C is an exploded perspective view illustrating one embeddable +/−12-degree light-generating module subassembly example, analogous in form to that shown in FIG. 119 for the shorter +/−30-degree version.

Figure 125D:
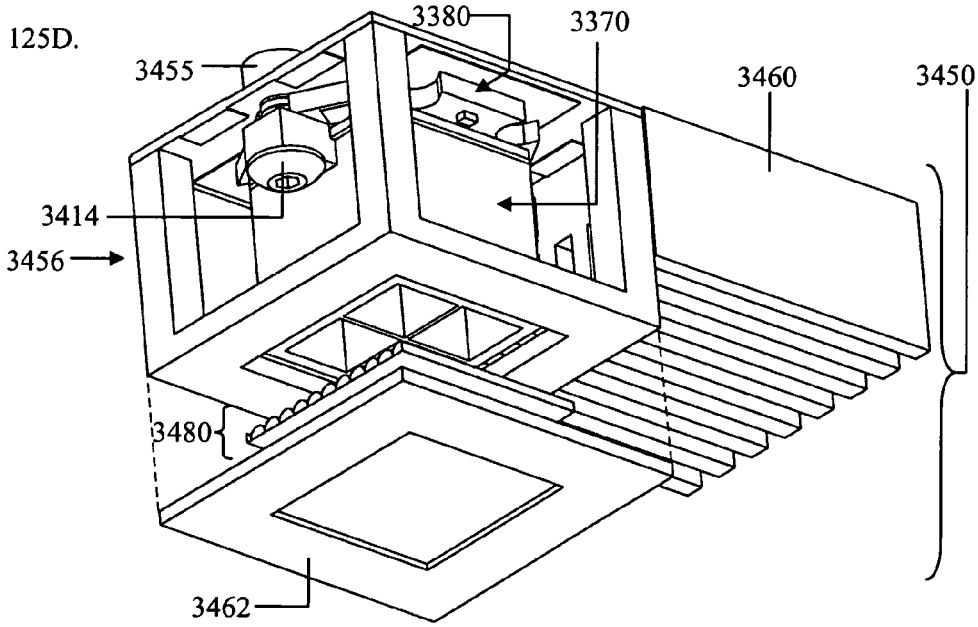

FIG. 125D is a perspective view of the +/−12-degree light-generating module of FIG. 125C after subassembly, with the exception of the output frame, which remains in exploded view for visual clarity of the quad-sectioned output aperture of RAT reflector.

Figure 126A:
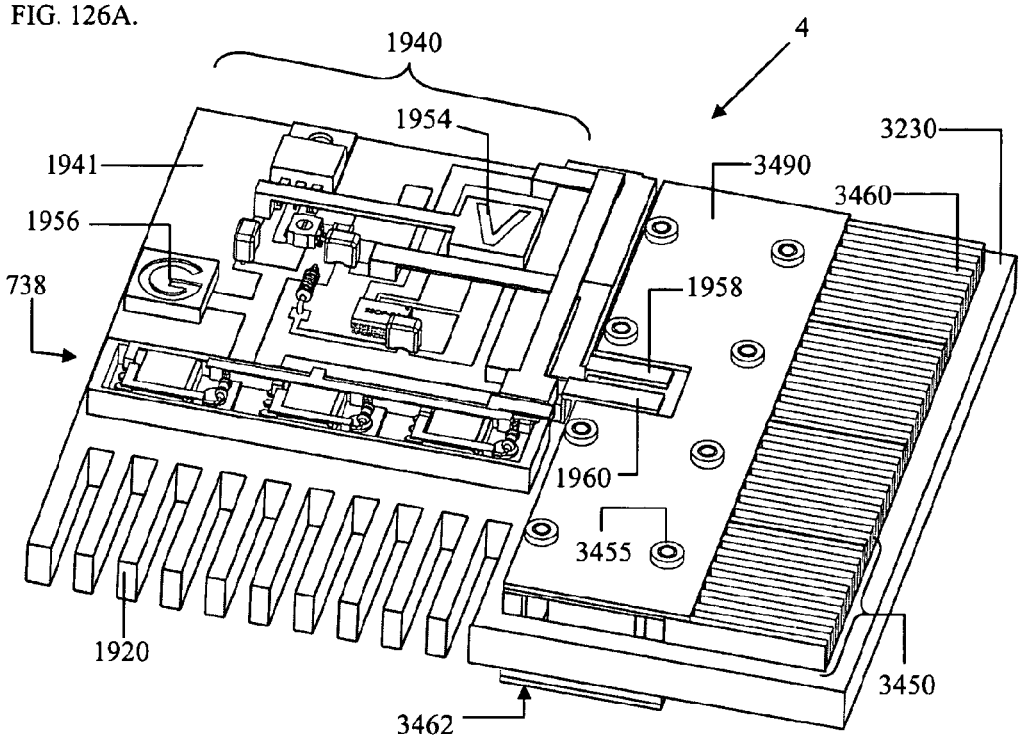

FIG. 126A is a backside perspective view of an embeddable light distributing engine embodiment formed according to the requirements of the present illumination system invention incorporating four +/−12-degree light generating modules containing the quad-sectioned RAT reflector of FIGS. 125A-125B, along with the elements of associated electronic voltage control as have been illustrated in previous examples.

Figure 126B:
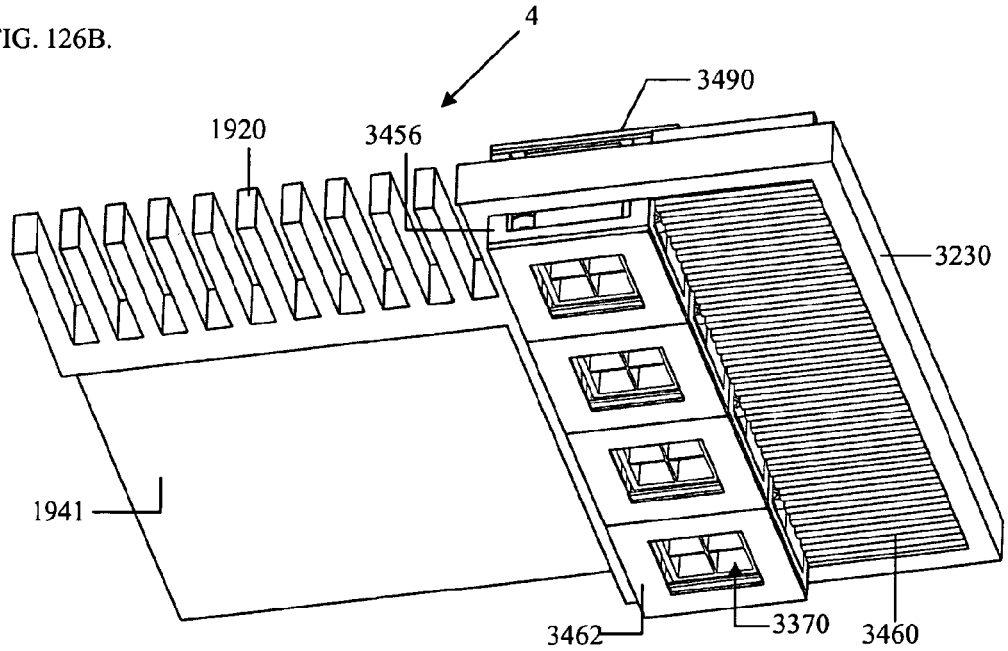

FIG. 126B is a floor side perspective view of the embeddable light distributing engine embodiment of FIG. 126A with an optional light spreading film stack removed to provide clear view of the four quad-sectioned RAT-reflector output apertures.

Figure 126C:
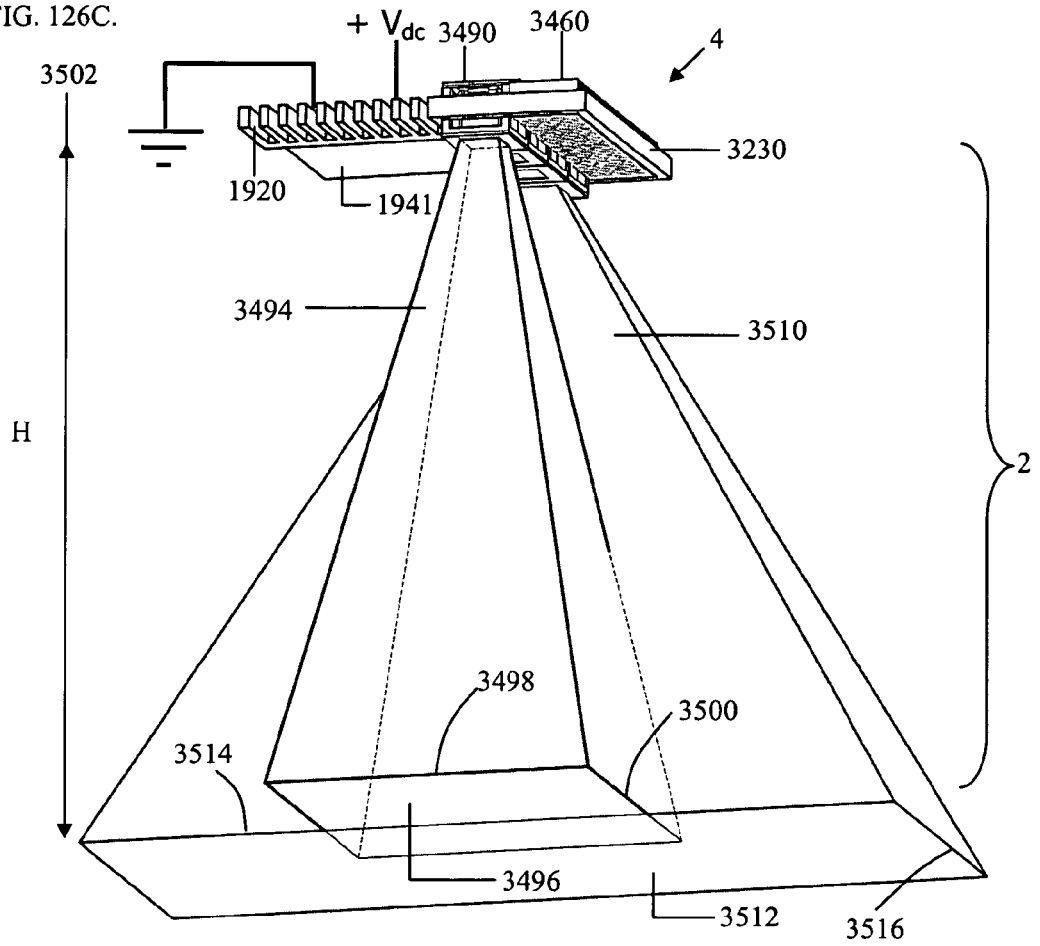

FIG. 126C is another floor side perspective view of the embeddable four-segment light-distributing engine of FIG. 126B, showing two of its four light generating modules switched on and illustratively different illuminating beams developed by each of them.

Figure 126D:
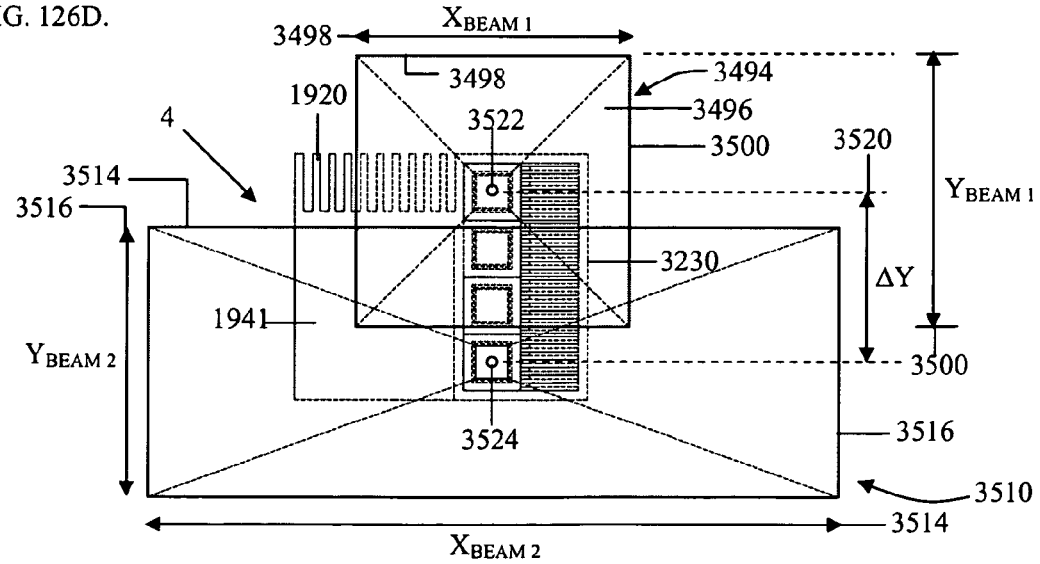

FIG. 126D is a planar view looking directly upwards at the line of four output apertures associated with the light generating portion on the bottom side of the embeddable light-distributing engine of FIG. 126C as seen from the plane being illuminated 250 mm beneath.

Figure 126E:
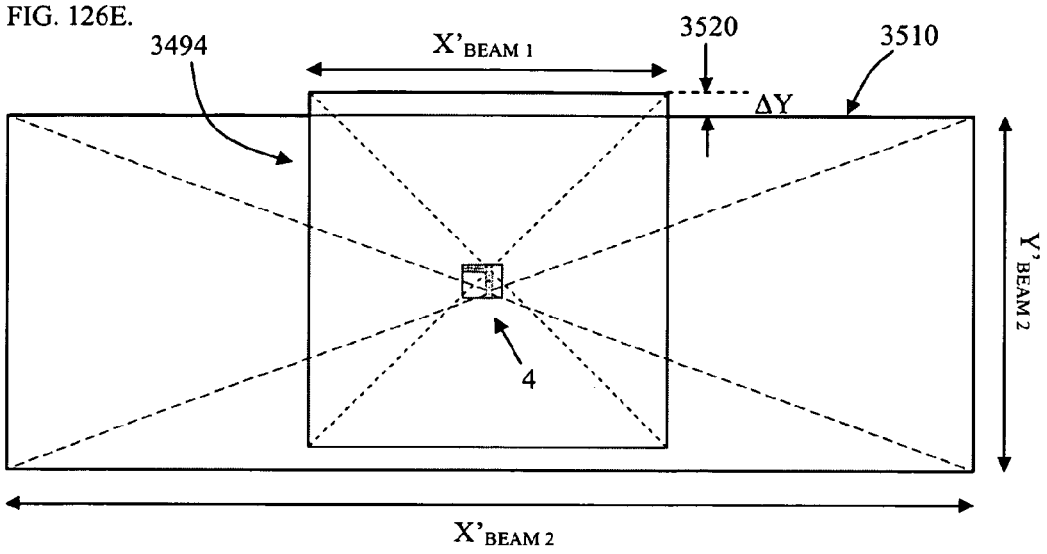

FIG. 126E is the same planar view as in FIG. 126D, but seen from a distance ten times further below, as from a floor surface 9-feet beneath (i.e., 2743.2 mm) the ceiling mounted engine.

Figure 126F:
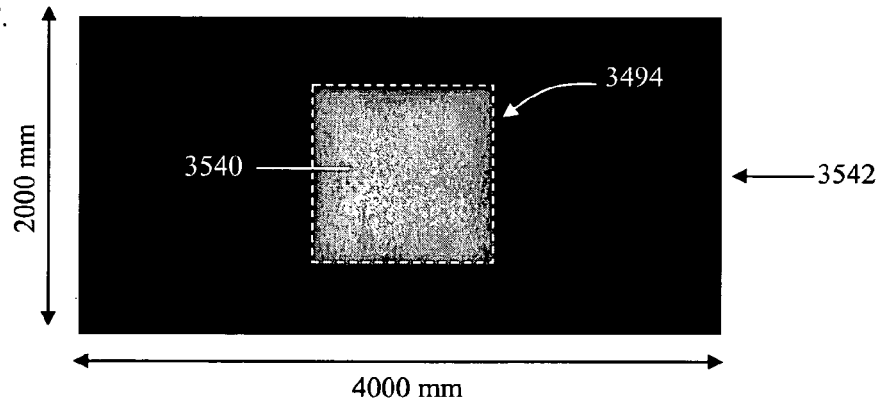

FIG. 126F is the computer simulated 1180 mm×1180 mm far field beam pattern produced on a simulated 4 meter×2 meter floor surface 9-feet below by a +/−12-degree×+/−12-degree illuminating beam from one quad-sectioned RAT reflector within the embeddable light-distributing engine of FIG. 126C.

Figure 126G:
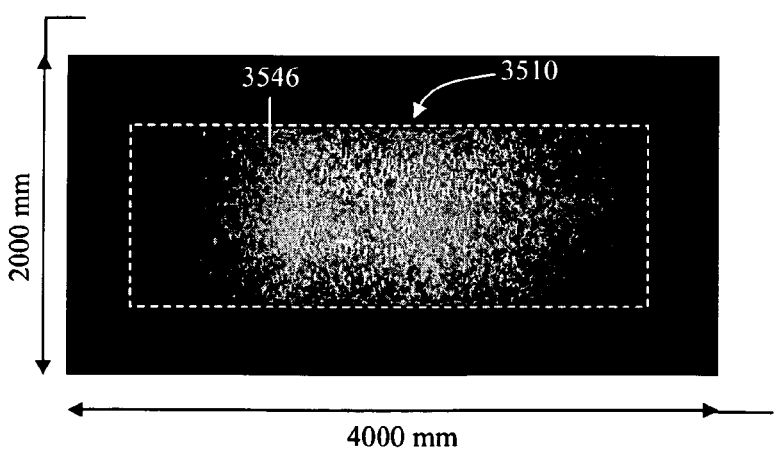

FIG. 126G is the computer simulated 3200 mm×1180 mm far field beam pattern produced when the quad-sectioned RAT reflector in the system of FIG. 126F has been combined with a single parabollically-shaped lenticular film sheet designed and oriented to spread light +/−30-degrees as shown in FIGS. 126C-126D.

Figure 127:
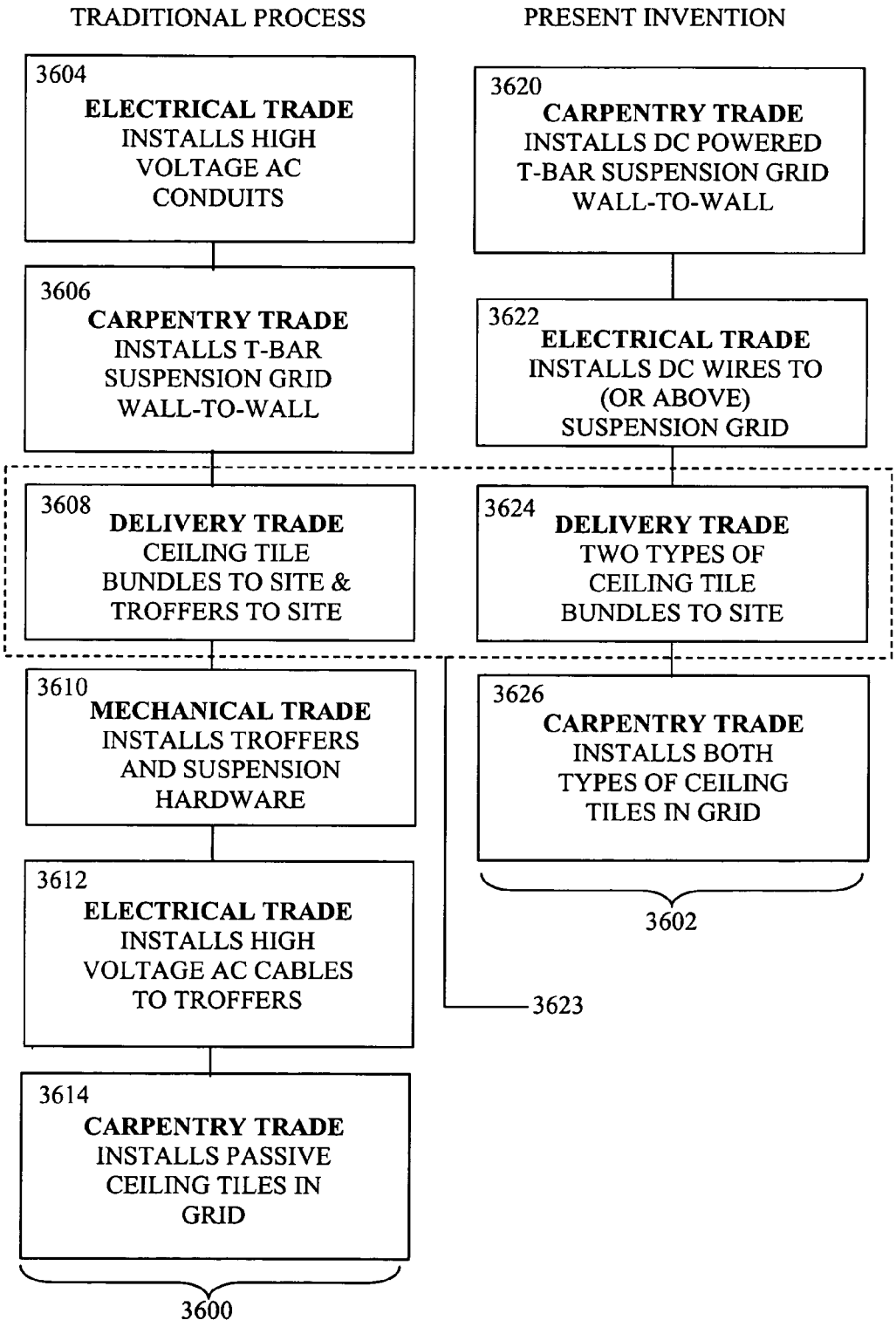

FIG. 127 is a side-by-side comparison of a flow associated with the traditional overhead lighting system installation process and a flow associated with the simplified installation process enabled by pre-manufactured tile illumination systems of the present invention, particularly when the associated.

Figure 128A:
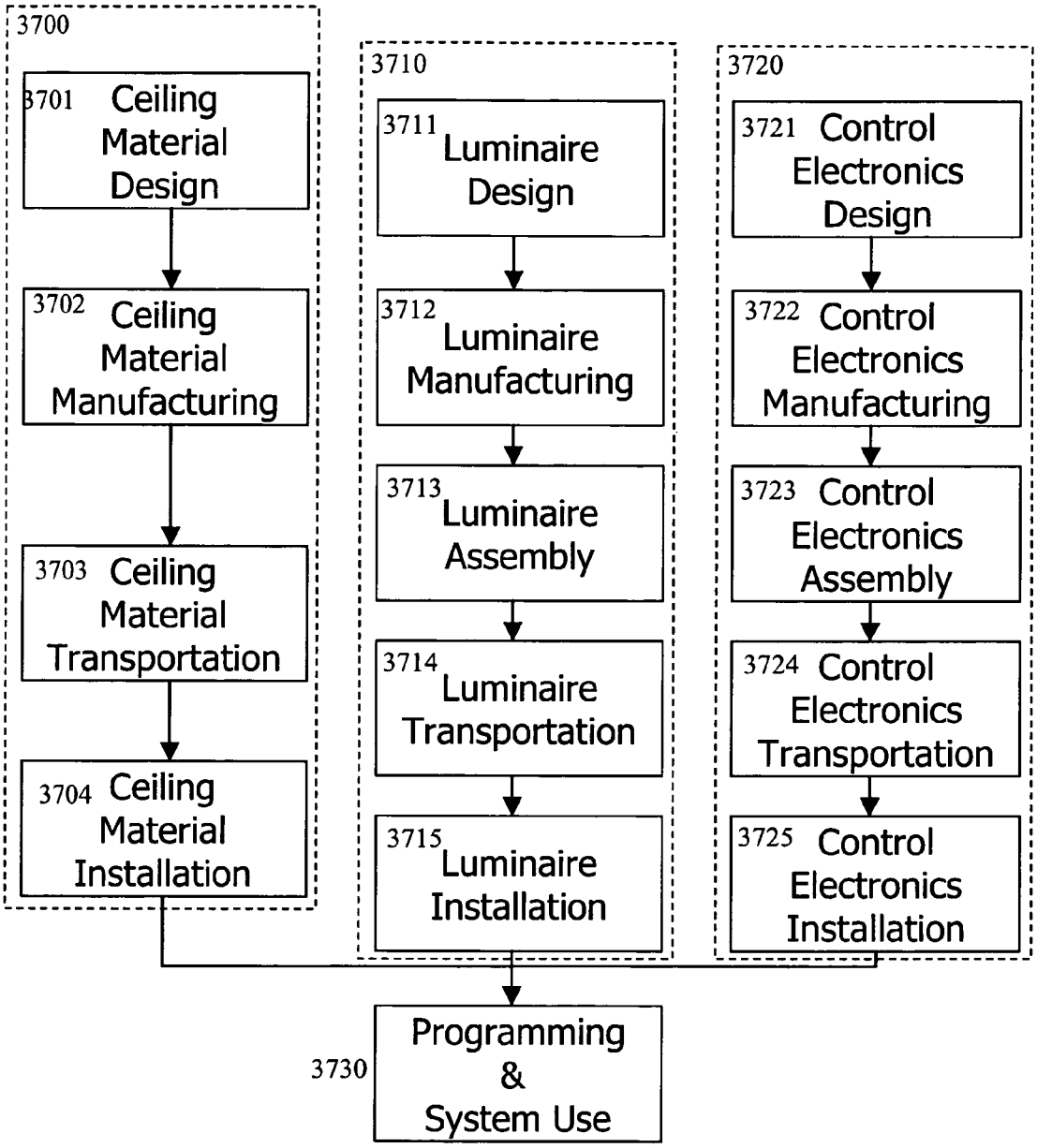

FIG. 128A is a top-level process flow, from design to use, associated with traditional ceiling and overhead lighting systems, including separate branches for ceiling materials, luminaires, and control electronics, each branch including such steps as design, manufacturing, assembly, transportation, and installation.

Figure 128B:
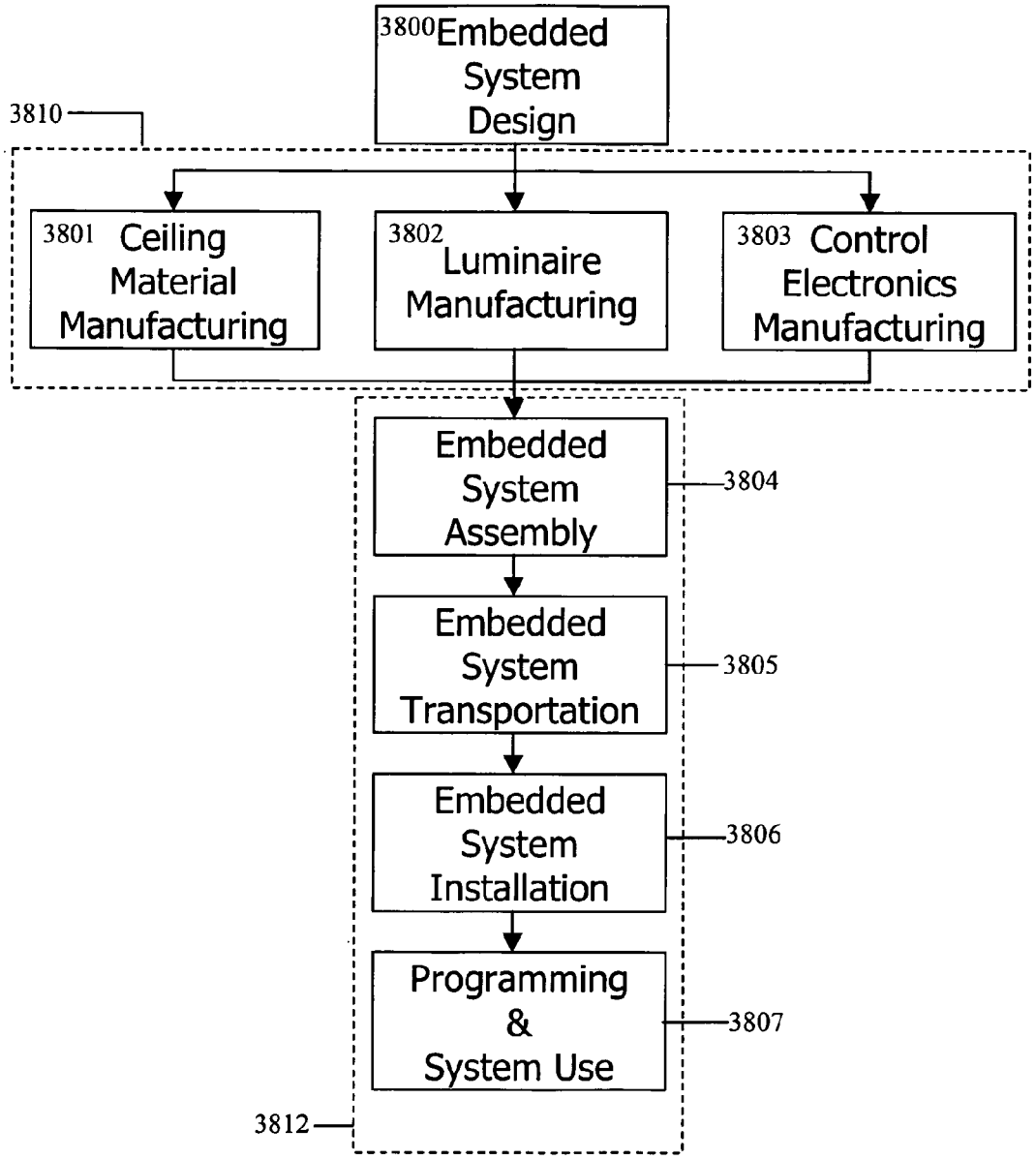

FIG. 128B is a top-level process flow, from design to use, associated with and enabled by the embedded illumination systems of the present invention, illustrating the system-oriented nature of the design-to-use process.

DETAILED DESCRIPTION OF THE PREFERRED EMBODIMENTS

Figure 1A:
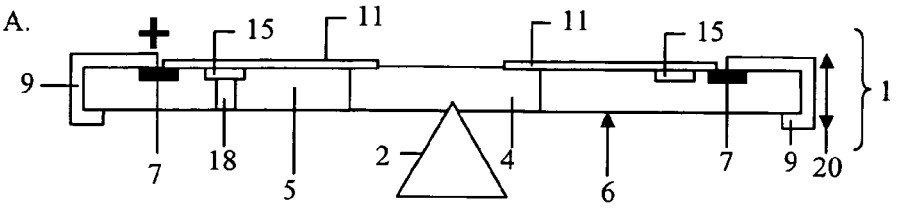
FIG. 1A is a generalized side view indicating the collective angular illumination produced by the overhead illumination system formed by embedding otherwise discrete lighting, electronic and inter-connective elements within the body of a thin ceiling (or wall) tile material.
Figure 1B:
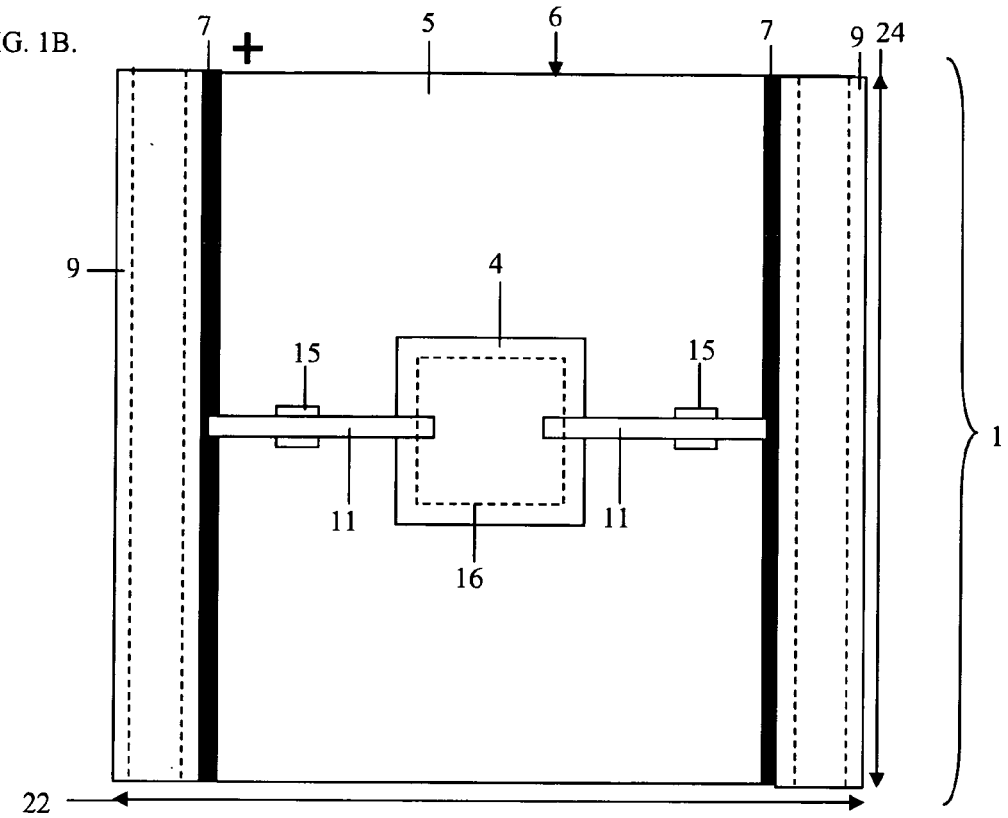
FIG. 1B is a generalized top view of system 1 showing the system's electrical utility side (as viewed from the air space just above a building's decorative ceiling or wall surface materials).
Figure 1C:
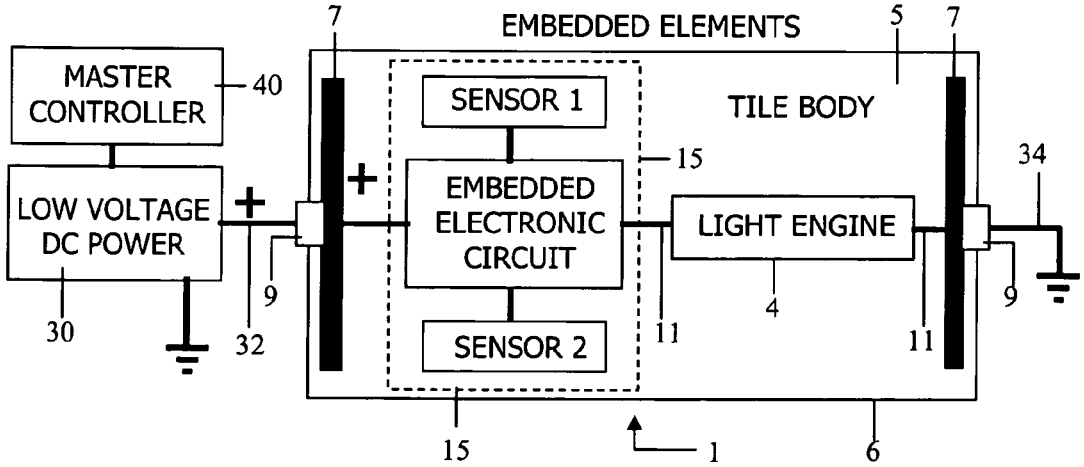
FIG. 1C is a generalized block diagram form of electrical circuit schematic for an optical illumination system in accordance with the present invention showing its interconnection with external supply of DC power, having positive side and a neutral ground (or common), and through that DC power channel, to a master source of control.

An optical system 1 constructed in accordance with the distributed overhead illumination system invention is shown in a generalized side view, FIG. 1A, in a generalized top view, FIG. 1B, and in a generalized block diagram form of electrical circuit schematic, FIG. 1C. For purposes of scaling, the cross-sectional thickness 20 of system 1 in FIG. 1A may be visualized as being 0.75 inches, and the edge boundaries 22 and 24 of system 1 in FIG. 1B may be visualized as being 2 feet by 2 feet square. In general, thickness 20 may vary between 0.25 inches and 1.5 inches, and edge boundaries 22 and 24 may vary between about 1-foot and about 6-feet, with the nominal dimensional combinations 2 feet by 2 feet and 2 feet by 4 feet being most popular among commercial standards. Within this description, all of the examples illustratively describe 24"×24" panel materials, most often referred to a "tile." In addition, all of the ceiling illumination examples provided below anticipate use in suspended (or drop) ceilings, where a suspended lattice holds square panels or tiles, some providing sources of illumination, and some not. The same embedded illumination system concepts within the present invention are more generally applicable to other sizes of panels and tiles, as well as to other common building materials, such as drywall panels.

FIG. 1A is a generalized side view indicating the collective angular illumination 2 produced by the overhead illumination system 1 formed by embedding otherwise discrete elements within the material body 5 of a ceiling (or wall) tile material 6, the embedded elements including, one or more light distributing engines 4, two or more electrical power conductors 7, two or more electronic connector elements 9, one or more electronic circuit elements 11, one or more electronic power control elements 15. Appropriate through holes and cavities for the elements to be embedded are produced in the body 5 of the tile material 6 during its manufacture, differentiating it in this way from conventionally made commercial examples of ceiling (or wall) tile materials having no such corresponding physical features. Power control elements 15, can be one or more monolithic integrated circuits or a single custom integrated circuit (in some instances including a microprocessor or custom microprocessor) and further including one or more signal sensors, one or more corresponding signal decoders, and a means of dc power regulation and switching (which could be discrete components driven by the integrated circuit or circuits). When an external supply of dc power (voltage and current) is connected, the operative power control element 15 provides a properly conditioned voltage to an electronic circuit element 11. This circuit element is connected to the +dc input terminal of a particular light-emitting engine 4 (or group of light emitting engines 4). When the circuit element senses and decodes a digital control signal associated with the light emitting engine (or group of light emitting engines) to which it is connected, the circuit acts to deliver power to that engine (or engines) as specified by the particular digital control signal received. Electrical connection with the external supply of dc power (voltage and current) is made through two or more electronic connector elements 9, at least one of which is connected to the positive (+) side of the external supply, and at least one of which is connected to the electrical common (or ground).

Power control element 15 is shown in FIGS. 1A and 1B for illustrative purposes only as being embedded in the body 5 of tile 6 separately from the embedded region for light emitting engine 4. In some preferred embodiments of the present invention it may be preferable to incorporate one or more power control elements 15 within (and as part of) light emitting engine 4. While two locations are illustrated for power control elements 15, it may be preferable to use only a single location.

The light-distributing engine 4 is distinguishable by its plate-like cross-sectional emitting area comprising a fraction of the tile body's cross-sectional area, and whose plate-like thickness falls substantially within the tile body's cross-sectional thickness. Appropriate through holes and cavities for the elements to be embedded are produced in the body 5 of the tile material 6 during its manufacture, differentiating it in this way from conventionally made commercial examples of ceiling (or wall) tile materials having no such corresponding physical features.

FIG. 1B is a generalized top view of system 1 showing the system's electrical utility side (as viewed from the air space just above a building's decorative ceiling or wall surface materials). Light distributing engine 4 is shown for purposes of illustration as being a single square entity embedded within the body 5 of tile 6. Light distributing engine 4 may also be rectangular (or circular), may include a multiplicity of light engines 4 placed contiguously (or substantially contiguously), or may include a multiplicity of light engines 4 embedded at different spatial locations within the body 5 of tile 6. The geometrical relationship between the emitting aperture area of plate-like light distributing engine 4 and the surface area of tile 6 is an important aspect of the present invention in that the emitting aperture area of each light distributing engine 4 is a large enough area to distribute emitted lumens such that aperture brightness (lumens per square foot) is acceptable for human view, and small enough such that the total emitting surface area of all emitting apertures embedded within a single tile 6 is substantially less than 50% that of the surface area of the tile.

The intent of the present invention is to embed plate-like light distributing engines 4 within the body 5 of thin lightweight tile 6 as a minor increase to the tile's weight, minor constituent of the tile's volume and area, while not so minor in area that the visual brightness of each emitting aperture were to become hazardous to view.

FIG. 1C is a generalized block diagram form of electrical circuit schematic for optical system 1 showing its interconnection with external supply of DC power (LOW VOLTAGE DC POWER) 30, having positive side 32 and a neutral ground (or common) 34, and through that DC power channel, to a MASTER CONTROLLER 40. Both master controller 40 and external supply of DC power 30 operate (provide programmed power to) a large group of optical systems 1, treating them each as separate entities (as in the separate ceiling tiles in a ceiling tile illumination system). Master controller 40 provides many operational and system programming features. However, its most fundamental function is to act as the effective "light switch" for all systems 1 in that it provides digital control signals (as explained further below) that determine which light engines 4 are powered and how much power is to be applied.

SENSOR 1 within power control element 15 is a digital signal receiver for transmissions from master controller 40, whether in the form of a high frequency electrical signal imposed on the DC power conveyed by the external supply of DC power 30, a radio frequency (RF) broadcast by an RF transmitter connected to (or part of) master controller 40, or an infrared (IR) broadcast by an IR transmitter connected to (or a part) of master controller 40 as a few examples.

Sensor 2 within power control element 15 may be one of a number of sensor types capable of detecting physical parameters or low level communication signals in the near field of a light emitting engine associated with the embedded electronic circuit. The master controller in the present invention may communicate with SENSOR 2 through the embedded electronic circuit. Thus, the master controller can learn of physical parameters such as ambient light levels, temperatures, and the motion of physical objects near the light emitting engines. Such sensors, distributed throughout the ceiling system, can receive human feedback from IR or RF signaling directly to the sensor. By this means, an office worker in an underlying work cubical may signal an embedded sensor above his location to cause different lighting actions be taken by the network. Alternatively, the office worker can generate the same actions by communicating to the master controller through IR or RF signaling, by use of a computer based application that may include a set of building coordinates referenced to the ceiling system, or through other interfaces. SENSOR 2 within (or a satellite of) power control element 15 is embedded in body 5 of tile 6 in conjunction with an access hole 18 (FIG. 1A) so as to have a clear view of the floor beneath system 1, and receptivity to either light measurement, RF, IR, or motion generated control signals recognized by power control element 15.

Figure 1D:
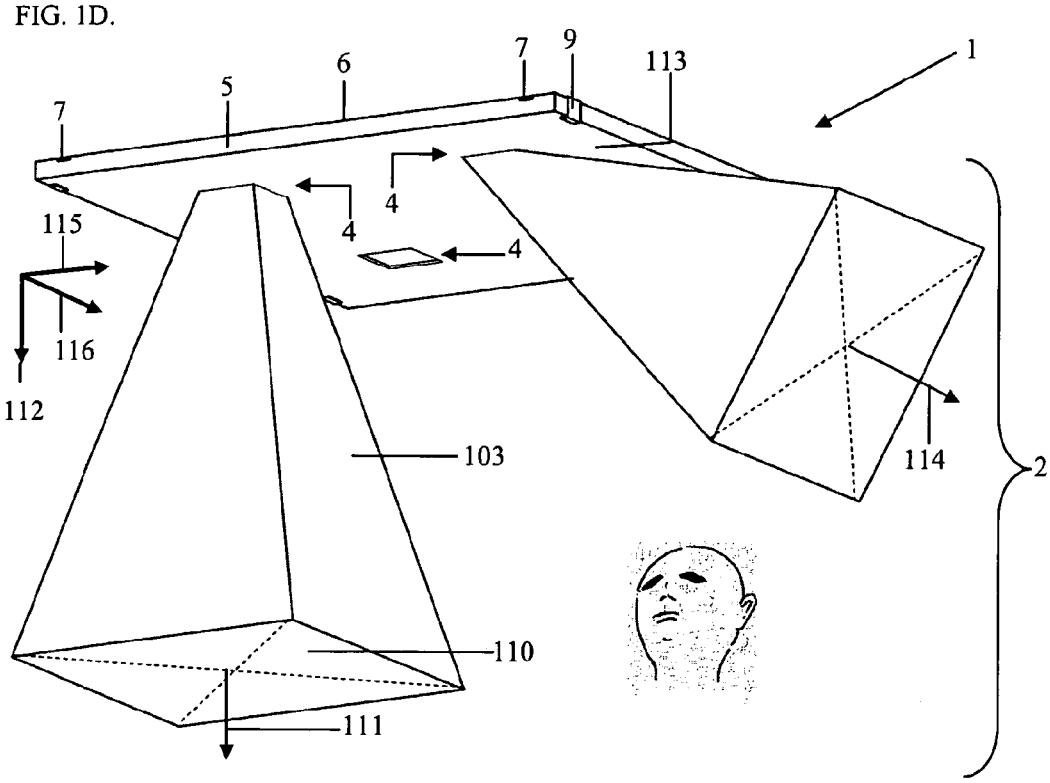
FIG. 1D is a generalized form of optical illumination system constructed in accordance with the distributed overhead illumination system invention shown in schematic perspective, as viewed from the floor below, including a multiplicity of light distributing engines embedded within body of a thin tile or panel material.

FIG. 1D is a generalized form of optical illumination system 1 constructed in accordance with the distributed overhead illumination system invention shown in schematic perspective, as viewed from the floor below, including a multiplicity of light distributing engines 4 embedded within body 5 of tile 6. This form of the present invention involves the collective angular illumination 2 provided by the superposition of individual light beams 103 emanating from of one or more of the widely-separated and strategically-grouped light emitting engines 4 embedded within, supported by, and receiving power from the body 5 of tile 6. In this illustration, optical system 1 encompasses one tile unit representative of a larger grid work of similar optical systems 1, that when held or joined together by a common method of support attached to a building structure, serves as an overhead ceiling providing organized illumination to a floor (or wall) surface below.

Other elements also contained within and supported by the body 5 of tile 6 in optical system 1 that can be seen in this view from below (if only by their exposed edges) include DC voltage buss conductors 7 (also called that supply a source means for remotely located electrical voltage and current 30 (FIG. 1C) and one or more electrical connector elements 9 (connected to embedded circuit elements within the body 5 of tile 6 hidden from view, but fully described in later illustrations).

The detailed distributions of individual light beams 103 depend on the type and design of light distributing engine 4, but are shown here organized in tightly defined angular cones. The cone boundary shown may represent a truly hard cutoff to the light, or, for example, the traditional full-width-half-max (FWHM) intensity points of a beam with a softer edge. Beams 103 have substantially square or rectangular cross-section 110, but they may also have circular or elliptical cross-sections.

Figure 1E:
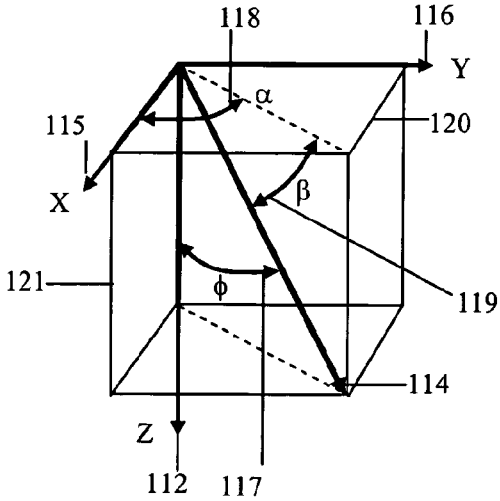
FIG. 1E is a perspective view of the system's coordinate system useful for showing the angular relationships of light beams in the tile-based illumination system of FIGS. 1A-1D.
Figure 1F:
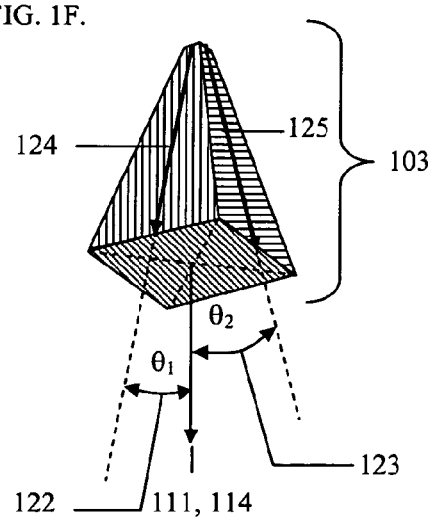
FIG. 1F shows a perspective view similar to that of FIG. 1A of a ceiling tile containing a single light distributing engine or single group of light distributing engines, as viewed from the floor beneath.

FIG. 1E is a perspective view of the system's coordinate system useful for showing the angular relationships of light beams 103 in system 1. Individual light beams 103 created by light distributing engines 4 in system 1 may be directed directly downwards towards the floor beneath along downward axis 111 running parallel to the system's Z-axis 112, which in turn is substantially perpendicular to surface plane 113 of ceiling tile 6. The individual light beams 103 may also be directed at an angle $\phi$, 117, along a tilted axis 114 so as to illuminate wall surfaces, objects on wall surfaces, or to spread light further than by beams directed as along downward axis 111 alone, as in FIG. 1D. Tilt angle $\phi$, 117, is expressed most generally with respect to the system's X, Y and Z axes 115, 116, and 112 as a function of angle ($\alpha$, 118; $\beta$, 119), that tilted axis 114 makes with its projection in each system plane 120 and 121 (X-Y and X-Z), as shown in FIG. 1D. The angular extent of individual light beams 3 in each of the two orthogonal system meridians is defined by the angle ($\theta_1$, 122; $\theta_2$, 123) formed between a light-ray (124, 125) at the extreme edge of light beam 3 in that meridian and the generally downward axis 111 or 114, as shown in FIG. 1F.

Conventional ceiling tile 6, in accordance with this form of the present invention, is usually a nominal 2 feet×2 feet or 2 feet by 4 feet in square or rectangular area, 0.250 to 1.5 inch in cross-sectional thickness, and made of an insulating material such as gypsum (or gypsum composite). Other sizes of ceiling tile 6 in accordance with the present invention may be of equal interest in some applications, and require different square or rectangular shape. Tile 6 may be made using a wider choice of building materials and composites including for example polymer composites, metal-polymer composites, or any other appropriate lightweight structural material, within the typical range of 0.5-inch to 0.75 inch in cross-sectional thickness, and in some cases to as much as 1.5 inches. Tile 6 may also be embedded with pre-molded secondary structures that fit substantially within the tile body cross-section and become a composite part of its body 5.

The generalized illumination system invention of FIGS. 1A-1D has been illustrated as an overhead ceiling tile illumination system providing down lighting on floors (and objects on floors) plus spot and wider flood lighting on walls (and objects on walls). The same principals and approach extend equally correctly to drywall ceiling panel illumination, wall tile illumination, and drywall wall illumination systems. In the analogous wall embodiments of the present invention, both down-directed and up-directed illumination beams can be used to provide obliquely directed lighting patterns on adjacent floors and ceilings.

Thin cross-section light distributing engines 4 in accordance with this form of the present invention, also referred to as thin luminaires or thin lighting fixtures, typically exhibit square, rectangular or circular apertures ranging in size from about 1"×1" to 4"×4", as viewed from the floor below, and are made to be contained substantially within, and supported by, the physical cross-section of the body 5 of an otherwise conventional ceiling tile 6.

For example, a 2-foot×2-foot ceiling tile 6 occupies 576 square inches while nine individual thin cross-section light distributing engines (only four are shown in FIG. 1D), if 2" by 2" in aperture area, occupy a total area of only 36 square inches. Consequently, the nine light emitting apertures of light distributing engines occupy only $^{36}/_{576}{}^{ths}$ (6.25%) of the exposed surface area of ceiling tile 6 as viewed from the floor below. If the nine light engines exhibited 4"×4" aperture areas, the ceiling tile area fraction occupied would only increase to 25%.

Figure 2A:
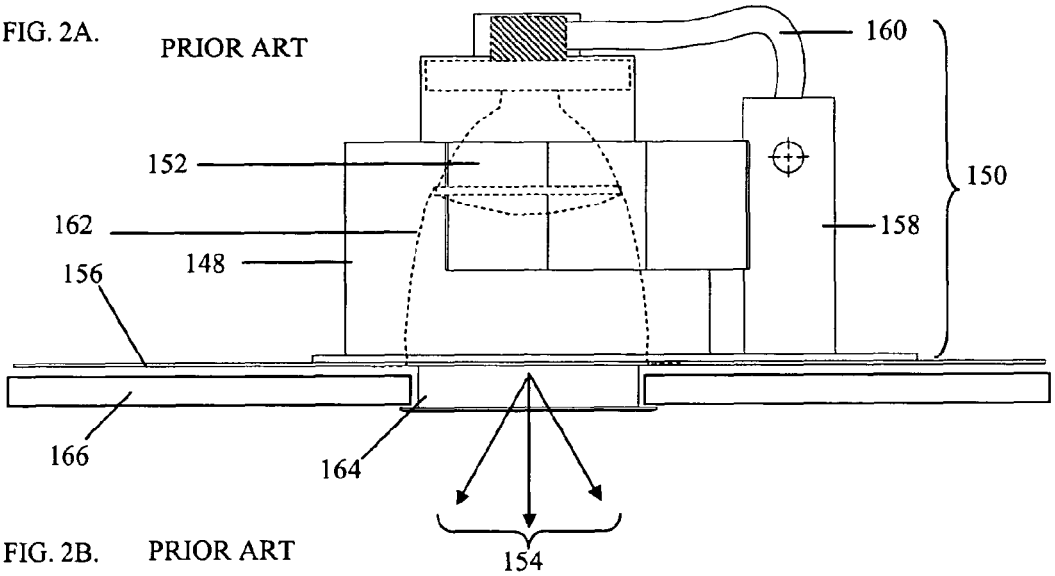
FIG. 2A. PRIOR ART
FIG. 2A shows one typical prior art example of a discrete down lighting fixture far too bulky to be embedded in body of a thin tile material.
Figure 2B:
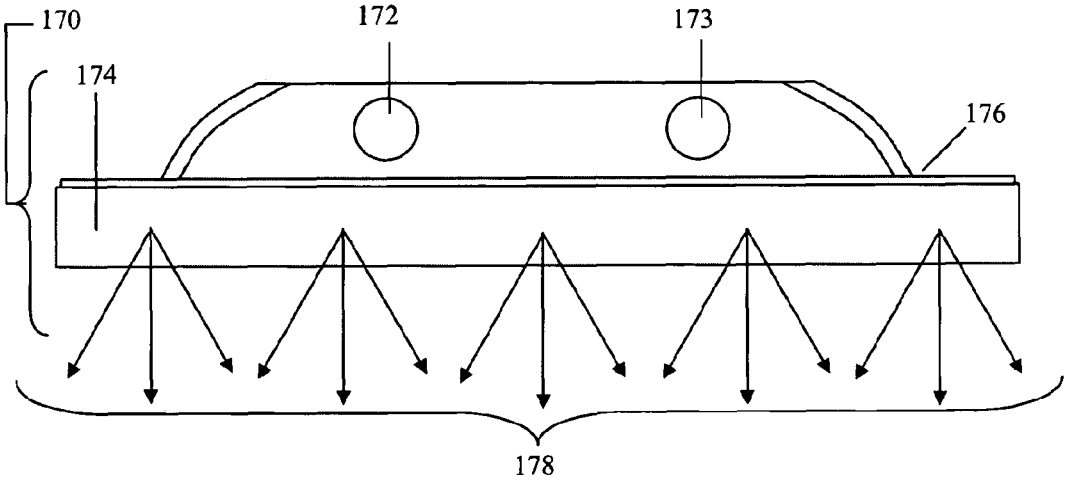
FIG. 2B. PRIOR ART
FIG. 2B shows another typical prior art example of a discrete down lighting fixture far too bulky to be embedded in body of a thin tile material.

This configuration is distinguished from all discrete variations on traditional overhead lighting prior art represented by the recessed down-lighting can in FIG. 2A and the fluorescent tube troffer in FIG. 2B, each typically occupying either a much larger area fraction of and weighing more than the same 2 foot×2 foot ceiling tile 6, sometimes replacing the ceiling tile entirely. In addition, the cross-sectional thickness of both traditional prior art lighting fixtures protrude a substantial distance beyond the cross-sectional thickness of ceiling tile 6, and neither are designed to be, manufactured to be or are installed embedded within or supported by the body 5 of ceiling tile 6.

FIG. 2A shows one typical prior art example of a discrete down lighting fixture far too bulky to be embedded in body 5 of tile 6. FIG. 2A is a schematic cross-sectional view of the heavy-gage metal housing 148 of a typical recessed down lighting can-styled fixture 150 for a 75 W PAR-30 lamp 152 (which may also be more generally a halogen type lamp, a metal halide type lamp, an HID type lamp, or even a an LED type lamp). Cross-sectional thickness varies with product and lamp type, but mostly range from 7" to 11". The type of lamp 152 also determines the angular range of light emission 154, which is typically designed to provide both flood and spot beams. There are smaller, lower wattage, halogen (MR-16) and LED versions, but even those are typically 4"-6" in thickness.

Compatibility with the type of ceiling tile shown in FIG. 1D sometimes requires using a 24"×24" steel lay-in-panel 156 (or bridge-like supports that span over the tile 6 and rest on the suspension lattice system that supports the entire ceiling) that helps distribute total fixture weight (which can be as much as 10-15 lbs for 75 W versions) including the required electronic ballast 158, 15-amp or 20-amp electric power cabling 160, housing 148, reflector 162 and trim parts 164). In situations where the 24"×24" ceiling tile 166 is not replaced in its entirety, a circular aperture hole is cut out manually and individually using a saw during the recessed can installation process to accommodate the size of the fixture's aperture (5" to 7" in diameter). Conventional ceiling tile materials are not in and of themselves strong or rigid enough to support the weight of the higher wattage versions, and their load-bearing fixture area (which ranges from about 7"×10" to 12"×12"). Such prior art lighting fixtures are often even too heavy to be supported by the metal suspension lattice systems used to support simple lightweight ceiling tile materials. Without secondary means of mechanical support, ceiling tile materials would likely crack, buckle or even collapse under the weight of the collective recessed can fixtures 150 that would be needed in a typical commercial ceiling, especially were tile materials to become wet.

The system of FIG. 2A at 12-15 lbs of weight for traditional lamp types is at least 10 times too heavy to be embedded in a common ceiling tile material according to the present invention, and with 7"-11" elevation, is 9-14 times too thick. Even the latest relatively lightweight (2.34 lb) screw-in type recessed LED down-lights made by Cree Inc. (LR4 and LR6), are 6"-10" tall and do not provide any significant weight reductions when screwed into existing metal housings. And Cree's newest LR24 architectural lighting model is 24"×24" and meant to substitute for a ceiling tile completely.

FIG. 2B shows another typical prior art example of a discrete down lighting fixture far too bulky to be embedded in body 5 of tile 6. FIG. 2B is the schematic cross-sectional view of one typical 24"×24" recessed fluorescent troffer 170 with two 40 W fluorescent tubes 172 and 173, plus its output illumination conditioner 174, either a lens sheet or light shielding louvers. This common prior art example is meant to replace a ceiling tile completely. The illustration provided doesn't include the corresponding electronic ballast or the 15-amp or 20-amp electric power conduit, BX or Romex type cabling, all of which add to the unit's bulk and weight. The luminaire housing 176 is made of heavy-gage steel so as to protect the input leads to the fluorescent ballast, the lamp sockets, the HG-containing fluorescent lamp tubes themselves and the associated components, from either shock or fire hazard according to building code standards set by Underwriters' Laboratories (UL) as in UL1570. A typical 24"×24" fluorescent troffer 170 such as this can weight as much as 15 lbs or more, and the 24"×48" type can weight 30 lbs or more. The thickness (or height) of housing 176 varies between about 2.25 inch for lay-in designs without louvers or lenses and slightly over 6 inches in the more rugged louvered designs. Light emission 178 is typically provided in the widest, Lambertian type of angular-distribution, and is usually at least +/−60-degrees (120-degrees full angle) and in some cases, wider.

The system illustrated in FIG. 2B at 15-30 lbs of weight is at least 30 times too heavy to be embedded in common ceiling tile materials according to the present invention. Even if mechanical weight were not a limiting factor, the bulky lighting fixture's substantial lateral and vertical dimensions would prohibit their application.

The objective of the present invention is to not just replace these traditionally thick and heavyweight lighting fixtures with thinner and lighter-weight alternatives, but also to introduce a completely new type of overhead (and wall-mounted) electronically-controlled lighting system integrated and embedded within a wide variety of thin cross-section building tile materials.

Figure 2C:
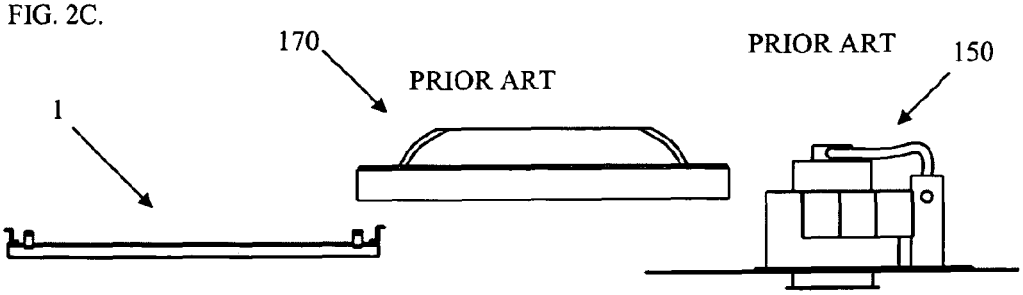
FIG. 2C shows side-by-side cross-sectional height comparisons among generally equivalent 24"×24" embodiments of the present plate-like ceiling tile illumination system invention as shown in the perspective of FIG. 1D, the bulky fluorescent troffer of FIG. 2B, and the bulkier recessed down lighting fixture of FIG. 2A.

FIG. 2C shows side-by-side cross-sectional height comparisons among generally equivalent 24"×24" embodiments of the present plate-like ceiling tile illumination system invention 1 (as generalized in the perspective of FIG. 1D), the bulky fluorescent troffer 170 (as generalized in FIG. 2B) and the bulkier recessed down lighting fixture 150 (as generalized in FIG. 2A). The integrated tile-based lighting system 1 of the present invention is not only substantially thinner than prior art examples, but unlike the prior art examples of FIGS. 2A-B, it contains separately controllable means for more than one source of light, and the means of control for each.

All prior art lighting fixtures like those of FIGS. 2A-2B provide means of electrical power connection, but external power cables have to be used as the power delivering means to each fixture. While this method of power delivery may also be used with the present invention, doing so is not its best mode of operation. Instead, thin-profile power delivery busses 7 (as in FIGS. 1A-1C) and associated power connectors 9 embedded into each tile system 1 eliminate need for a traditional maze of external power delivery cables. These elements provide means for a built-in grid of power delivery when tile system 1 is suspended in a traditional overhead tile-supporting lattice 180 such as illustrated generally in FIG. 2D, and provide an on-tile power transfer element that may be accessed by other elements requiring need of access to DC voltage or ground.

Figure 2D:
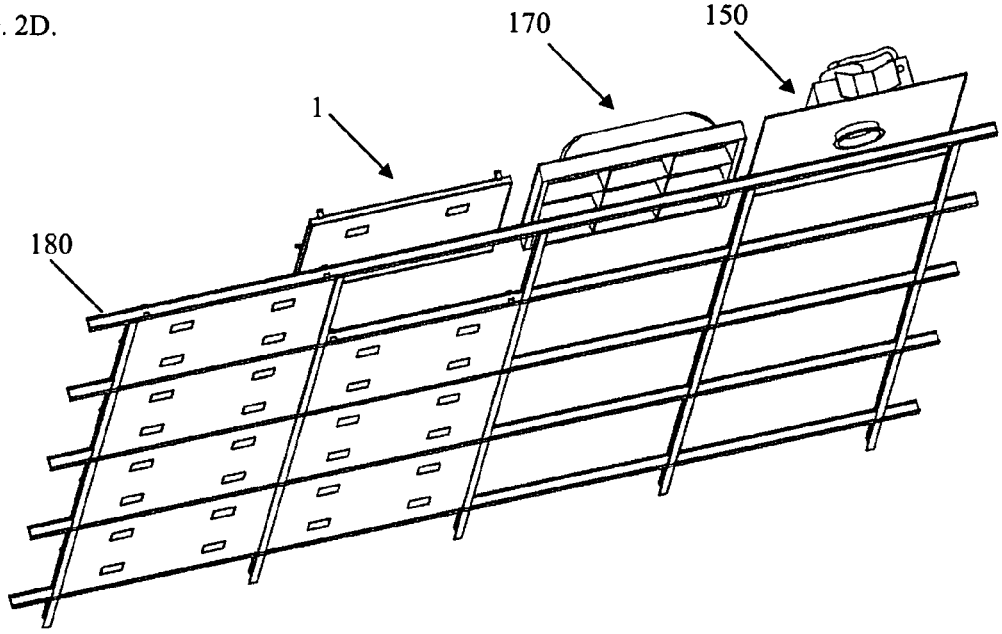
FIGS. 2D and 2E provide two different perspective views from the floor below of the standard type of metal grid ceiling tile suspension lattice 180 used universally to support or suspend large groups of lightweight ceiling tile.
Figure 2E:
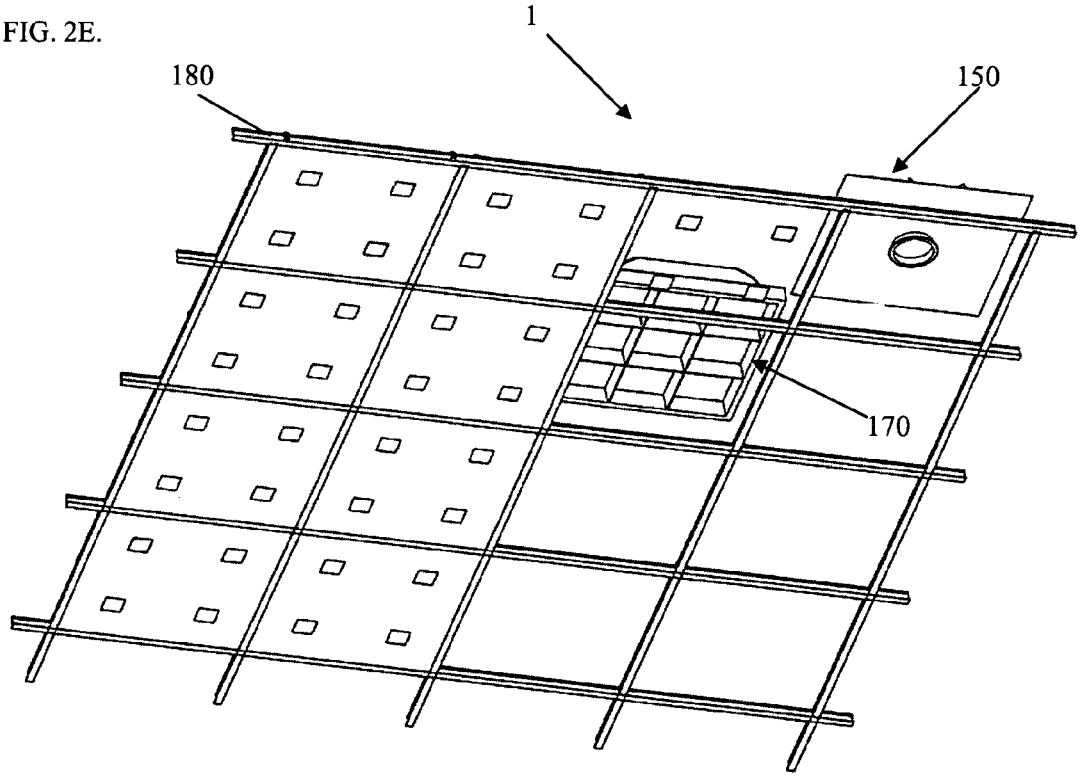

FIGS. 2D and 2E provide two different perspective views from the floor below of the standard type of metal grid ceiling tile suspension lattice 180 used universally to support or suspend large groups of lightweight ceiling tile. Examples of both tile system 1 and prior art lighting fixtures 150 and 170 are provided for the purpose of comparing their mechanical differences. Installation procedures for all embodiments of tile system 1 are practically identical to those used to install the plain lightweight ceiling tile themselves. This is far from the case with any of the bulkier prior art fixtures, which require a fair amount of physical strength and balance to jockey into place.

Thin tile lighting systems 1 of the present invention may be thinner and lighter-weight than prior art examples, but applications dictate that they must also supply equivalent amounts of illumination.

One point of reference is given by the standard 24"×24" fluorescent troffer 170 (FIG. 2B), which uses two 40 W fluorescent lamps to provide a total of 6300 lamp lumens inside metal housing 176. Of these 6300 lumens, approximately 4000 lumens emit within the fixture's flood lighting output 178, nominally in a +/−60-degree or larger angular range. When one fixture 170 is placed in suspension lattice 180 surrounded by 8 passive ceiling tiles in a 6 foot×6 foot array, an object to be illuminated on a plane surface 1.5 m directly below (for example, tables and desks) receives about 1000 Lux average illuminance (4000 lumens per every 3.34 $m^2$) assuming all neighboring fixtures 170 in the larger suspension system 180 are powered to their recommended 80 W level. This example arbitrarily assumes about a 7 foot ceiling height and 30" tabletops.

The same illuminance level is achieved with the present invention using various combinations of embedded light distributing engines 4 ranging from large groupings of light distributing engines 4 embedded in a single tile surrounded by passive tiles to a small group of light distributing engines 4 embedded in every tile. Suppose for example that each individual light distributing engine 4 of the present invention were arranged to deliver 300 lumens to the floor below. When deployed in a single 24" tile surrounded by 8 passive ones, the single tile would require 13 embedded light distributing engines 4 to provide equivalent illumination (e.g., 4000/300=13.33). When light distributing engines 4 of the present invention are deployed in every 24" tile, each tile would require only 1.48 embedded engines. Practically speaking, this means embedding 2 engines in some tiles, and a single engine in others. The same performance equivalency is possible with 2 engines in every tile, each engine powered to emit 222 lumens.

FIGS. 3A-8 immediately below provide more schematic descriptions of the general ways in which the basic light emitting, power conducting, power controlling and power sensing elements are embedded and integrated within ceiling (or wall) tile 6 of the present invention. More detailed illustrations follow further below as in FIGS. 9-58.

Figure 3A:
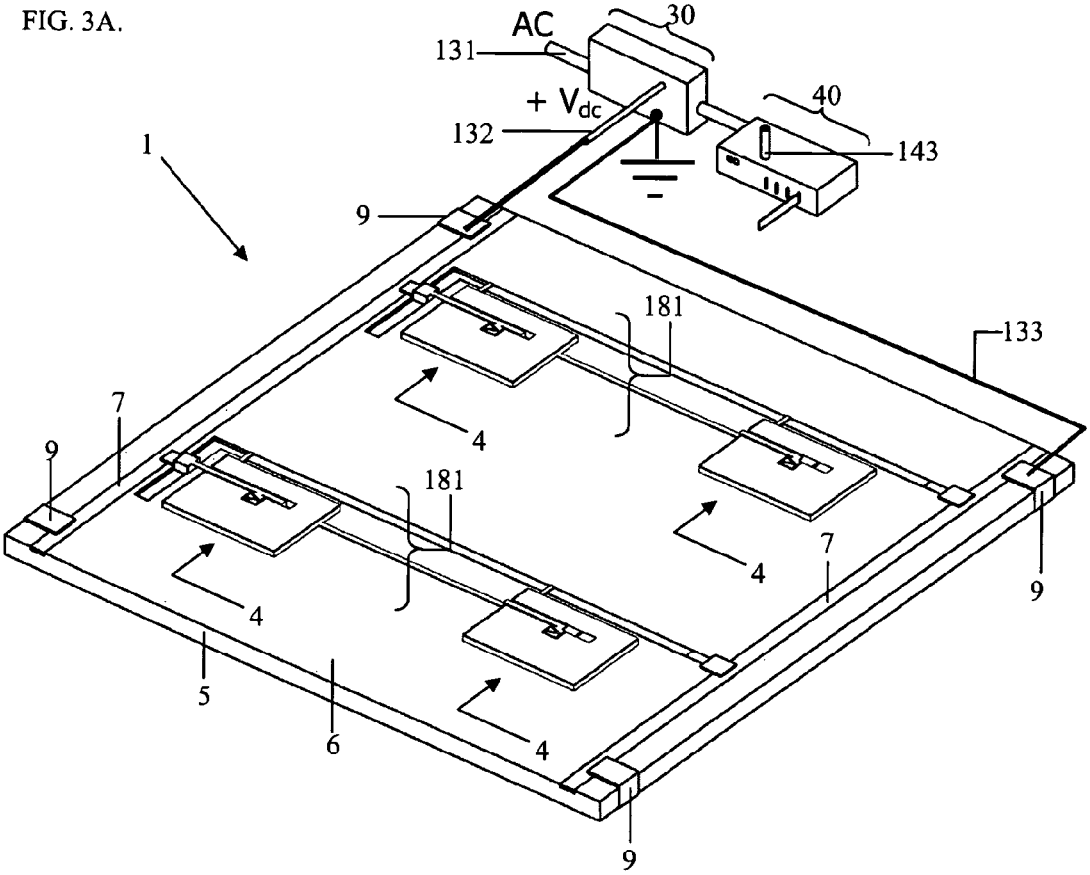
FIG. 3A is a perspective view of a single tile embodiment of the present tile illumination system invention as viewed from the utility (or plenum) space above (or behind the equivalently tiled wall surface).

FIG. 3A is a simple perspective view of a single tile embodiment of optical system 1 as viewed from the utility (or plenum) space above (or behind the equivalently tiled wall surface), corresponding to the perspective view given previously in FIG. 1D as viewed from the floor area to be illuminated below. This system is powered by low voltage DC power source 30 and controlled by signals provided by master controller 40 (whether by RF antenna 143, an IR transmitter, or a digital signal imposed on DC voltage source 132.

Figure 3B:
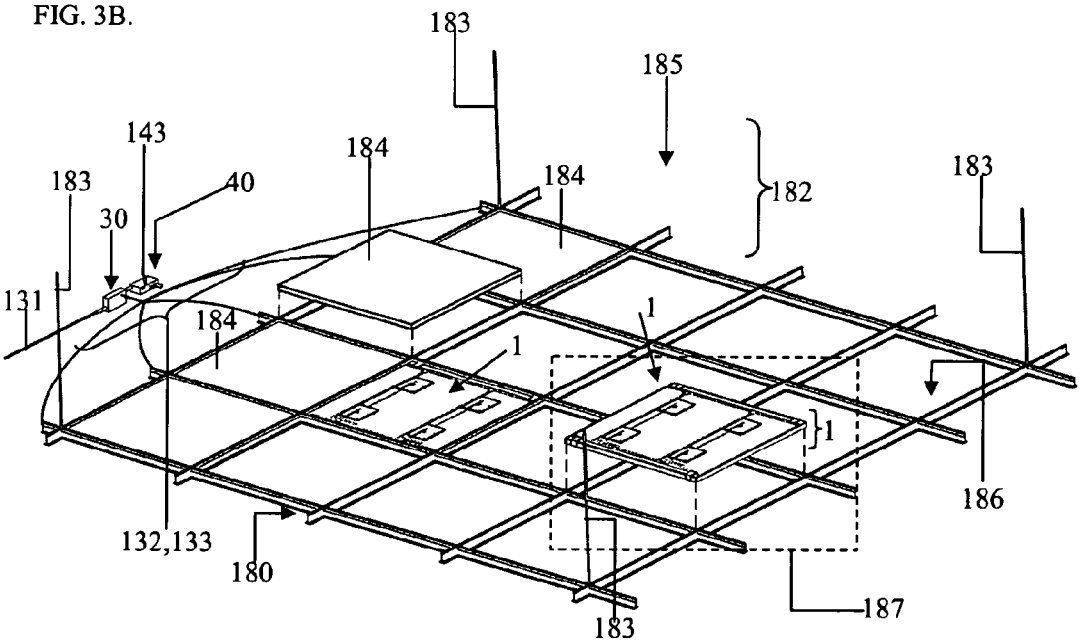
FIG. 3B is a perspective view of a 4×4 multi-tile embodiment of the tile illumination system of FIG. 3A, providing an example of suitable means for suspending and electrically powering a multi-tile illumination system.

FIG. 3B is a perspective view of a 4×4 multi-tile embodiment of optical system 1, providing an example of suitable means for suspending (e.g., suspension system 180 and mechanical hangers 183) and electrically powering (e.g., by means of supply 30) a multi-tile system 185, any tile within which having the capacity for a plurality of embedded light distributing engines 4 per tile (e.g., four as in the present example), similar to the illustration introduced in FIG. 1D. In this example, both conventional plain tiles 184 and embedded tile illuminating system 1 of the present invention are deployed in a single system 185. Electrical power from DC voltage source 30 is routed to the suspension system 180 via voltage and ground wires 132 and 133 in a manner developed in more detail below, wherein the suspending members themselves serve as the DC voltage delivery (and ground path access) system required for each tile 6 in the group of tiles involved, via connectors 9 (as in FIGS. 3E-3H below).

In general, voltage and ground wires such as elements 132 and 133 are insulated wires or cables with ability to transfer power from the external supply 30 to a tile illumination system 1 or a group of tile illumination system's 1.

Figure 3C:
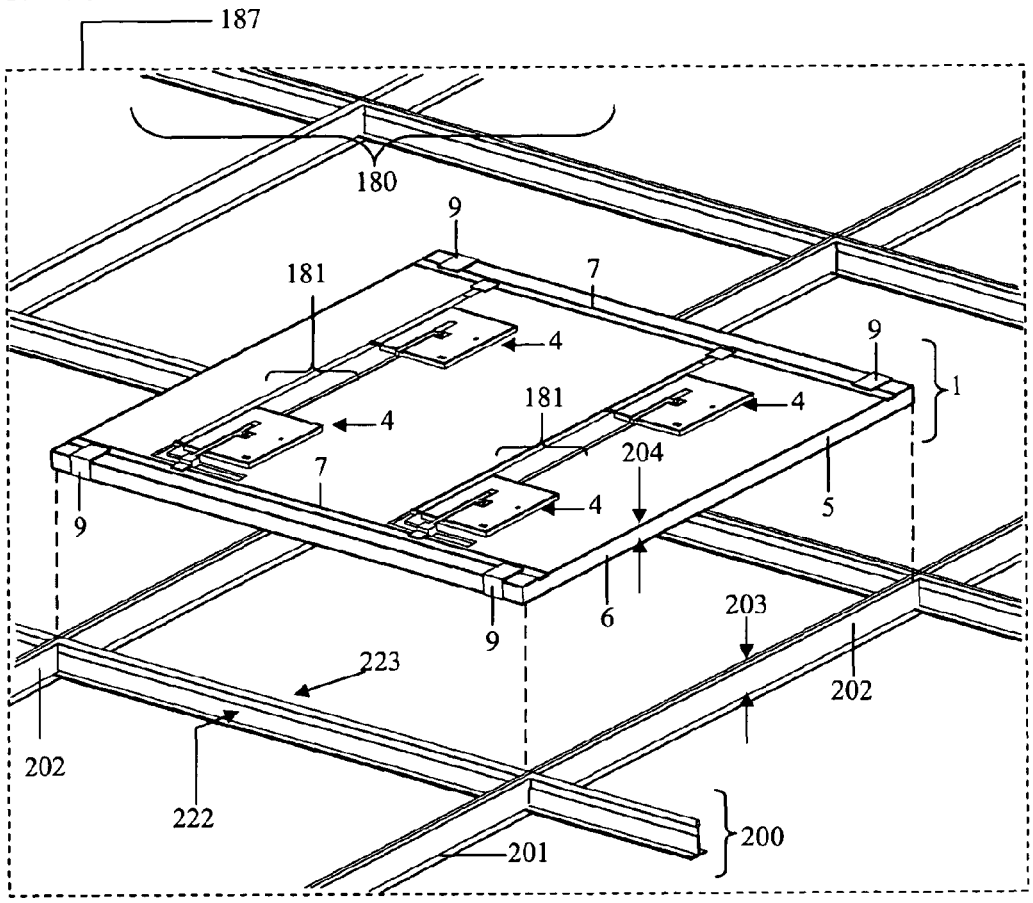
FIG. 3C is a magnified perspective view of a dotted region shown in FIG. 3B.

FIG. 3C is a magnified perspective view of dotted region 187 as shown in FIG. 3B making it easier to see the general relationships existing between the system's integrated electrical power transfer elements (7, 9 and 181) that are embedded into the body 5 of tile 6 at time of manufacture, and the embedding, in this case, of the four light distributing engines shown. These integrated electrical power delivery elements (7, 9 and 181) may be also referred to as on-tile power transfer elements, embedded wiring elements, wiring elements, signal transmission elements, electrical circuit element.

The arrangements shown are illustrative of many similar arrangements possible for the same purposes, as will be illustrated in greater detail below.

Embedded wiring (or power transfer) elements 181 shown in both FIGS. 3A-3C provide electrical interconnection between the embedded light distributing engines 4 underneath and the embedded DC voltage buss conductors 7, with equivalency to embedded wiring element 11 as shown previously in FIGS. 1A-1C. In some configurations, the embedded wiring (wires, cables, or circuits) 181, also convey control-voltages as instructed by the system's master controller 40. The embedded elements 181 as illustrated in FIG. 3A interconnect the four light-distributing engines 4 with DC supply voltage ($V_{dc}$) 132 and the external system ground supply buss 133 via embedded electrical connectors 9. More detailed illustrations are given further below.

Electrical connectors 9 as shown generally in FIGS. 1A and 1B, are one form of the tile's access to electrical power. Electrical connecting elements 9 such as these may be either passive as shown for example in FIGS. 3D-3I, or may be have a more complex electronic function, as is described for example in FIG. 3J.

External supply of DC electrical power 30, as shown in both FIGS. 3A and 3B, is arranged to convert standard high voltage alternating current (AC) input 131 to one or more low voltage direct current outputs 132. The DC supply voltage may be pre-regulated within external supply 30, may be regulated by a locally embedded circuit within the body 5 of each tile 6, or may be regulated within local circuitry within each light distributing engine 4. DC voltage outputs 132 may be hard-wired with traditional cabling to power conductors 7 on each system 1, or as is illustrated in FIG. 3C, applied only to tile elements on the periphery of a suspended ceiling system (as along parallel electrically-conducting suspension elements in a system 180 of such elements), or conveyed tile-to-tile in a grid-like delivery array, in either case without need of the bulky cables and harnesses of cables used in traditional ceiling systems. As shown in FIGS. 1A-1C electrical power is provided through elements 7 and 181 to embedded electronic circuit 15 that provides the necessary voltage and current adjustments for each miniature light distributing engine 4 or group of engines 4 involved. The embedded electronic circuit 15 is distributed on a tile-by-tile basis, and either contained in a single remote location within the body 5 of every tile 6, as an integral part of one or more of the embedded light distributing engines 4, or both.

In some areas of buildings (especially areas that are cramped or oddly-shaped), it will be more convenient to run AC power close to the installation area, and terminate the AC in an electrical box containing an AC-to-low-voltage-DC converter, as symbolized in FIGS. 3A-3B. Tile illumination systems 1 containing embedded light distributing engines 4 can be installed as needed, and low voltage wire cables can be routed to and connected directly to the appropriate light distributing engines. Each cable can power one or more than one light distributing engine 4. These short-run connections also avoid use of the bulky cables and harnesses of cables used in traditional ceiling systems.

The principles of master power control (e.g., master controller 40 in FIGS. 3A-3B) applicable to providing the power switching controls necessary for each tile system 1 in the array of tile illumination systems 1 in accordance with the present invention were set forth by the schematic circuit of FIG. 1C above. FIGS. 3A and 3B represent the same relationships in perspective view. Shown as separate entities, master controller 40 and power supply 30 may in fact be combined as a single unit (and are illustrated side-by-side to convey this integration). Functionally, power supply 30 provides a pre-regulated source of DC voltage and current adequate to drive all light distributing engines 4 in the ceiling (or wall) system to maximum light output. Digital instruction sets broadcast by master controller 40, either through hard wires, or wirelessly, enable local power control elements 15 to meter out the appropriate voltage (and current) to each light-distributing engine (and fractional part of each light distributing engine) they are interconnected with.

Alternatively, the low voltage DC power may be supplied by a source completely independent of the master controller, and signals coming from the master controller can be capacitively coupled to the DC power distribution system. In yet another embodiment, the master controller signals can be applied to the AC power system and bridged across from the AC system to the DC system near the point where the conversion from AC to DC power is made. Such approaches allow the master controller to be placed substantially anywhere along the power train within the structure containing the lighting system.

In a complete lighting system the master controller generally acts as a central communications node. The master controller can receive inputs and commands from its own front panel, from computer-based applications either directly connected to the controller or connected to the controller through a network, from individual light emitting engines (and sensors), or from remote controls dispersed throughout the building containing the lighting system. The most common farm of remote control appears to the user to be a conventional "light switch." The master controlled receives input from the "switch," processes the information, and sends an encoded command to the appropriate light-distributing engine.

In FIGS. 3A and 3B the master controller 40 is shown as being above the ceiling grid to make more clear its relationship with the other components shown. It should be noted that different communication protocols could be introduced within the AC and DC systems, so that a protocol translator might be needed at the bridge point between the AC and DC systems. It is also possible that the same protocol could be used in both AC and DC environments.

Information encoded by master controller 40 includes, for example, the number of lumens to be emitted by each light emitting engine unit and, the emitted color. Master controller 40 then broadcasts these electrical power control instructions through a direct physical connection to the power supply grid or by wireless means and thus to the individual power control elements 15. Each control element determines if the received instructions are meant for that particular control element, and sends the appropriate voltage and current to the appropriate light distributing engines 4 and their internal light emitters.

In addition to the particular example of the system of FIGS. 3A-3C, the master control signals from master controller 40 may also be physically connected using hard wire cables to one or more units of ceiling tile optical system 1 through a bridging version of connector elements 9, such as those described further below in FIGS. 3D and 3I. From such mechanical connector embodiments, the control signals may be passed directly across system traces in element 181 to embedded circuit 15, and then in that manner from tile-to-tile.

Alternatively, connector 9 might include an active, translator circuit that transcodes and/or repackages the instructions as necessary before they are sent across element 181. This might be the case if the communication protocol used by the master controller differed from the protocol used across the ceiling panel grid. Such electronically agile connector elements would be able to sense radio frequencies (RF) transmitted by means of antennae element 143 on master controller 40, or be able to sense visible or infrared light transmitted by optical element 146. In this case (because of the mix of wireless and wired signal transport) it is more likely that some form of transcoding and/or repackaging of signals will be implemented. Generally however, it would be preferred in order to reduce system complexity that the embedded circuit 15 could directly decode and execute the signals and commands sent by the master controller. Master controller 40 may also receive (and process) data streams broadcast or directly communicated by the building's own intelligently automated facilities control system. Such data would routinely contain higher-level power management and after-hours control strategies. Among its many possible capabilities, master controller 40 may be programmed to retain operating statistics and a usage history for each individual tile-based illumination system 1 that may be used to implement and refine its own internal lighting control strategies. The master controller may also record additional statistics from sensors, both those embedded in the ceiling and from other locations around the building, said sensors collecting data such as light levels, light colors, motion, power consumption, etc.

The examples of FIGS. 3B-3C illustrate perspective views of a standard type of ceiling tile suspension system prevalent world wide in both industrial and residential building use, each shown from within the ceiling's so-called utility (or plenum) space 182. Pre-formed tiles 6 used in accordance with the present invention are made to conform to commercial building system standards for suspended ceiling tiles' which rely on T-bar based metal suspension frameworks with lattice openings typically 24"×24", 24"×44", 20"×60", 600 mm×600 mm and 600 mm×1200 mm as a few common examples worldwide. Some representative manufacturers include Armstrong, Bailey Metal Products, Ltd., and USG.

FIG. 3B shows a representative 4×4 portion of an illustrative T-bar type suspension lattice 180. This illustration is meant to be representative of all existing prior art systems of this type, with the exception being its adaptation for use with ceiling illumination systems 1 of the present invention. The suspended ceiling support system 185 includes suspension lattice 180 a foot or two below the building's structural ceiling, and vertical suspension members 184 supporting the suspended lattice 180 from the structural ceiling. Wall anchors, not shown in this illustration, typically provide additional mechanical stability for suspension lattice 180. Square openings 186 in suspension lattice 180 may have any length and width dimension made to match the dimensions of ceiling tile 6, but in this case the openings are scaled for example as 24"×24", which is a particularly common commercial arrangement. Individual single light distributing engine examples of ceiling tile illumination systems 1 may be distributed one per available opening in this illustration, or in any fraction of available openings. Illumination from each system 1 is directed downwards towards the floor beneath, and provides particularly uniform coverage. Two installed units 1 are shown for example in FIG. 3B, one being in the process of its installation, with dotted lines indicating its insertion path.

FIG. 3C provides a magnified view of illustrative suspension lattice 180 of FIG. 3B showing one ceiling tile illumination system unit as it's being installed within a corresponding unit cell of suspension lattice 180. In this example, ceiling illumination system 1 represent but one form of system 1 in accordance with the present invention, inserted into suspension lattice 180 from above, light emitting aperture side facing the floor beneath. Other examples will be given in progressively more detail, below.

FIG. 3C shows a finer level of detail than FIG. 3B, but hides internal view of its embedded light-distributing engine 4. The T-bar structure of classical suspension lattice 180 is evident.

The detail of FIG. 3C also shows constituent T-bars 200 of suspension lattice 180 in greater detail. Conventional commercially available T-bars are configured illustratively as T-bar 200 and provide a physical shelf, lip or face 201 in support of ceiling tile edges, with T-bar side members 202 being longer in length 203 than thickness 204 of ceiling tile 6. In this example, additional electrically conductive elements are assumed that reach each embedded electrical connector 9 on the opposing edges of tile 6 in system 1. This means of DC voltage delivery is described in greater detail by means of FIGS. 3E-3G.

FIGS. 3D to 3J illustrate schematically a few of the preferable ways in which physical connectors may be embodied to convey electrical power and electrical power control instructions to each and between tile illumination systems 1 in the suspension system lattice. The resulting electrical connectivity grid-work establishes a substantially embedded circuit layer that constitutes formation of a distributed electronic communications network of all constituent ceiling tile illumination systems 1. The illustrations in FIGS. 3D to 3J are meant to emphasize the primary interconnectivity means, and are not intended as completely designed physical connectors. More detailed examples are provided further below, as in FIGS. 68-71.

Providing power to and logical control of discrete electronic elements in a 2D-array of discrete electronic elements, whether by means of passive or active addressing, is well established in the field of microelectronics (e.g., LCD display screen). In large-scale array applications such as applies to the present invention, a wider range of acceptable addressing options is available. In general, it is efficient to make use of the planar nature of the ceiling tile surface as a substrate or base as a carrier of thin form electrical interconnection circuitry, even modifying the surfaces of the T-bar suspension members themselves used to support them for this same purpose. Yet, practice of the present invention is not limited to integrated means of electrical interconnection. Practice may also include the direct point-to-point wiring between external power source and every light-distributing engine 4 (or every group of light-distributing engines on a tile) in the planar system of light distributing engines 4. Point-to-point wiring from power source to lamp is the most common means of power delivery in existing overhead ceiling light systems.

Figure 3D:
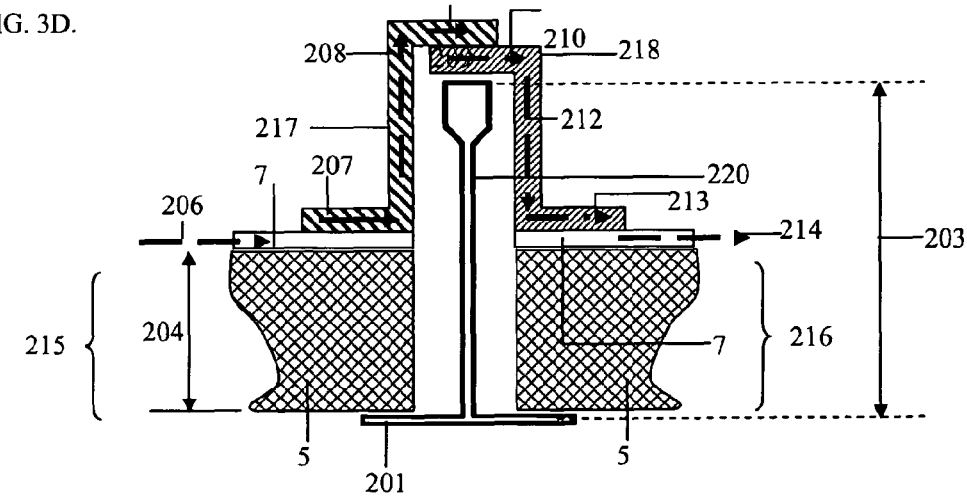
FIG. 3D shows a cross-sectional side view of one possible T-bar type support member for tile illuminating systems, and one possible generalized form of electrical power interconnection.

FIG. 3D shows a cross-sectional side view of one possible T-bar type support member 210 and one possible generalized form of electrical power interconnection made between two adjacent tile system units 215 and 216 by means of bridging electrical connectors 217 and 218. In this example, the bridging connectors are attached to each other during installation to provide a solid connecting bridge between adjacent units of the present invention, either for electrical power, between on-tile buss power conductors 7 embedded within adjacent tiles as illustrated, and/or between embedded wiring elements 181 for on-tile power transfer and the digitally encoded power control signals that are originally broadcast separately by master controller 40, as was allowed in FIGS. 1C, 3A, 3B and 3D. T-bar support member 220 has one of many typical commercially manufactured cross-sections, whose runner height 203 is typically 1.5," which exceeds height 204 of normally 0.75" thick ceiling tile 6. Connectors 217 and 218 provide a physical bridge over the tallest point of T-bar type support member 220. The arrows 206-214 indicate the electrical transmission path, whether for electrical power continuity, tile-to-tile as between buss bars 7, for a multiplicity of circuit paths needed to pass the digitally encoded control signals from the embedded wiring element 181 on one tile to the corresponding embedded wiring element 181 on another, or for both. Alternatively to going over the T-bar, these connectors could connect through slots in the T-bar. The T-bar face support, 201 in both FIGS. 3C and 3D is usually between 9/16" and 15/16" wide, depending on the product.

Figure 3E:
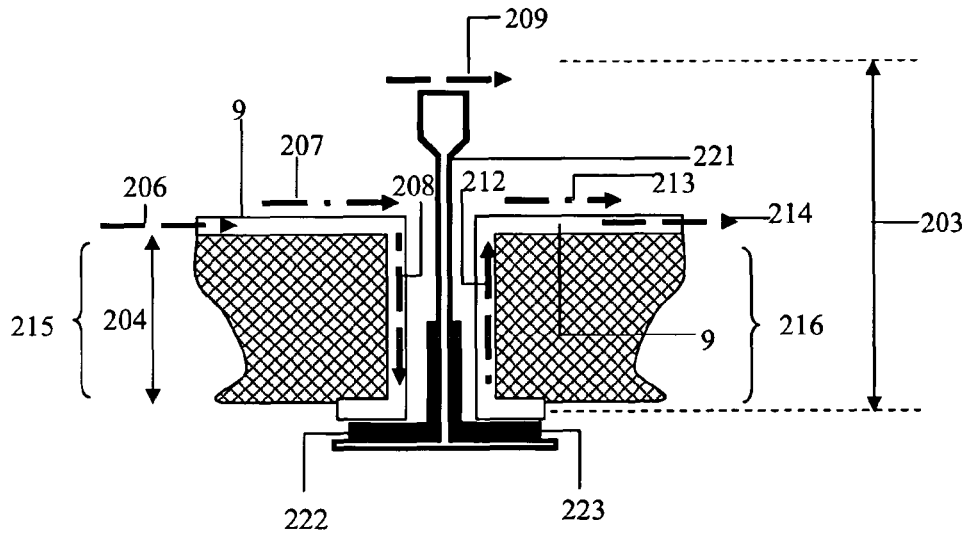
FIG. 3E shows a cross-sectional side view of another possible T-bar type support member, similar in most ways to that shown in FIG. 3D, but modified so as to be made at least partially, electrically conductive.

FIG. 3E shows a cross-sectional side view of another possible T-bar type support member 221, similar in most ways to that shown in FIG. 3D, but modified so as to be made at least partially, electrically conductive. In this variation on the present invention, electrical power is drawn through each ceiling tile illumination system 1 by the tile system's purposeful electrical contact (e.g., connector 9) with an electrically modified T-bar type suspension means 221 connecting the tile (or panel) to its neighbor and the ultimate connection with an electrical common or ground. Additional means may be provided to assure reliable electrical contact is maintained between 9 and 222 (and 223). Mechanical fastening means including the use of locking tabs, screws, or conductive epoxy may be applied.

In one illustrative form, a conductive power connector 9 in electrical-contact with power buss 7 (shown previously in FIGS. 1A, 1B, 3A and 3C for on-tile power transfer) wraps about the edge of ceiling tile 6 (as shown in FIGS. 1A and 1B) so that a part of it makes physical (and electrical) contact with a correspondingly conductive regions 222 and 223 of T-bar support 221, 222 and 223 being in electrical contact with each other through the T-bar. In doing so, electrical continuity is arranged from the left hand tile to the right hand tile shown in FIG. 3E.

Accordingly, the electrical transmission path 206-214 is just as represented in FIG. 3D, but instead of bridging over the top from one tile to its neighbor (as with T-bar element 220 in FIG. 3D), the electrical transmission in this case tunnels across the underside of modified T-bar element 221. In another version similar to the tile wrap around connector 9 and T-bar's flat connectors 222-223, the tile could have a male plug (in electrical contact with buss 7) and the T-bar a female socket, again with the two opposing T-Bar connectors (sockets) being in electrical contact which each other through the T-Bar. In both cases the electrical transmission, as before, may be a flow of low voltage DC power, a flow of high frequency digital signaling, or both.

Figure 3F:
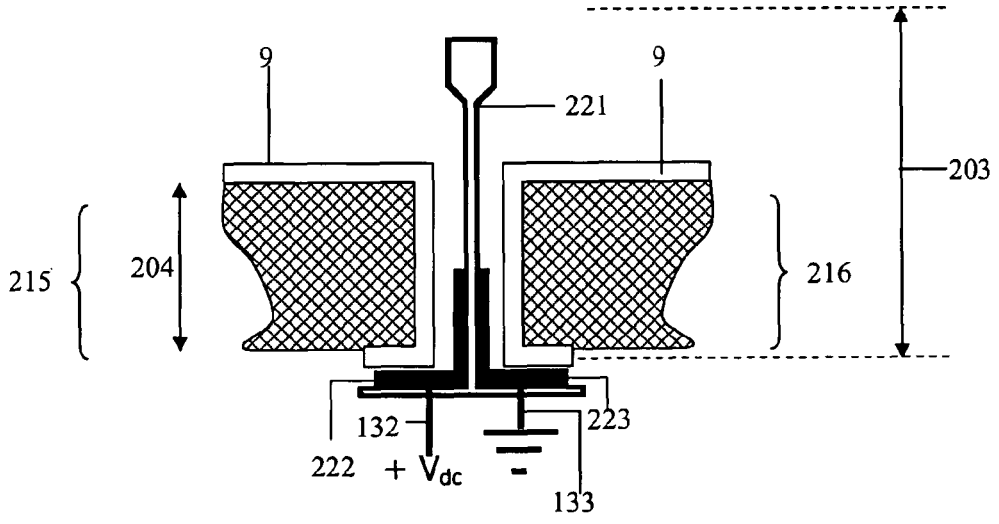
FIG. 3F shows a simple variation on the T-bar support member of FIG. 3E, wherein the two conductive sides of a T-bar element are electrically isolated from each other, with one connected to $V_{dc}$ output line and the other connected to system ground.

FIG. 3F shows a simple variation on FIG. 3E, wherein the two conductive sides (222 and 223) of T-bar element 221 are electrically isolated from each other, with one connected to $V_{dc}$ output line 132 from DC voltage supply 30 and the other connected to system ground line 133 (as in FIG. 3A).

Figure 3G:
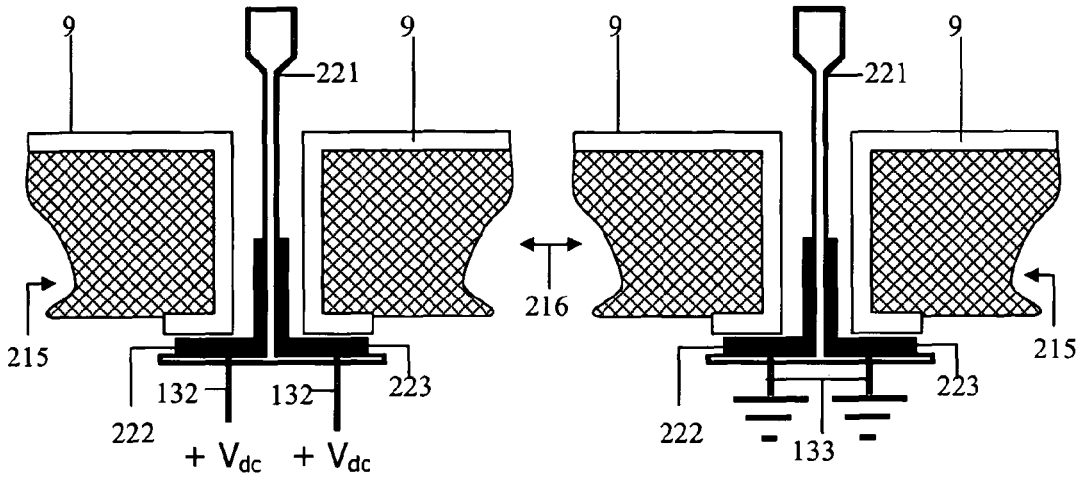
FIG. 3G is a schematic representation an alternative embodiment to the T-bar suspending means shown in FIG. 3F.

FIG. 3G is a schematic representation of an alternative embodiment to that shown in FIG. 3F, in this case with every other parallel T-bar element 221 in suspension system 180 of parallel T-bar elements 221 having both its internal conductors 222 and 223 connected to $+V_{dc}$, and every neighboring parallel T-bar element 221 having both its internal conductors 222 and 223 connected to ground. In this example, every other tile system 215 and 216 must be reversed in their polarity needs.

The L-shaped form of conductors 222 and 223 in FIGS. 3E-3G are only intended as conceptual examples.

Figure 3H:
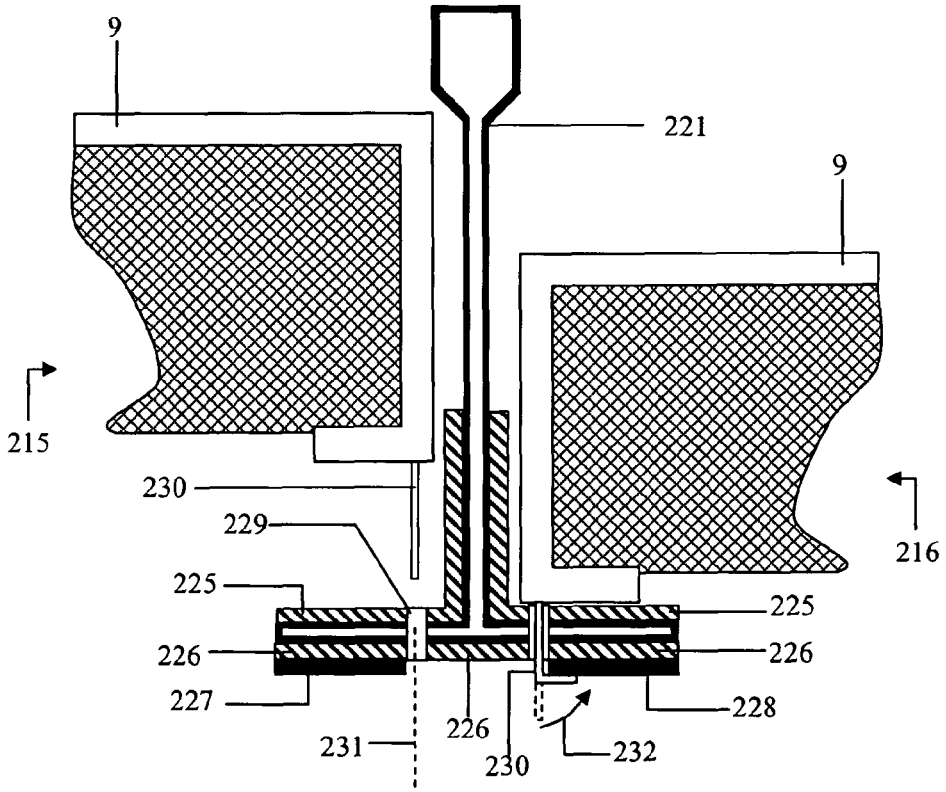
FIG. 3H is a cross-sectional view of the T-bar element FIGS. 3E-3G providing a more secured interconnection means to the embedded connectors 9 of two adjacent tile illumination systems of the present invention.

FIG. 3H is a cross-sectional view of T-bar element 221 of FIGS. 3E-3G providing an example of a more secured interconnection means to the embedded connectors 9 of two adjacent tile illumination systems 215 and 216 of the present invention. In this example, which is illustrated in more detail further below, the cross-hatched layers 225 and 226 designate an electrically insulating coating applied to T-bar 221, coatings which may be an insulating paint (e.g., an acrylic spray paint such as Krylon™), an adhesively-applied plastic film (e.g., Kapton or Mylar or polyester), or a surface coating covering the entire outer surface of T-bar member 221, as a few examples. Conductive strips 227 and 228 are parallel to each other, electrically isolated from each other and applied, in this example, to the continuous insulating layer 226. Slots (one on each side of the T-bar's vertical member) 229 are cut, stamped or punched completely through the T-bar material 221 so as to permit mechanical passage for conducting tab 230. Conducting tab 230 is a physical extension of connector 9 that inserts into slots 229 in T-bar 221 along guideline 231, and in this example is then folded over in an arc 232 that assures a tight fit and good electrical contact with bottom conductors 227 and 228. The dimensions and shape of both the slot 229 and the tab 230 may be adjusted so that as the tab 230 is pulled through slot 229, a tighter (e.g., interference) fit is effectuated as well.

The length of this suspension system support member runs from wall to wall, either as a continuous T-bar member, or as a sequential line of mechanically spliced section. In either case, the electrical conductors 222 and 223 are arranged to be electrically continuous as well. Just a portion of the suspension system's support-members running lengths 200 are illustrated in FIG. 3C. High conductivity (low resistance) via plugs symbolized as 224 may be added in situations requiring them to reduce signal (or power) loss due to $I^2R$ dissipation.

The idea of modifying some aspects of a tile suspension system grid as a means of simplifying access to AC voltage has appeared in various prior art descriptions now public domain. No commercial ceiling tile suspension products are known that provide or have provided any means of convenient electrical access or purposeful electrical continuity.

Tile (or panel) systems 1 of the present invention preferably use low voltage DC to power and control their embedded light distributing engines 4. For this reason, the simple conductive modification illustrated in FIGS. 3F-3H are likely to provide a satisfactory and producible solution. No external wires or cables are necessary. Electrical contact between ceiling tile connectors 9 and the corresponding conductive surfaces on the T-bars to which they are in contact is likely to be sufficient. If necessary to solidify electrical conductivity between elements 9 and elements 222 and 223, snap-in features, mechanical tabs, or conductive adhesive may be added.

Tile suspension systems according to the present invention supply alternating parallel lines of positive DC voltage and ground through one continuous T-bar type element or through lines of segmented T-bar type elements, reaching from one wall surface to the opposing wall surface. Structural cross-pieces are cut into these electrical conductive channels without interference, completing the traditional grid-like suspension system structure, and solidifying their strength. Further details will be provided below.

Figure 3I:
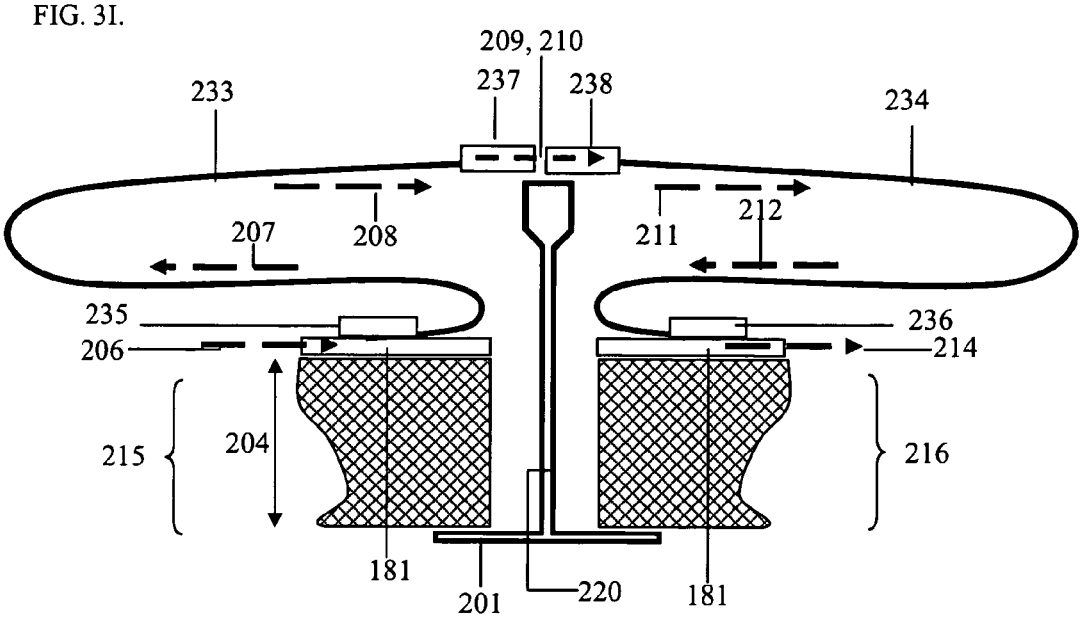
FIG. 3I shows a cross-sectional side view of another simple T-bar type electrical interconnection means between adjacent tile illumination systems.

FIG. 3I shows a cross-sectional side view of another simple electrical interconnection means between adjacent tile illumination systems 1: jumper cable assembly pairs 233/234. In this straightforward approach, electrical power transfer and signal transmission elements (such as 7 and 181) would be made to terminate with electrical attached cable elements 233 and 234. Cable elements 233 and 234 can be wire, flexible printed circuits, flat ribbon cable or flat flex jumpers. There are many popular manufacturers (e.g., Flexible Circuit Technologies, Tyco Electronics Amp, Molex/Waldom Electronics Corp., JST, 3M, Oki Electrical Cable Co. Inc., and Calmont Wire and Cable, Inc. to provide just a few examples). Cable element attachment to tile system 1 elements 7 or 181 may be either permanent (as in soldered) or removable (as in block connectors 235 and 236). Regardless, the cable element's external connectors 237 and 238 are matched appropriately as male and female counterparts.

The interconnection means illustrated in FIG. 3I suggests a logical sequence for tile system 1 installation. Tile system 1, in accordance with the present invention, is pre-manufactured with appropriate jumper cables 233 (and 234) each having necessary external connector means 237 (and 238). A first tile system 1 is inserted upwards from below into a conventional tile suspension system opening, and seated on T-bar surfaces 201 (see FIG. 3E for example) taking care to be sure that all jumper cables 233 and 234 flop over into the neighboring unoccupied suspension system opening. Corresponding jumpers 233 (and 234) and their associated connector means 237 (and 238) on a second neighboring tile system 1 to be installed are attached to those on the previously installed tile system 1. This second tile system 1 is then inserted upwards into its adjacent opening in the same manner, taking care as before to assure that all its unattached jumper cables 233 (and 234) also flop over into its unoccupied neighbor opening. This process flow is repeated until all tile openings are filled.

This interconnection approach is managed easily by a single (tile) installer, as the cable from one tile hangs down and through suspension lattice 180 so that it may be easily attached to a neighboring tile in this manner before it is installed in a neighboring lattice opening.

For ceiling system openings in the suspension system designated for plain tiles (i.e., those without embedded light distributing engines 4), those plain tiles according to the present invention can still be embedded with at least two power conductors 7, and at least one circuit or power transfer element 181. These elements embedded in otherwise plain tile serve as electrical bypass elements that maintain low loss electrical connectivity from tile to tile. Alternatively, extension cables compatible with the method of FIG. 3I could be provided.

Figure 3J:
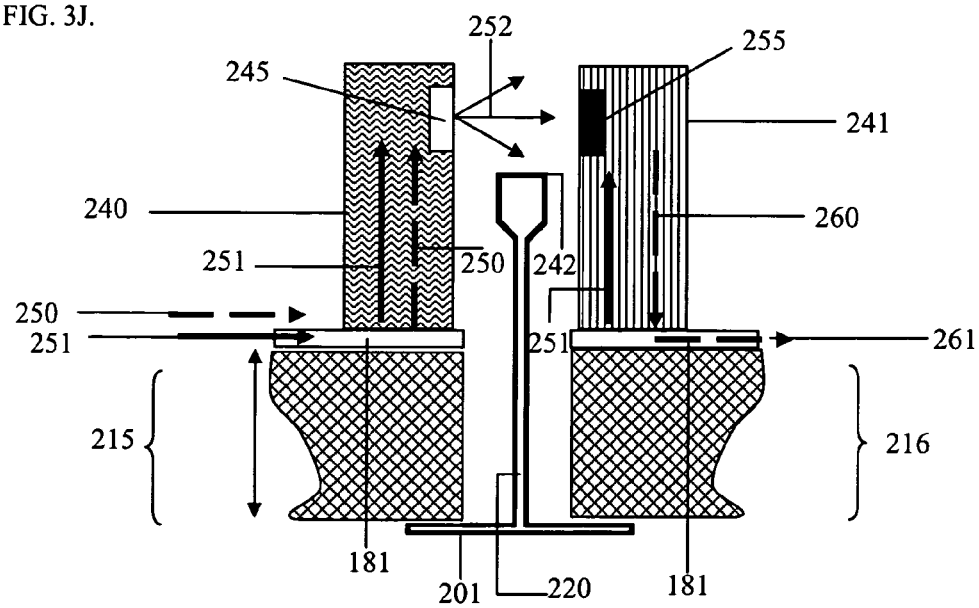
FIG. 3J shows yet a means of T-bar type electronic tile-to-tile electrical communication within the present invention that offers a wireless form of inter-tile interconnectivity suited to the digitally encoded power control signals used to adjust the power level of each light-emitting engine included.

FIG. 3J shows yet another means of electronic tile-to-tile electrical communication within the present invention that offers a wireless form of inter-tile interconnectivity suited to the digitally encoded power control signals used to adjust the power level of each light-emitting engine 4 that is included within ceiling illumination system 1.

In this interconnection embodiment of the present invention, an optical (infrared or visible light), radio frequency (RF) or micro-wave (μW) transceiver (transmitting) element 240 is mounted on embedded wiring (or power transfer) element 181 and located near one edge of each tile system 1 within ceiling system 185, in general proximity to a corresponding transceiver (receiving) element 241 mounted on an embedded wiring element 181 on the closest edge of an adjacent tile system 216. For the present example, the transceiver illustrated is assumed to be an optical frequency transceiver, either IR or visible, just for illustration purposes. Optical transmitter elements 240 and optical receiver elements 241 are constructed so that they are substantially on line of sight with each other, transmitter 240 broadcasting within the numerical aperture of receiver 241, both mounted high enough above the topmost portion 242 of the ceiling tile illumination system's T-bar suspending surface that the corresponding optical beams 252 are not blocked, shadowed or otherwise occluded by any mechanical parts, such as the bulk sidewalls of T-bar 220. Alternatively, if the T-bars have any regularly spaced holes or slots, the transmitter/receiver pair can be aligned to communicate with each other through said holes and slots, thus able to sit lower to the tile.

Each optical transmitter 240 includes one or more light-emitting device 245, preferably a low power visible or infrared light emitting diode (LED). In this case, every such optical transmitter 240 receives digitally encoded electrical signals (250, dotted) along with sufficient DC operating power, in one of the manners discussed above during the discussion of active elements 182. Digitally encoded electrical signal 250 represents the compete instruction set broadcast to all tiles (or groups of tiles) in system 185 by master controller 40. Digitally encoded electric signal 250 modulates LED 245 so that it emits a correspondingly encoded digital optical beam 252. A portion of digital optical beam 252 is then received within the entrance aperture of optical receiver 255, on adjacent tile system 216, optical receiver 255 being preferably a photodiode or an avalanche photodiode. Once received, digital optical signal beam 252 is electronically demodulated within electronic receiver component 241 as digital signals 260, which then flow through to electrical circuit element 181 on tile system 216 as digital signals 261. Any transcoding issues are handled in one of the same manners discussed above during the discussion of active elements 182. These digital signals 261 provide the necessary digital operating instructions for the light emitting engines 4 included within tile system 216. In this manner one tile system 215 is able to pass on a global instruction set from remotely located master controller 40 to a larger group of system wide tile illumination systems via 261, with each tile system such as 216 removing (or listening to) its own local instructions and then passing on (repeating) the remaining digital instruction set (or the complete instructions), respectively to neighboring tile systems. Such an optical connection system is applied easily to effect sequential interconnection along a continuous row or continuous column of adjacent tile systems contained in suspension lattice 180.

Figure 3K:
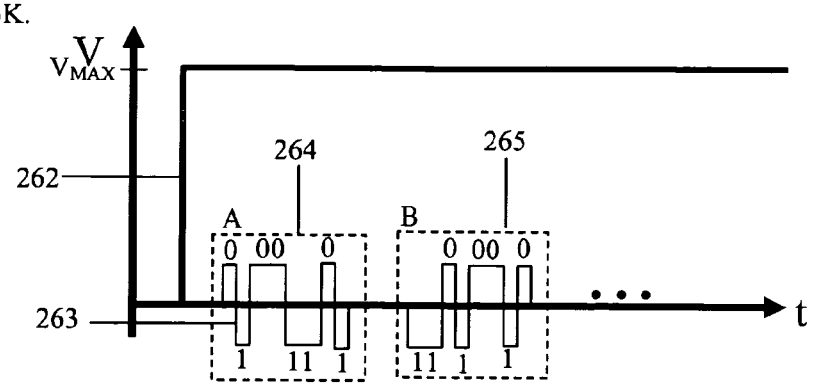
FIG. 3K is a schematic plot of both the dc voltage level applied to buss elements, along a symbolic representation of a high frequency digital voltage signal broadcast by a master system controller.

FIG. 3K is a schematic plot of both the dc voltage level 262 supplied by external power supply 30 to (and through) buss elements 7, along with one symbolic representation of the high frequency digital voltage signal 263 broadcast by master controller 40, each as a function of time. In this context, master controller 40 may be thought of as a radio transmitter. Every packet (A, 264 and B, 265) is encoded (1's and 0's) and has an address key in its header and every receiver reads and executes only the packets following its own address key (or keys). In this symbolic illustration, only 8 bits are drawn in each packet—a real world lower bound. This encoding approach supports much longer digital strings. The best mode packet length depends on the application involved including issues such as room size, tile size, number of light emitting engines (and sub-functions like color, number of dimming levels, number of independently controlled LEDs per light engine to mention a few). To implement such a process, only a general key need be burned into every local IC (within power control elements 15) and some "group keys" stored to local memory in the receiving IC regarding the pre-programmed set-up for the floor of the particular building. The "group keys" represent especially designated groups of light emitting engines 4 that are to be primarily operated in tandem.

A suspended ceiling spanning an area 40 feet by 40 feet would contain 400 2 foot by 2 foot tiles in a 20×20 array. If each tile contained two (2) light-distributing engines apiece (and lacking any set-up programming) a total of 800 sequential information packets could conceivably be broadcast sequentially. If each bit is, for example, 0.1 ms in length (as might be the case in a low performance system), and assuming, for example, 32 bits per packet and a 1 ms dead space between packets, each packet would occupy 3.2 ms. With 800 packets, and 800 dead spaces, the total transmission time to all light engines is 3.36 seconds. This corresponds to a digital frequency of 10,000 bits/sec, and an analog frequency response of 100,000 Hz.

Allowing 3 seconds to turn on the lights in a room, to effect a designating dimming, or activate a task light (or group of task lights) in a given work area, would probably be deemed too long in most office settings. However, once the system has been programmed after its installation and group addresses have been provided to most of the light emitting engines in the system (thereby greatly reducing the number of packets needed to address the entire space), activation and dimming times would be as fast (and usually faster) than the response provided by light control methods in current practice.

Of course, there are times when a more pleasing activation or dimming experience can be achieved by prolonging the effect through purposeful programming of sequential light emitting engine activation. Such effects are easily provided during the programming of the master controller. Such effects would enable precisely activated actions, which would seem to occur instantly, or when desirable, deliberately slowly. That is, a deliberate pre-programmed activation delay might be considered as being desirable, when it would enable the sequential firing of an array of light emitting engines 4 across a given portion of the ceiling system, as in a wash across a room (like a wave). Such an effect might also be attractive as flood lights (or spot lights) are activated down a long hallway.

Figure 3L:
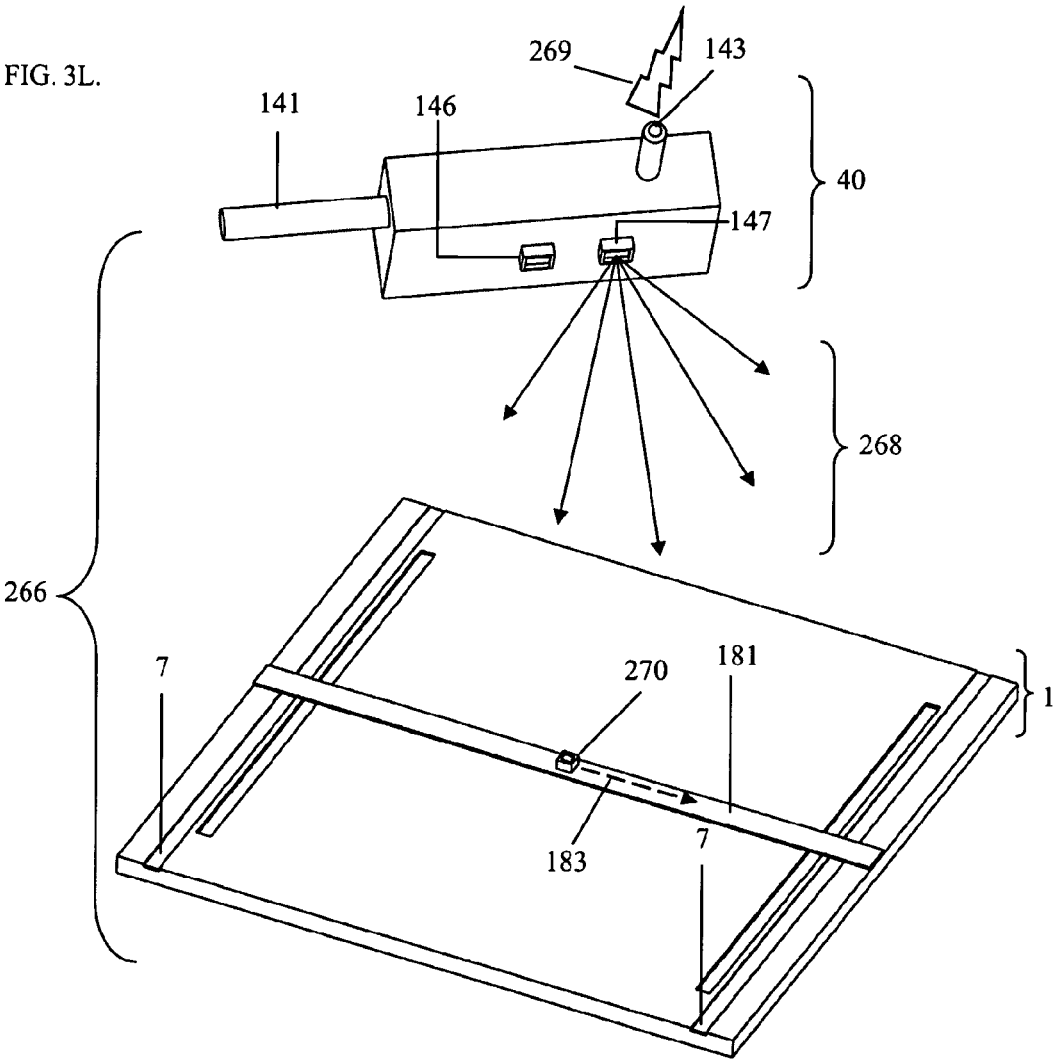
FIG. 3L is a perspective view showing schematic relationships between a master controller, the digital control signal radiation broadcast globally, and one global signal receiver attached to one ceiling tile illumination system that may be among a larger group of ceiling tile illumination systems 1.
Figure 3M:
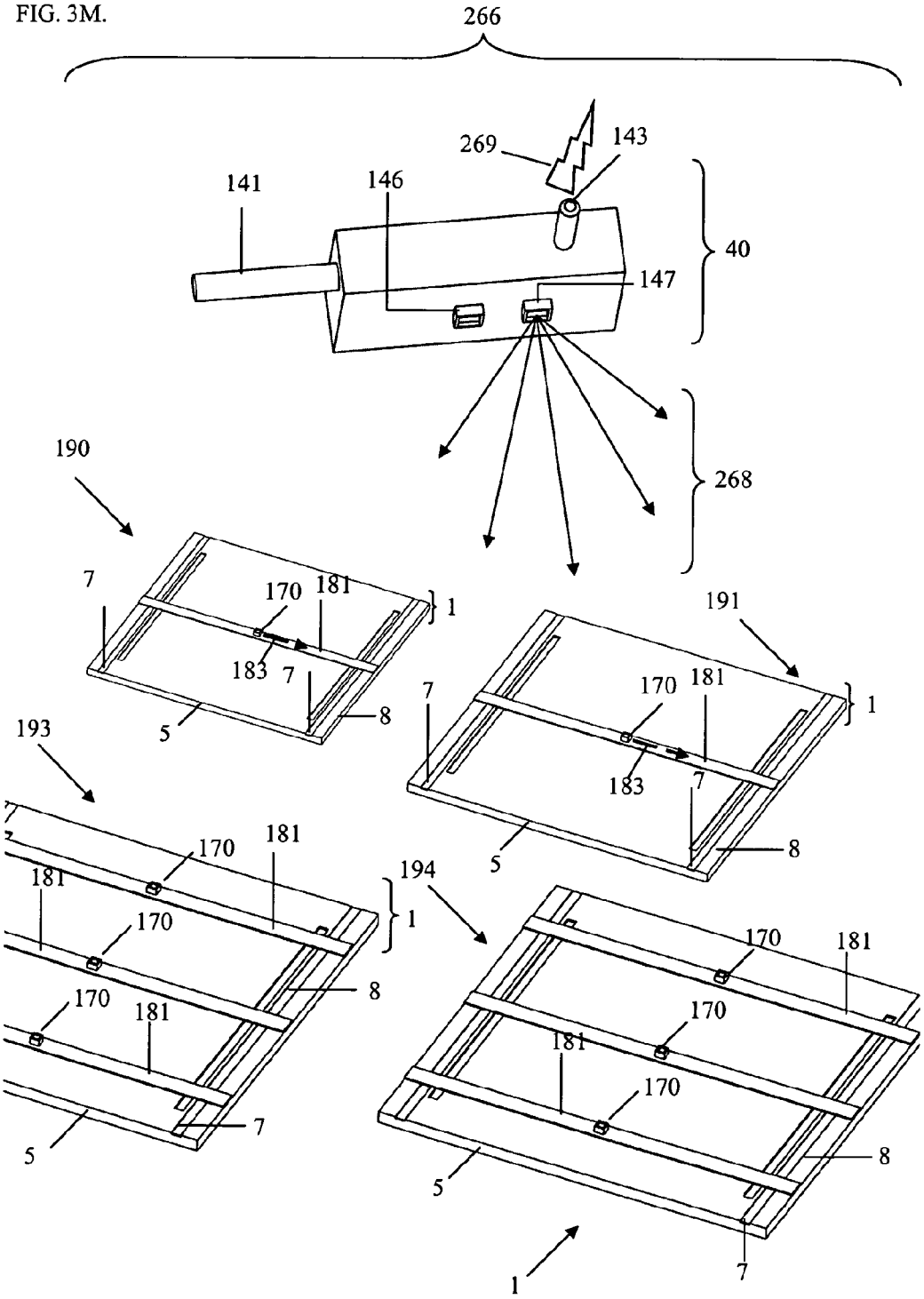
FIG. 3M is a perspective view showing schematic relationships between a master-controller and the backsides of a group of separate tile illumination systems 1 represented in this illustration by four arbitrarily different tile system configurations, each according to the present invention, each containing one or more light distributing engines, and one or more global signal receivers.

FIGS. 3L-M illustrate a globally wireless electrical interconnection communication system 266 including one (or more) ceiling tile illumination systems 1 (or groups of ceiling tile illumination systems 1) arranged in accordance with the present invention and orchestrated by master controller 40. A wireless communication system 266 may be preferable in commercial or industrial building situations where there are a large number of tile illumination systems 1 (or groups of tile illumination systems 1) included within ceiling suspension system 185, when there is a relatively deep, un-crowded open-air utility (or plenum) space, or both. For such circumstances each tile system 1 includes one or more sensors such as optical, radio frequency (RF) or microwave (μW) receivers 270 (e.g. SENSOR 1, FIG. 1C) connected to (or made a part of) power control element 15 (hidden) on embedded wiring element 181, whose purpose is to sense, collect and detect the globally transmitted digitally-encoded optical (RF or μW) signals broadcast by master controller 40. Master controller 40 either includes or incorporates one or more of the appropriate optical transmitters: 143 for radio frequency (RF) or microwave (μW) components and antennae, and 146-147 for IR or visible light. Optical transmitter 147 is illustrated as emitting visible light beam 268, and radio (or microwave) transmitter 143 is illustrated as emitting electromagnetic radiation 269. While several communication wavelengths could be included (and activated) simultaneously, lowest cost is associated with choice of only one communication means and wavelength. Whatever the choice of broadcast radiation, corresponding receivers (SENSOR 2) 270 are arranged on each tile system 1.

FIG. 3L is a perspective view showing schematic relationships between master controller 40, the digital control signal radiation (optical, 268; or rf, 269) broadcast globally, and one global signal receiver 270 attached to one ceiling tile illumination system 1 that may be among a larger group of ceiling tile illumination systems 1.

FIG. 3M is a perspective view showing schematic relationships between master-controller 40 of FIG. 3L and the backsides of a group of separate tile (or panel) illumination systems 1 represented in this illustration by four arbitrarily different illustrative tile system configurations 190, 191, 193 and 194, each according to the present invention, each containing within their tile body 5 one or more light distributing engines 4, and one or more global signal receivers 270. Tile illumination systems 190 and 191 compare with illustrations in FIGS. 1A and 3B-E. Tile illumination systems 193 and 194 compare with illustrations in FIGS. 1D, 2D-E and 3A.

In general, light distributing engines 4 (FIGS. 4A-4C) used within embodiments of the present invention consist of one or more light emitters 271 (preferably LED light emitters) having output aperture 272 combined with an efficient light distributing optic 273 designed to beam collective output illumination 2 from an output emitting aperture 278 made large enough in area (width 279 shown) to moderate the aperture's illuminance. Light distributing optic 273 comprises input aperture 274, output aperture 279, an arrangement of reflective (and refractive) means 275 collectively providing for efficient light transfer from input aperture 274 to engine output aperture 278 operating in a way that transforms input light 280 into a substantially uniform distribution of output light 103 composed of a multiplicity of uniformly distributed beams having angular extent 122 ($+/-\theta_1$ and $+/-\theta_2$) in the beam's two orthogonal meridians ($+/-\theta_1$ in the plane illustrated) and that guides transmitting light 285 to exit engine 4 in an intended output direction 111 (or 114), as described in FIGS. 1D-1F. Both light emitter 271 and associated light distributing optic 273 are also made thinly enough (at thickness T, 282) to fit substantially within a ceiling (or wall) tile's physical cross-section.

Figure 4A:
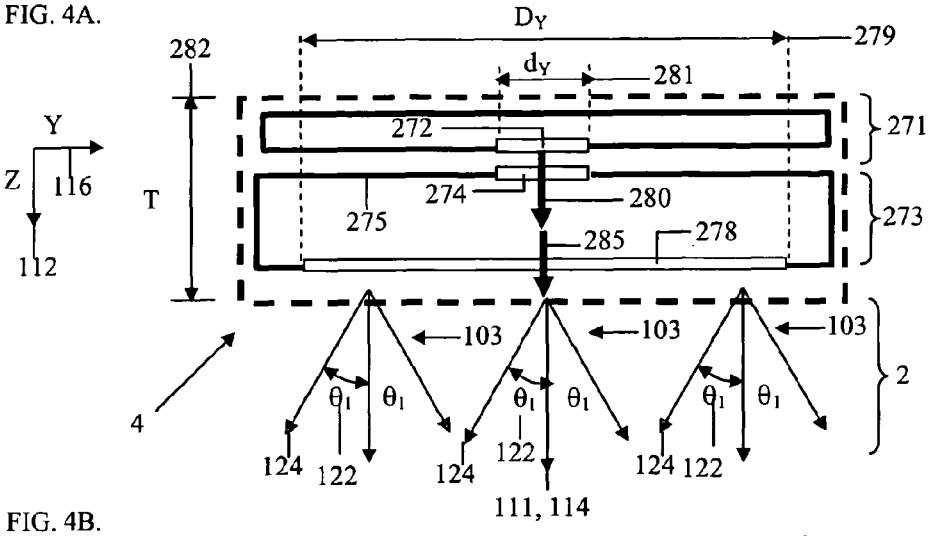
FIG. 4A is a side cross-section illustrating a vertically stacked form of light distributing engine 4 of a thickness that's embeddable within body of a ceiling tile or comparable building material.
Figure 4B:
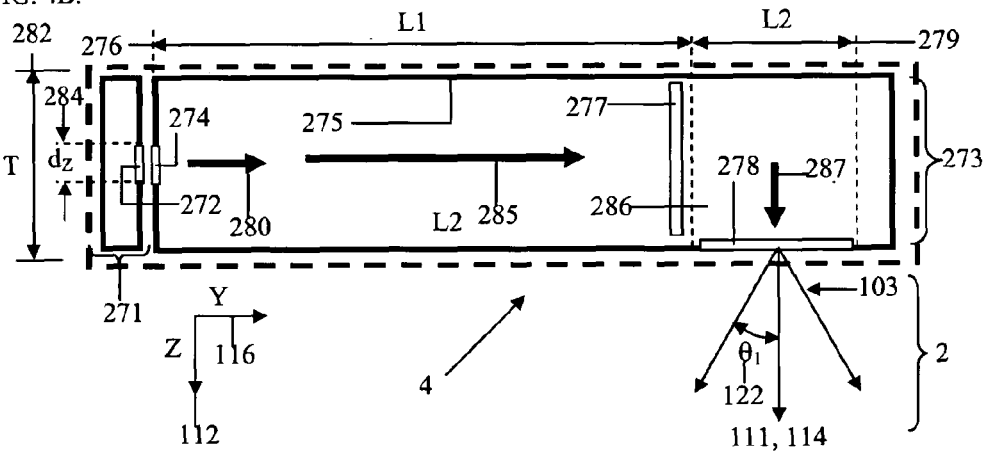
FIGS. 4B and 4C are side cross-sections illustrating two different horizontally stacked forms of light distributing engine embeddable in body of a ceiling tile or comparable building material, each being orthogonal variations on the vertically stacked form of FIG. 4A.
Figure 4C:
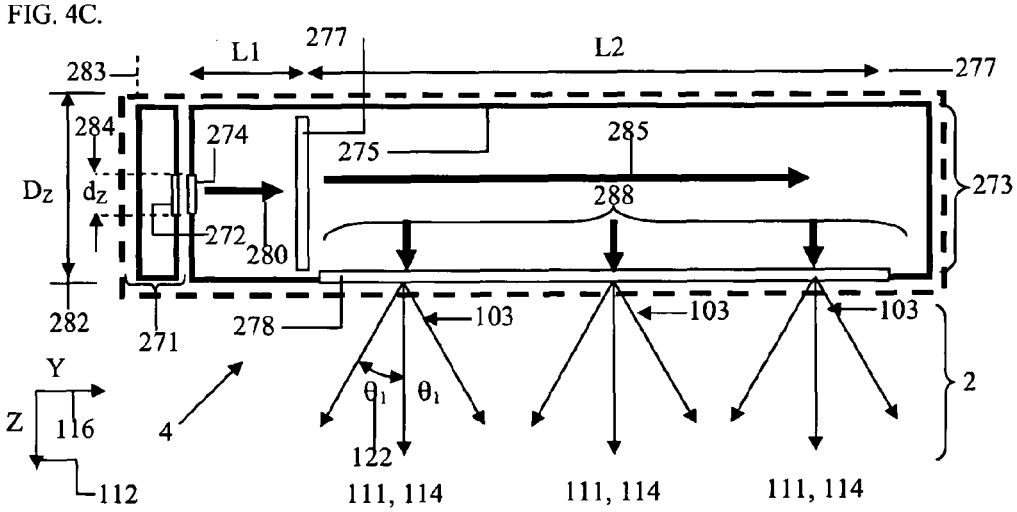

FIGS. 4A-4C provide generalized examples of three preferred forms of light distributing engine 4, not drawn to scale. FIGS. 5-14 provide generalized examples of how the light distributing engine types of FIGS. 4A-4C are embedded within the body 5 a ceiling (or wall) tile 6. Specific examples are provided further below.

FIG. 4A is a side cross-section illustrating a vertically stacked form of light distributing engine 4 of a thickness 279 that's embeddable within the body 5 of a ceiling tile 6 or comparable building material. The engine's output aperture 278 emits a uniformly distributed beam illumination 2 outwards from its surface area, $(D_Y)(D_X)$ if square (or rectangular), and $\pi D_Y^2/4$ if circular. Because of the design of light distributing optic 273 and the action of its generally indicated internal reflecting and refracting elements 275, output light 2 is maintained within a substantially symmetric beam of angular extent 122 expressed by angles $\theta_1$ in the meridian shown, and $\theta_2$ in the orthogonal meridian not shown. Output light projects downward 111 along the system's Z-axis 112, or in oblique direction 114 at an angle to axis 112, depending on the internal design of light distributing optic elements 275.

The input aperture 274 of this form of light distributing optic 273 is located directly below output aperture 272 of light emitter 271, positioned to receive substantially all emitted light 280. Input light 280 passes sequentially through apertures 272, 274 and 278, and in doing so is transformed by reflection and refraction elements 275 from the wide-angle input distribution of light emitter 271 into the narrower angle beam 285 exiting as output illumination 2. The two opposing apertures 272 and 274 are preferably aligned with each other, of similar dimension $d_Y$ 281 (with 274 preferably no smaller than 272), and have similar shape (either square, rectangular or circular).

The output aperture 278 of this form of light distributing optic 273 is located below and in-line with input aperture 274. Output aperture 278 may comprise one or more of a clear transmissive window, a scattering type diffuser, a lenticular type diffuser, a diffractive type diffuser, a sheet of microlenses, a sheet of micro prisms, a multi-layer reflective polarizer film (e.g. DBEF™ as manufactured by 3M or equivalent), a nano-scale wire grid reflective polarizer (e.g. PolarBrite films by Agoura Technologies) and a phase retardation film (as manufactured, for example, by Nitto Denko). The two opposing apertures 274 (input) and 278 (output), as shown in FIG. 4A, are preferably aligned with each other, but are different in size as indicated by common cross-sectional dimensions $d_Y$ 281 and $D_Y$ 279. The input and output apertures of light distributing optic 273 are not constrained to be similar in shape (either may be square, rectangular or circular). Aperture ratio $(D_Y/d_Y)$ is $N_1/\mathrm{Sin}(\theta_1)$ in the cross-sectional meridian of FIG. 4A, $N_1$ being a positive number greater than or equal to 1, a value depending on the internal design of light distributing optic elements 275. Aperture ratio $(D_X/d_X)$ is $N_2/\mathrm{Sin}(\theta_2)$ in the orthogonal cross-sectional meridian, with $N_2$ also being greater than or equal to 1.

When $N_i=1$, the illuminance of output aperture 278 substantially equals the illuminance of the output aperture 272 of light emitter 271, which is preferable only in certain spot lighting applications of the present invention when beam direction 114 points away from or is shielded from direct human view.

Values of $N_i$ greater than one dilute viewable output illuminance and thereby reduce risk to human viewers. Using preferable reflective designs for light distributing optics elements 275 (shown in examples further below), values of $N_i$ greater than 6 are feasible for this form of light distributing engine 4.

Specific examples of the present distributed tile illumination system 1 invention using this form of vertically-stacked light distributing engine 4 are provided further below (as illustrated by the examples in FIGS. 103-124)

FIGS. 4B and 4C are side cross-sections illustrating two different horizontally stacked forms of light distributing engine 4 embeddable in body 5 of ceiling tile 6 (or other comparable building material), each being orthogonal variations on the vertically stacked form of FIG. 4A. The form of FIG. 4C, in particular, enables the largest practical ratio of output aperture size to input aperture size, thereby maximizing the dilution of output aperture luminance.

FIG. 4B is a side cross-section illustrating a horizontally arranged form of light distributing engine 4 wherein the output light 280 from output aperture 272 of light emitter 271 flows with average pointing direction substantially horizontal (in axial direction 116) through adjacent input aperture 274 of light distributing optic 273. Light distributing optic 273 consists of two sequential parts, a first part defined by running length L1, 276, and a second part defined by running length L2=$D_Y$, 279, plus output aperture 278. In this form of light distributing engine 4, L1 is substantially larger than D. Reflective and refractive elements 275 deployed within the first part of light distributing optic 273 are arranged to transform the wide-angle input light 280 from aperture 274 into narrower angle output light 285 in intermediary aperture 277 separating the first part of light distributing optic 273 from the second part, both beams parallel to horizontal axis 116. Transformed light 285 enters the second part of light distributing optic 273, which is a region of redirection, 286, and is thereby redirected as beam 287 along orthogonal axial direction 112, as output illumination 2. Aperture ratios, in this form, $D_Y/d_Z$ and $D_Y/d_Z$, are substantially the same as were described for the form of FIG. 4A.

FIG. 4C is a side cross-section illustrating another horizontally arranged form of light distributing engine 4. In this case, not only is running length L2 of the second part of light distributing optic 273 is now substantially longer than running length L1 of the first part, but so is the comparable size of the output aperture 278. Just as shown in FIG. 4B, input light 274 passes through intervening aperture 277 (separating part 1 of light distributing optic 273 from part 2), and transforms to narrower angular width light beam 285. Beam 285 then passes through the reflective and refractive elements 275 deployed within the extended running length L2 of light distributing optic 273. As it does so, a sequential stream of spatially distributed output beams 288 are extracted downwards through output aperture 278 in a direction (or directions) substantially different than the generally horizontal direction of beam 285. Each extracted output beam 103 in the distribution of output beams 288 are maintained within a substantially symmetric angular extent 122 expressed by angles $\theta_1$ in the meridian shown, and $\theta_2$ in the orthogonal meridian not shown. Output light projects downward 111 along the system's Z-axis 112, or in oblique direction 114 at an angle to axis 112, depending on the internal design of light distributing optic elements 275.

Preferable light distributing engines 4 used in accordance with the present invention, have a thin enough cross-sectional thickness to fit substantially within the body 5 of ceiling tile 6 and have an output aperture 278 that is not only substantially larger than the corresponding output aperture 272 of light emitter 271, but as in the form of FIG. 4C, direct view back to the light emitter's output aperture 271 has been prevented.

It is important to prevent direct view of bare LED light emitters 271 because the aperture luminance of most commercially produced ultra-bright LED emitters 271 available today is far too high to be considered safe for human viewing. Typical LED light emitter output aperture illuminance, whether bare or covered by a lens, exceeds 1,000,000 Cd/m$^2$, and for some of the more powerful commercial emitters, can be as high as 40,000,000 Cd/m$^2$.

For this reason, it is not recommended that high lumen LED light emitters (or groups of LED light emitters) be embedded directly into access holes cut through the body of a ceiling tile material 6 as a means of providing down lighting onto a floor space below, as shown in the perspective views of FIGS. 5 and 6. The risk of eye damage is severe, and off-angle glare is excessive.

Figure 5:
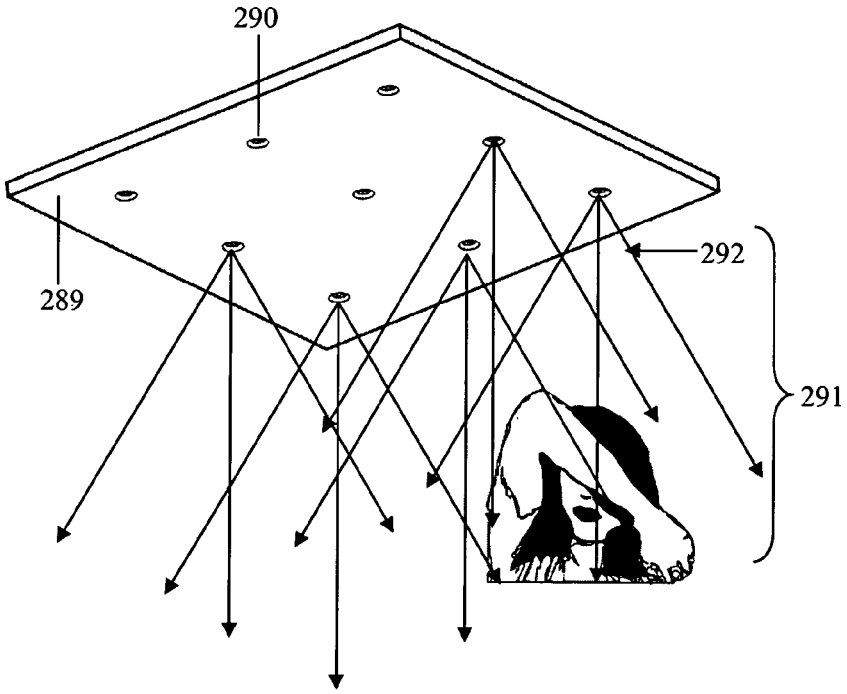
FIG. 5 is perspective view from the floor below of an otherwise normal 24"×24" tile material provided illustratively with nine circular holes, each containing an ultra-bright LED emitter providing no viewer protection from the emitter's blinding brightness
Figure 6:
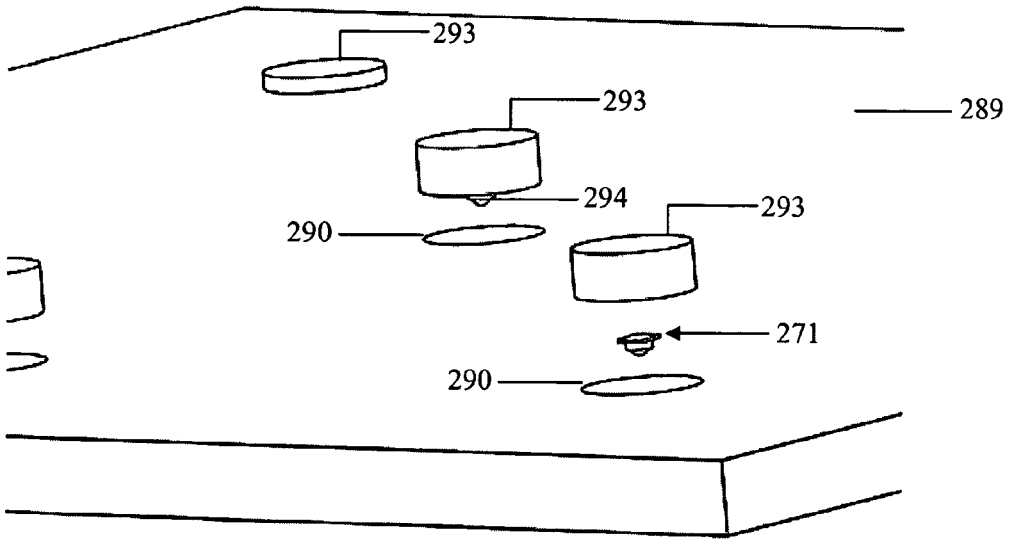
FIG. 6 shows an exploded perspective view of the backside of a central portion of the tile illumination system illustrated in FIG. 5.

FIGS. 5 and 6 are examples where high-brightness light emitters have been deployed within the cross-sectional thickness of a conventional ceiling tile material, but have been done so in a configuration that provides no viewer protection from the emitter's blinding brightness.

FIG. 5 shows a perspective view from the floor below of an otherwise normal 24"×24" ceiling tile 289 that has been provided illustratively with nine circular holes, each inadvisably containing only an ultra-bright LED emitter 271 (e.g. CREE XR-E with dome lens), installed individually, one per hole 290. Each hole 290 is made large enough to provide a sufficient outlet for the emitted light 291 from the simple LED light emitter 271 to reach and thereby illuminate the floor below. In this situation, a viewer shades her eyes to protect them from the blinding glare experienced from direct line of sight within any beam 292 from any particular LED light emitter 271 visible through access hole 290. In this simple situation, the LED emitters 271 involved are in direct view, and their effective aperture illuminance (sometimes called brightness) is, as a result, much too high for practical use.

FIG. 6 shows an exploded perspective view of the backside of a central portion of tile 289 of FIG. 5. Cylindrical plugs 293 represent mounting packages for LED light emitters 271, which in this example is a 7 mm×9 mm XR-E manufactured by CREE with 5 mm diameter dome lens 294 in a 6.8 mm diameter lens holder. Dome lens 294 enables clear view of the LED's 1 mm×1 mm emission surface. This emitter delivers between 80 and 100 white lumens at about 1 watt depending on its exact color and quality ranking.

The corresponding aperture luminance, I, is calculated by equation 1 in candela per square meter (Cd/m$^2$, also known as Nits), for a circular emitting aperture area of diameter D (in inches), L lumens passing through the aperture area, and an illuminating beam having +/−$\theta_1$ and +/−$\theta_2$ degrees of angular extent. The corresponding illuminance of a square aperture, X inches by Y inches, is given by equation 2. Use of equation 1 or 2 depends on the size and shape of the emitting surface seen by the eye.

$$I_{CIRC}\,(\mathrm{Cd/m^2})=[(3.246)*L/(0.25\pi D^2/144)]/[\mathrm{Sin}(\theta_1)\mathrm{Sin}(\theta_2)] \quad (1)$$

$$I_{RECT}\,(\mathrm{Cd/m^2})=[(3.246)*L/(XY/144)]/[\mathrm{Sin}(\theta_1)\mathrm{Sin}(\theta_2)] \quad (2)$$

Viewable luminance in the flawed example of FIGS. 5-6 is about 40,000,000 Cd/m$^2$ as given by equation 2, with X=Y=1 mm and $\theta_1=\theta_2$=60-degrees FWHM.

Figure 7:
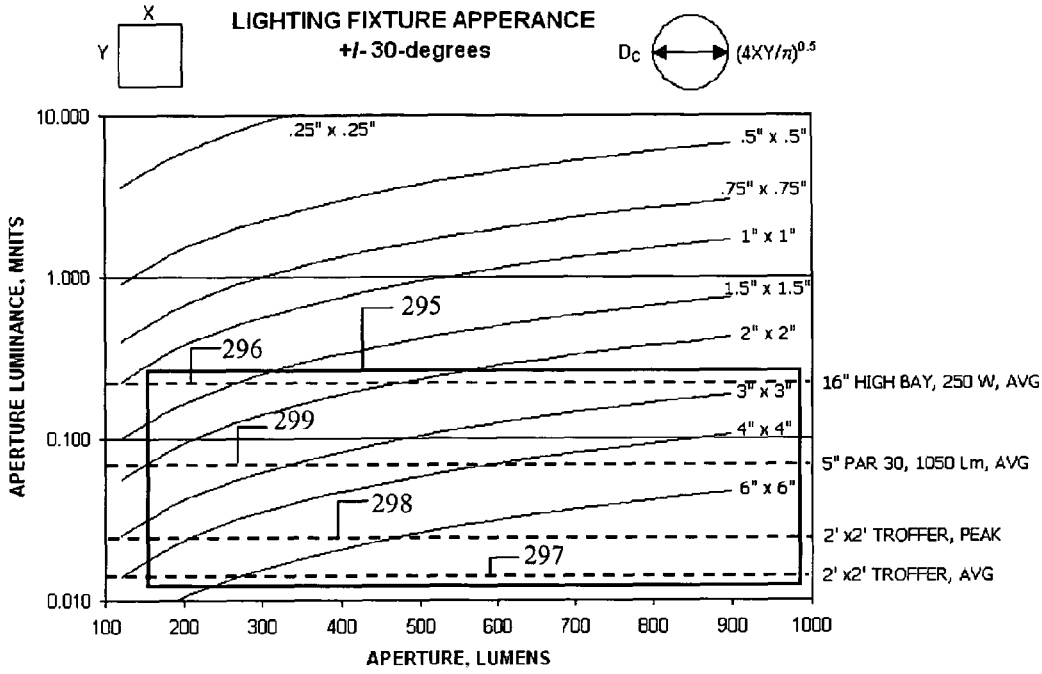
FIG. 7 is a graph describing a generalized representation of a lighting fixture's aperture luminance in MNits as a function of the number of lumens flowing through the fixture's effective aperture.

Boundaries between flawed examples such as this and those considered practical in commercial lighting practice of the present invention are delineated in FIG. 7.

FIG. 7 is a graph based on solutions of equations 1 and 2 showing a generalized representation of a lighting fixture's aperture luminance in MNits (multiples of 1 million Cd/m$^2$) as a function of the number of lumens flowing through the fixture's effective aperture, in this example within a beam of angular extent +/−30-degrees (a typical specification in high quality general overhead lighting situations). Similar representations may be made for wider and narrower beams of illumination. In this representation for +/−30-degree flood lighting, each curve corresponds to a particular lighting fixture's (rectangular) aperture area (XY) given in square inches. Each curve also corresponds to the luminance of the equivalent circular apertures having diameter $D_C$ according to the expression $D_C=(4XY/\pi)^{0.5}$.

A preferred range of luminance acceptability is illustrated generally by boundary box 295, bounded on the high side by dotted line 296 indicating the average luminance of a typical 16" diameter commercial high bay overhead down lighting can using a 250 W metal halide lamp, and on the low side by dotted line 297 indicating the average luminance of a typical 2'×2' fluorescent troffer running at 80 W. Dotted lines 298 and 299 correspond to other typical commercial references, the peak surface luminance of an 80 W fluorescent tube, 298, and the average aperture luminance of a 75 watt 1050 lumen 5" incandescent halogen PAR 30, 299.

The relationships implicit in FIG. 7 show that commercially useful illumination apertures for light distributing engines used in accordance with embodiments of the present invention are those whose effective aperture areas 278 are larger than about 1 square inch, and preferably larger than about 2 square inches. Effective illuminating aperture-areas less than 1 square inch are shown as exhibiting dangerously high brightness levels even at moderate lumens.

Light distributing engines having smaller aperture areas than those prescribed by boundary box 295 are best used only when output light beams 2 are directed physically away from or cannot be easily seen by human viewers beneath.

Figure 8:
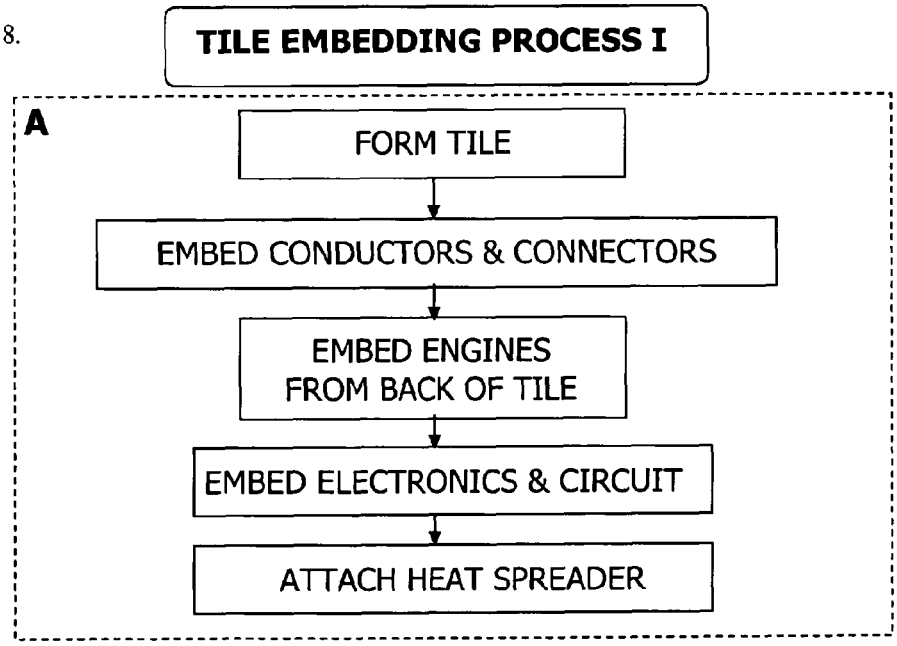
FIG. 8 is a generalized flow chart summarizing a one stage process sequence for embedding light distributing engines, electrical elements, electronic circuits, and wiring elements within the body of an otherwise conventional tile material, in accordance with the present invention.

FIG. 8 provides a generalized flow chart summarizing a one stage process sequence for embedding light distributing engines 4, electrical conductors 7, electrical connectors 9, electronic circuit 15 (including sensor elements and power control elements), and wiring elements 181 (abbreviated as circuit) within the body 5 of an otherwise conventional tile material 6, in accordance with the present tile illumination system invention 1. This series of process steps are performed sequentially to complete the production of a tile illumination system 1. Two alternative two-stage tile embedding process sequences are summarized in the flow charts of FIGS. 9 and 10.

Figure 9:
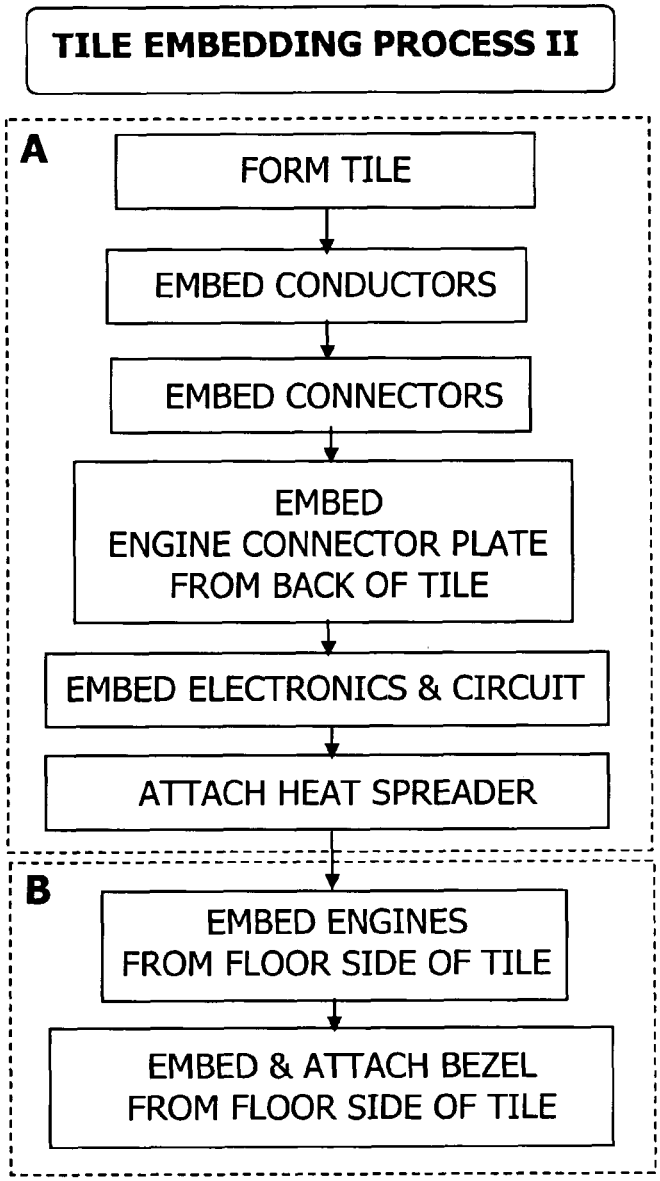
FIG. 9 is a generalized two-stage process flow equivalent to that of FIG. 9 except that in stage A, engine connector plates are embedded into tile 6 instead of the complete light distributing engines themselves, followed by a second stage B, wherein the light generating portions of the light distributing engines are embedded in a removable manner.

FIG. 9 is a generalized two-stage process flow equivalent to that of FIG. 9 except that in stage A, engine connector plates are embedded permanently into tile 6 instead of the complete light distributing engines themselves, followed by a second stage B, wherein the light generating portions of the light distributing engines are embedded in a removable manner. With this modification, the light distributing engines are added from the floor side of tile 6, followed by the attachment of a decorative bezel. This sequence allows for easy replacement of any or all light distributing engines without need for removing the tile 6 from the overhead tile suspension system, or for otherwise disturbing the embedded elements.

Figure 10:
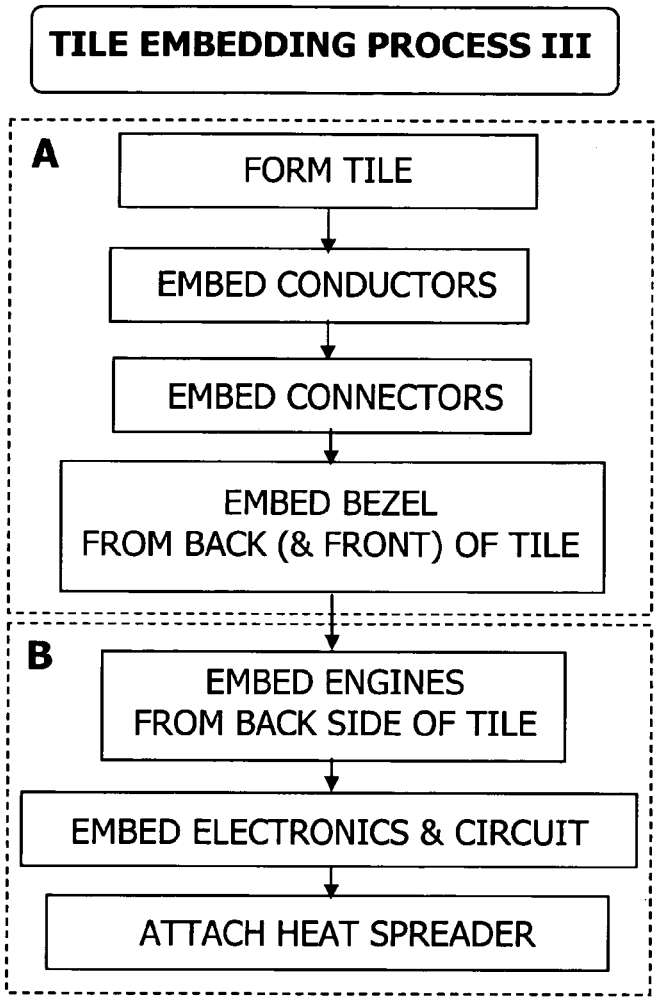
FIG. 10 summarizes another generalized one-stage process flow, similar to the flow of FIG. 9.

FIG. 10 summarizes another generalized one-stage process flow, similar to the flow of FIG. 9. In this variation, conductors 7, connectors 9 and a bezel are embedded the backside of tile 6, with the bezel optionally incorporating a fascia applied from the front of the tile. As in the flow of FIG. 9, the light distributing engines are embedded from the backside of tile 6, as are the embedded wiring elements (circuits), and connectors.

In each instance, a thin backside cover element may be added optionally as a protective barrier for the light distributing engines that also may provide an electrical shielding and heat spreading function (not shown).

Figure 11:
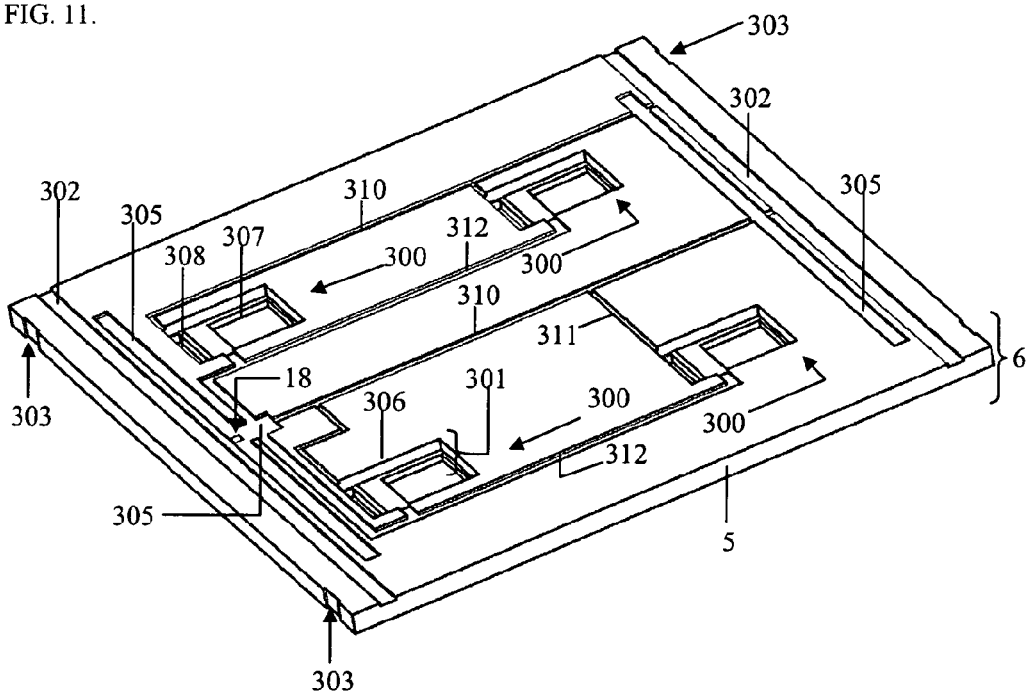
FIG. 11 shows a perspective view of the backside of an illustrative tile after its production with structured cavities formed with internal features 301 that facilitate embedding of thin-profile light distributing engines of the present invention.
Figure 12:
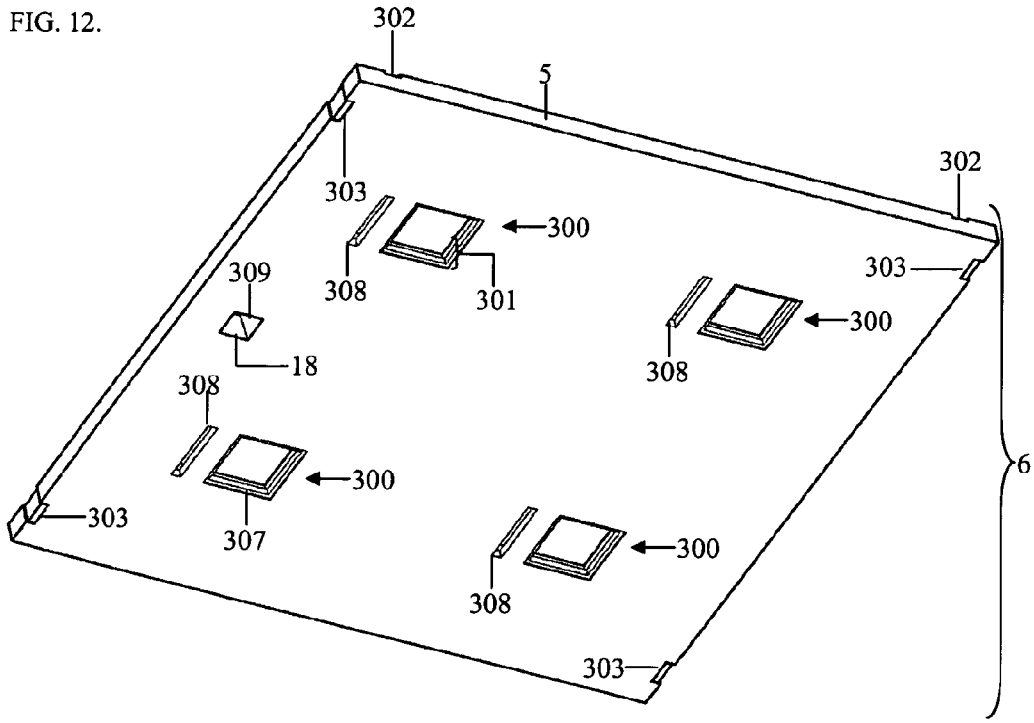
FIG. 12 shows a perspective view of the front (or bottom, or floor) side of the illustrative tile shown from the back (or top) in FIG. 11.

The generalized one-stage tile system manufacturing process flow of FIG. 9 is illustrated in detail by the sequential examples of FIGS. 11-41 for an otherwise conventional 24"× 24"×¾" tile material 6. The first step in this flow is to form the tile so that it contains embedding details (e.g., 18, 300, 301, 308 and 309) plus electrical interconnectivity features (e.g., 302, 303, 305, 306, 307, 310, 311 and 312), as shown in FIGS. 11-12. This step can occur either during the tile forming process or as a post-forming process (as in stamping, embossing, punching, machining, drilling and the addition of pre-molded inserts). The next steps, shown in FIGS. 13-41, involve manually (or automatically) embedding the various elements to be included, i.e., light distributing engines 4, DC power delivery busses 7, and DC power buss connectors 304 in the pre-formed features of tile 6. This step may also involve inserting various electrical interconnection circuit elements (flexible or rigid) in correspondingly shaped embedding slots (e.g., 310-312) provided as well. In the present example, embedded wiring elements (as variations of 181 as in FIGS. 3A, 3B, 3E, 3L and 3M), are added sequentially, as shown in FIGS. 24-41.

FIG. 11 shows a perspective view of the backside of an illustrative tile material after its production with structured cavities 300 formed with internal features 301 that facilitate embedding of thin-profile light distributing engines of the present invention. In the example of FIG. 11, close-fitting nesting areas (or cavities) are provided that facilitate the embedding of four individual light distributing engines 4 (not shown), slots 302 for embedding DC power delivery busses 7, recesses 303 for embedding positive and neutral DC power buss connectors 304 (not shown, but similar to connectors 9 in FIG. 1A), clearance slots 305 to embed various electronic circuit elements 15 (as in FIG. 1A), slots to contain electrical wiring elements (e.g. 310-312) plus at least one through hole 18 providing (optional) means for light input from the floor region below to reach an embedded light sensor (as shown in FIG. 1A), and optionally, at least one through hole 308 (per structured cavity 300) that allows an air flow path.

The geometric elements in FIG. 11 represent one example of features that facilitate the embedding of light distributing engines 4, electronics, and electrical interconnectivity. Specific geometric details, spatial locations and dimensions for all features of internal features 301 within structured cavities 300, such as cavity size (and shape) 306, cavity aperture (opening) 307 and airflow opening 308 depend on the size, shape and geometrical layout of the light distributing engine's package, as well as on the size, shape and spatial location of its illuminating aperture, as well as on the size, shape, and spatial location of its heat sink. The spatial locations (and the number) of structured cavities 300 (and internal features 301) within the body 5 of tile 6 may also vary with the personal choices in artistic design. Other locations than those shown in this example may be chosen for recesses 303, one of which may be the end points of buss slots 302.

FIG. 12 shows a perspective view of the front (or bottom, or floor) side of the illustrative tile shown from the back (or top) in FIG. 11. Provision is made for one airflow opening 308 per engine cavity 300. Floor side opening 309 of access hole 18 is shown as having an internal taper, the surfaces of which are optionally reflective, to facilitate light coupling (when necessary) from the floor beneath to an embedded sensor associated with embedded electronic circuit 15 (as in FIG. 1A). Embedded sensors may be for example, light level sensors, IR signaling sensors, and motion sensors.

Figure 13:
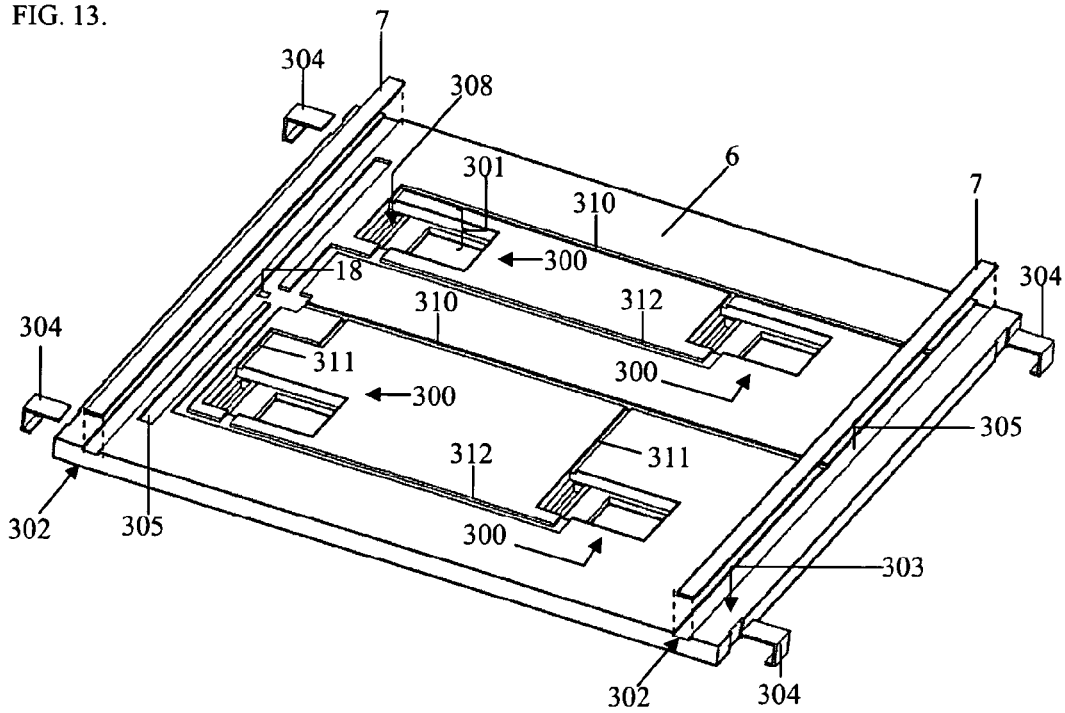
FIG. 13 and FIG. 14 are exploded (FIG. 13) and assembled (FIG. 14) perspective views seen from the backside of a tile material illustrating the embedding of DC power delivery busses into pre-made slots, and the embedding of illustrative DC power buss connectors into preformed recesses, both during tile system production.
Figure 14:
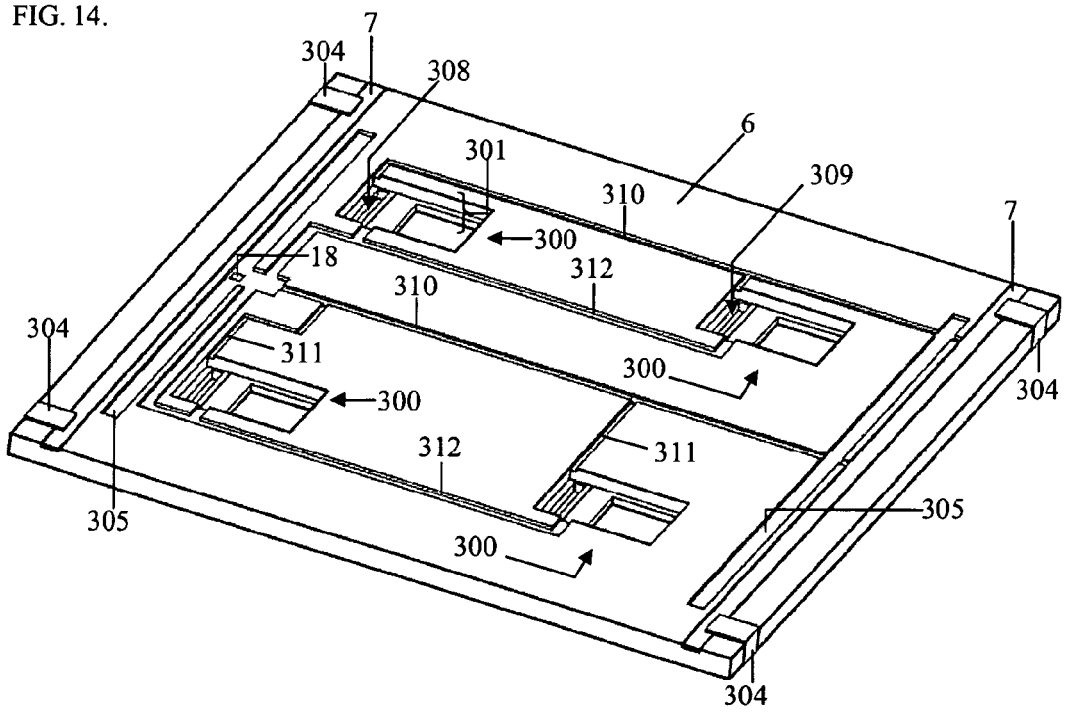

FIGS. 13-14 are exploded (FIG. 13) and assembled (FIG. 14) perspective views as seen from the backside of a tile 6 illustrating the embedding of DC power delivery busses 7 into pre-made slots 302, and the embedding of illustrative DC power buss connectors 304 into preformed recesses 303, both during production. The DC power buss connectors 304 of this example follow the example of FIG. 3G, one of several practical power interconnection means, some of which are illustrated generally in FIGS. 3F-3I.

Rigid circuit elements, flexible (flex) circuits elements, flat cables, wires or wiring harnesses providing the necessary electrical interconnectivity are embedded into slots (310-312) either contemporaneously, or after the embedding of light distributing elements 4.

Figure 15:
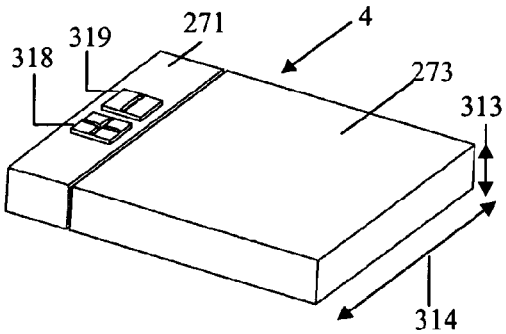
FIG. 15 and FIG. 16 show backside (FIG. 15) and floor side (FIG. 16) perspective views of a generalized light distributing engine example in accordance with the present invention whose thickness and width correspond to the cross-section shown in FIG. 4C.
Figure 16:
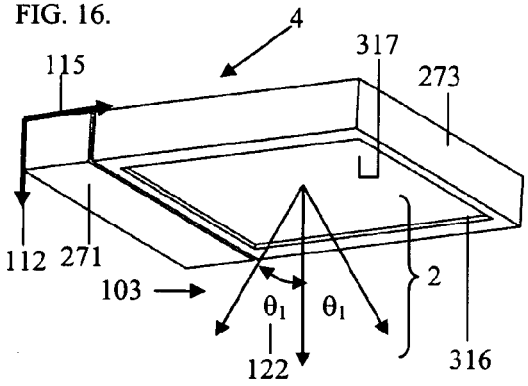

FIGS. 15-16 show backside (FIG. 15) and floor side (FIG. 16) perspective views of a generalized light distributing engine 4 example in accordance with the present invention whose thickness 313 and width 314 correspond to the cross-section shown in FIG. 4C. Light emitter 271, in this case, contains one or more LED emitters, not shown, along with necessary combinations of interconnection circuitry, heat extraction means, and output optics (lens or reflector), also not shown. Further details on preferable light emitters 271 and light distributing optic 273 are provided further below.

Light emitter 271 couples directly into light distributing optic 273. When a positive voltage is provided to positive (anode) electrode 318 on emitter 271, and a path to ground is provided via cathode electrode 319, electrical current flows through the constituent LED emitters within 271, and output illumination 2 flows substantially downwards as shown from aperture 317 of light distributing optic 273, with output beams 103 having deliberately limited angular extent 122 ($+/-\theta_1$ and $+/-\theta_2$) in each meridian, as explained above.

When basic light distributing engines 4 of FIGS. 15 and 16 are embedded in structured cavities 300, electrodes 318 and 319 must be electrically routed to embedded electronic circuit 15, included to control current flow. The present example involves one remotely located embedded electronic circuit 15 per tile shared by the embedded engines involved, in this case controlling current in each of the four light distributing engines to be embedded. In later examples, the equivalent functionality of electronic circuit 15 is embedded in each individual engine as part of its construction.

Figure 17:
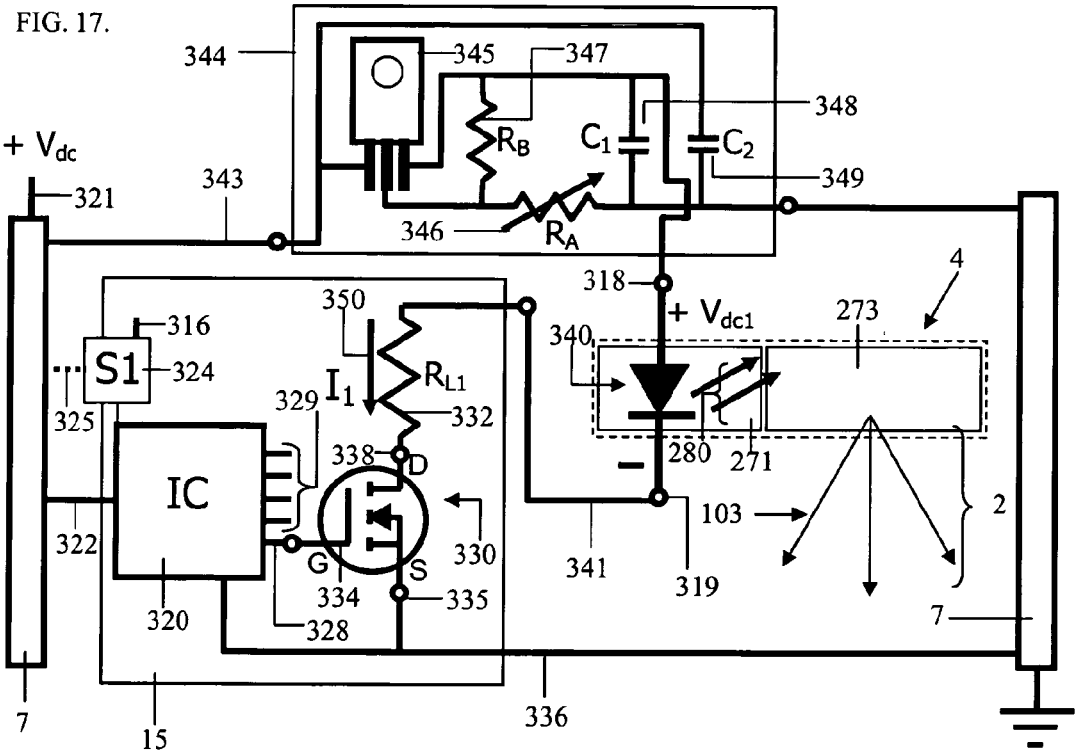
FIG. 17 shows a simple operative schematic circuit for remotely powering and controlling the internal LED light emitter (or light emitters) within each embedded light-distributing engine of the present invention.

FIG. 17 shows a simple operative schematic circuit for remotely powering and controlling the internal LED light emitter 271 (or light emitters 271) within each embedded light-distributing engine 4 of the present invention. The circuit of FIG. 17 assumes IC 320 (equivalently ASIC 320 or group of IC's 320) connects with external DC supply voltage 321 ($+V_{dc}$) on buss 7 via connection line 322 and converts this line voltage to a proper operating level within IC 320 (e.g., 5 v), senses and interprets digital control signals sent from master controller 40 via sensor S1 components 324 (whether by buss connection 325, radio antenna 326 or a constituent light detector not shown), and provides necessary DC voltage signal 328 for high power current controlling element 330 (shown as a power MOSFET, e.g., STMicroelectronics Model STP130NH02L, N-channel 24 v, 0.0034 w, 120A STripFET in TO-220 package with diode protection) connected in series with separate current limiting load resistor ($R_L$) 332. The MOSFET is being used as a digitally triggered current switch. Optionally, current controlling element 330 may be an operational amplifier. If an operational amplifier is used, signal 328 from IC 320 provides an analog voltage that controls the output current flowing from the amplifier through LED light emitter 271 (or light emitters 271). A MOSFET is used in the present example for current controlling element 330 because of its compatibility with simple digital control schemes. Signal 328, one of many possible control signals 329 produced by IC 320, is applied to the MOSFET gate line (G) 334. MOSFET source (S) terminal 335 connects to ground line 336. Current limiting load resistor 332 connects MOSFET drain (D) terminal 338 with negative (cathode) electrode 319 of light emitter 271 via interconnection line 341, electrode 319 connected internally to negative (cathode) side of LED 340 (or group of LED's 340). The positive side of LED 340 (or group of LED's 340) connects directly through positive electrode 318 of light emitter 271, either directly through positive voltage line 343, to power buss 7 and thereby to DC supply voltage 321, or as shown, through three terminal voltage regulator 344.

The amount of light 280 generated by LED 340 depends on a number of factors that may each cause the amount of light actually produced by each light engine to differ from intended specification. For this reason, the schematic circuit of FIG. 17 provides a practical means of voltage adjustment (or regulation) 344, so that output variations may be easily balanced across all light distributing engines 4 in the system of light distributing engines 1. This is particularly important in overhead flood lighting uses of the present invention where uniform illumination levels are needed over large floor areas. Light engine output differences arise in practice because of LED quality differences (e.g., differences in typical operating voltage, lumens/watt or both) and because the actual voltage $V_{dc1}$ developed at each engine's electrode 318 might differ from one another. For these reasons, a means of voltage regulation 344 is included between voltage delivery line 343 and positive LED electrode 318. Three-terminal discrete analog IC voltage regulators 345 are thin, compact, and commercially available (e.g., Fairchild Semiconductor Model LM317T in a TO-220 package, or LM317D2TXM in a D2-PAK surface mount). Custom models can also be designed to address specific needs. An external potentiometer 346 of total resistance $R_A$ is incorporated to provide a manual means of adjusting (and setting) the constant voltage level desired at electrode 318. Electrically controlled potentiometers can also be used. The resistance value $R_B$ of associated balance resistor 347 is selected by means of reference equation 4, so that the desired regulated output voltage $V_{dc1}$ is achieved for a given potentiometer resistance $R_A$ and a given supply voltage $V_{dc}$, such that current $I_A$ flowing through potentiometer 346 is small (on the order of 100-uA). As one example, when $V_{dc}$=24 vdc and $V_{dc1}$ is to be set as at constant level 22 vdc, $R_B$~$R_A$. So for a potentiometer resistance of 1000 ohms, the balance resistor is about 1000 ohms as well. Capacitors $C_1$ and $C_2$ (348 and 349), about 0.1 μf and 1 μf respectively (to increase stability, 348; and to improve response time, 349)

$$V_{dc1} = \left[1.25V_{dc}\left(1 + \frac{R_A}{R_B}\right)\right] + [I_A R_A] \tag{4}$$

As an alternative to a physically adjusted potentiometer, it should be mentioned that IC 320 might be designed to include a programmable register (or to read a programmable register) that would be loaded during manufacturing calibration of light distributing engine 4. In operation IC 320 would use the register value to generate and provide to the voltage regulator an appropriate voltage level in order to provide balanced emissive brightness for the light-distributing engine 4.

Stepping down the voltage with a voltage regulator locally near the light-distributing engine can serve another function besides compensating for variable LED requirements for $V_{DC1}$; namely that of compensating for variable input voltages, $V_{DC}$, due to variable voltage drop of power transmitting elements. With different distances to the tiles from power supply 30, the different light-distributing engine will often receive different voltages that are varying amounts below the power supply's original output, the drops due to the finite resistance per length of common electrical conductors. However, for a 24V power supply line, a voltage regulator configured to take a range of voltages, say 22.1-24V, and drop them all to 22V would help compensate for the varying conductor length effect. In such a system, as long as no light-distributing engines are so far from the power supply that over 1.9V is lost on transmission, the effect of varying lengths will not result in varying light-distributing engine brightness. For example, 18-gauge wire typically drops about 1.9V in 60 feet, so, if using 18-gauge wire point-to-point supply-to-lighting element cables, and a regulator set point 2 V below the power supply's set point, cables can vary any length within 0 feet and 60 feet without a noticeable effect on the lighting element performance.

When using a MOSFET as the current controlling element, control signal 328 applied to it gate line 334, either permits operating current ($I_1$) 350 to flow through LED 340, or it prevents operating current ($I_1$) from flowing. Current 345 is set as in equation 3 by the presumed supply voltage (+$V_{dc1}$) at electrode 318 divided by the total series path resistance ($R_T$), total series path resistance being the sum of the series resistance of LED 340 ($R_{LED}$), the series resistance of MOSFET 330 ($R_{FET}$) and load resistance ($R_{L1}$). The lower the series resistance, the higher the LED's operating current, and the greater its light output level. In a two-level on-off situation, $V_{dc1}$ and $R_T$ are set for the LED's maximum permissible current and wattage.

$$I_1 = \frac{V_{dc1}}{(R_{L1} + R_{LED} + R_{FET})} \tag{3}$$

LED emitter 340 is switched "on" passing current $I_1$ for as long as signal 328 provides an above threshold voltage level (e.g. +5 vdc). In this situation, the LED's output light 280, as shown in FIG. 4C, flows into light distributing optic 273, which in turn outputs the intended illumination 2 from light distributing engine 4 in accordance with the present invention. The light-distributing engine 4 is "off" when $I_1$ is 0, which occurs whenever signal 328 provides 0 vdc (and $R_{FET}$ approaches infinity).

Figure 18:
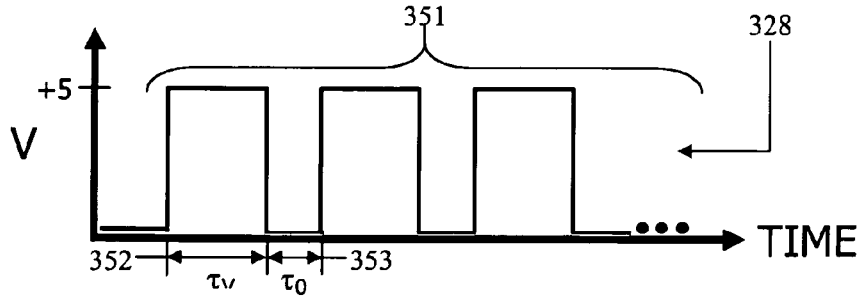
FIG. 18 is a schematic illustration of a continuous stream of +5 vdc control pulses 351 having time-duration 352 ($\tau_v$) separated by time periods 353 ($\tau_0$) at 0 vdc.

A larger number of LED operating current levels (e.g., $I_1$ to $I_n$) are needed to lower (or "dim") the illumination provided by each light-distributing engine 4 in it's "on" state. Essentially an infinite number of lighting levels are accessible using the circuit of FIG. 17 with IC 320 providing control signal 328 to gate line 334 in the form of a continuous stream of +5 vdc control pulses 351, as shown in FIG. 18, having time-duration 352 ($\tau_V$) separated by time periods 353 ($\tau_0$) at 0 vdc. Human vision doesn't perceive the flicker of light sources powered by alternating current at frequencies above about 72 Hz. A frequency of 72 Hz, as one example, corresponds to ($\tau_V$+$\tau_0$)=13,889 μs. A MOSFET's switching time is well below 10 μs, which on a 13,000 μs time scale is practically instantaneous. The mathematical relationship between light level (0 to 1), pulse duration in microseconds, and pulse frequency (PF) in Hertz (Hz) is given by equation 5. The number of pulses per second is simply $10^{+6}/\tau_V$, with $\tau_V$ entered in microseconds. This means that to operate any light-distributing engine 4 continuously at 10% of its maximum permissible lighting level with current flow $I_1$ with PF=72 Hz, as one example, pulse stream 351 comprises 720 pulses of 1,389 μs duration per second. Similarly, a 50% dimming level is achieved at the same PF with 144 pulses of 6945 μs duration per second.

$$LL=[(0.9)10^{-6}]\tau_V PF \tag{5}$$

In many commercial lighting applications, however, it's only necessary to provide a finite number of dimming levels (i.e., digital dimming). One way of doing this is to dedicate more than one MOSFET-resistor pair to each LED 340 in each light engine's light emitter 271.

Figure 19:
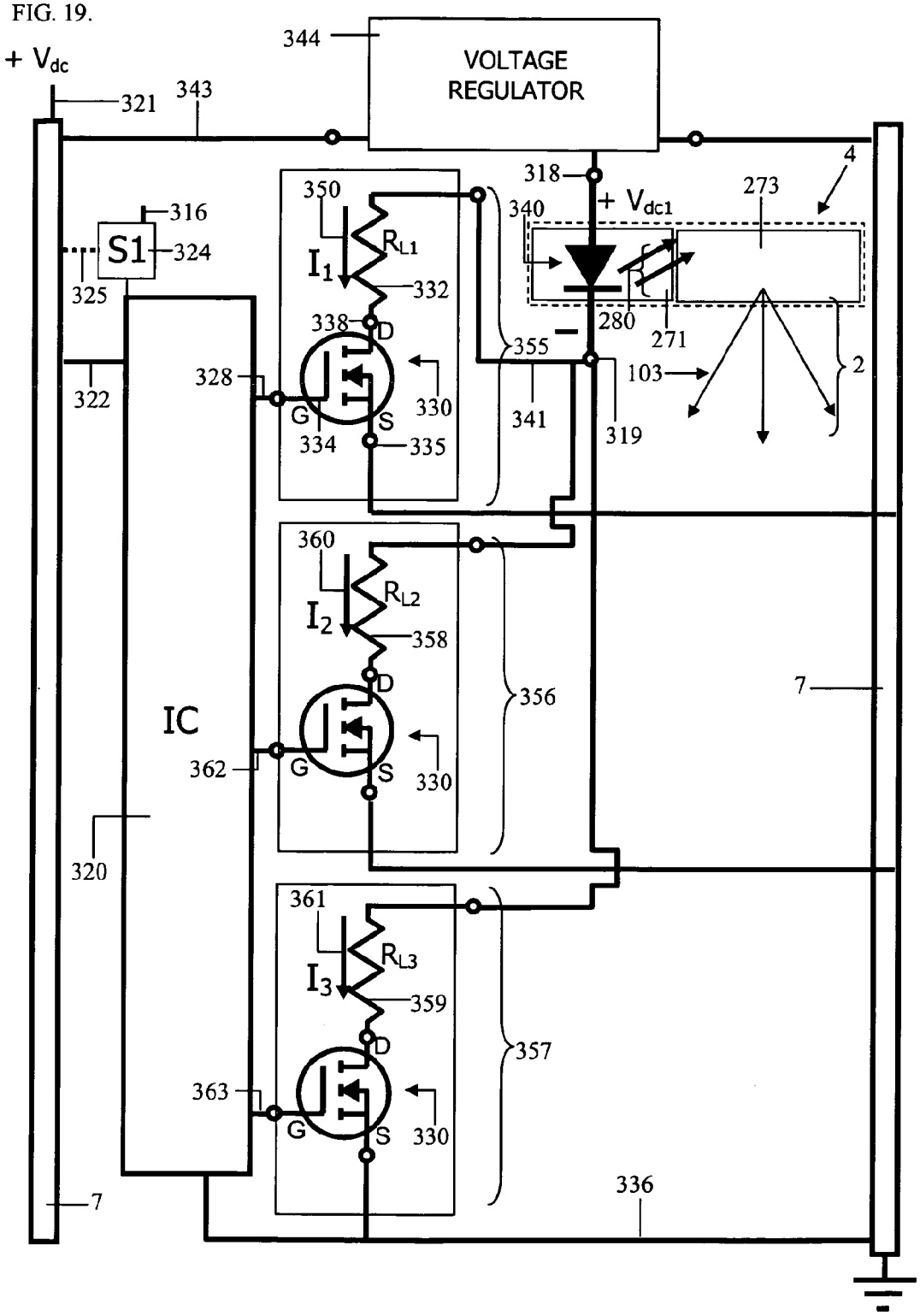
FIG. 19 is a schematic circuit illustrating a digital dimming method incorporating three parallel MOSFET-resistor branches to achieve eight levels of light engine operation (e.g. full off, full on and 6 levels of dimming).

FIG. 19 is a schematic circuit illustrating a digital dimming method incorporating three parallel MOSFET-resistor elements, as in branches 355, 356 and 357 to achieve eight levels of light engine operation (e.g. full off, full on and 6 levels of dimming). Each element (or circuit branch) uses an identical MOSFET with a differently sized serial load resistor 332, 358, and 359 ($R_{L1}$, $R_{L2}$ and $R_{L3}$), to achieve correspondingly different branch currents 350, 360, and 361 ($I_1$, $I_2$, and $I_3$). IC 320 determines which of its three designated low current control signal lines 328, 362 and 363 are activated at any time. In this manner, light-distributing engine 4 provides its maximum light output level when its total operating current is made $I_1$. This full-on state occurs when the total series resistance is the smallest possible, i.e., with the parallel combination of branches 355, 356 and 357 forcing the parallel combination of $R_{T1}$, $R_{T2}$ and $R_{T3}$ ($R_{T1}\|R_{T2}\|R_{T3}$) enabled when control signals 328, 362 and 363 are simultaneously +5 vdc. The corresponding full-off state occurs when the control signals 328, 362 and 363 are simultaneously +0 vdc and total resistance approaches infinity.

Figures 20, 21:
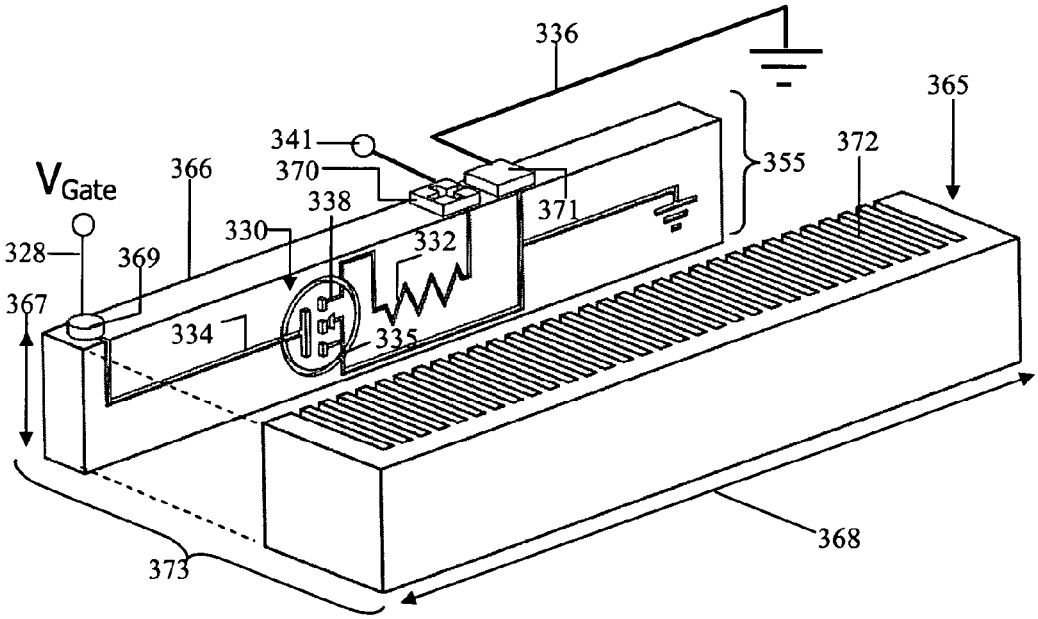
FIG. 20 is a table summarizing the eight possible engine operating levels: on, off, and six intermediate levels enabled by control signal combinations that activate only one or 2 branches at a time.
FIG. 21 is an exploded schematic perspective view illustrating one way of grouping the higher power components together with a slotted heat sink for combination with voltage regulator circuitry and light distributing engines of the present invention.

FIG. 20 is a table summarizing the eight possible engine operating levels, on, off and six intermediate levels enabled by control signal combinations that activate only one or 2 branches at a time, made using one possible set of sample resistance values $R_{T1}$=15Ω, $R_{T2}$=30Ω, and $R_{T3}$=45Ω, with $R_{T1}=R_{Li}+R_{LED}+R_{FET}$, i=1, 2, 3 as introduced above. For this example, the 8 operating levels are: 100%, 81.8%, 72.7%, 54.5%, 45.5%, 27.3%, 18.2% and 0% which represents a reasonably linear current dimming progression (though the brightness progression will be less linear than current progression for high brightness LED's).

The more parallel MOSFET branches per LED 340, the more levels of light dimming that are possible. The total number of intermediate operating levels ($n_I$) depends on the total number of parallel branches ($n_B$) and on the number of switching combinations ($s_{Ci}$, i=1, 2, 3, 4, . . . ($n_B$−1)) according to equation 6, the number of combinations without replications (e.g., $n_B$ branches taken $s_{Ci}$ at a time). The total number of levels is more simply $2^n$, where n is the number of branches ($n_B$). So for the example with 3 branches, $n_I$=((3!)/(2!))+((3!)/(2!))=6, making 8 total levels, including full on and full off. And, the total number of levels including on and off is $(2)^3$. When there are 4 switchable branches, the total number of levels is $2^4$=16.

$$n_I = \sum_i \frac{n_B!}{s_{Ci}!(n_B - s_{Ci})!} \tag{6}$$

There are three options for embedding the discrete electronic operating components (e.g., 320, 324, 344, 355, 356 and 357) associated with the circuits shown in either FIG. 17 or FIG. 19 (or their functional equivalents).

The first option is to include all the operating components in the remote cavity 305 prepared for them within the backside of tile 6 (e.g., FIG. 11), embedding insulated positive and negative conductor elements in slots 312 so as to enable operating current ($I_i$) flow between the positive and negative electrodes 318 and 319 of each engine 4, to and from the remotely located components with which they are interconnected. In this instance, light-distributing engine 4 is in its simplest form, that of the combination of light emitter 271 and light distributing optic 273, as shown in FIGS. 15-16.

The second option is to divide the necessary operating components between remote location 305 and the light distributing engines themselves. One of the preferable ways of doing this is to include all the lower power components (e.g., 320 and 324) in remote cavity 305 (as in FIG. 11), while localizing the higher power components (e.g., 344, 355, 356 and 357) within and as part of each embedded light-distributing engine 4 (as in FIGS. 21-24). In this instance, the insulated positive and negative conductor elements within slots 312 may be rated at lower voltage (e.g. 5 vdc) and lower current (e.g., few micro-amps to few milliamps) than they would if carrying the fully operating engine power (which typically is 1-15 watts).

FIG. 21 is a exploded schematic perspective view illustrating one way of grouping the higher power components (e.g., voltage controlled power switch 330 shown as power MOSFET and series resistor 332) together with slotted heat sink 365 for combination with voltage regulator circuitry 344 and light distributing engines 4 of the present invention. Branch package 366, whose height 367 and width 368 generally matches the height 313 and width 314 of the basic light-distributing engine 4, comprises gate connector 369, branch connector 370 (which busses to the cathode terminal 319 of LED 340, and ground connector 371). In this example, heat sink 365 contains vertical slots (or fins) 372 that enable air passage from floor to (and through) ceiling tile 6, while facilitating heat extraction from both the high power components in package 366 and the heat dissipating elements of light emitter 271 within light distributing engine 4. When necessary, airflow permitting fins 372 may also be arranged in a horizontal or other manner to improve heat extraction. Furthermore, part, or all, of the high power component grouping may be relocated to one of the other sides of the lighting element, or raised higher, in order to allow heat to flow into the finds from the side of the sink 365. This would be particularly necessary in an embodiment where no through-holes were available for airflow to come from below the tile.

FIG. 21 shows only one MOSFET/resistor series branch 355, as in the circuit of FIG. 17, but multiple branches, such as those shown in the schematic circuit of FIG. 19, may be included as well.

Figure 22:
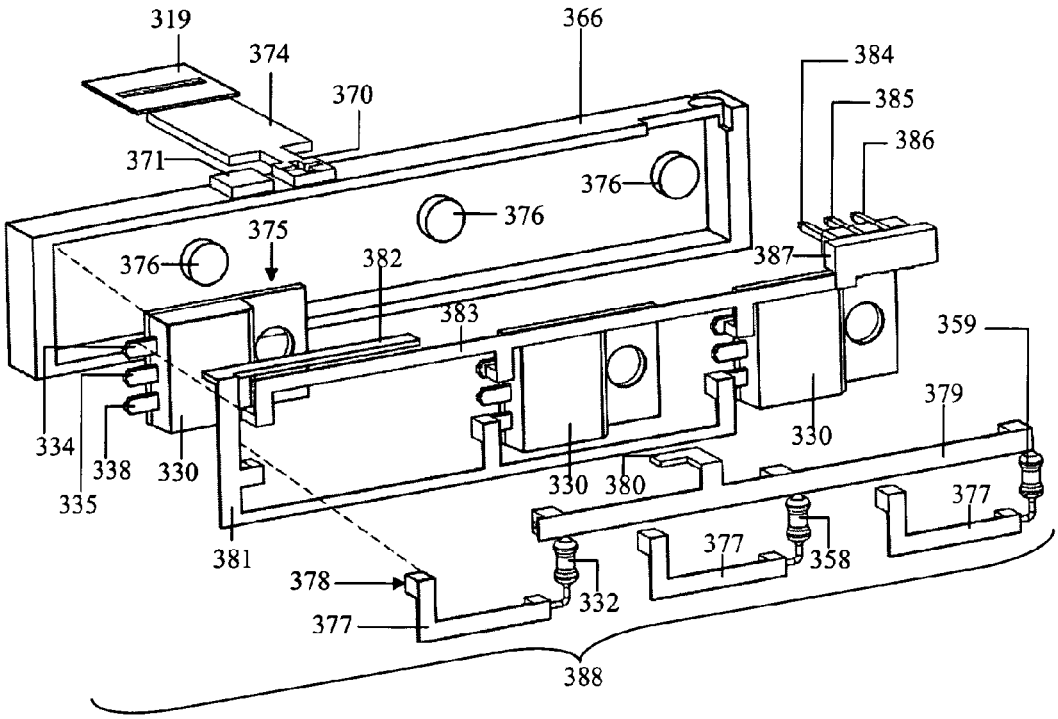
FIG. 22 is an exploded perspective rear view illustrating of one way of grouping and wiring the three current-switching branches shown in FIG. 19, doing so within the package arrangement shown in FIG. 21.

FIG. 22 is an exploded perspective rear view illustrating of one way of grouping and wiring the three current-switching branches (355, 356 and 357) shown in FIG. 19, doing so within the package arrangement 366 shown in FIG. 21.

Figure 23:
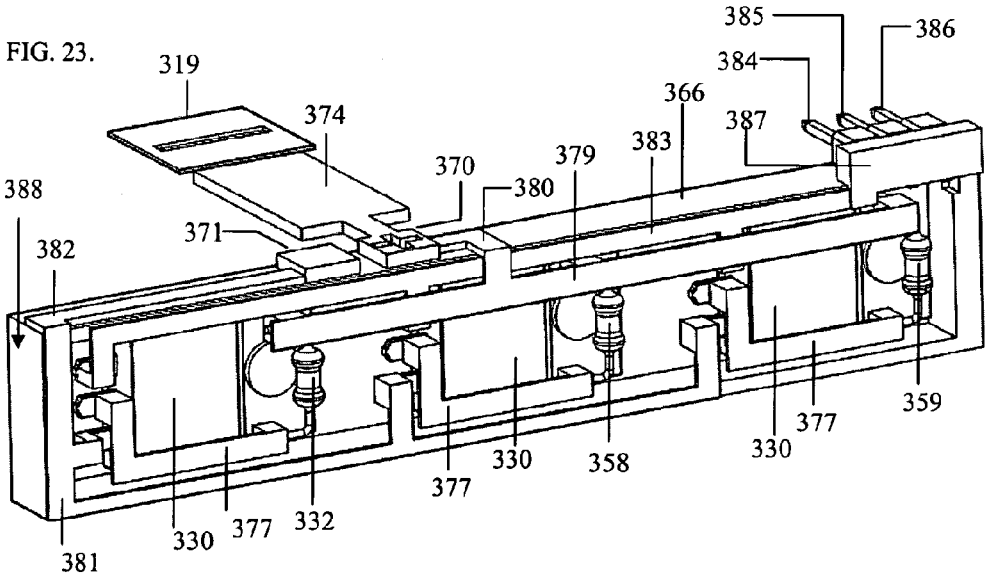
FIG. 23 is an unexploded view of FIG. 22.

FIG. 23 is an unexploded view of FIG. 22.

The basic hollow container 366 used for included elements may be made of metal, ceramic or plastic, but preferably metal to provide low thermal resistance between each of the power dissipating elements (e.g., the TO-220 packaged 375 MOSFET's 330 used in this example) and finned heat sink 365 (not shown in these two views). The three electrodes on each MOSFET 330 are as above, gate 334, source 335 and drain 338. The three MOSFETS attach to the interior of hollow container 366 using mounting bosses (376), which may also be screws or fasteners (or through holes for screws or fasteners). Each MOSFET 330 may also be soldered (or glued) to the surface of container 366. Electrical buss elements 377 and contact feature 378 together connect the MOSFET's center (drain) terminal 335 with one end of load resistor 332 (358 and 359). Electrical buss element 379 interconnects the opposing ends of load resistors 332, 358 and 359, and routes them via connecting element 380 to terminal 370, and then via buss connector 374 to the negative terminal 319 of light distributing engine 4. Electrical buss element 381 and electrical circuit element 383 are electrically separate and functionally isolated from each other. Buss element 381 provides interconnection between source terminals 338 of the three illustrative MOSFET's 330, and busses them to the container's ground terminal 371 via connector element 383. Electrical circuit element 383, in this example contains three electrically isolated gate signal lines (e.g., 328, 362 and 363 in FIG. 19), each one corresponding to the interconnection line between each MOSFET gate terminal 334 and each corresponding connector pin 384, 385, and 386 in connector block 387.

Wiring elements 377, 379, 381 and 383 may be the conductive circuitry of a printed circuit board (PCB), or flexible circuit ribbon, or other equivalent means of electrical wiring. The illustrative group of current switching MOSFET's 330, their associated load resistors, their associated electrical wiring, their associated connectors and the common container are collectively assembled as subsystem 388. FIG. 23 represents the assembled form. A back cover may be added to the otherwise exposed rear side of hollow container 366 (not shown) to further protect and embed constituent elements. The back cover may also be a substrate for some or all of the circuit elements, and as an alternate mounting surface for the MOSFET's.

Figure 24:
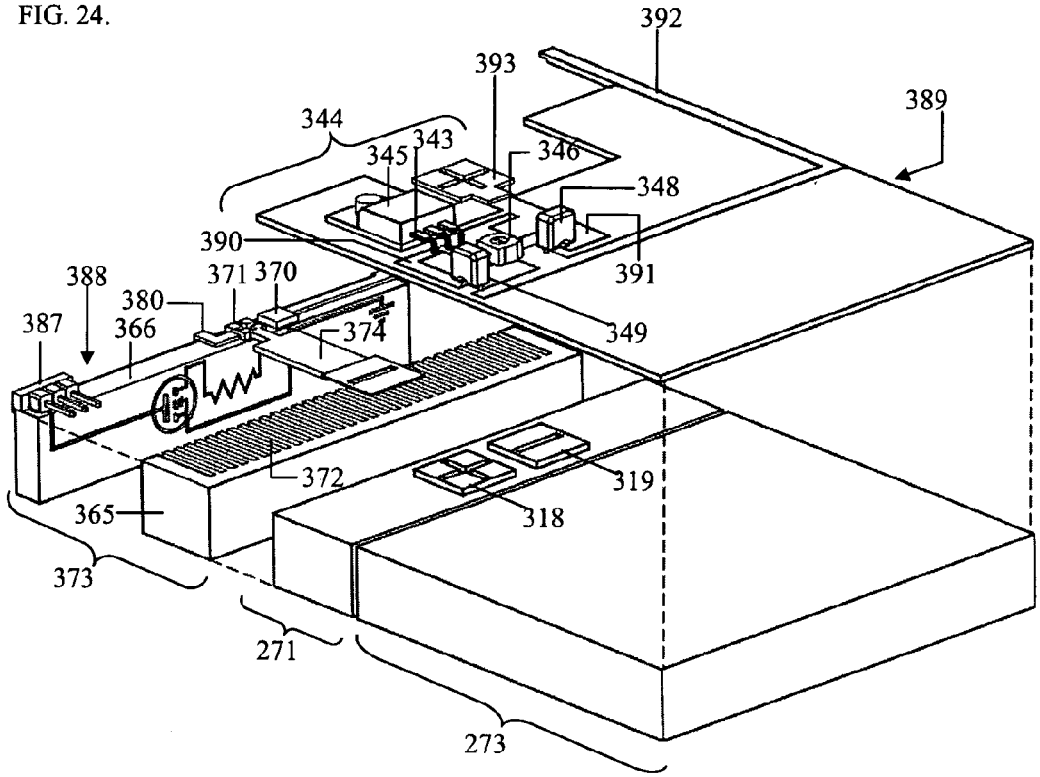
FIG. 24 is an exploded perspective view of a complete light-distributing engine of the present invention representative of the option of localizing the higher power electrical elements within the embedded engine.
Figure 25:
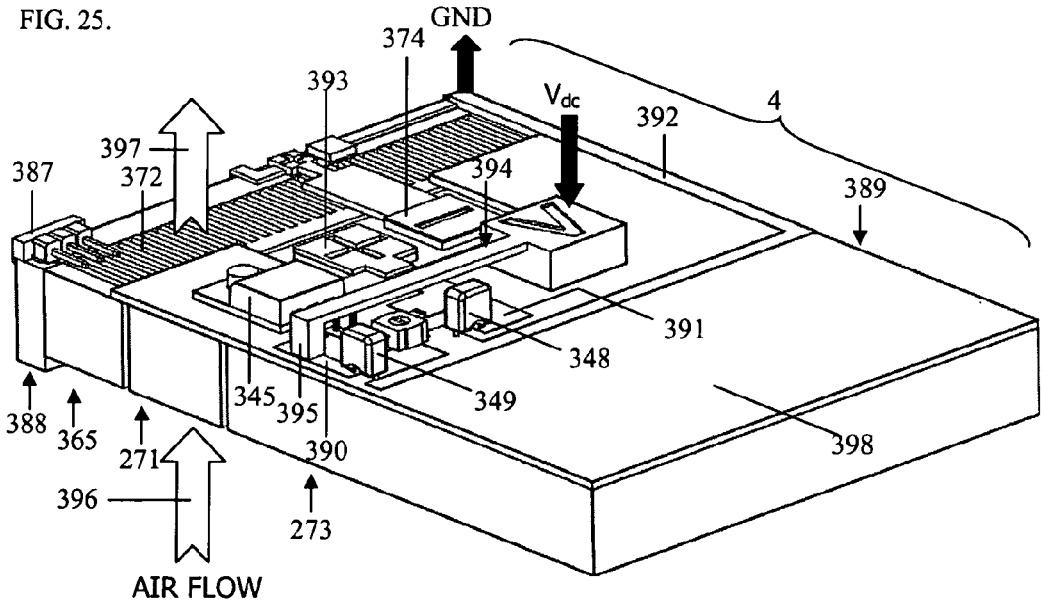
FIG. 25 is a conventional assembled perspective view of a complete light-distributing engine of the present invention representative of the option of localizing the higher power electrical elements within the embedded engine.

FIG. 24 is an exploded perspective view, and FIG. 25 is a conventional assembled perspective view, of a complete light-distributing engine 4, representative of the second option described above—that of localizing the higher power electrical elements within the embedded engine. In this example, local current switching subsystem 388 (as illustrated in FIGS. 22-23), is combined with heat sink 365 (as illustrated in FIG. 21), LED light emitter subsystem 271, local voltage regulation subsystem 344 (as was diagramed in FIG. 17), and light distribution optic 273, forming another embodiment of the light distributing engine 4 for use in practicing the present invention. The subsystem 388 may alternatively be constructed with slots or holes, raised higher relative to sink 365, or run along a different side of sink 365, emitter package 271, and optics package 273 in order to allow air to flow into the fins of sink 365 from the side of the sink that subsystem 388 covers in FIG. 24.

Regulator subsystem 344 is arranged on circuit 389, which in this example is attached to the common backside of light emitter 271 and light distributing optic 273. Conductive electrical circuit elements 390, 391 and 392 provide the associated electrical interconnection paths set forth in FIG. 17), with element 390 serving as the target point for DC voltage input and element 392 connecting to the system's ground via ground terminal 370 and thereby to the tile system's embedded ground buss. Electric component elements arranged on circuit 389 include voltage regulating MOSFET 345 as explained earlier, capacitors C1 (348) and C2 (349), and miniature potentiometer 346 with its central voltage adjustment screw. Load resistor 347 ($R_B$) is hidden from sight in these views behind potentiometer 346.

This is just one example, using mass-market catalog components. In mass-production, the actual components used will be much smaller in size, and will fit on a single circuit board layer similar to 389.

DC input voltage, $V_{dc}$, is applied to the voltage regulator's input terminal 343 (and its common circuit element 390), per the schematic diagrams of FIGS. 17 and 19. The input terminal is located physically wherever most convenient to facilitate contact with the tile's embedded voltage delivery buss, as will be illustrated below. The input terminal's form and location depends on the physical layout chosen for the specific regulator components, which in some cases may be more sophisticated than the present example. For this particular arrangement, however, convenient locations include the top of voltage regulating MOSFET 345 and any other equivalently accessible space on the top surface of circuit 389, such as the one shown as an example just to the side of circuit element 391 in FIG. 25. The simple surface-mount connector bridge 394 routes input voltage from its contact surface 395 to conductive layer 390.

Cooling airflow 396 from the floor below light distributing engine 4 passes upwards and through its vertical heat sink fins 372 as upward flow 397, extracting heat from heat sink 365 and the power dissipating constituent parts 388 and 271 attached to it.

Figure 26:
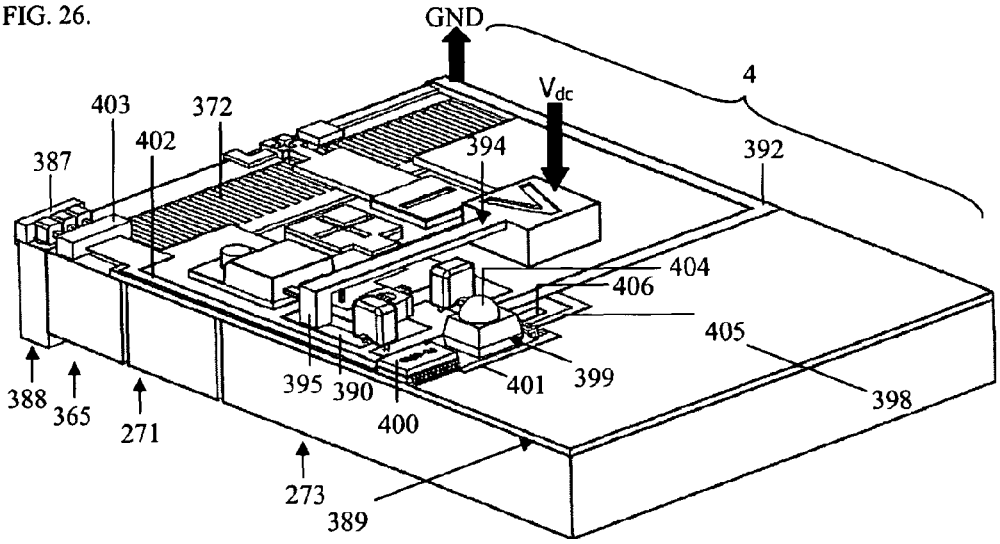
FIG. 26 is a perspective view of the light-distributing engine shown in FIG. 25, illustrating the addition of an infrared (IR) receiver element and an IC to receive and process IR control signals transmitted generally by a Master Controller as introduced in FIGS. 1C, 3L and 3M.

The third option is to locate all the necessary operating components as in FIG. 26, low power and high power, within and as part of each respective light distributing engine 4 or else substantially within the same location (same recess or hole), on the tile. By doing this, no conducting elements are required in slots 312 of ceiling tile 6 for the delivery of the engine's control signals, as all the necessary interconnectivity, other than positive operating voltage and ground path, are provided locally within each engine. The additional elements (sensor, preprocessing demodulator if needed, and main microprocessor) fit easily in the unoccupied open area 398 on circuit 389.

There are of course other options than these three, but they are considered closely related subsets. One example of this is a variant on the third option, making one of the embedded light distributing engines serve as the master engine for the tile 6 in which its located. In this scenario, the other engines on that tile are electrically interconnected to the master engine and are equipped with only those electronic components enabling slave performance with respect to the master engine.

In all examples of the present invention, and particularly those that follow, where portions of the power control functionalities expected from embedded electronic circuit 15 (as conveyed generally in FIG. 1C) are combined with or attached to the light-producing element, the combination is considered the light-distributing engine 4. The light-distributing engine 4 provides output illumination 2 upon application of a controlled source of DC voltage, which it receives by interconnection with the constituent elements of the embedded electronic circuit 15, and in turn through the electronic circuit's connection to the external voltage supply 30. When the electronic circuit is embedded in a physically different part of tile 6 than the embedding of the light distributing engine's LED light emitter portion 271 and light distributing optic portion 273, the constituent parts of the embedded electronic circuit are described separately. Yet, when electronic circuit element and light distributing engine elements are grouped together, as in the examples of FIG. 24 and FIG. 25, the embedded resultant is frequently designated as light-distributing engine FIG. 26 is a perspective view of the light-distributing engine 4 shown in FIG. 25, illustrating the addition of infrared (IR) receiver element 399 and IC 400 (previously 320) to receive and process IR control signals transmitted generally by a Master Controller 40 as was introduced in FIGS. 1C, 3L and 3M. IC 400, for example, a 24-pin application specific integrated circuit (ASIC) that handles the digital bit stream via circuit line 401 from IR receiver element 399 directly and that is powered by regulating engine input voltage Vdc (e.g., +24 vdc) to +5 vdc internally. (Note: IC 400 has the same functionality of earlier references as IC 320, but from here on is an actual commercial package style, and is in this way distinguished the generic representations in previous illustrations.) In some situations, it may be preferable to place a preprocessing IC in between IR receiver element 399 and IC 400. In either case, IC 400 responds to digital headers having the correct local address for the engine being controlled, and receives the digital instruction sets (or words) that follow, outputting the corresponding control voltages through parallel circuit lines 402 and connector block 403 to the gate terminals of the three resident current switching MOSFET's 330 via connector 387, as in FIG. 23. One suitable IR receiver element 399 is Model TSOP-349 manufactured by Vishay Semiconductors. The IR light broadcast by Master Controller 40 is collected by the receiver's dome lens 404 and conveyed to an internal PIN diode, wherein it is transduced and applied to an internal demodulation circuit including an output transistor.

Figure 27:
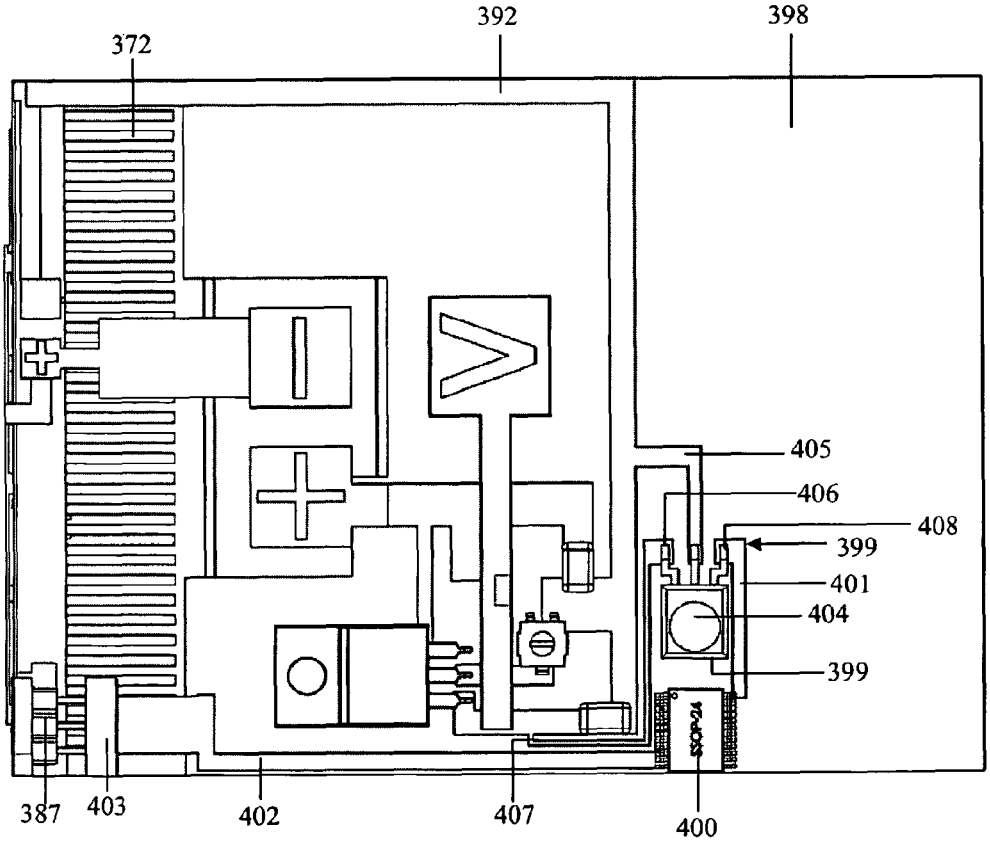
FIG. 27 is a top view of FIG. 26 clarifying its illustrative interconnections.

FIG. 27 is a top view of FIG. 26 clarifying its illustrative interconnections. The central terminal of IR receiver element 399 is connected to ground buss 392 by circuit line 405. Far side terminal 406 connects to the engine's input voltage $V_{dc}$ at circuit line 390 via circuit line 407. Far side terminal 408 outputs the demodulated digital bit stream and is routed to IC 400 by circuit line 401, for further processing. The interpreted output of IC 400 flows through parallel circuit lines within 402.

Figure 28:
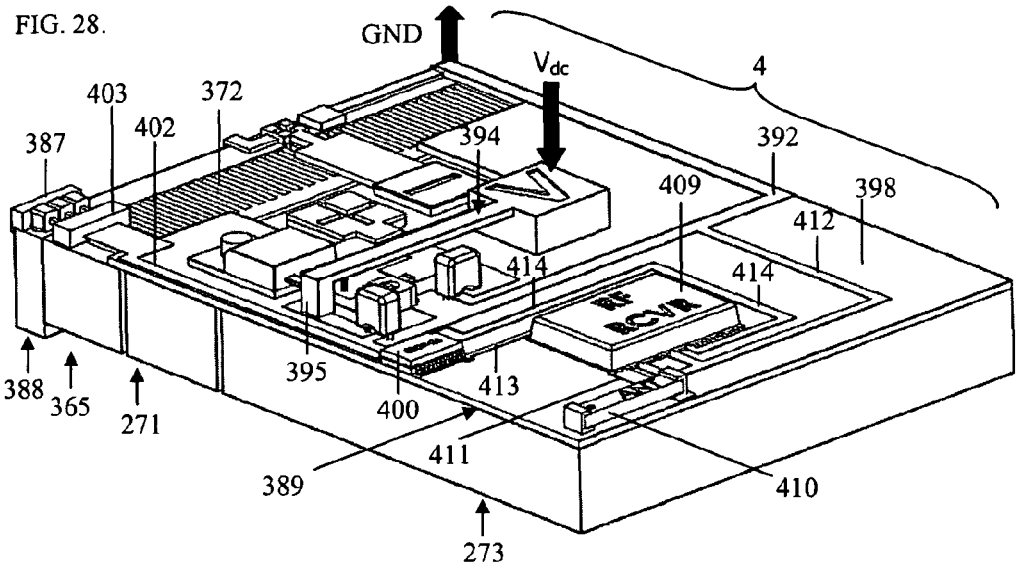
FIG. 28 is a perspective view of a light-distributing engine embodiment containing a radio-frequency (RF) receiver module and RF chip-antenna.

FIG. 28 is a perspective view of a light-distributing engine 4 embodiment containing a radio-frequency (RF) receiver module 409 and RF chip-antenna 410, instead of the IR receiver element 399 and dome lens 404 of FIGS. 26-27.

Figure 29:
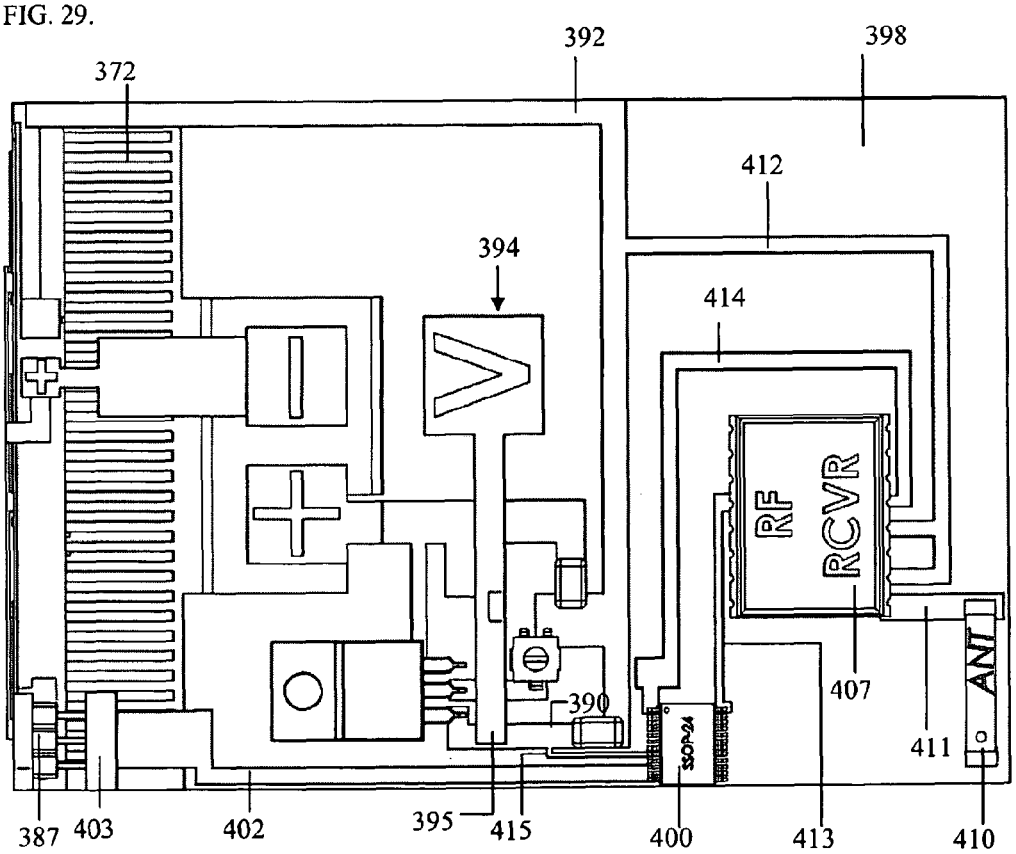
FIG. 29 provides a top view of FIG. 28 clarifying electrical interconnections shown.

FIG. 29 provides a top view of FIG. 28 clarifying electrical interconnections shown. The 16-pin SMD RF receiver 407 is similar to Model RXM-916-ES-ND manufactured by Linx Technologies, Inc., matched with surface mount antenna 410, similar to ANT-916_CHP. Although the footprint of RF receiver module 409 and chip antenna 410 is significantly larger than that of IR receiver element 399 (about 8× in area), the relatively compact RF elements still fit easily in unoccupied region 398 of circuit element 389, with ample room for additional electrical components (e.g., capacitors and resistors) as they are needed. In this example, antenna 410 is connected to receiver module 407 by circuit line 411. Ground connection line 412 routes to existing ground buss 392. The receiver module's demodulated bit stream output connects to IC 400 via circuit line 413. A regulated supply of +5 vdc is applied to RF receiver 407 via circuit line 414 between IC 400 and the proper terminal of receiver 407. Higher supply voltage $V_{dc}$ connects to IC 400 by circuit line 415, wherein it is internally scaled and regulated as a reliable source of 5 vdc, provided as an output service for circuit line 414.

Figure 30:
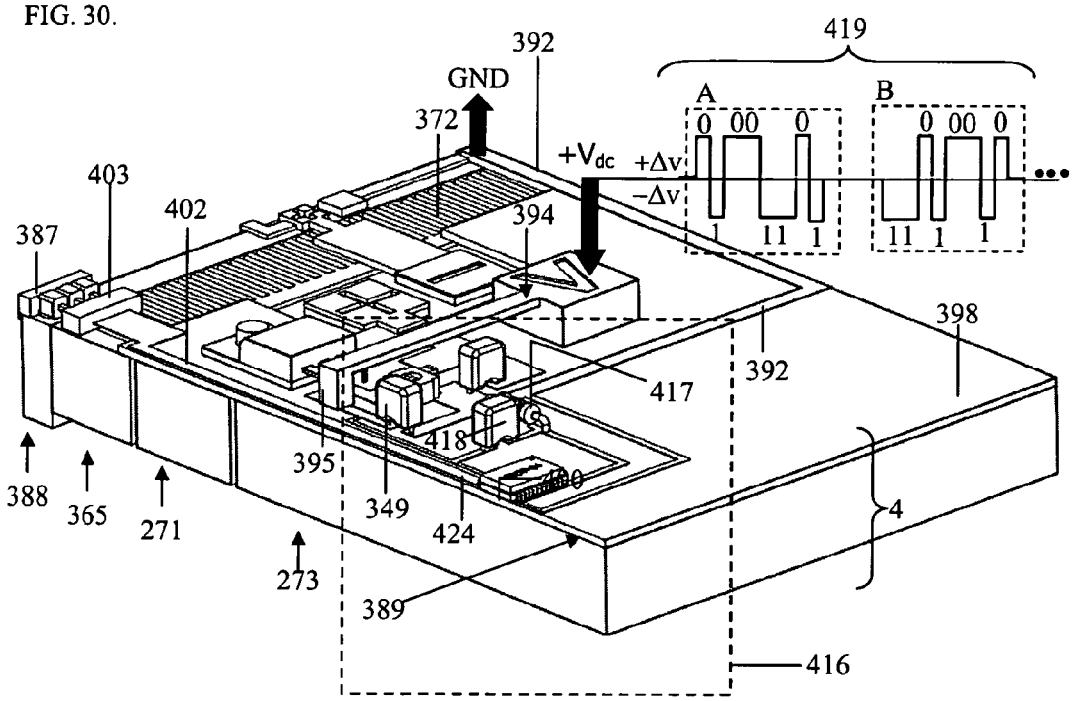
FIG. 30 provides a perspective view of yet another fully configured light distributing engine example with all operating components included on a plane layer to receive control signals from a Master Controller localized on that plane layer.
Figure 31:
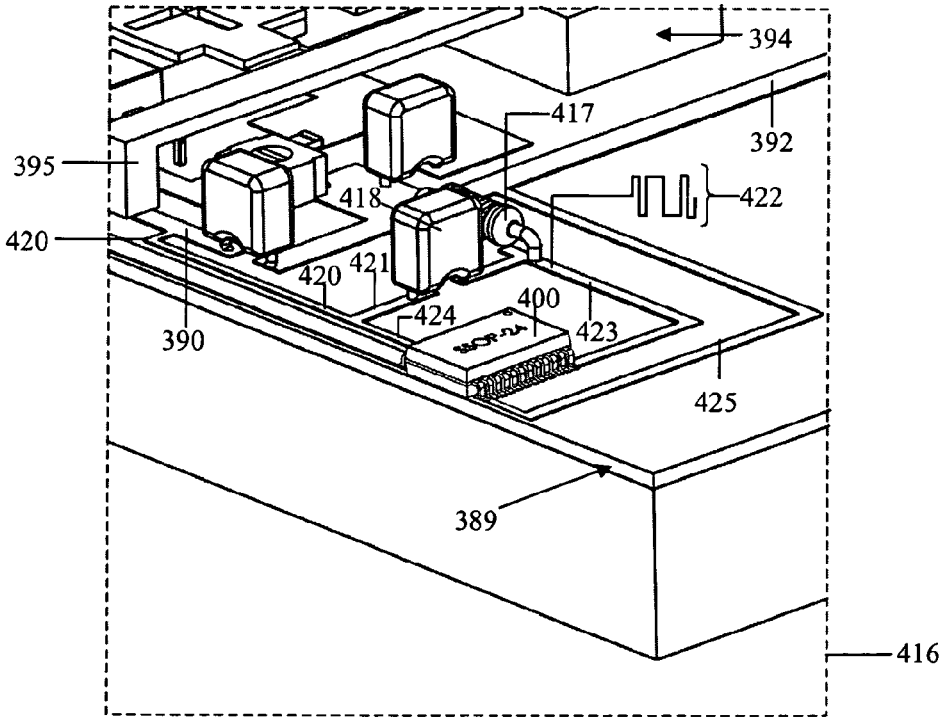
FIG. 31 is a magnified perspective view of the illustration contained in FIG. 30.

FIG. 30 provides a perspective view, and FIG. 31 a magnified perspective view 416, of yet another fully configured light distributing engine example with all operating components included on layer 389 in open space 398 to receive control signals from Master Controller 40 localized on layer 389. In this example of the present invention, three extra components are deployed to implement a DC version of traditional X-10 communication protocols, an application specific IC 400 (or equivalent group of IC's) with internal voltage regulation and preprocessing built in, resistor 417 ($R_C$), and decoupling capacitor 418 ($C_D$). X-10 protocols involve sending high frequency digitized control signal bursts over conventional 120 VAC household wiring. In that context, X-10 protocols impart digitized messages (e.g., 4-bit words) as a series of 1-ms bursts of high frequency AC (e.g., 120 kHz) onto standard 60 Hz AC. A binary "1" in that case is interpreted as every 120 kHz burst falling near a 60 Hz AC crossing point, and a binary "0" by every lack of a burst. Specific microcontroller demodulation circuits are used to interpret the encoded AC signals. The arrangement illustrated in FIGS. 30-31, however, pertains to a DC rather than AC system, and allows a simpler means of modulation and demodulation. In accordance with the present invention, Master Controller 40 (FIGS. 3L-3M) applies a stream of digital pulses representing the "1's" and "0's" of the digital words broadcast as a weak +/−Δv amplitude modulation 419 on system supply voltage, $+V_{dc}$ (as was introduced in FIG. 3K). The high frequency DC pulse stream is easily extracted in good form from the DC level by the simple capacitive decoupling components 417 and 418 included within light distributing engine 4. Good decoupling quality requires making the coupler's RC time constant ($R_A C_D$) significantly shorter than the prevailing pulse width in bit stream 419. Noise filtration and associated comparators may be included as needed within the pre-processing circuits of IC 400 to counter any unacceptable TTL pulse shape impurities that might occur during the decoupling process. When Master Controller 40 is configured to transmit 0.1 ms digital pulse streams, for example, local decoupling resistor 417 is 100Ω, and local decoupling capacitor 418 is 0.01 μF, the implied RC time constant (1 μs) is 100 times shorter than the pulse width (100 μs), and minimum pulse shape distortion is expected.

The system's DC input supply voltage, $V_{dc}$, from connector bridge 394 and its contact 395 is applied to decoupling capacitor 418 by circuit line 420 leading out from circuit line 390, just before voltage regulator capacitor 349. Capacitor 418 passes high frequency voltage modulation 422 to IC 400 via circuit line 423, but blocks DC level, $V_{dc}$. Circuit line 424 routes $V_{dc}$ from line 420 to the corresponding input terminal on IC 400 and through it to the IC's internal voltage scaling and regulating circuits. Ground connection is provided for IC 400 by circuit line, which connects with the engine's ground buss 392.

Any of the light distribution engines 4 provided as examples in FIGS. 15, 16 and 24-31 may be embedded in tile 6 prepared as shown in FIGS. 11-14.

Figure 32:
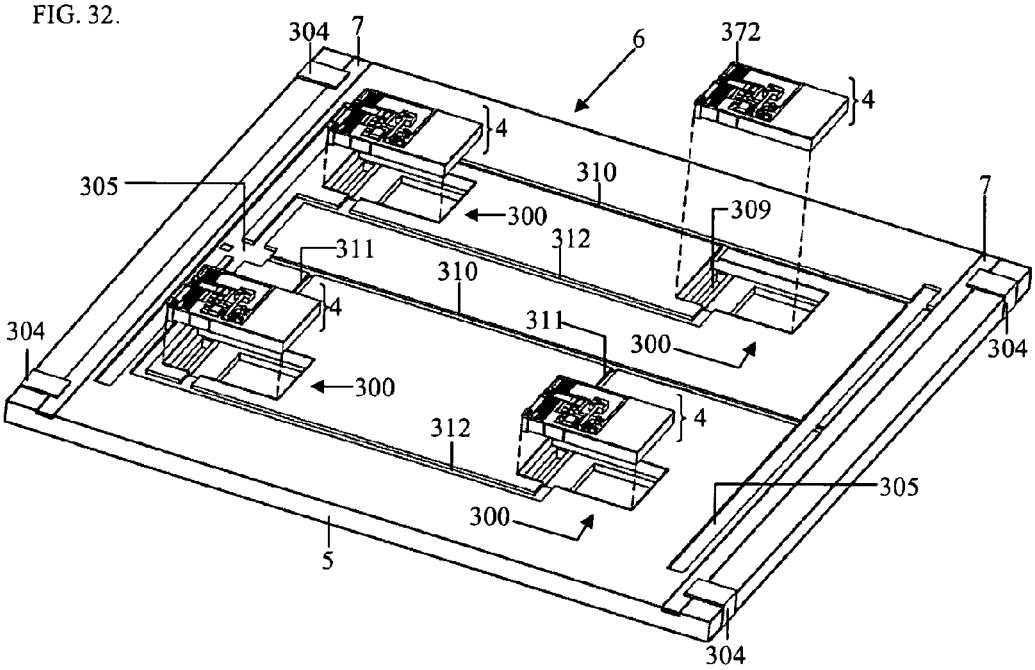
FIG. 32 is an exploded perspective view shown from the backside of a tile material illustrating the embedding process for the light distributing engine example of FIGS. 24-25.
Figure 33:
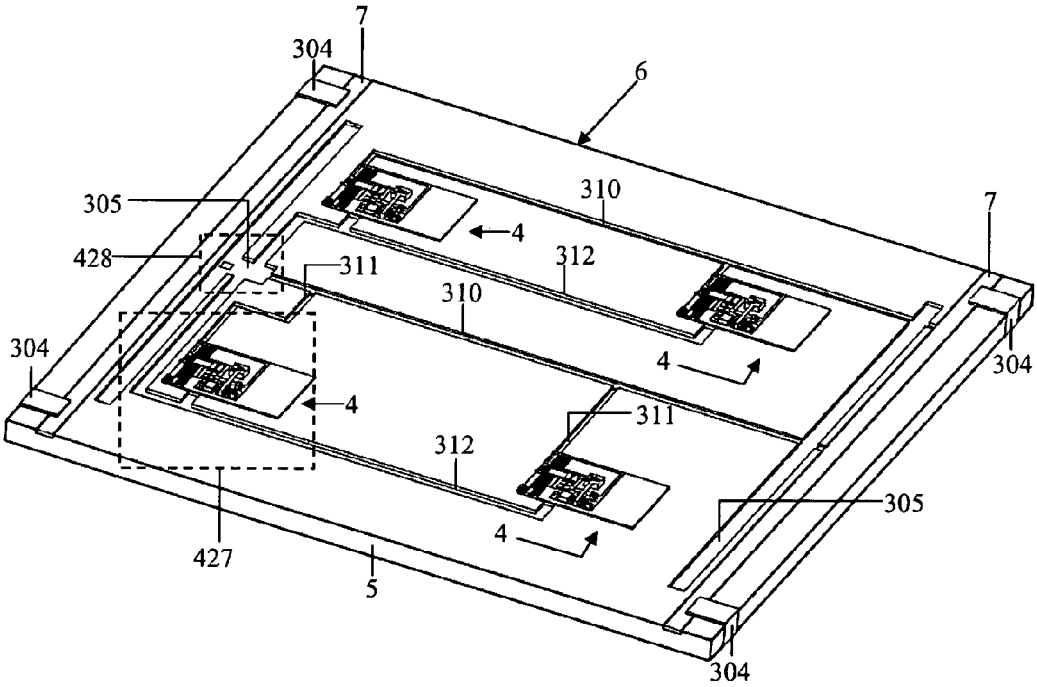
FIG. 33 is a completed perspective view of the exploded view presented in FIG. 32.

FIGS. 32 and 33 are exploded (FIG. 32) and completed (FIG. 33) perspective views shown from the backside of tile 6 illustrating the embedding process for the light distributing engine example of FIGS. 24-25. This is an illustration of the second engine power control option described above, embedding (and centralizing) the tile's low power controlling elements remotely in tile cavity 305, and connecting them with corresponding higher-power switching elements localized within each individual light-distributing engine 4 in the tile 6.

Figure 34:
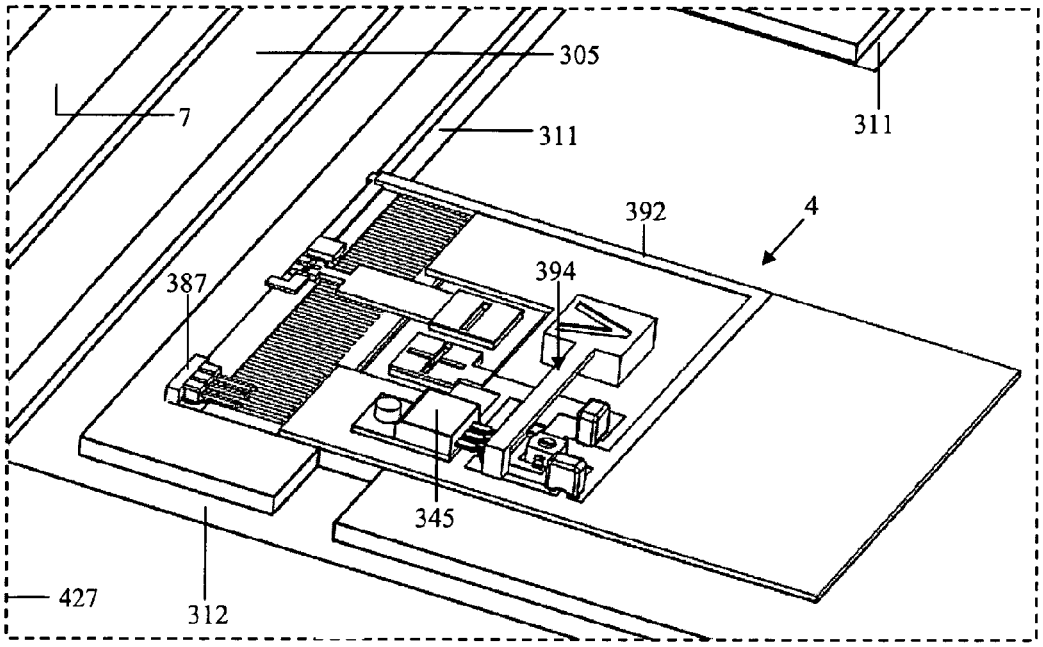
FIG. 34 shows magnified portion of a tile material modified in accordance with the present invention in the vicinity of one of its embedded light distributing engines.

FIG. 34 shows magnified portion 427 of tile 6 (or building material equivalent) modified in accordance with the present invention in the vicinity of one of its embedded light distributing engines 4. The illustrative engine's 3-terminal gate signal connector 387 is in position for interconnection with wiring to be embedded in slot 312 in a following process step. Bridge connector 394 is in position to connect with a voltage delivery buss to be installed above it. The engine's local ground buss line 392 is in position to attach to a tile ground line buss to be embedded in tile slot 311.

Figure 35:
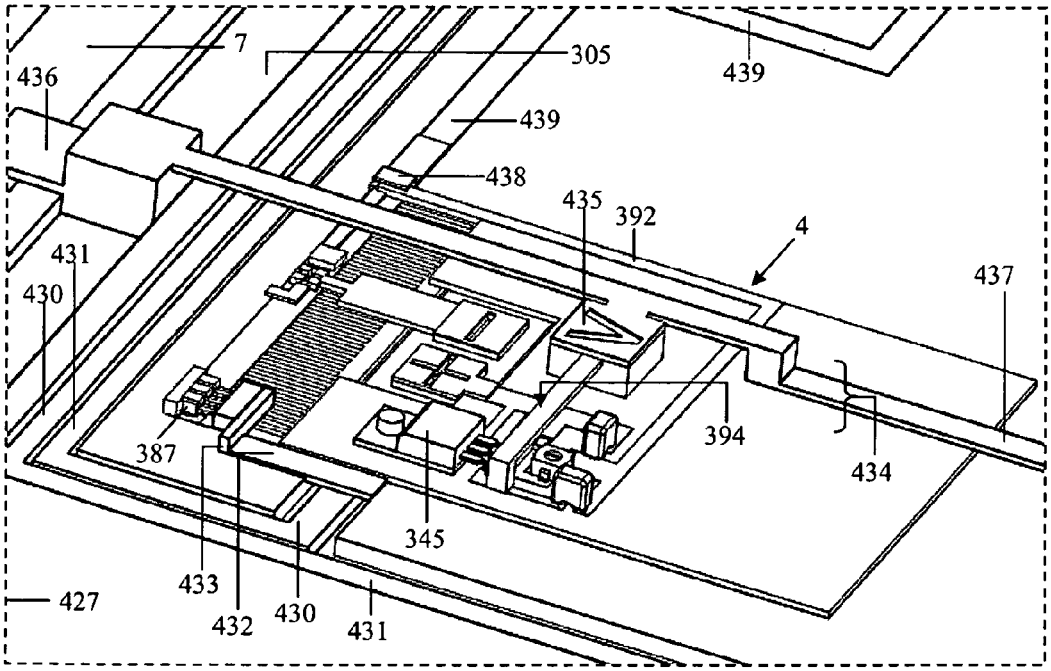
FIG. 35 shows the magnified portion of the illustratively embedded light-distributing engine, as in FIG. 34, except that in this view the associated inter-connective wiring has been added in the pre-prepared slots made within the tile material involved.

FIG. 35 shows the magnified portion 427 of illustratively embedded light distributing engine 4, as in FIG. 34, except that in this view the associated inter-connective wiring has been added in the pre-prepared slots made within the tile 6 involved. Circuit strips 430 and 431 (which may be flexible or rigid circuits, insulated wires or insulated cables) are embedded in tile slot 312 to route digital control voltages from low power instruction receiving components remotely located in the cavity 305 (not shown). In the present example, each circuit strip 430 and 431 contain 3 separate signal lines, one for the gate line of each MOSFET current switching element 330 in the engine's high power subsystem 388 (FIGS. 22-25). Connecting strip 432 and connector 433 route signals from circuit strip 430 to connector 387. DC voltage strap 434 is embedded in the slot portion of tile cavity 305 by electrode connector 436 in electrical contact with voltage buss 7, and thereby connects the engine's voltage bridging element 394 with the tile's embedded DC power buss 7. Electrode tab 435 connects to voltage strap 434 and thereby connects it with the engine's voltage bridging element 394. Extension strap 437 routes the voltage connection to the neighboring light distributing engine. Ground strap segment 439, embedded in tile slot 311, connects the engine's ground line 392 with the tile's ground buss (not shown).

Figure 36:
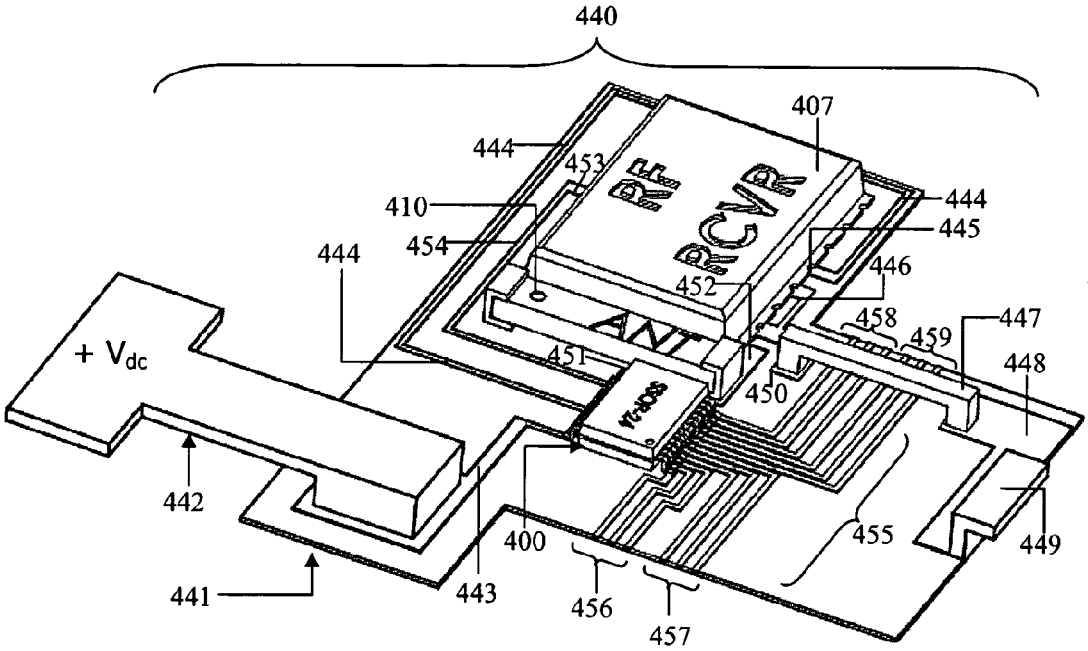
FIG. 36 is a perspective view illustrating one example of low power electronic control circuitry (i.e., the embedded electronic circuit illustrated in FIG. 1C) in a form made for embedding in a cavity preformed within a tile material.

In general, voltage bridging element 394, connecting strip 432, DC voltage strap 434, dc voltage buss 7, and embedded wiring elements 181 are examples of on-tile electrical power transfer, or power transfer elements composed of conductive wires, conductive strips, and/or other conventionally low resistance conduits of electrical current. As such they may be considered supply-to-tile power delivery elements FIG. 36 is a perspective view illustrating one example of low power electronic control circuitry (i.e., embedded electronic circuit 15 as in FIG. 1C) in a form 440 made for embedding in a cavity 305 preformed with a tile material 6. In this example, application specific IC 400, RF receiver 407 and chip antenna 410 (of FIGS. 28 and 29) are combined on common remote circuit element 441. (The IR receiver example of FIGS. 26-27 and the capacitive de-coupler example of FIGS. 30-31 are equally applicable examples for this illustration.) Voltage connecting strap 442 bridges circuit line 443 to embedded DC power buss 7 providing access to $V_{dc}$. Circuit line 443 connects Vdc to one of the 24 terminals on IC 400, and its internal voltage scaling and regulation circuits. A regulated source of +5 vdc is output from IC 400 through the terminal connecting to circuit line 444, which routes to the +5 vdc voltage terminal 445 of RF receiver 407. The receiver's connection to system ground is enabled by circuit line 446, conducting bridge 447, circuit pad 448 and connecting tab 446. IC 400 connection to system ground is made via a circuit line 449 (not shown) connecting pad 450 with IC terminal 451. Chip antenna 410 connects to RF receiver 407 via circuit pad 452, and serves one function of sensor 1, FIG. 1C, that of detecting the radio frequency control signal (e.g., 269 in FIG. 3L) broadcast by the system's master Controller 40. RF receiver 407 then provides the associated sensing function, that of demodulating the detected signal and reconditioning it as a well-shaped digital bit stream. That digital bit stream is output at RF receiver terminal 453 along circuit line 454 to IC 400. IC 400 is configured to receive and interpret the detected digital bit stream, responding only to those instructions (or digital words) intended for the control of its resident light distributing engines 4.

For the present tile embedding illustration, master control instructions are being received, processed and routed as twelve separate 0 or +5 vdc switch settings (depending on the digital instruction received) along circuit lines 455 heading to each of the tile system's four resident light distributing engines 4, and each engine's three localized MOSFET current switching branches connected to its constituent LED light emitter 271 (as in the schematic diagram of FIG. 19). The three circuit lines 456 are directed to the tile's lower left light distributing engine 4; the three circuit lines 457, to the lower right engine; the three circuit lines 458, to the upper left engine; and the three circuit lines 459, to the upper right engine. A higher number of instructions may be processed as may be required by using a larger IC, a different style of IC packaging or multiple IC's.

Figure 37:
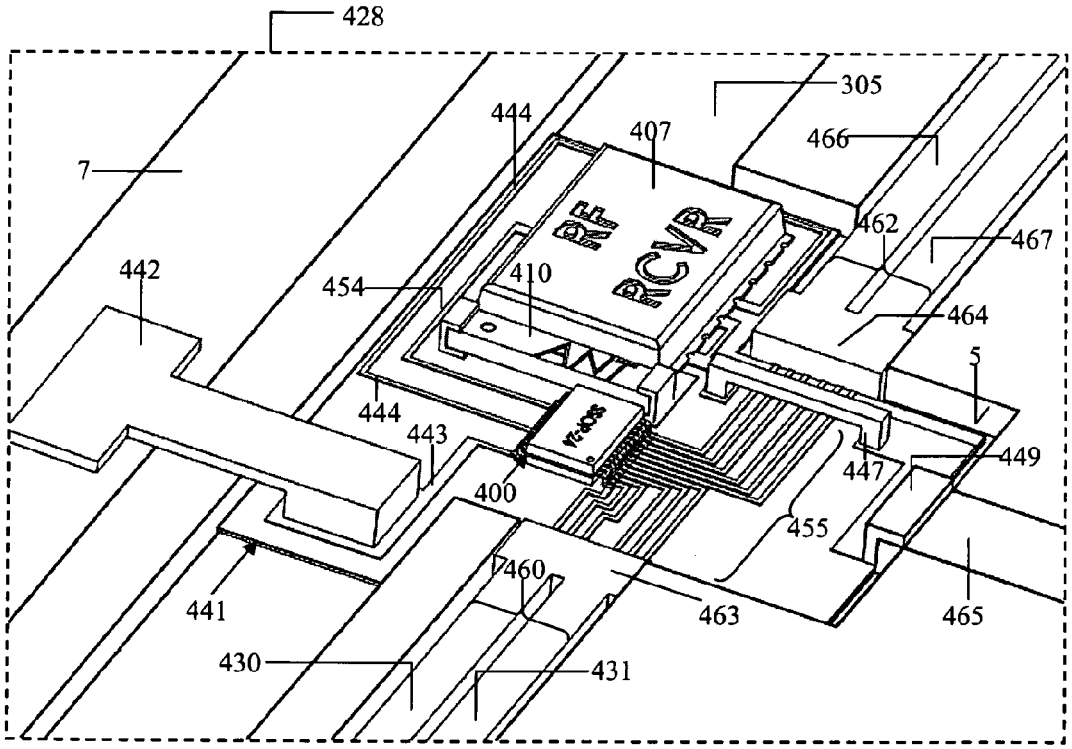
FIG. 37 is magnified perspective view illustrating the embedding of the low power electronic control circuit of FIG. 36 in a remotely located embedding cavity preformed in a tile material.

FIG. 37 is magnified perspective view illustrating the embedding of the low power electronic control circuit 440 of FIG. 36 in remotely located embedding cavity 305 preformed in tile 6. The region of view corresponds to previously unoccupied region 428 as shown in FIG. 33. Control circuit 440 is pushed down into preformed cavity 305, and in doing so, resides substantially within body 5 of tile 6. FIG. 37 also illustrates the embedding of control signal cable circuits 460 and 462 (which may be flexible circuit strips, rigid circuit strips, insulated cables or insulated wires), associated cable connector heads 463 and 464, and the tile's internal ground strap 465 now occupying slot 310. Each cable circuit body, 460 and 462, embedded in upper and lower tile slots 312, consists of two separate circuitry members, 430 and 431 within cable circuit 460, and 466 and 467 within cable circuit 462. Each circuitry member (430, 431, 466 and 467) contains three insulated voltage lines (not shown) corresponding to the three illustrative low-level control voltages being distributed to each of the four illustrative light distributing engines. Connector heads 463 and 464 make electrical contact with groups of planar circuit lines 455, whether by mechanical contact, solder, or conductive epoxy.

Figure 38:
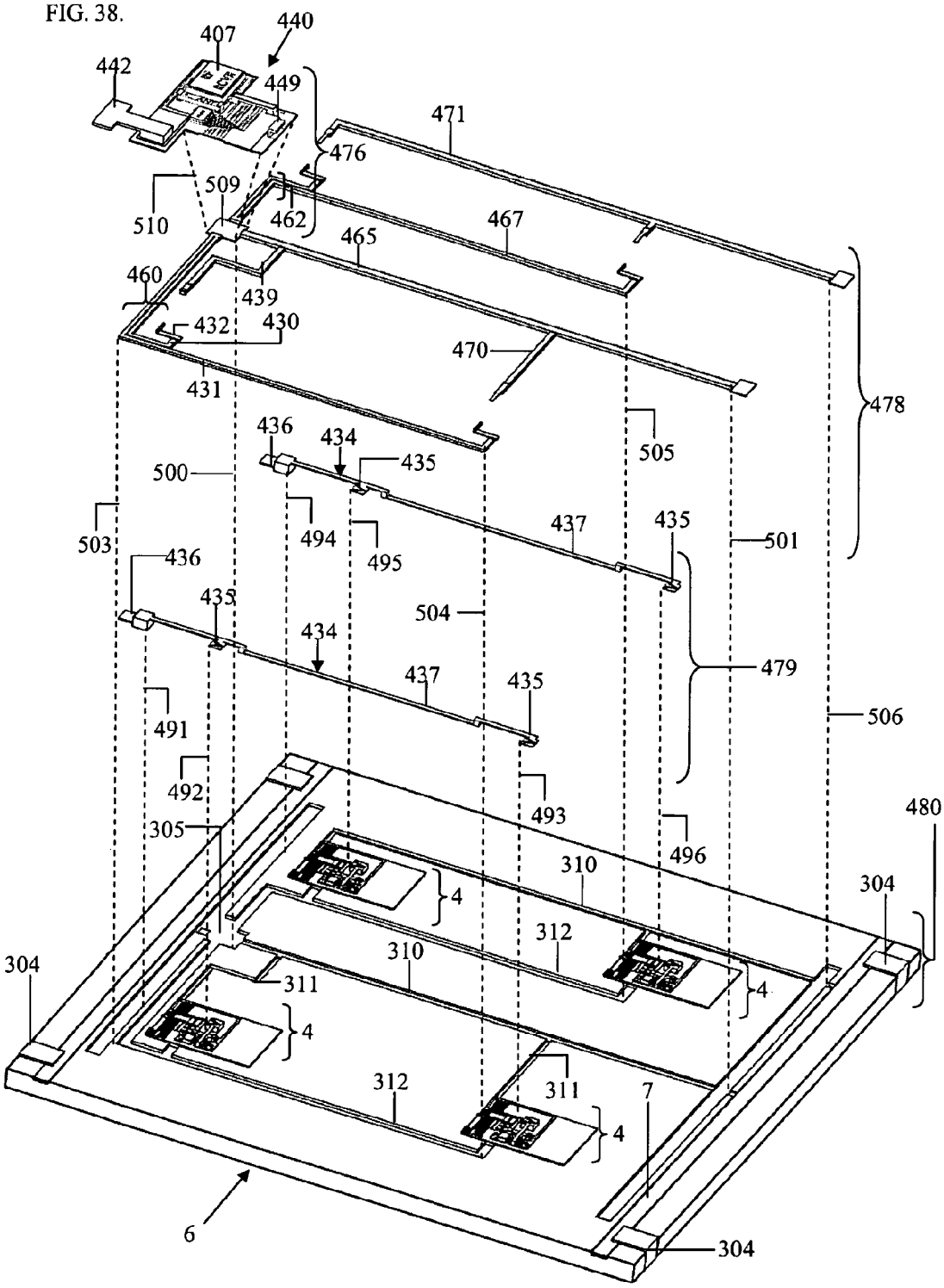
FIG. 38 is a perspective view shown from the backside of a tile material illustrating the embedding process for the case where low power controlling elements are remotely located in a preformed tile cavity separated substantially from the embedded light distributing engines themselves.
Figure 39:
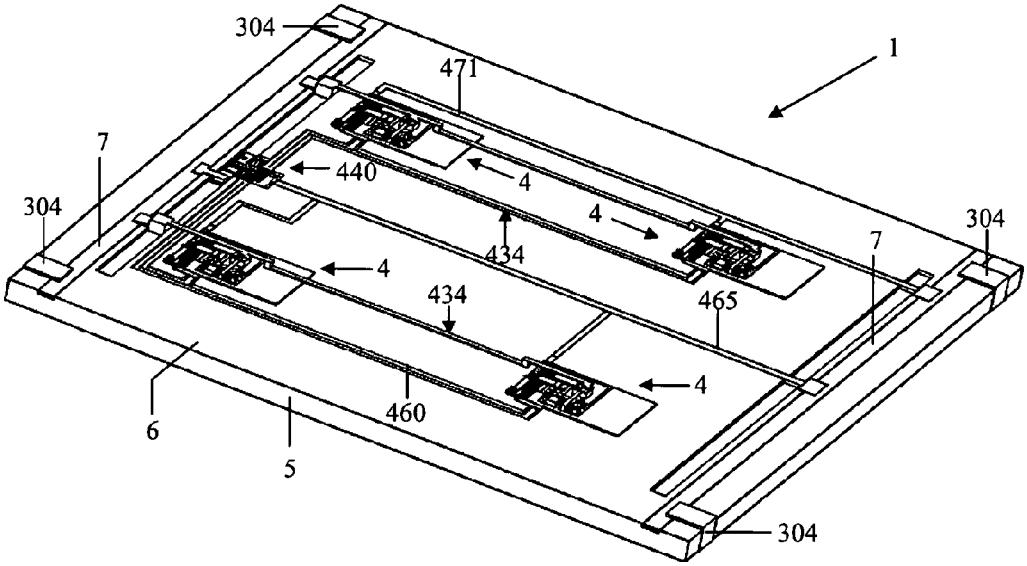
FIG. 39 is a perspective view of the tile illumination system of FIG. 38 as viewed from the backside of the tile material involved with all embedded elements and connections in place.

FIGS. 38 and 39 are perspective views shown from the backside of a tile material 6 illustrating the embedding process for the case where low power controlling elements 440 are remotely located in a preformed tile cavity 305 separated substantially in distance from the embedded light distributing engines themselves. These views illustrate the embedding process for the second engine power control option described above, embedding (and centralizing) the tile's low power controlling elements 440 remotely in a preformed tile cavity 305, and connecting them with embedded wiring members (460, 462, 465, 437, 470 and 471) to the corresponding higher-power switching elements localized within each individual light-distributing engine 4 in embedded separately in the tile material 6.

FIG. 38 is exploded in four layers, low power electronic control circuit layer 476 (which is shown in magnified scale for better viewing) with circuit element 440, control wiring layer 478 with circuit elements (460, 462) and ground straps (437, 465, 471), voltage delivery layer 479 comprising two identical voltage delivering conducting straps 435, and tile base layer 480 with its previously embedded light distributing engines 4, DC power busses 7 and power buss connectors 304.

One illustrative embedding sequence is provided as an example. Voltage delivery layer 479 is embedded in ceiling tile 6 as voltage straps 434 are lowered into place and embedded (as shown in FIG. 35), one at a time, along guide lines 491-493 and 494-496. As this is done, connector block 436 makes electrical contact with DC voltage buss 7 (via lines 491 and 494) and with the four voltage-delivery electrodes 435, which make electrical contact with each light engine's DC voltage electrode 394 (via lines 492, 493, 495 and 496). Ground strap 465 and ground extensions 439 and 470 are lowered into receiving slots 310 and 311 in tile 6 along guidelines 500 and 501 and embedded. The two control circuit wiring elements 460 and 462 are lowered into their respective slots 312 in ceiling tile 6 along guidelines 503-505 and embedded. Ground strap 471 is lowered into receiving slot 310 along guideline 506 and embedded. And, power control element 440 is embedded in cavity area 305 of tile 6 on top of receiver plate 509 of ground strap 465, lowering its illustratively magnified view along guidelines 510.

FIG. 39 is a perspective view of the tile illumination system 1 shown in FIG. 38 in accordance with the present invention as viewed from the backside of tile 6 with all embedded elements and connections in place.

Figure 40:
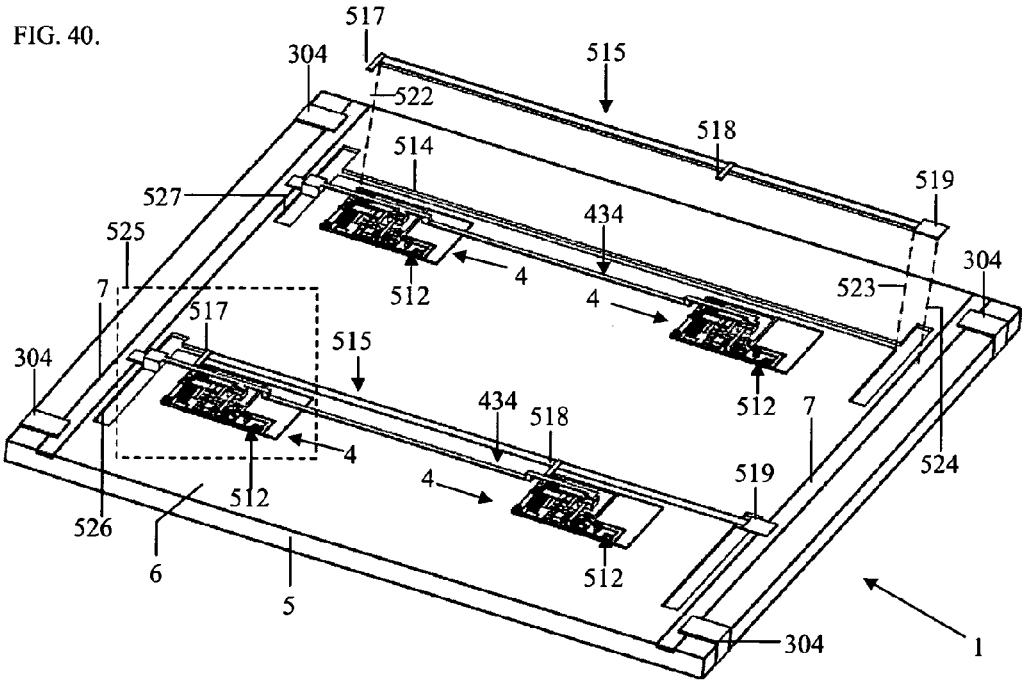
FIG. 40 is a perspective view of a closely related embodiment to the illumination system of FIG. 39 also viewed from the backside of the tile material involved, that has all necessary power controlling electronics components embedded on the backside of each light distributing engine.

FIG. 40 is a perspective view of a closely related embodiment of illumination system 1 according to the present invention, also viewed from the backside of tile 6, that has all necessary power controlling electronics components embedded on the backside of each light distributing engine 4, as in the third embedding option described above. The light distributing engines 4 shown in this variation are those illustrated previously in FIGS. 30 and 31 wherein signals from Master Controller 40 are interpreted by a local RC demodulating circuit 512 arranged to sample high-frequency digital modulation imposed on the DC voltage supply. Remote cavity 305 and its associated wiring slots in the body 5 of tile 6 have been eliminated, simplifying the tile's backside interconnection layout. The two illustrative DC voltage straps 434 remain, delivering engine voltage to the four embedded engines, but two new ground wire slots 514, and two new ground straps 515 (one embedded and one exploded) have been added. Ground connector tabs 517 and 518 are included to make electrical connection with ground lines 392 on each light distributing engine 4, and buss connector 520 is included to make electrical connection with ground side voltage buss 7. The parallel DC voltage and ground circuits implicit in straps 434 and 515 are analogous to the simple embedded wiring elements shown more schematically above, as for example in FIGS. 3A, 3B, 3L and 3M.

The two ground straps 515 are embedded after first embedding the four light distributing engines 4, lowering them as illustrated in FIG. 40 along guidelines 522, 523 and 524 into receiving slots 514 preformed in the body 5 of tile 6.

Figure 41:
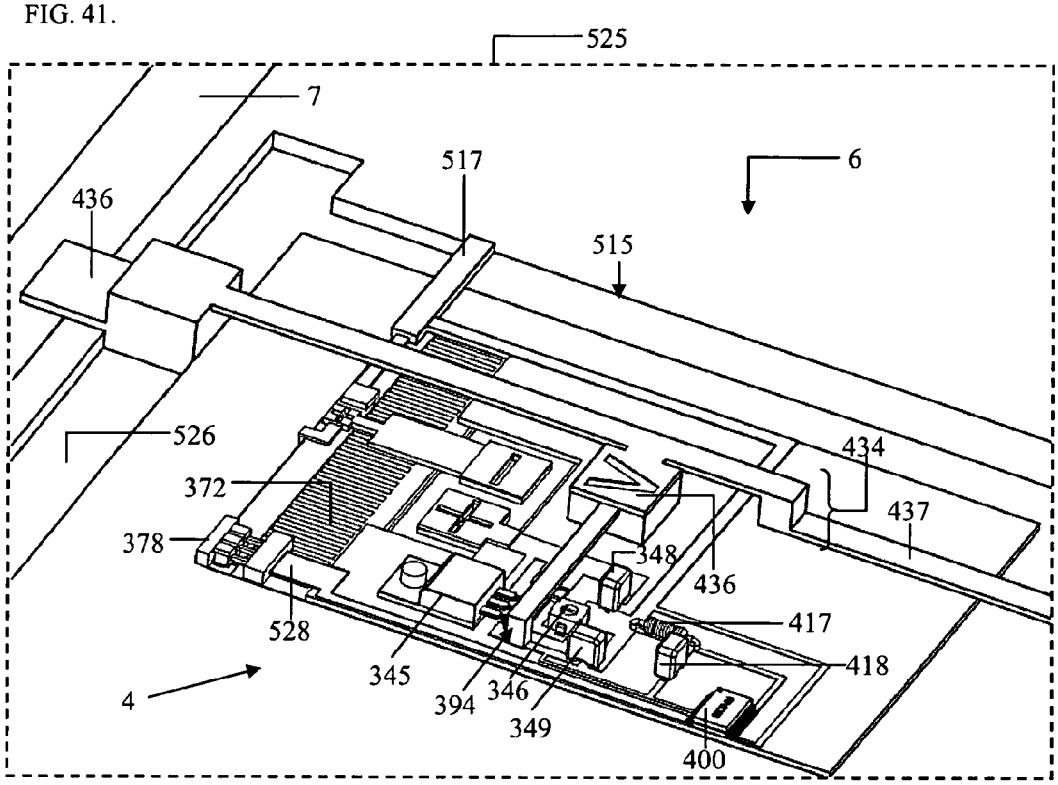
FIG. 41 is a magnified perspective view of a region in the lower left corner of FIG. 40 showing one of the four embedded light distributing engines, its voltage connection straps, its ground connection straps, and its embedded circuitry.

FIG. 41 is a magnified perspective view of the region 525 in FIG. 40 showing one of the four embedded light distributing engines 4 (lower left), its voltage connection straps (434), its ground connection straps (515), and its embedded circuitry (e.g., 345, 346, 348, 349, 400, 417, and 418). This magnified view is similar to the one shown previously in FIG. 35, but shows inclusion of demodulating power control elements with the engine, and the embedding of a simpler ground strap 515. In this example, the demodulated gate control signals are sent out of IC 400 along control circuit 528 and through connector 378 to the embedded MOSFET current switching branches beneath.

Thus far, the process of embedding light distributing engines 4 of the present invention has been illustrated as being manifest entirely from the backside of tile 6. In some cases, it may be equally preferable, as in the two-stage tile embedding process set forth in the process flow diagram of FIG. 9, to embed only the engine's electronic chassis plate 530 from the backside of tile 6, with the remaining light distributing engine parts 271 and 273 being embedded from the opposing (floor) side of tile 6.

Figure 42:
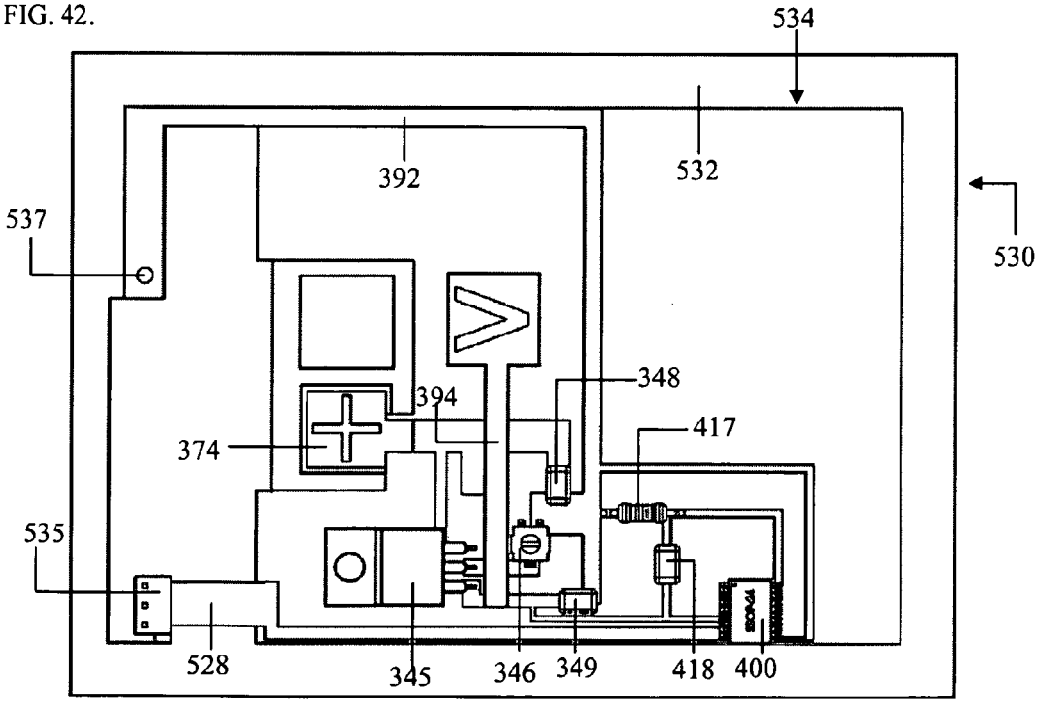
FIG. 42 is the top view of an illustrative chassis plate portion of a two-part embeddable light distributing engine according to the present invention, configured to hold all the engine's low power electronic control components.

FIG. 42 is the top view of the illustrative chassis plate 530 portion of a two-part embeddable light distributing engine 4 according to the present invention, configured to hold all the engine's low power electronic control components. Chassis plate 530 is embedded into the backside of tile 6, and contains mechanical attachment means (not shown) for the light generation portion of the engine that's embedded from the opposite (floor) side of tile 6. The version as shown in FIG. 42 utilizes practically the same elements as were shown illustratively in the one-part engine layout of FIG. 41. Mechanical support for tile embedding is provided by chassis frame 532, which includes an attached circuit layer 534 similar to circuit 389, as was shown in FIGS. 30 and 31 (and alternatively in FIGS. 24, 25, 27, 28, and 29). Circuit layer 534 includes voltage regulation elements 345, 346, 347 (hidden) and 348, a control signal demodulation means (RC elements 417 and 418 plus IC 400), DC voltage connection-bridge 394, (LED) light emitter electrode connector 394, gate control circuit 528, its associated three-pin connector block 535, ground line 394, and ground connector 537.

Figure 43:
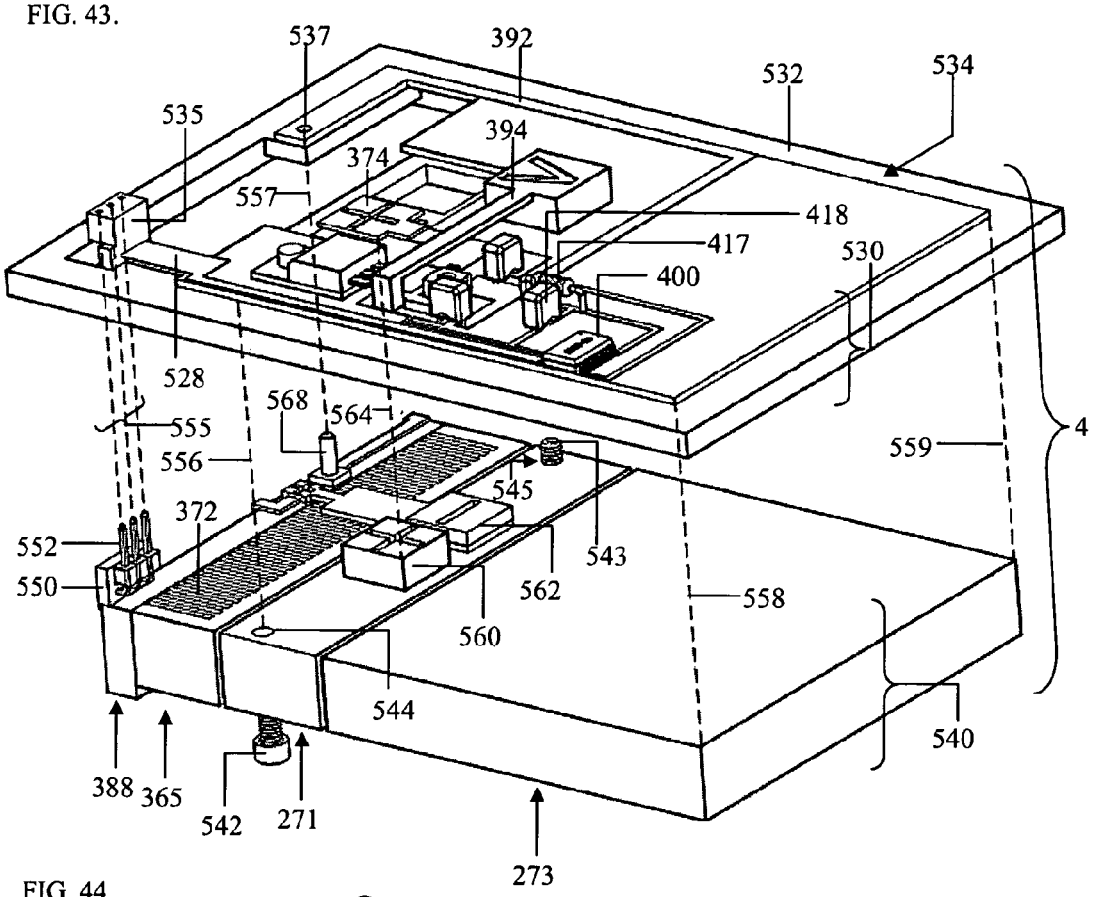
FIG. 43 is an exploded perspective view showing the working relationship between both parts of this illustrative two-part light-distributing engine of the present invention.

FIG. 43 is an exploded perspective view showing the working relationship between both parts of this illustrative two-part light distributing engine 4: the electronic chassis plate 530 of FIG. 42 and the high power light-distributing portion 540 (including parts 373, 271 and 273 as illustrated previously in FIGS. 24 and 25). Two mounting screws (542 and 543) and two corresponding recessed through holes (544 and 545) are added to light emitter portion 271 as means of binding the two parts of this variation together via two corresponding attachment holes 546 and 547 (both hidden) in the underside of chassis plate 530. Control voltages are carried by gate control circuit 528 through connector block 535 and routed to high power current switching module 388 by corresponding connector block 550 and its connector pins 552, which slide into connector block 535 as the two engine halves are brought together along guidelines 555-559. Positive electrode terminal 560 of LED light emitter 271 makes good electrical contact with positive output connector 374 from the voltage regulation components on chassis plate 530 as the two elements are brought together along guideline 557. Access to system ground is provided by connector pin 568 and its mating connector element 537 and its external connection to the tile system's ground buss.

Figure 44:
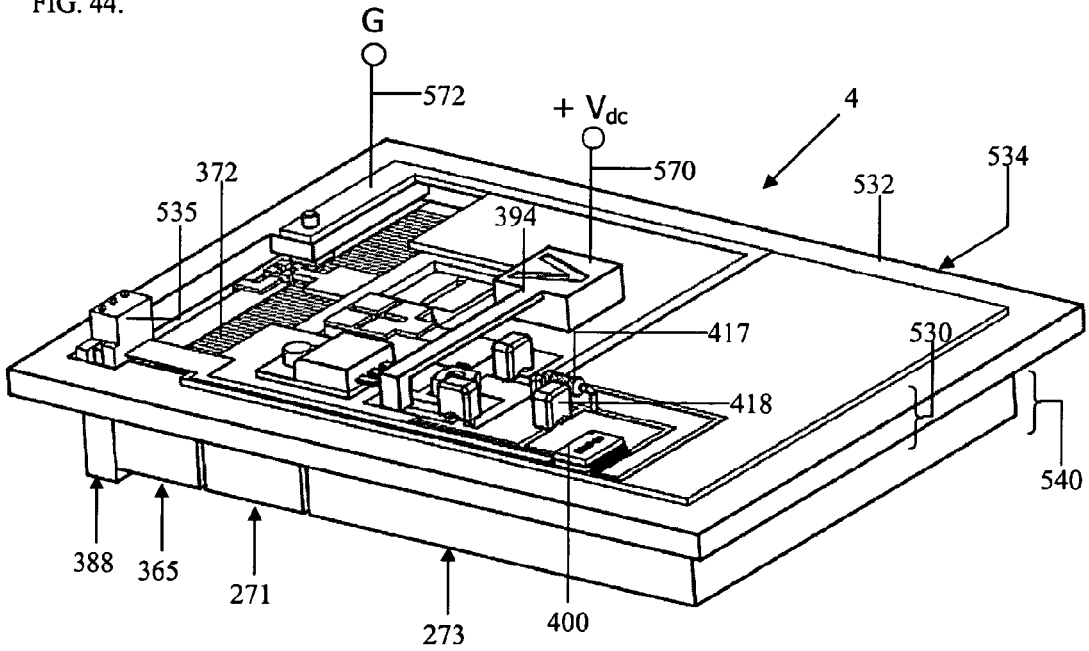
FIG. 44 shows a perspective backside view of the two-part light-distributing engine of FIG. 43 with its two halves attached.

FIG. 44 shows a perspective backside view of the two-part light-distributing engine 4 of FIG. 43 with its two halves 540 and 530 attached.

Figure 45:
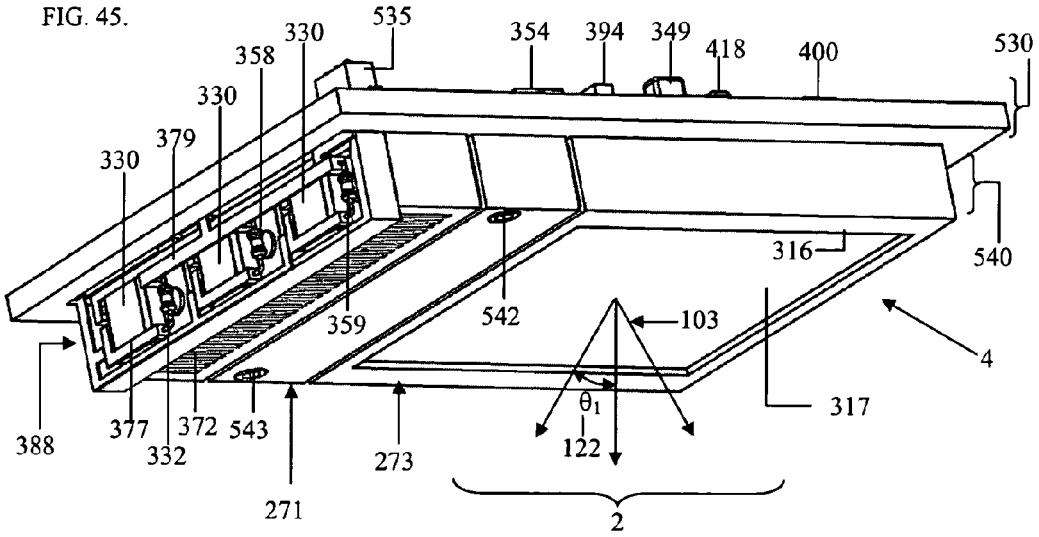
FIG. 45 shows a perspective floor-side view of the two-part light-distributing engine 4 of FIGS. 43 and 44.

FIG. 45 shows a perspective floor-side view of the two-part light-distributing engine 4 of FIGS. 43 and 44. FIG. 45 further shows this perspective view from the exposed backside of high power current controlling element 388, which was illustrated in greater detail through the examples in FIGS. 22-23. A multiplicity of light beams 103 having limited angular extent 122 ($+/-\theta_1$ in the meridian illustrated; $+/-\theta_2$ in the orthogonal meridian) are distributed evenly over aperture 317 within edge boundaries 316 by light distributing optic 273 when voltage source 570 and path to ground 572 are provided to corresponding contact points on chassis plate 530 as shown in FIG. 43.

The first step in this alternative two-stage tile system manufacturing process is the forming of an illustrative 24"×24" tile 6 similar to that shown in FIGS. 11-12, but one that contains the corresponding embedding details and interconnectivity features required by the two-part engines of this variation of the present invention. Just as with the one-stage manufacturing process flow illustrated in FIGS. 9, and 11-41 above, this tile forming step can occur either during the tile forming process itself or as a post-forming process (as in stamping, embossing, punching, machining, drilling and the addition of pre-molded inserts).

Figure 46:
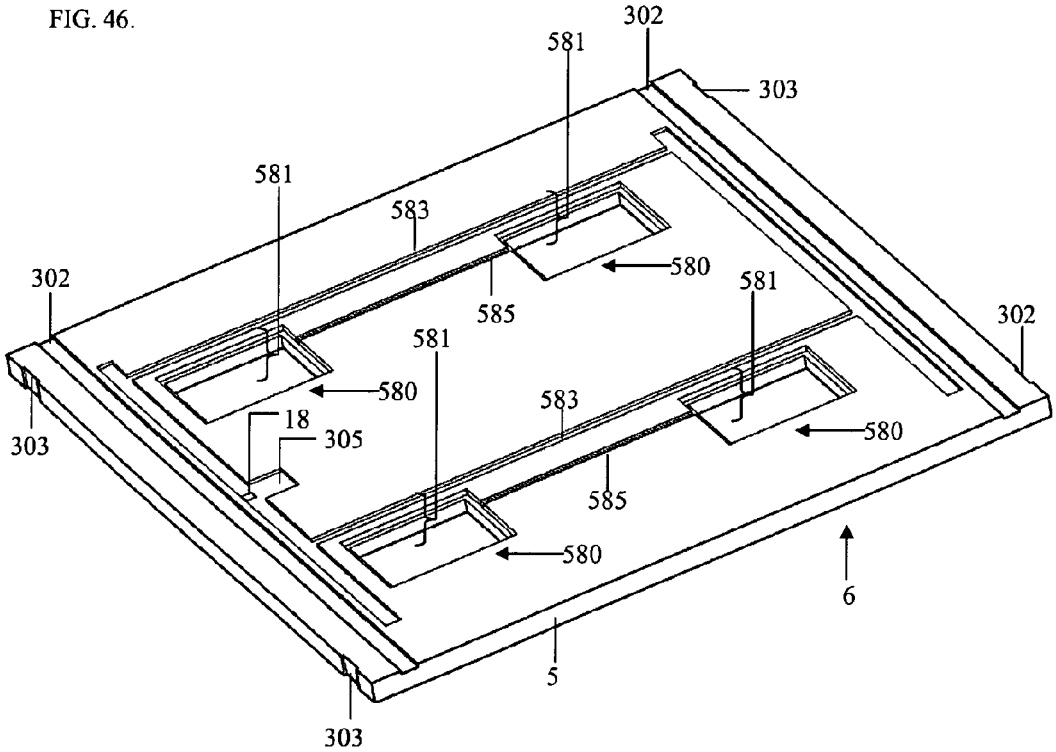
FIG. 46 is a perspective view of the backside of an illustrative tile material after its production with structured embedding cavities formed with internal features that facilitate the two-part backside embedding process.

FIG. 46 is a perspective view of the backside of an illustrative tile material after its production with structured embedding cavities 580 formed with internal features 581 that facilitate the two-part backside embedding process, in this example, illustrating incorporation of four electronic chassis plates 530, as was shown in FIGS. 43-45. The perspective view of FIG. 46 also shows the production of embedding slots 583 and 585 facilitating incorporation of interconnection ground straps similar to 515 and interconnection voltage straps similar to 434, both as previously described in FIG. 40. Additional slots and features are provided, as in FIG. 11, 302 for DC power delivery busses 7, 303 for power buss connectors 304, 305 indicating an optional cavity for embedding remotely located electronics (as in the examples above) and an optional through hole 18 enabling optical signals to pass through tile 6 from the floor space below.

Figure 47:
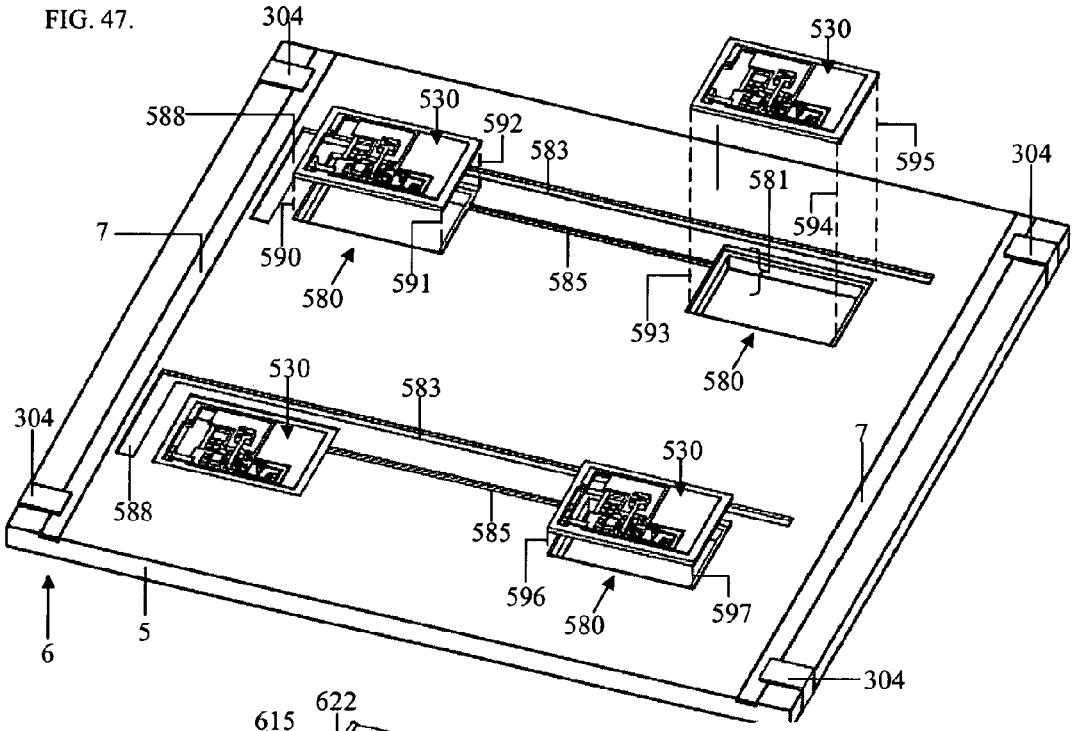
FIG. 47 is an exploded perspective view illustrating a first series of backside embedding steps, as performed during the two-stage tile manufacturing process of FIG. 9.

FIG. 47 is an exploded perspective view illustrating a first series of backside embedding steps, as performed during the two-stage tile manufacturing process of FIG. 9. The optional interconnection slots 305 and 18 shown previously in preformed tile 6 of FIG. 46 have been simplified (and/or eliminated) as 588 to better suit the present example of FIG. 47. DC power busses 7 and power connectors 304 are embedded first, and shown as such, as illustrated earlier in FIGS. 13-14. Following this, each of the four illustrative electronic chassis plates 530 are embedded securely in their corresponding receiving structures 581 provided for that purpose within each embedding cavity 580 along the respective guidelines 590-597 as shown. The electronic chassis plates 530 in this illustration are shown symbolically. For greater resolution of the implicit details, see the magnified illustrations in FIGS. 43-45.

Optionally, the entire light distributing engine 4, chassis plate 530 and high power light-distributing portion 540 being attached together as one separable unit, may be embedded from the backside in the manner shown for supply situations suited to this alternative. The advantage of the two-part light distributing engine 4 remains nonetheless, as it facilitates removal, replacement, change-out or repair of the high power light-distributing portion 540 of any so manufactured tile illumination system 1 of the present invention without need to work above a ceiling tile grid or behind a wall tile installation.

Figure 48:
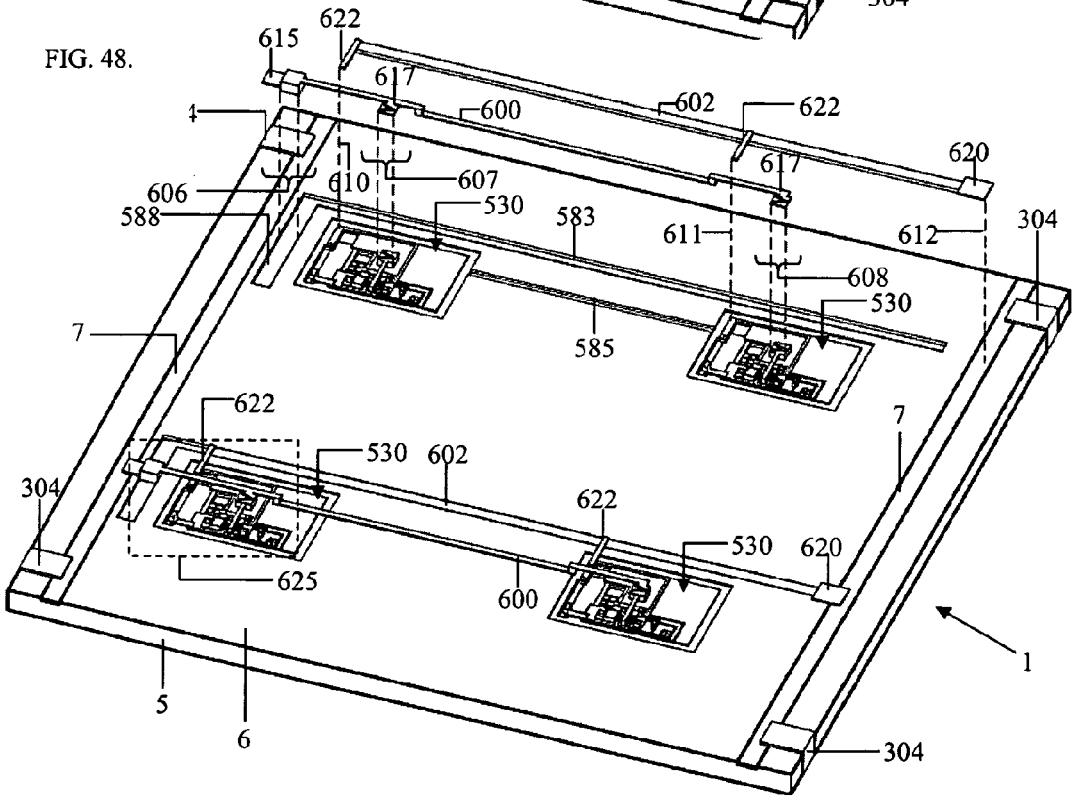
FIG. 48 is an exploded perspective view similar to that of FIG. 47, showing the completely embedded electronic chassis plates and the second set of backside embedding steps in the two-stage tile manufacturing process of FIG. 9.

FIG. 48 is an exploded perspective view similar to that of FIG. 47, showing the completely embedded electronic chassis plates 530 and the second set of backside embedding steps in the two-stage tile manufacturing process of FIG. 9. The electronics chassis plates 530 used in this example (as in FIGS. 42-44) contain simple RC-type demodulating circuitry that extracts digital light emitter control signals superimposed on the DC voltage supplied (see the enlarged versions in FIGS. 30-31). Equivalently, the demodulation methods of FIGS. 26-29 achieve the same result using different demodulation means (RF and IR). DC power is applied to each electronic chassis plate 530 through built-in wiring straps 600 and 602 that are connected to external sources of DC voltage and system ground. The exploded DC voltage strap 600 is embedded into the body 5 of tile 6 via guidelines 605-608, whereas the exploded ground access strap 602 is embedded via guidelines 610-612. Electrical contact is made by voltage strap 600 to voltage delivery buss 7 with connector tab 615 and to electronic chassis plate 530 with connector tab 617. Electrical contact is made by ground strap 602 to ground side voltage delivery bus 7 (on right) with connector tab 620, and to the ground line on each electronic circuit plate 530 with connector 622.

Figure 49:
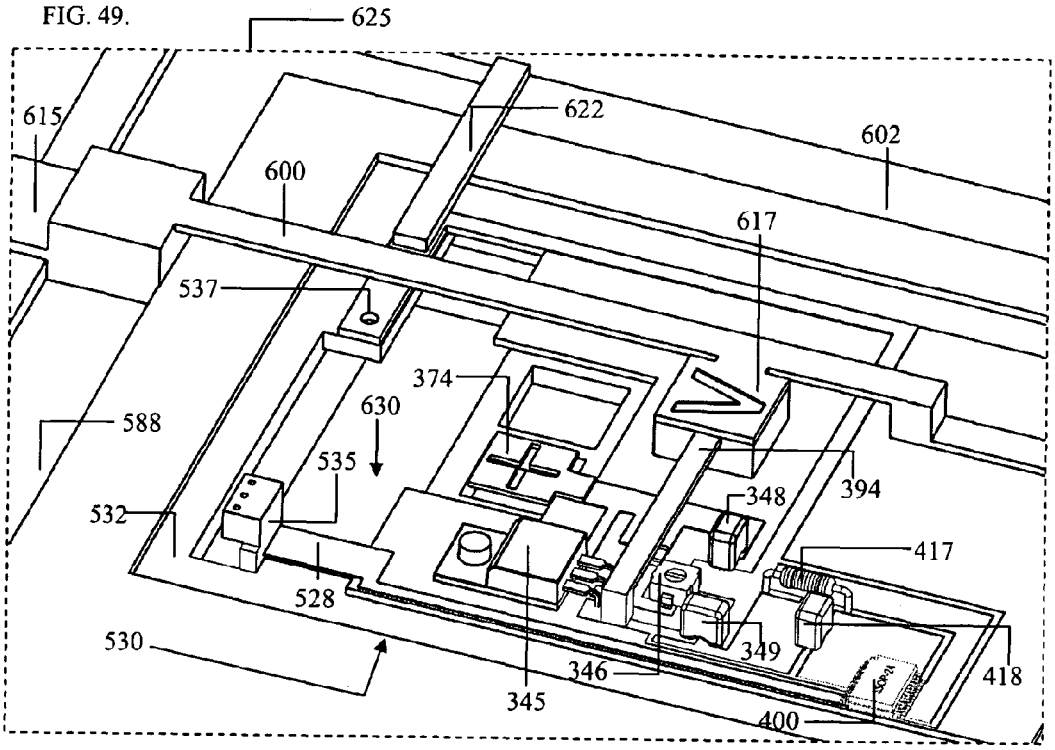
FIG. 49 is a magnified backside perspective view that clarifies implicit embedding details unable to be viewed distinctly in the lower left hand region of FIG. 48 because of the miniature part sizes involved.

FIG. 49 is a magnified backside perspective view of the lower left-hand region 625 (dotted) that clarifies implicit embedding details unable to be viewed distinctly in FIG. 48 because of the miniature part sizes involved. Dotted region 625 in this example covers about a 3"×4" area, which is a small fraction of the illustrative tile's 24"×24" surface area. All the elements shown have been described previously, with the exception of 630 which points out the opening in electronic chassis plate 530 that allows air flow to pass through the heat sink fins 372 of the companion high power fight distributing portion 540, still to be embedded and attached.

Figure 50:
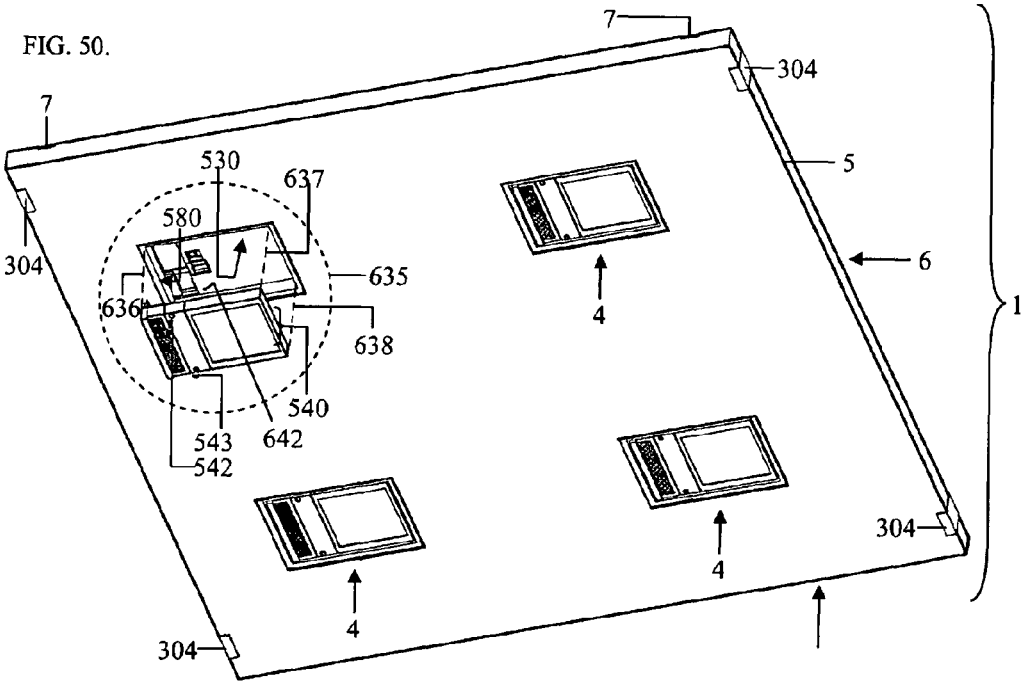
FIG. 50 is an exploded perspective view of tile illumination system 1 of FIG. 48 as seen from the floor below showing the process of embedding the high power light distributing portion of the light distributing engine involved.

FIG. 50 is an exploded perspective view of tile illumination system 1 of FIG. 48 as seen from the floor below showing the process of embedding the high power light distributing portion 540 of light distributing engine 4. In this illustration, three high power light distributing portions 540 have been embedded by prior attachment to previously embedded electronic chassis plates 530. A fourth light-distributing portion 540 is shown in exploded region 635 (dotted), just prior to its embedding and attachment. This light-distributing portion 540 is raised into structured cavity 580 (see FIG. 46) upwards along guidelines 636, 637, and 638. In addition to the physical attachment of portion 540 to portion 530, several electrical interconnections are made as well, as interconnection elements on portion 540 are mated with counterpart interconnection elements on portion 530. Attachment screws 542 and 543 and one of their two attachment holes 642 in chassis plate 530 are shown for example (e.g., 4-40 socket head cap screw, 14 mm tip-to-tail, 2.85 mm through hole). Another means of mechanical attachment uses spring clips.

Figure 51:
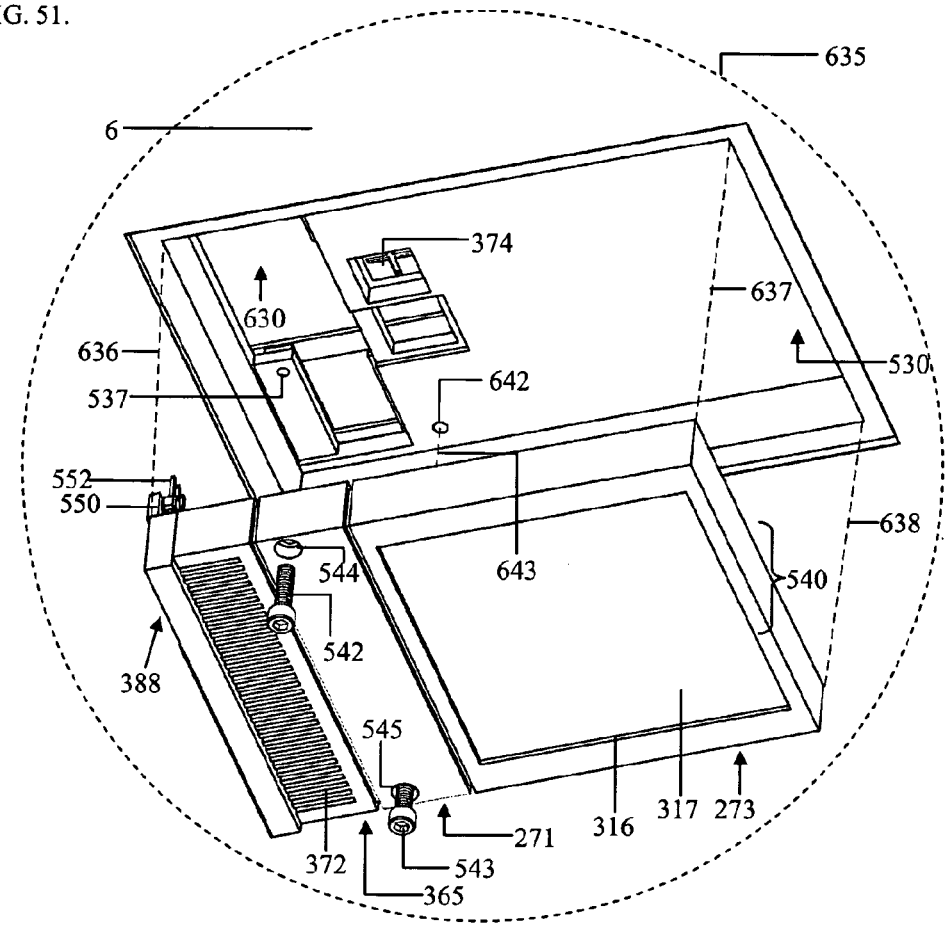
FIG. 51 is a magnification of exploded region shown in the perspective view of FIG. 50, revealing the embedding and interconnection details described with greater visual clarity.

FIG. 51 is a magnification of exploded region 635 as shown in the perspective view of FIG. 50, revealing the embedding and interconnection details described with greater visual clarity. Magnification 635 shows DC power connector 374 on chassis plate 530, guideline 643 along which screw 543 travels during insertion in attachment hole 642, gate control voltage connector pins 552 and connector block 550 on high power switching element 388, and ground connecting receptacle 537 on chassis plate 530. Further details on the attachments between elements 540 and 530 were shown in FIG. 43 including guidelines 555 followed by the path taken by connector pins 552 as they route into counterpart connector receptacles 535 on chassis plate 530, and guideline 557 followed by ground connecting pin 568 on portion 540 as it mates with ground connecting receptacle 537. It should be noted that in all instances in which screw type fasteners have been shown in the described embodiments that snap type fasteners could serve equally as well.

Figure 52:
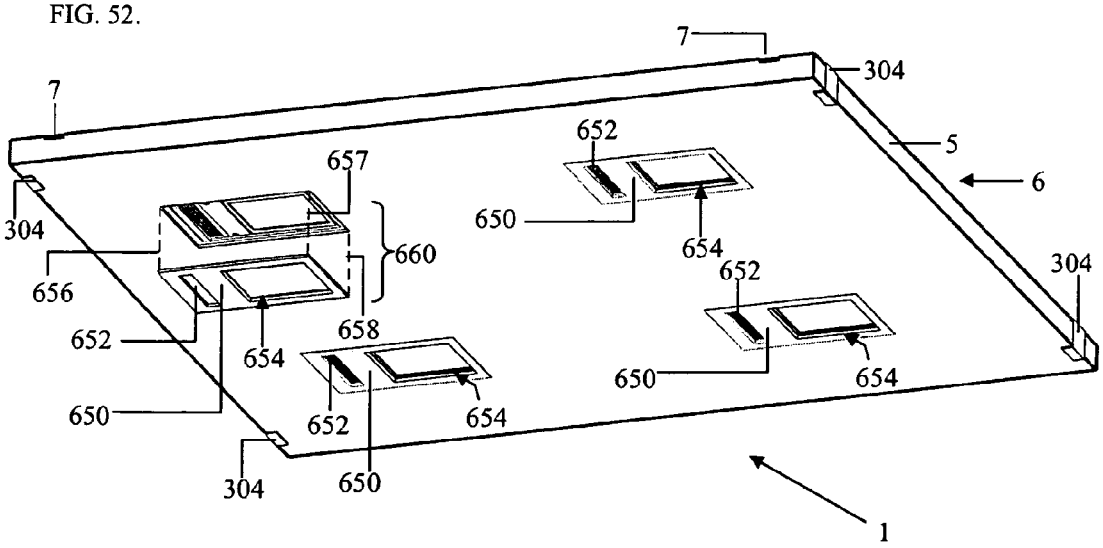
FIG. 52 is a floor side perspective view similar to that shown in FIG. 50, but in this instance illustrating the embedding of cover plates with airflow slots and illumination apertures generally matching the size of aperture boundaries on the light distributing optic involved.

FIG. 52 is a floor side perspective view similar to that shown in FIG. 50, but in this instance illustrating the embedding into the body 5 of ceiling tile 6 of decorative cover plates or fascia 650 with airflow slots 652 and illumination apertures 654 generally matching the size of aperture boundaries 361 on light distributing optic 273. Illumination aperture 654 may further comprise air, a clear plastic (or glass) sheet, or a set (e.g., stack) of one or more light spreading sheets such as lenticular lens sheets, micro lens sheets, sheets with light scattering haze, diffractive diffuser sheets, holographic diffuser sheets, reflective polarizer sheets, volume diffuser sheets, surface diffuser sheets, textured diffuser sheets or black-matrix micro-lens (beaded) sheets. Fascia's 650 are embedded in the body 5 of ceiling tile 6 along guidelines 656, 657 and 658, as shown in exploded detailed 660. The backside of fascia 650 may be attached to ceiling tile 6 with push pins, with spring clips, by press-fit with the boundaries of tile cavity 580 or with its detailed structure 581 (see FIG. 46), or it may be attached to mechanical attachment features provided for on light distributing portion 540.

Figure 53:
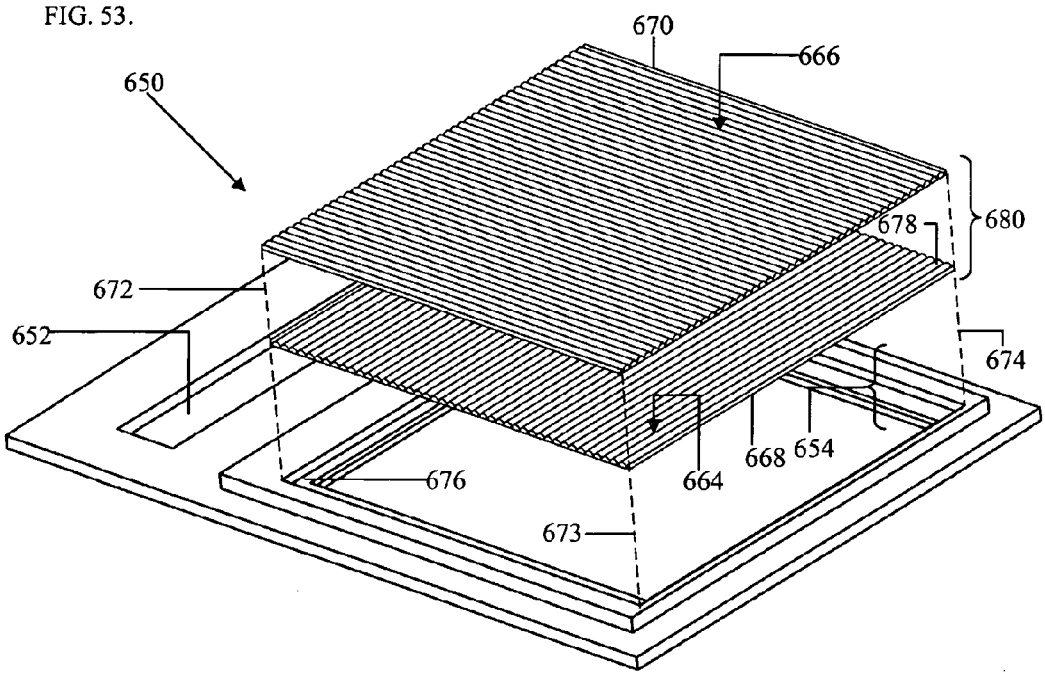
FIG. 53 shows an exploded perspective view of the backside of an illustrative fascia that includes two orthogonally oriented lenticular lens film sheets within its illumination aperture.

FIG. 53 shows an exploded perspective view of the backside of an illustrative fascia 650 (or cover plate) that includes, as one particular example, two lenticular lens film sheets 664 and 666 within its illumination aperture 654. In this example, lenticular films sheets 664 and 666 are arranged with their lenticule axes 668 and 670 orthogonal to each other, and their lenticule vertices facing away from the floor beneath as shown, to provide a particular degree of additional angle spreading to the illumination 2 and its angular extent 122 emanating from aperture 317 of light distributing engine 4 as was shown, for example, in FIG. 45. Lenticular lens film sheets 664 and 666 are assembled into the fascia's illumination aperture 654 from the backside as shown along guidelines 672, 673 and 674, either as pre-die-cut film sheets or as a pre-assembled frame (not illustrated). Either way, the films (or their frame) are adhesively bonded (or glued) along their edges to fascia surface 676. In cases where there are two film sheets as shown in FIG. 53, the film sheets may be pre-bonded together. An exemplary point of bonding might be at one (or more) of their corners (e.g. 678). Alternatively to gluing, the films may be mechanically captured by either a second interlocking frame, said frame interlocking with fascia 650 and trapping the film(s) between the frame and fascia, or by addition of small retaining features (such as grooves or overhanging tabs) on the backside of fascia 650 that allow films to be slid in and out by hand or tool, but substantially retain the films while the fascia is being handled, installed, or uninstalled.

Figure 54:
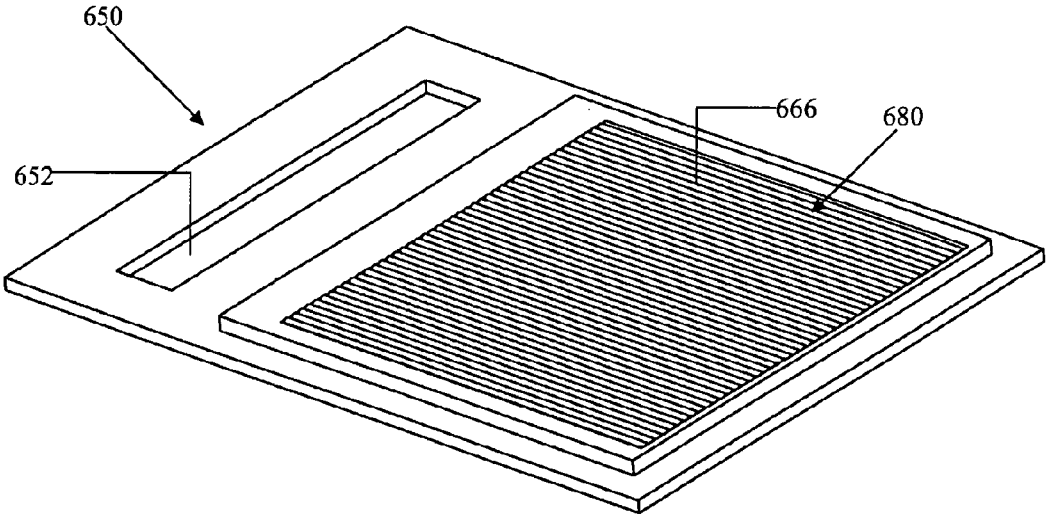
FIG. 54 shows a perspective view of a final arrangement of the illustrative fascia or cover plate in FIG. 53, post-assembly.

FIG. 54 shows a perspective view of a final arrangement of the illustrative fascia 650 in FIG. 53, post-assembly. Users of tile illumination systems 1 in accordance with the present invention are able to change the illumination pattern of any one, any group, or all of the illumination apertures at will by simply removing the fascia 650 from its tile cavity 580 and reinstalling another fascia 650 having another set of included films 680 with a different angle spreading effect, as described in U.S. Provisional Patent Application Ser. No. 61/024,814 (International Stage Patent Application Serial Number PCT/US2009/000575) entitled Thin Illumination System. In some applications it may be preferable for the angle changing films like 664 and 666 to be installed as a part of the output aperture of light distributing engine 4 rather than as part of fascia 650, which may instead have other output films 680.

Figure 55:
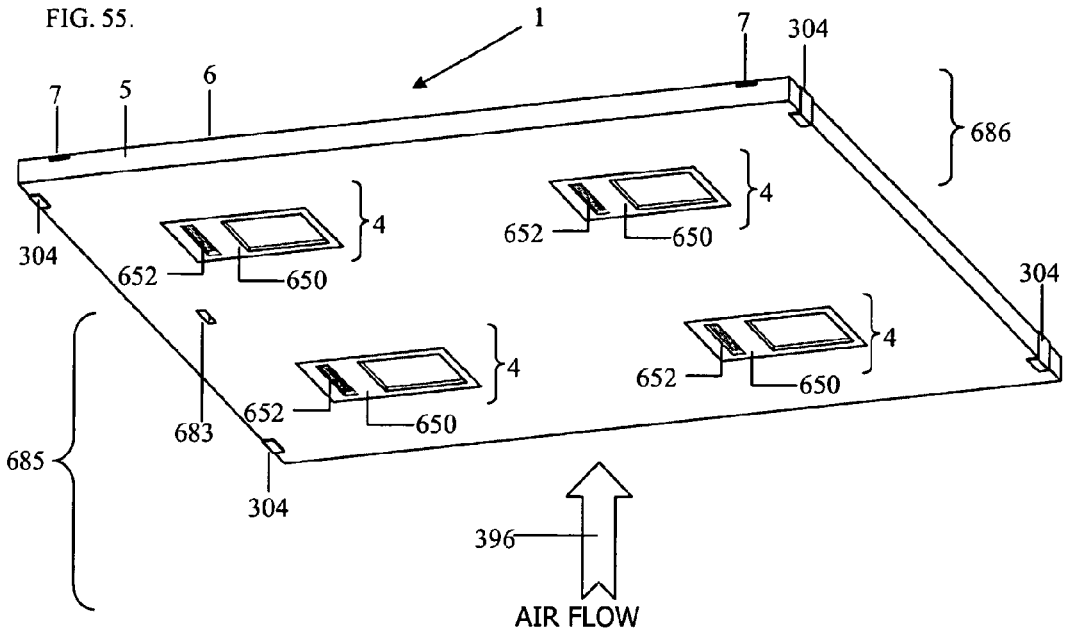
FIG. 55 is a perspective view of the fully embedded tile illumination system 1 of FIG. 52 as seen from the floor space below.

FIG. 55 is a perspective view of the fully embedded tile illumination system 1 of FIG. 52 as seen from the floor space 685 below. Optional slots 652 enable ambient convective airflow 396 (as in FIG. 25) to pass from space 685 between tile 6 and the floor beneath through the four embedded light distributing engines 4 (and their heat extracting fins 372), to the utility (or plenum) space 686 above and beyond. Feature 683 is a variation on 18 (see FIGS. 11-14) to provide an optional means of pass through from floor space 685 for IR sensor information (e.g., for light level sensor signal delivery, for motion sensor signal delivery and/or for remote power switching signal delivery).

Figure 56:
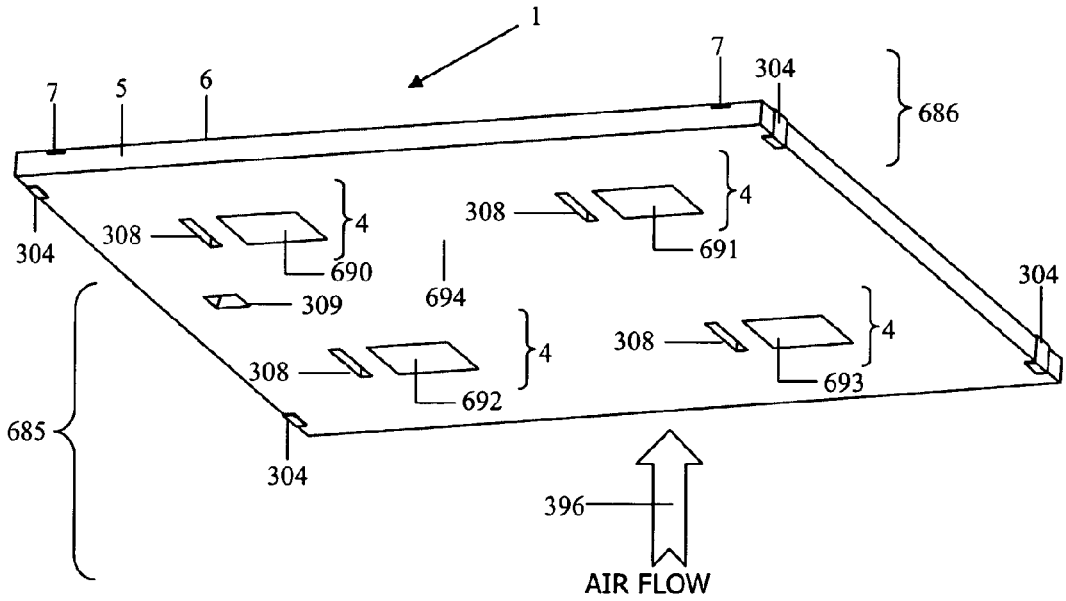
FIG. 56 is a perspective view of the fully embedded tile illumination system example of FIG. 40 as seen from the floor space below.

FIG. 56 is a perspective view of the fully embedded tile illumination system 1 of FIG. 40 as seen from the floor space 685 below. Optional floor side slots 308 in the body 5 of tile 6 enable ambient convective airflow 396 (as in FIG. 25) to pass from space 685 between tile 6 and the floor beneath through the four embedded light distributing engines 4 (and their heat extracting fins 372), to the utility (or plenum) space 686 above and beyond. Feature 309 is the floor side opening of through hole 18 (see FIGS. 11-14) to provide a different means of optional pass through from floor space 685 for IR sensor information (e.g., for light level sensor signal delivery, for motion sensor signal delivery and/or for remote power switching signal delivery). Aperture covering sheets 690-693, one per embedded engine, may contain light spreading or diffusing media as described above in FIGS. 53-54 that alter (or widen) the angular extent 122 and 123 ($\theta_1$ and $\theta_2$ as in FIGS. 1F, 4A-4B, and 16) that is otherwise characteristic of the particular embedded light distributing engine 4 positioned beyond. These covering sheets, which are optional, may contain different combinations of one or more of a clear glass (or plastic) sheet, a lenticular lens sheet, a micro-lens array sheet, a polarizing sheet, a diffusing sheet, a light diffracting sheet, a holographic diffuser sheet, a sheet with light scattering haze, a beaded black-matrix micro-lens sheet, a sheet having surface texture (and/or transparent color) matching the surface texture of the tile's plane surface 694. One preferable arrangement, as above, is that of a stacked combination of two lenticular lens sheets oriented with respect to each other such that their cylindrical element axes are substantially orthogonal, and with their respective cylindrical lenticules (i.e., cylindrical lens elements) being formed with a shape chosen to achieve the particular amount of angular spread in each output meridian (i.e., $\theta_1$ and $\theta_2$ as shown in FIGS. 1F, 4A-4B, and 16). Aperture covering sheets 690-693 may be contained within a bezel or frame so as to enable easy removal and replacement as a means of changing the particular illumination characteristic, as from a narrow set of beam angles 122 and 123, to selectively wider ones.

Figure 57:
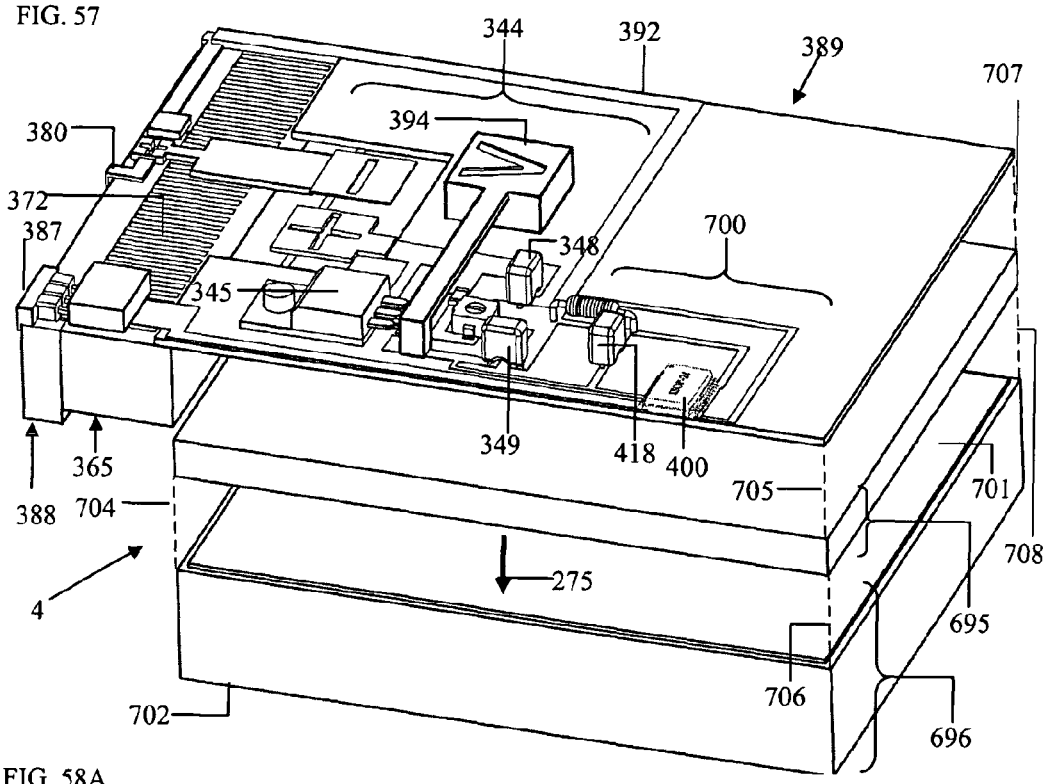
FIG. 57 illustrates, in exploded perspective view, a form having a co-planar arrangement.

The tile system examples provided in illustration of the present invention have thus far been based on the notion of embedding square or rectangular light distributing engines 4 (as in FIGS. 1B, 1D, 2D, 2E, 3C, 11-16, 21-35, and 38-56) into the body 5 of tile 6, as were summarized in the horizontally-stacked schematic cross-sections of FIGS. 4B-4C. In these examples, an LED light emitter 271 and a light distributing optic 273 are co-planar. While co-planar arrangements may be preferable in situations calling for light distributing engines 4 with the greatest possible thinness, an LED light emitter module 695 (similar to 271) may also be vertically stacked directly above a light distributing optic 696 (similar to 273) in accordance with the present invention, as in the schematic cross-section of FIG. 4A. FIG. 57 shows one example illustrating this form schematically in exploded perspective view. In this example, two groups of electronic power control components (voltage regulator group 344 as in FIG. 24 and demodulation component group 700 as in FIGS. 56-31) are positioned above light emitter module 695, and one group (current switching group 388 as in FIGS. 22-23) is positioned to the side. In applications requiring greater thinness, all the associated electronic components may be arranged so as to physically surround the thickness of light emitter 695 and light distributing optic 696. Moreover, other forms and shapes of heat sink element 365 may be incorporated beyond the one illustrated in FIG. 57, including for example, elements similar to 365 on all four sides of elements 695 and 696, and a heat spreading plate placed in between light emitter 695 and light distributing optic 696, as two examples. Heat spreading plates could also be located between light emitter 695 and circuit 389, and furthermore circuit 389 could be designed with open areas for a heat sink to protrude from that back of lighting element 695 through the open areas in the circuit, optionally with vertically oriented heat fins. Light emitter 695 provides light flows 275 (as in FIG. 4A) whether locally or evenly across an entrance aperture within face 701 of light distributing optic 696, and output illuminating beams 103 (not shown) emerge evenly across face 702. The elements attach to each other along guidelines 704-708. A few specific examples of this will be provided further below.

The schematic light distributing engine cross sections shown in FIGS. 4A-4C, however, are not limited only to such to square or rectangular forms. Equivalent examples of the present invention can be constructed embedding circular (i.e., disk shaped) light distributing engines 4.

Figure 58A:
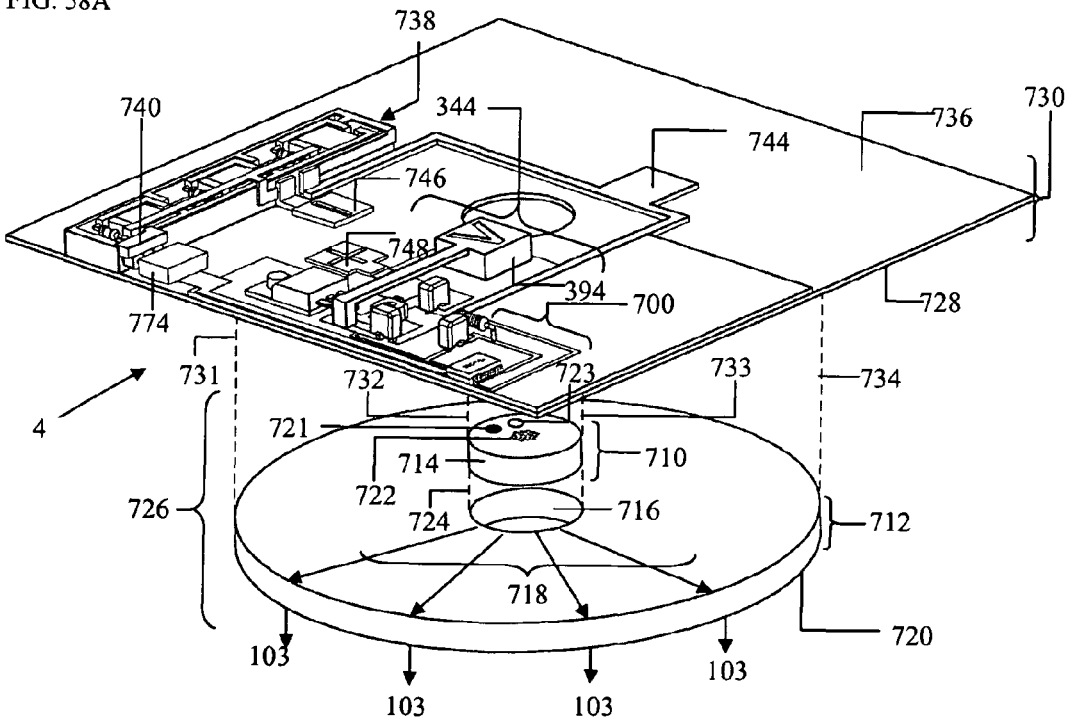
FIG. 58A is an exploded perspective view of an embeddable co-planar form of circular light distributing engine in accordance with the present invention derived from the schematic form of FIG. 4C by making a circular rotation of the entire light distributing engine system shown about the left hand edge 283 of light emitter 271.

FIG. 58A is an exploded perspective view of an embeddable co-planar form of circular light distributing engine 4 in accordance with the present invention that's derived from the schematic form of FIG. 4C by making a circular rotation of the entire light distributing engine system shown about the left hand edge 283 of light emitter 271 (also parallel to the system's z-axis 112), as has been described in U.S. Provisional Patent Application Ser. No. 61/024,814 (International Stage Patent Application Serial Number PCT/US2009/000575) entitled Thin Illumination System. Such a circular rotation produces the disk-like radial light emitter 710 at the center of a ring-like circular light distributing optic 712 as shown in FIG. 58A. Disk-like radial light emitter 710 contains an internal group of LED emitters or chips (not shown) that are arranged to emit light outwards in a radial fashion from cylindrical surface aperture 714. The radially emitted light from surface 714 passes immediately into the annular cylindrical ring aperture 716 of ring-like light distributing optic 712 as radial light flows 718 distributed substantially homogeneously throughout distributing optic 712. As radial light flows 718 pass-through distributing optic 712, they are extracted substantially evenly over the element's disk-like bottom surface 720 as illuminating output beams 103. Feature 722, which may be substantially larger than shown, attaches to the center of disk-like emitter 710 and serves as a thermally conductive heat extraction element arranged to remove heat from the LED emitters or chips located inside or on the periphery of disk-like emitter 710. Features 721 and 723 are positive and negative power terminals from internal light emitters, such as LED's (similar to electrodes 318 and 319 as in FIG. 15 discussed above for example).

Figure 58B:
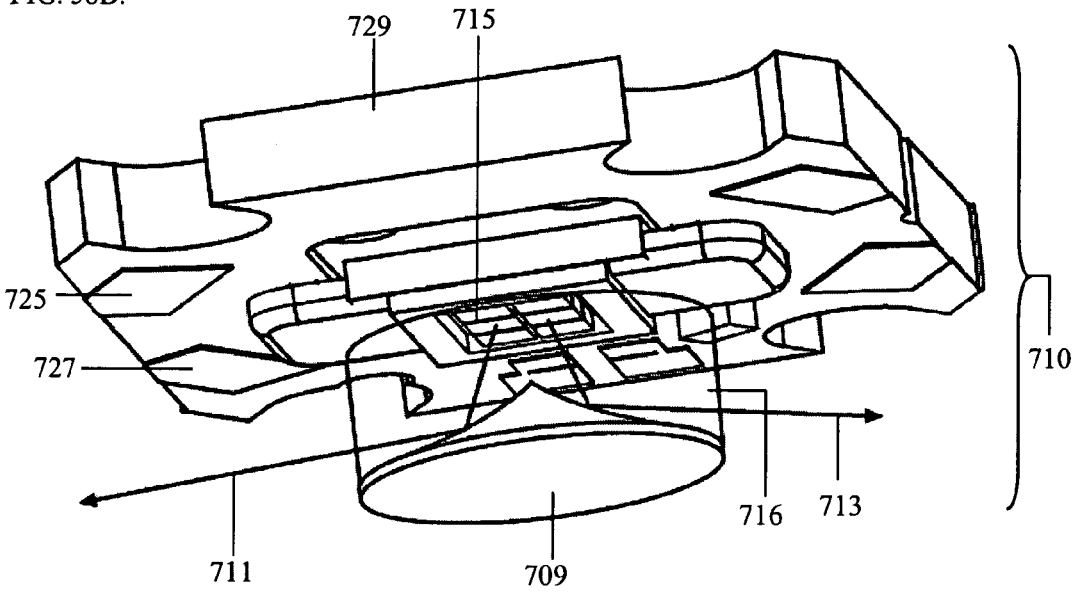
FIG. 58B is a perspective view of one example of a disk-like radial light emitter containing a conical reflector practiced in accordance with the present invention.

FIG. 58B is a perspective view of one example of disk-like radial light emitter 710 practiced in accordance with the present invention, as has been described in U.S. Provisional Patent Application Ser. No. 61/024,814 (International Stage Patent Application Serial Number PCT/US2009/000575) entitled Thin Illumination System, wherein a conically shaped reflecting element 709 is used to re-direct emitted light 711 and 713 from an internal group of LED emitters or chips 715 in a radial fashion through annular ring aperture 716 of ring-like circular light distributing optic 712. In this example, one of many possible commercial LED emitters 729, a variation of the six-chip OSTAR™ manufactured by Osram Opto-Semiconductor, with positive and negative power terminals 725 and 727 corresponding to equivalent elements shown generally in FIG. 58A as 721 and 723. Annular ring aperture 716 corresponds to the boundary of a clear (optically transparent) cylindrical polymeric medium, optically coupled to the polymeric medium immersing LED chips 715 and conically shaped reflecting element 709.

Figure 58C:
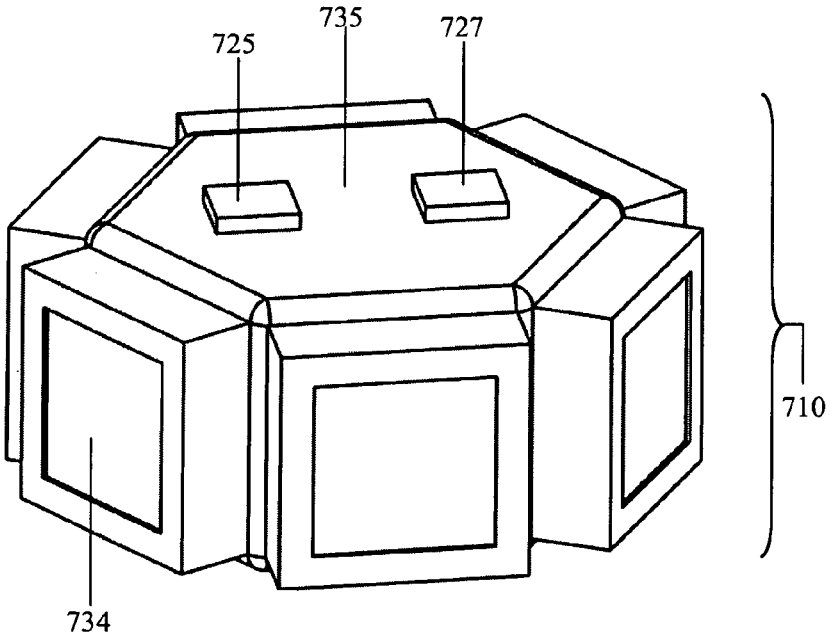
FIG. 58C is a perspective view of another example of a disk-like radial light emitter practiced in accordance with the present invention, having six discrete LED emitters (or chips) in a circular array.

FIG. 58C is a perspective view of another example of disk-like radial light emitter 710 practiced in accordance with the present invention, this having six discrete LED emitters (or chips) 734 attached electrically and thermally to heat sink element 735. Collective positive electrical electric power terminals 725 and 727 correspond to those shown in FIG. 58B. In this example, output light for the emitting ring shown radiates outward and through annular cylindrical ring aperture 716 of ring-like circular light distributing optic 712. Various embodiments like that of FIG. 58C, including variations in the number, shape, size, and arrangement of the emitters 734, are possible, with the common element of such embodiments being that the emitting apertures of the emitters 734 face substantially radially outward from the axis of rotation (or symmetry).

Figure 58D:
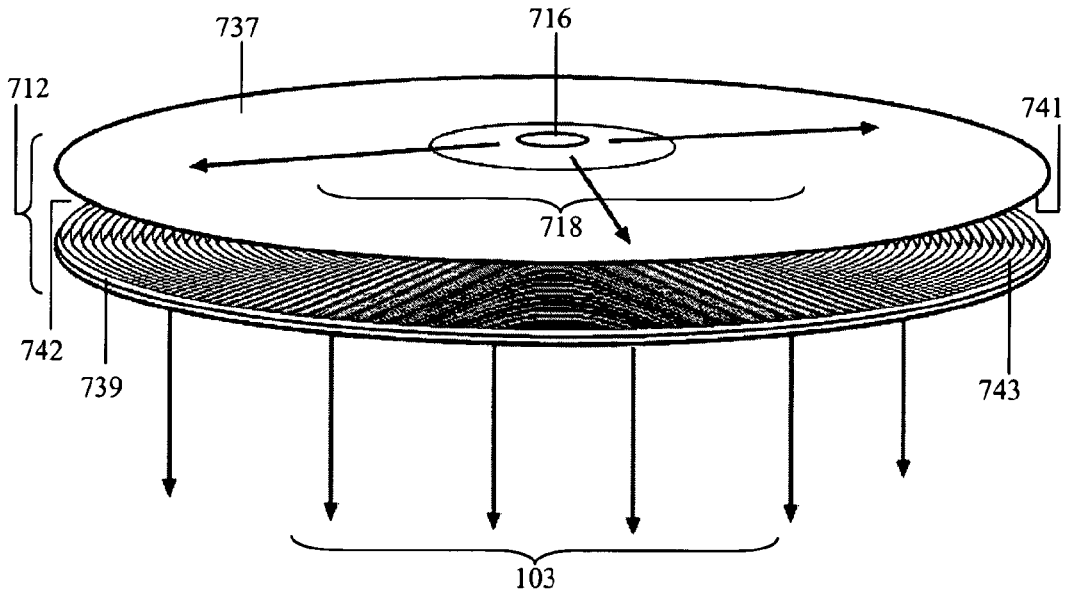
FIG. 58D is a perspective view of the constituent elements (circular light guiding disk and radially grooved refractive film) comprising a circular light distributing optic used in accordance with the present invention.

FIG. 58D is a perspective view of the two illustrative constituent elements of ring-like circular light distributing optic 712. In this example, the two constituent elements of distributing optic 712 are circular light guiding disk 737 having a mathematically shaped cross-sectional thickness, and radially grooved light redirecting film or sheet 739 made of optically refractive dielectric material, both as described in U.S. Provisional Patent Application Ser. No. 61/024,814 (International Stage Patent Application Serial Number PCT/US2009/000575) entitled Thin Illumination System. In accordance with the present invention, input light from radial light emitter 710 flows through annular ring aperture 716, propagates within circular light guiding disk 737 as light rays 718 by means of total internal reflection, escapes from light guiding disk 737 into air-gap 742, and is redirected as output light 103 by the refractive action of radial grooves 743 of radially grooved light redirecting sheet (or film) 739. In best practice of the present invention, the radial rings 743 of each radial groove in radially grooved light redirecting sheet (or film) 739 are in close proximity to the correspond output face 741 of circular light guiding disk 737, separated from each other by small air-gap 742 (shown having exaggerated separation for visual clarity). The opposite bounding-face of circular light guiding disk 737 is either given a specularly reflecting metal coating (e.g., as by vapor deposition of silver or aluminum), or is bounded by a discrete reflective material (e.g., commercial film materials ESR or SilverLux™ that are manufactured by 3M).

Disk-like light emitter 710, as shown in FIG. 58A, installs inside ring-like light distributing optic 712 along guidelines 724, and then the combined light-emitting unit 726 attaches to bottom side 728 of embeddable electronic circuit 730 along guidelines 731-734. In the illustrative example of FIG. 58, embeddable electronic circuit 730 is configured as a square or rectangular plate 736 containing illustrative voltage regulator group 344, illustrative demodulation group 700, and illustrative current switching group 738 (as a horizontally arranged variation on current switching group 388 shown previously) with associated connectors 740 and 774. DC voltage ($V_{dc}$) is applied, as in earlier examples, to voltage-bridge 394, and external ground connection is made via electrode pad 744. Positive and negative emitter terminals 721 and 723 are connected with topside electrodes 746 and 748 via circuits not shown on the underside surface 728 of plate 736. Of course, the constituent components of circuit 730 could be rearranged within a circular configuration of plate 736 to match the layout of surface 7200, or in many other configurations fitting in an area smaller than the total area of the downward-facing surface of light distributing engine 4.

Figure 59:
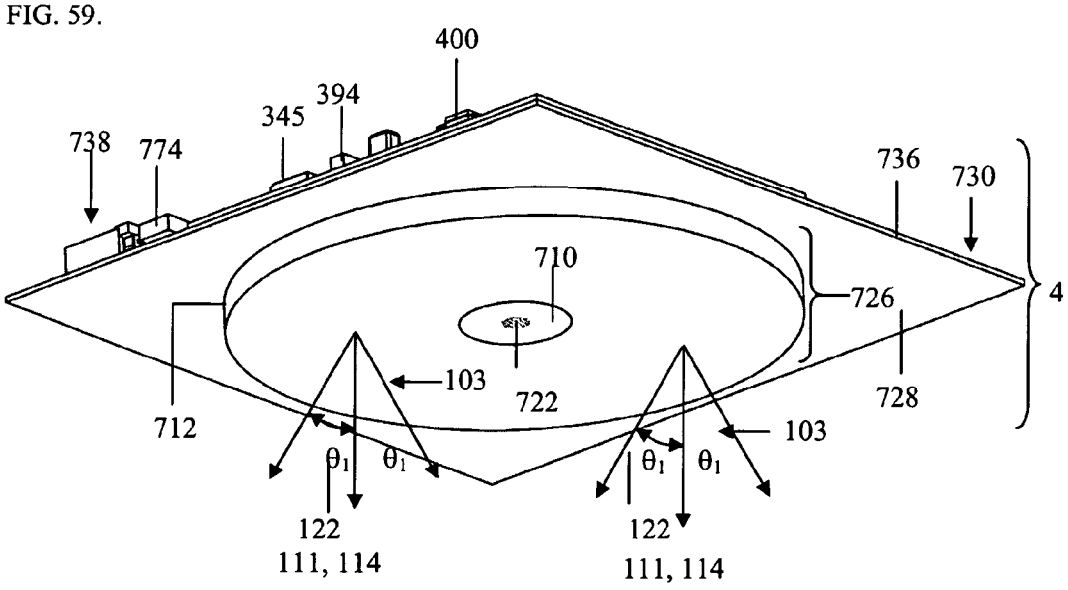
FIG. 59 is a perspective view as seen from the floor beneath (light distributing side) of the light-distributing engine of FIGS. 58A-58D after its assembly.

FIG. 59 is a perspective view as seen from the floor beneath (light distributing side) of the light-distributing engine 4 of FIG. 58A after its assembly. Despite the fact that its emitting aperture is circular, its collective illumination may be arranged to have a square, rectangular or circular cross-section, by inclusion of light spreading sheets such as those illustrated in FIGS. 53-54. Said light-spreading sheets can also provide illumination cross-sections other than rectangular (circular or elliptical) as has been described in U.S. Provisional Patent Application Ser. No. 61/024,814 (International Stage Patent Application Serial Number PCT/US2009/000575) entitled Thin Illumination System. Said light-spreading sheets could, for example, be held within circular frames that snap-on or screw on to a corresponding circular framing member around the periphery of light distributing optic 4.

Figure 60:
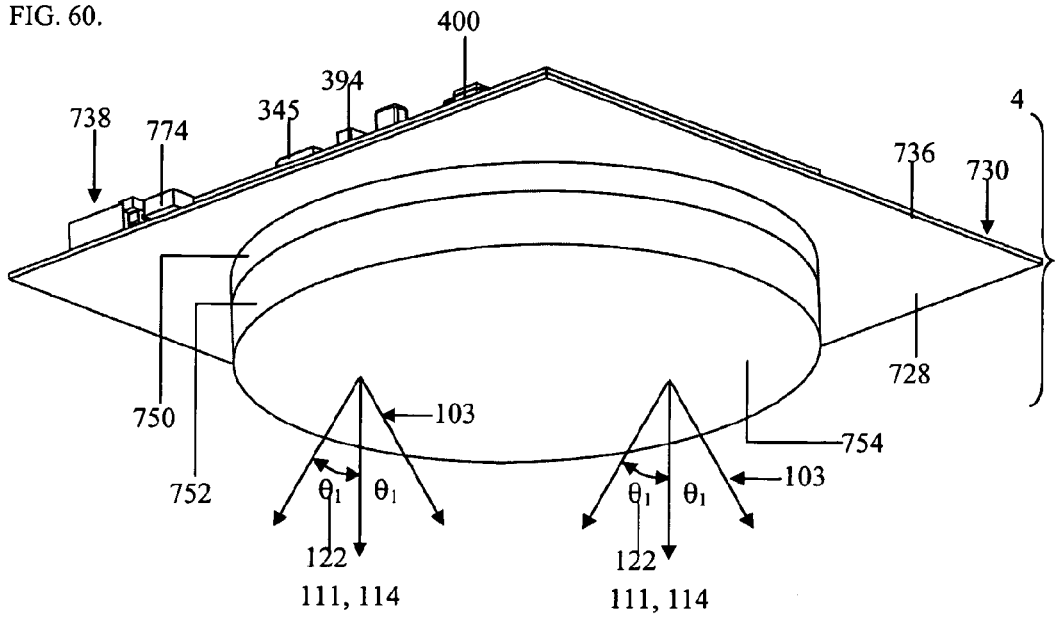
FIG. 60 is a variation on the system of FIG. 59, also shown in perspective view from the floor beneath, arranged as a circular form of the vertically stacked light distributing engine layout represented schematically in FIG. 4A.

FIG. 60 is a variation on the system of FIG. 59, also shown in perspective view from the floor beneath, arranged as a circular form of the vertically stacked light distributing engine layout represented schematically in FIG. 4A. In this form, the cross-section shown in FIG. 4A has been rotated about its centerline, parallel to Z-axis 112. The result is a circular disk-like light emitter 750 containing down-directed sources of light, and mounted just beneath it, a circular disk-like light distributing optic 752 that receives such sources of light and spreads them uniformly over circular output aperture surface 754 as beams 103.

Figure 61:
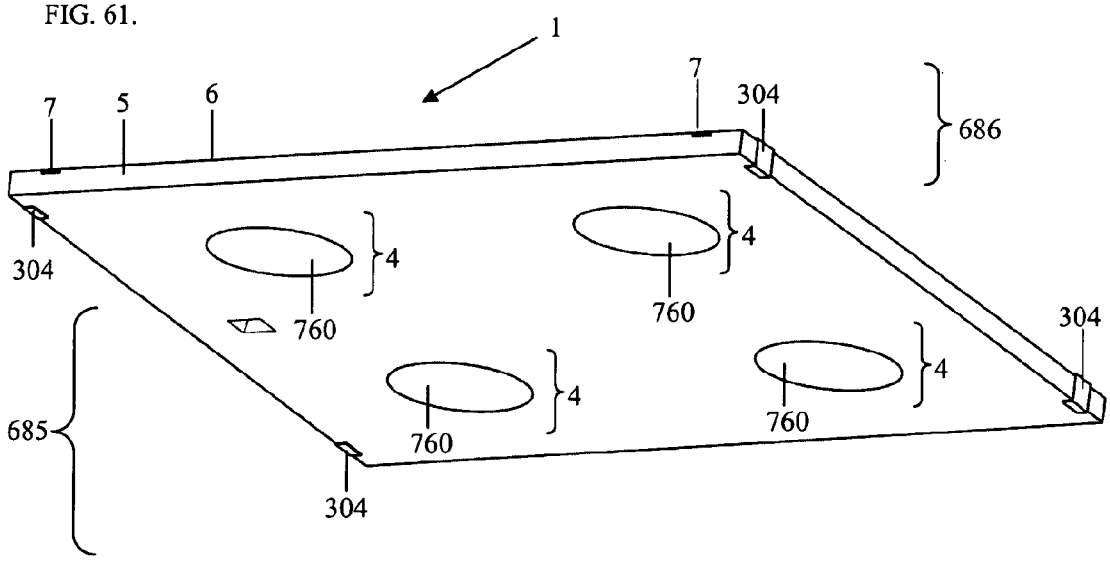
FIG. 61 is a perspective view of the fully embedded tile illumination system of the present invention as seen from the floor space below using either forms of circular disk-like light distributing engines shown in FIGS. 58-59.

FIG. 61 is a perspective view of the fully embedded tile illumination system 1 as seen from the floor space 685 below, similar to those shown above in FIGS. 54-56, but in this illustration using forms of circular disk-like light distributing engines 4 such as those shown in FIGS. 58-59. Circular embodiments 760 of replaceable decorative cover plates or fascia 650 (as in FIGS. 53-54) are included, and may be fitted with the same lenticular lens sheet angle spreading capabilities as described by elements 664 and 666 for the square or rectangular cut counterparts.

When an appropriate supply source of $V_{dc}$ is applied to either the illustrative tile system 1 of FIG. 55, FIG. 56, or FIG. 61 as to the left side DC voltage connectors 304, and an appropriate ground connection is made to the right side connectors 304, the constituent light distributing engines 4 are considered to be powered and ready to provide output illumination to the floor (and walls) beneath at a level of illumination prescribed by the system's Master Controller 40 (as described above).

Yet other variations of combined light distributing optic 726 are may be used in accordance with the present invention. In one example of this, light distributing optic 712 may be configured so as to have other output aperture shapes besides the circular (ring-like) example of FIGS. 58-61. This variation is described in U.S. Provisional Patent Application Ser. No. 61/024,814 (International Stage Patent Application Serial Number PCT/US2009/000575) entitled Thin Illumination System, wherein light distributing optic 712 is rotated to have a square-shaped bounding perimeter instead of a circularly shaped bounding perimeter. In this case, disk-like emitter 710 emits light radially into a surrounding light distributing optic 712 whose bounding perimeter is square instead of a circular, and that has been designed to control the radial light substantially the same way the circularly-shaped distribution optic does. Examples of appropriate square-perimeter light distributing optics, along with related triangular and square sub-quadrants of such square-perimeter optics, are described in U.S. Provisional Patent Application Ser. No. 61/024,814 (International Stage Patent Application Serial Number PCT/US2009/000575) entitled Thin Illumination System. Generally, as long as the light distributing optic 712 is designed such that it processes the radially propagating light 718 and outputs predominately down-directed light 103, the perimeter of the light distributing optic 712 is not constrained to a particular shape.

Figure 62:
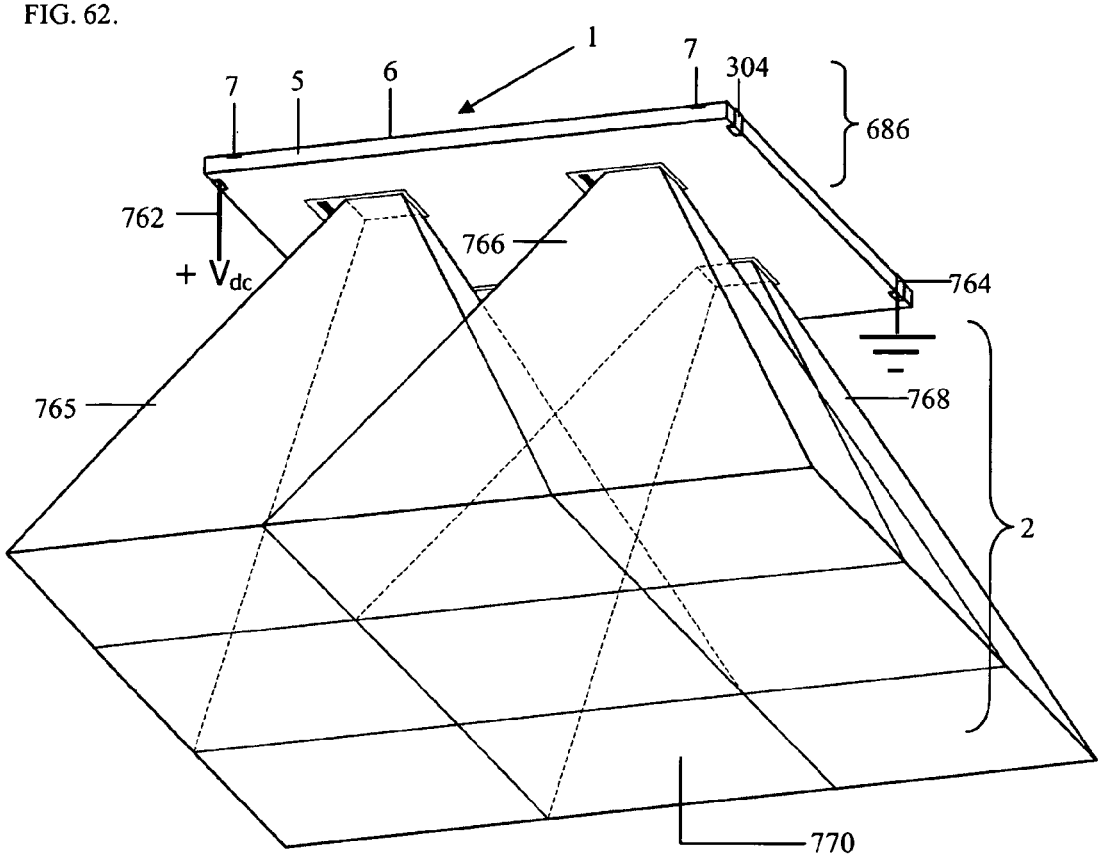
FIG. 62 provides one example of the present illumination system invention in operation as a perspective view from the floor beneath.

FIG. 62 provides one example of the present illumination system invention in operation as a perspective view from the floor beneath. In this case, it shows the tile illuminating system 1 of FIG. 55 activated by supply voltage 762 ($V_{dc}$) applied to one (left hand) voltage buss 7, and a ground (or neutral) connection 764 applied to the opposing (right hand) voltage buss 7. Master Controller 40 (not included in FIG. 62) sends digital control signals that are demodulated within each of the four embedded light distributing engines 4 as explained above. When the demodulated control signals signify an "on" condition, light beams of illumination 765, 766, 767 (hidden) and 768 at the prescribed level for each light distributing engine 4 are presented to the floor space below.

The four beams 765-768 illustrated in the example of FIG. 62 each have a +/−30-degree angular cone in their two meridians (i.e., $+/-\theta_1=+/-30$-degrees and $+/-\theta_2=+/-30$-degrees, where the angular extent values can be set according to various metrics, including the full-width half max of the distribution, a more fully cut-off condition such as full-width 10% max, or other), which is a particularly desirable low-glare illumination specification for most general overhead flood lighting systems (as in offices, libraries, schools, and residential ceilings, to mention just a few). The four illustrative beams (765-768) overlap as on illustrative beam cross-sectional surface 770, and produce generally even illumination 2 on the floor surface beneath (not shown). The four beams 765-768 in this example each have a substantially square cross-section, which is a characteristic property of one class of preferable thin profile light distributing engines 4 described in U.S. Provisional Patent Application Ser. No. 61/024,814 (International Stage Patent Application Serial Number PCT/US2009/000575) entitled Thin Illumination System. When other configurations or other types of light emitting engines (including many traditional light engines) are used, the output beams (530-533) may also have circular beam cross-sections.

The angular extent (or spread) of each illuminating beam (765-768) depends on the internal design details of the light distributing optic 273 (or 696 if as in FIG. 57) used within each particular light-distributing engine 4 that is embedded, and also on the design (or composition) of the corresponding replaceable aperture-covering decorative cover plates or fascia 650 (FIG. 55), 690-693 (FIG. 56), or 760 (FIG. 61) associated with it. In this manner, a diversity of illumination objectives may be met using a single tile 6, and also by extension using a group of tiles 6 as in a system of tiles 6 (e.g., system 185 in FIG. 3M).

Figure 63:
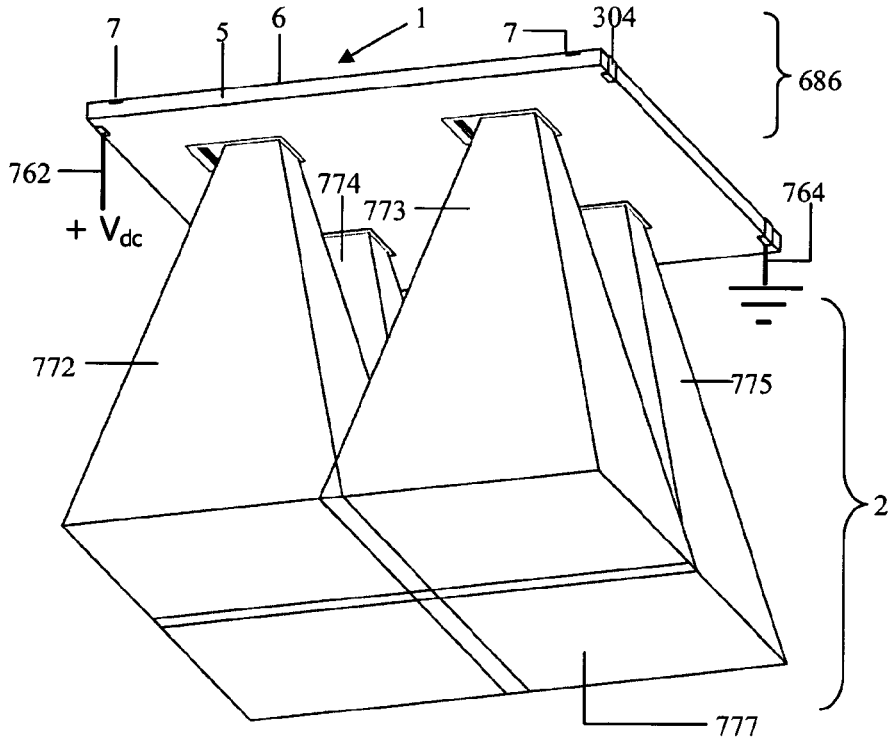
FIG. 63 provides another example of the present illumination system invention in operation as a perspective view from the floor beneath, this with four illustrative illumination beams narrower in angular extent than those shown in FIG. 62.

FIG. 63 provides another example of the present illumination system invention in operation as a perspective view from the floor beneath, this with four illustrative illumination beams 772-775 shown as being narrower in angular extent than those in FIG. 62. Such narrower-angle beams provide a practical source of overhead spot light illumination 2 that might be used in lighting a limited work or task area. The different angular extents illustrated between the systems of FIG. 62 and FIG. 63 are due either to the internal designs of their light distributing engines 4, the designs of their aperture-covering decorative cover plates or fascia 650, or both. Beam overlap plane 777 as illustrated in the example of FIG. 63 is too close to tile system 1 for adequate spatial uniformity given the narrow beam angles involved (e.g., +/−15-degrees). Further away from tile 6 (i.e., closer to the floor beneath), the beam overlap uniformity becomes excellent.

Figure 64:
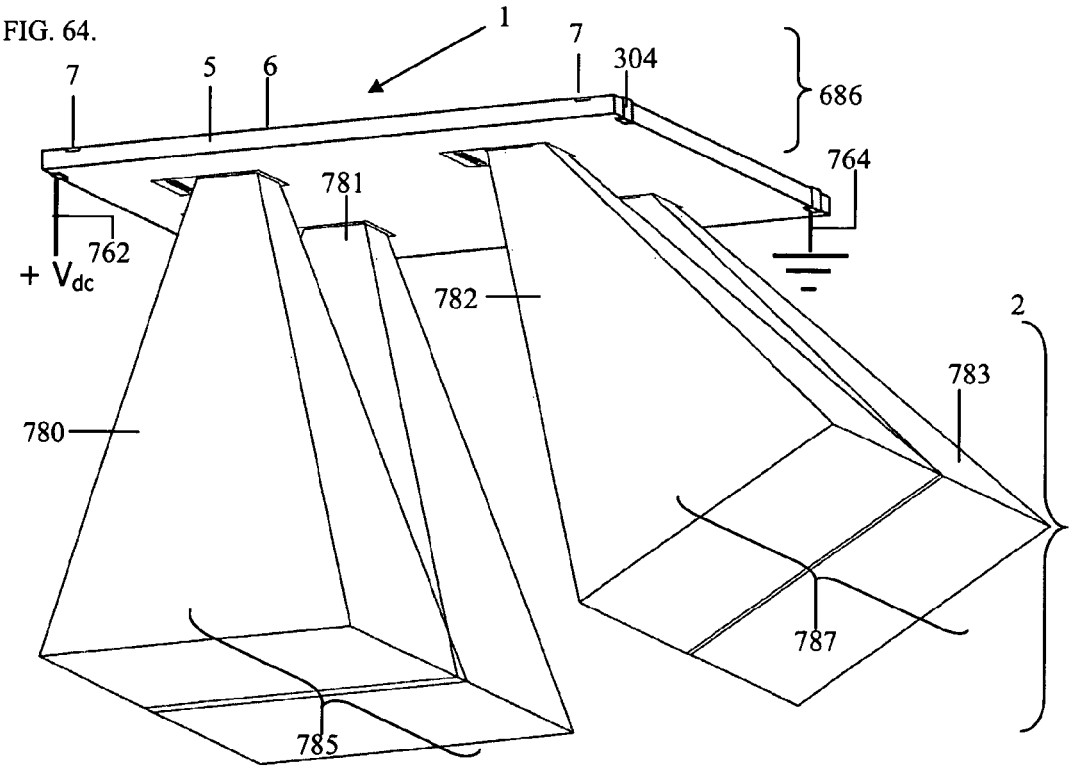
FIG. 64 shows yet another example of the present illumination system invention in operation as a perspective view from the floor beneath, this arranged with two spot lighting task beams directed downwards and two spot lighting task beams directed obliquely downwards.

FIG. 64 shows yet another example of the present illumination system invention in operation as a perspective view from the floor beneath, this arranged with two spot lighting task beams 780 and 781 directed downwards and two spot lighting task beams 782 and 783 directed obliquely downwards, as if to light objects on a wall beyond, to light objects on the floor from an angle, or to boost brightness on a patch of floor that was lit insufficiently from above.

Figure 65:
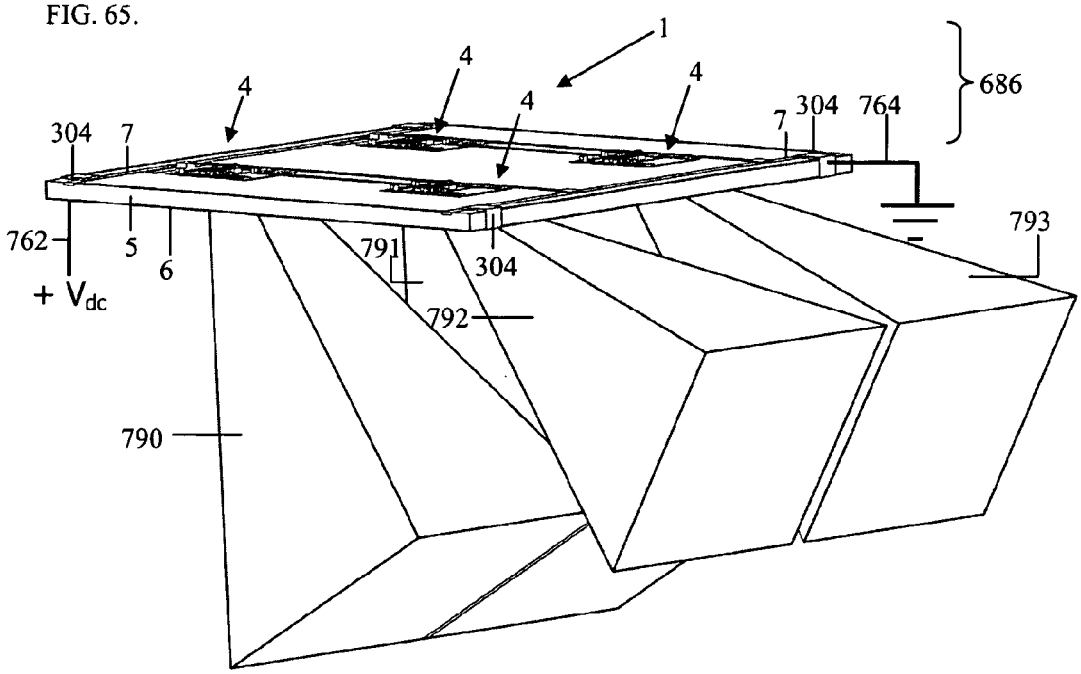
FIG. 65 shows yet another example of the present illumination system invention in operation as a perspective view from slightly above the level of the tile, this arranged with two spot lighting task beams directed obliquely downwards and two spot lighting task beams directed obliquely downwards much less steeply than in the example of FIG. 64.

FIG. 65 shows yet another example of the present illumination system invention in operation as a perspective view from slightly above the level of the tile, this arranged with two spot lighting task beams 790 and 791 directed obliquely downwards and two spot lighting task beams 792 and 793 directed obliquely downwards much less steeply, as if to light objects on a wall beyond at different spatial heights, or so as to vary the spatial variation of brightness on one object or set of objects.

Figure 66:
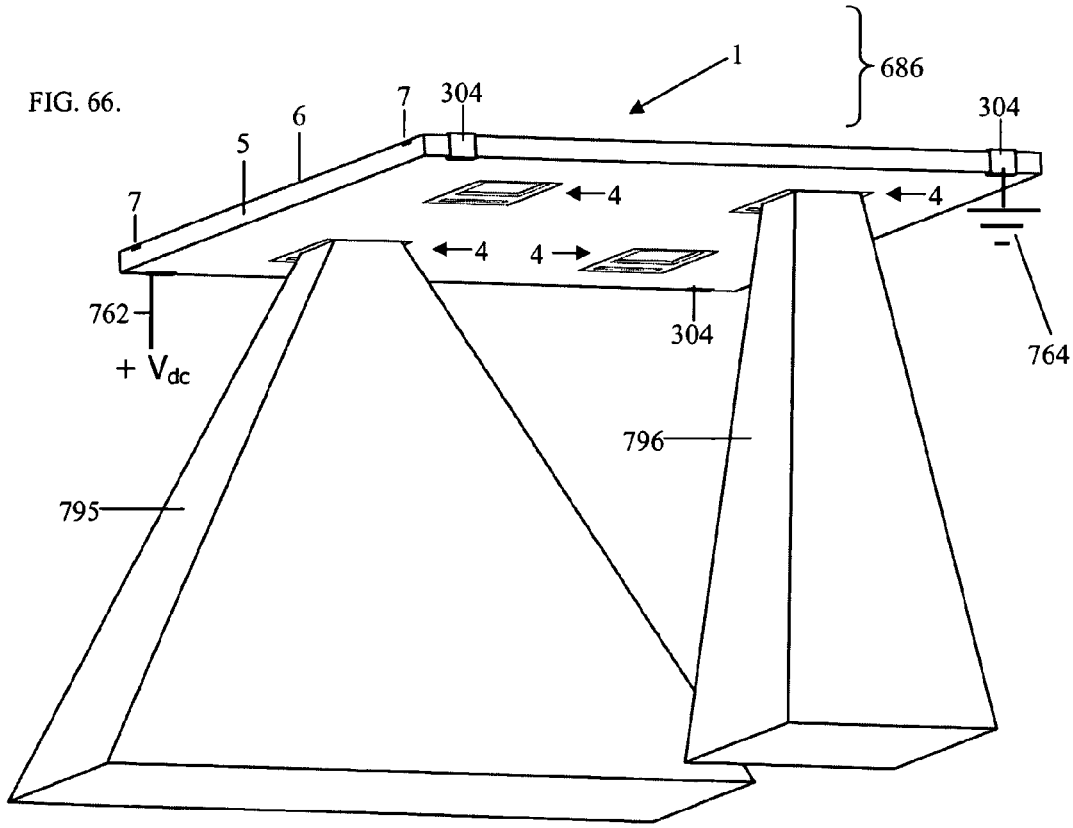
FIG. 66 shows yet another example of the present illumination system invention in operation as a perspective view from the floor beneath, this arranged with two light distributing engines on, and two off.

FIG. 66 shows yet another example of the present illumination system invention in operation as a perspective view from the floor beneath, this arranged with two light distributing engines on and two off. In this example of the beam pattern diversity possible with preferable light distributing engines 4, beam 795 is made asymmetric with rectangular cross-section, +/−8-degrees in one meridian and +/−30-degrees in the other, while beam 796 has a square cross-section, +/−5-degrees in both meridians. In situations where this tile illumination system 1 is suspended 9 feet (108") above the floor beneath, as one example, beam 795 provides an even rectangular lighting pattern on a 30" high table surface that is approximately 93" long and 13" wide (e.g., almost 8 feet by 1 foot). Such long narrow lighting patterns are particularly well suited to long narrow commercial display lighting applications. Yet, simply by changing out this light distributing engine's output aperture system 650 (e.g., FIGS. 53-54) and the lenticular lens sheets (664 and 666) within, other rectangular geometries may be covered as well. Under the same conditions, narrower illuminating beam 796 makes a tight square spot lighting pattern (9" by 9"), which is well suited, for example, to highlighting an object of art.

Many other combinations of beam characteristics may be chosen by the design of the light distributing engines 4 that are embedded, and by the removable cover plates 650 (or 690-693) used to widen their output beam angles.

Figure 67:
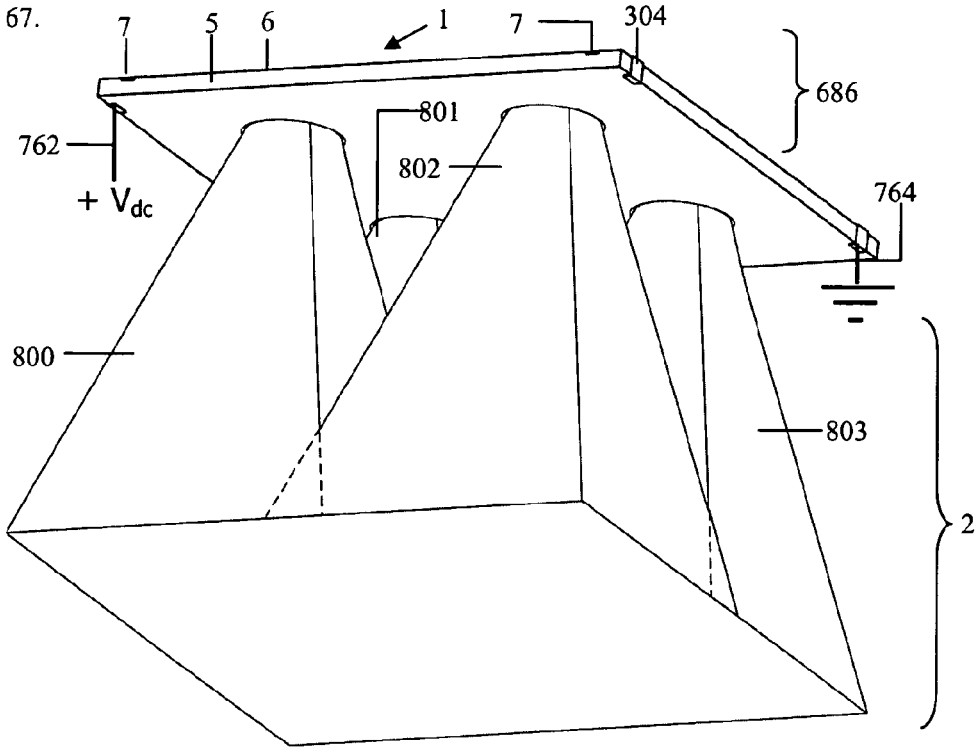
FIG. 67 shows one analogous operating example of illumination system in accordance with the present invention employing four circular light distributing engines embedded as illustrated in FIG. 61.

FIG. 67 shows one analogous operating example of illumination system 1 employing four circular light distributing engines 4 embedded as illustrated in FIG. 61. This perspective view taken from the floor beneath illustrates that despite the circular output aperture shapes of the embedded light engines, that it is equally possible to provide beams 800-803 each having a square (or rectangular) cross-section. Simply by changing the output covers 760 (as in FIG. 61) the illuminating beams may be made circular in cross-section as well.

The means of connecting electrical power to each tile system 1 (or group of tile illumination systems 1) according to the present invention was introduced generally in FIGS. 3A and 3B, via selected examples of suitable electrical power connectors shown in the schematic cross-sections of FIGS. 3D-3J.

A more specific illustration is given in FIGS. 66-68 immediately below, which illustrates one way a group of tile illumination systems 1 (and the light distributing engines 4 embedded within them) according to the present invention may be implemented advantageously in a practical overhead ceiling suspension system very similar to those in widespread use today. The notable modification that is made to otherwise standard suspended ceiling systems and their various T-bar runners, cross-members (also called cross-tees), and splicing accessories, is the addition during manufacture of embedded insulating and conducting elements able to transmit DC electrical power via the constitution of the suspending elements themselves.

Figure 68:
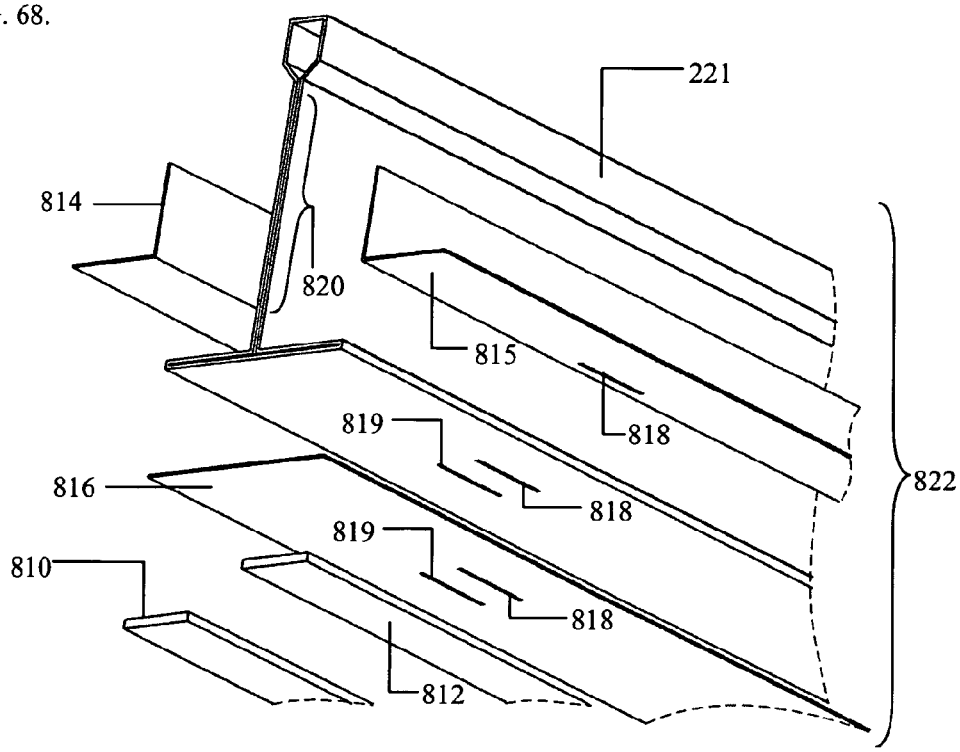
FIG. 68 is an exploded perspective view of the illustrative interconnection method introduced earlier in FIG. 3H.

FIG. 68 is an exploded perspective view of the illustrative interconnection method introduced earlier in FIG. 3H, showing the detailed construction 822 of a short portion of an otherwise standard T-bar styled main runner 221 (made typically of coated steel, galvanized steel or aluminum), fitted during its manufacture for convenient use with the present invention to include conductive layers 810 and 812, insulating layers 814-816, and symmetrically placed connector attachment slots 818 (right side) and 819 (left side), symmetrically disposed about central stem 820. Main T-bar runners such as 221 are typically 12 feet in their running length, and then extended to any length needed by well-established splicing/connecting methods, easily modified to enable electrical continuity across the splice. The T-bar's physical dimensions vary with intended application, but are nominally 1.5" high vertically and $^{15}/_{16}{}^{ths}$ of an inch wide along the tee. This power connecting approach assumes (but doesn't illustrate) the addition of an insulating tape or covering to protect the conductive surfaces against accidental human contact with otherwise exposed conductors.

Figure 69:
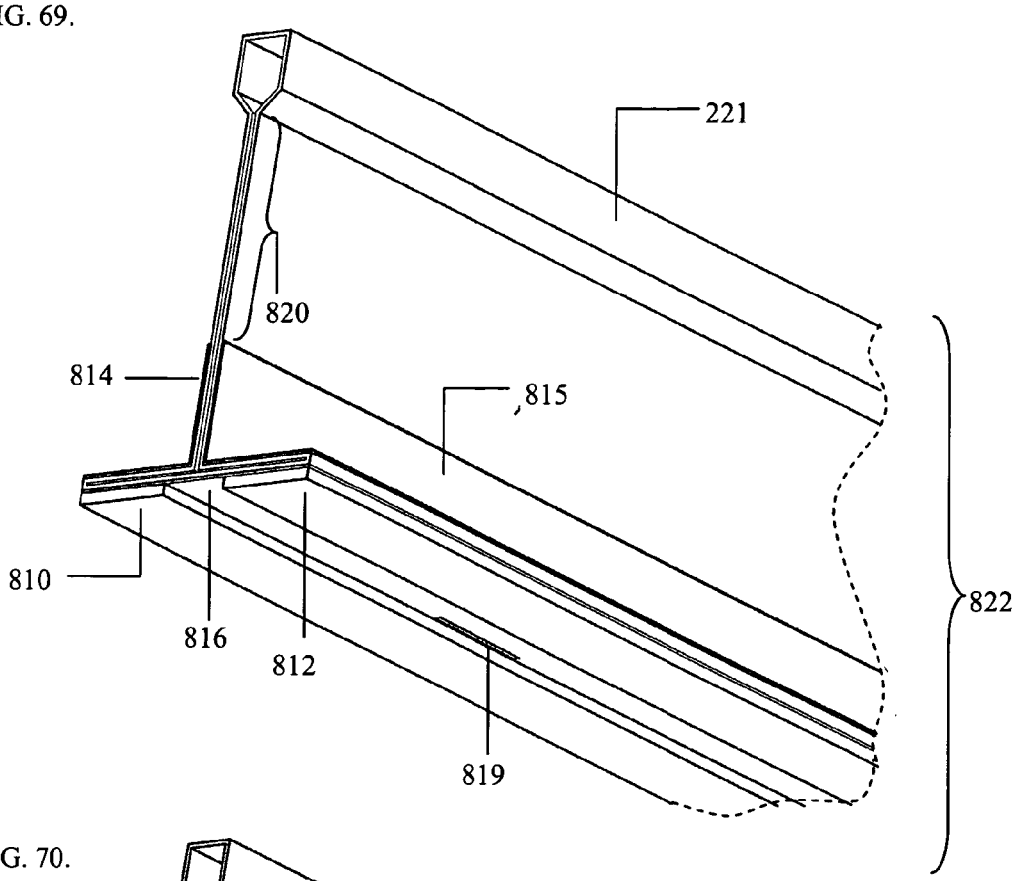
FIG. 69 is a perspective view of the fully processed form of electrically conducting T-bar styled runner system as was just shown in the exploded view of FIG. 68.

FIG. 69 is a perspective view of the fully processed form of electrically conducting T-bar styled runner system 822 as was just shown in the exploded view of FIG. 68. Right side attachment slot 818 is hidden from view behind the thickness of right side conductor 812. Insulation layers 815 and 816 as illustrated are plastic films laminated to the plane surfaces of T-bar runner 221 using pressure sensitive adhesive. Layers 815 and 816 may also be made, however, as a coating that completely encapsulates all exposed surfaces of T-bar runner 221, as for example by any of the standard metal coating means including for example, spray painting, dip coating, and powder coating.

Figure 70:
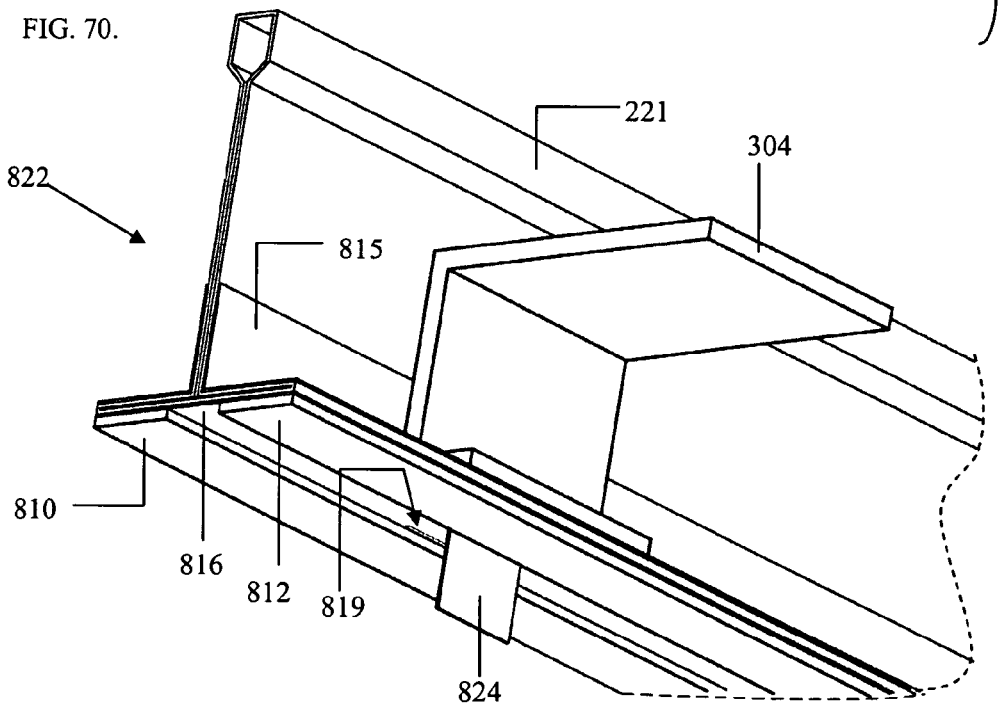
FIG. 70 is a perspective view of the electrically conducting T-bar styled runner system of FIG. 69 with the addition of embedded DC voltage connector with the addition of a thin bendable extension tab.

FIG. 70 is a perspective view of the electrically conducting T-bar styled runner system 822 of FIG. 69 with the addition of embedded DC voltage connector 304 (similar to 9) with the addition of a thin bendable extension tab 824. Tab 824 is electrically conducting (as is connector body 304), sized to fit easily into access slots 819 (and in this illustration 818), and readily bendable via finger pressure in a counter-clockwise fashion to effect tight contact with conductor 812. Connector 304 is shown without its intended embedding in body 5 of tile 6 to better illustrate its working relationship with runner system 822.

Figure 71:
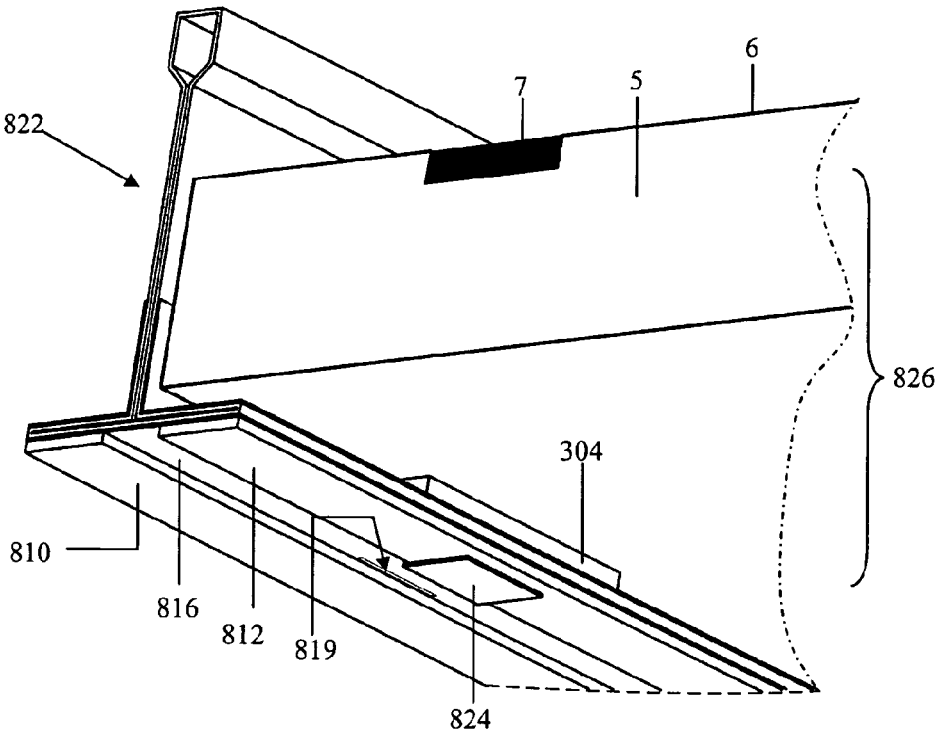
FIG. 71 is a perspective view of the electrically conducting T-bar styled runner system 822 of FIG. 70, in this case illustrating its combination with appropriate ceiling tile material, including the fully installed tabbed edge connector shown more clearly in FIG. 70.

FIG. 71 is a perspective view of the electrically conducting T-bar styled runner system 822 of FIG. 70, in this case illustrating its combination with appropriate ceiling tile material 6, including the fully installed tabbed edge connector 304 shown more clearly in FIG. 70. This perspective view shows only the left front corner section 826 of tile 6, with embedded DC voltage connector 304 (as shown in FIG. 70), its thin tab extension 824 shown in its completely bended state making mechanical and electrical contact with conductor 812, and an end view of DC voltage buss 7, also in mechanical and electrical contact with connector 304, as shown previously. In cases requiring additional mechanical (and electrical) integrity, a miniature machine screw could be added via concentrically aligned attachment holes made in bent tab 824, the tee surface of runner system 822 and in the bottom tee-surface of T-bar runner 221. Alternatively to connector tab 824, conductors 810 and 812 could have conductive tabs that wrap around the horizontal edges of T-bar 822, such that connector 304 (without tab 824) would sit on the tabs. A number of other connection schemes are also possible, including snap-together male/female connector pairs, one of the pair on the T-bar, the other on the tile.

Tile suspension systems such as those illustrated schematically in the perspective views of FIGS. 2D, 2E, 3B and 3C contain parallel T-bar styled runners and orthogonal T-bar style crossing members (typically called cross tees). Cross tee elements connect from runner to runner, and complete the tile suspension matrix, thereby providing necessary support framing for all four sides of a standard overhead ceiling tile 6, no matter what it's shape (square or rectangular). In the electrically conductive T-bar style suspension system of the present invention, the cross tees are made to be electrically neutral, or insulating. They are thereby constructed in a manner that does not provide short circuits or otherwise interfere with the continuity of parallel DC voltage delivery channels provided by the runner systems 822 as developed in FIGS. 68-71.

Manufacturers of standard ceiling tile suspension systems (e.g., Armstrong, Bailey, USG, General Rolling Mills and others) have developed many clever and convenient ways of adding in sturdy cross tee elements fitting snugly between adjacent runners. Ordinarily holes (or slots) for cross-tee mounting are pre-punched at standard intervals in the T-bar's vertical sidewall surface (820 as for example in FIG. 69) so that regular spacing of cross tees is facilitated. In some cases, locking tabs at the end of the cross-tee elements fit through these access holes and lock tightly together. In other cases additional locking clips are added for greater stability, especially in areas prone to seismic activity.

Cross-tee systems most suitable for use with the present invention pass through (or bridge) the electrically conducting runners 822 without electrical interference. One example of this has been introduced by Armstrong wherein two cross-tee elements are locked together by use of a bridging connector screwed snugly to both cross-tees, effectively splicing them together in a rigid structure that enables them to drop over (or bridge over) the associated runner (or runners).

Other commercial cross tee approaches are equally adaptable, including Armstrong's Screw Slot System in which cross tee tabs pass through pre-punched slots in the runner's sidewall, and then screw to mounting tabs pre-bonded to the runner's sidewall.

There are also many other power delivery alternatives available for use with the present invention (e.g., point-to-point wiring, wiring harnesses, point-to-point wiring from a distributed group of drop boxes serving as extensions of main supply 30 to mention a few of the more common examples).

At the heart of the present invention, however, are the embeddable lighting distributing engines 4, with their integrally embedded power controlling electronics, and their integrally embedded electrical connectivity, shown fundamentally through the schematic cross-sections of FIGS. 4A-4C, and from a system integration standpoint in the examples of FIGS. 24-31, 34-35, 41-45, 49-51, and 57-60.

Internal descriptions of thin-profile LED light emitter 271 (and 710) and the correspondingly thin-profile light distributing optic 273 (and 712) were ignored in earlier examples to simplify system-level examples of the tile embedding process. While the general mechanisms underlying the associated performance of these thin light distributing elements were set forth by the schematic relationships depicted in the cross-sections of FIGS. 4A-4C, examples of the actual parts involved in preferred embodiments remains to be illustrated.

The primary attributes of preferable light distributing engines 4 according to the present invention are their physical thinness, expansion of their light distributing output apertures relative to those of the light emitter's they incorporate, and the well-organized directionality of their output illumination. Physical thinness is necessary so that the preferable light engine may be embedded substantially within the physical cross-section of useful tile materials (whether gypsum, drywall, or some other tile-like building material). A sufficiently enlarged output aperture is preferred to dilute the dangerously high viewing brightness of small area light emitters such as LED's. And well-organized output illumination is preferred over diffuse illumination to improve efficiency in spot lighting applications and to reduce glare in flood lighting applications.

Figure 72:
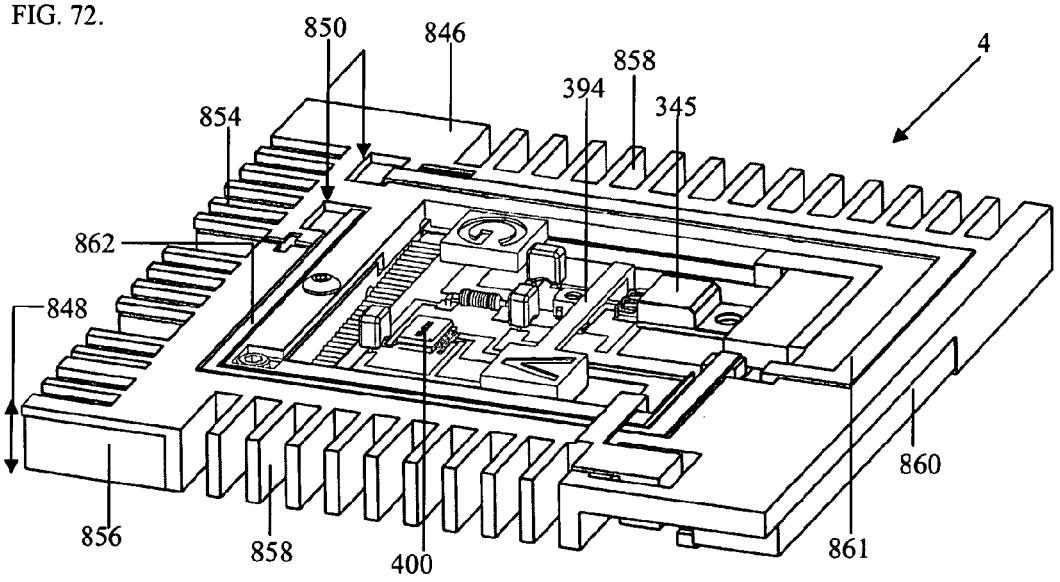
FIG. 72 is a perspective view shown from the backside of the embedding plate involved, illustrating one type of embeddable thin light distributing engine compatible with best mode practice of the present invention.
Figure 73:
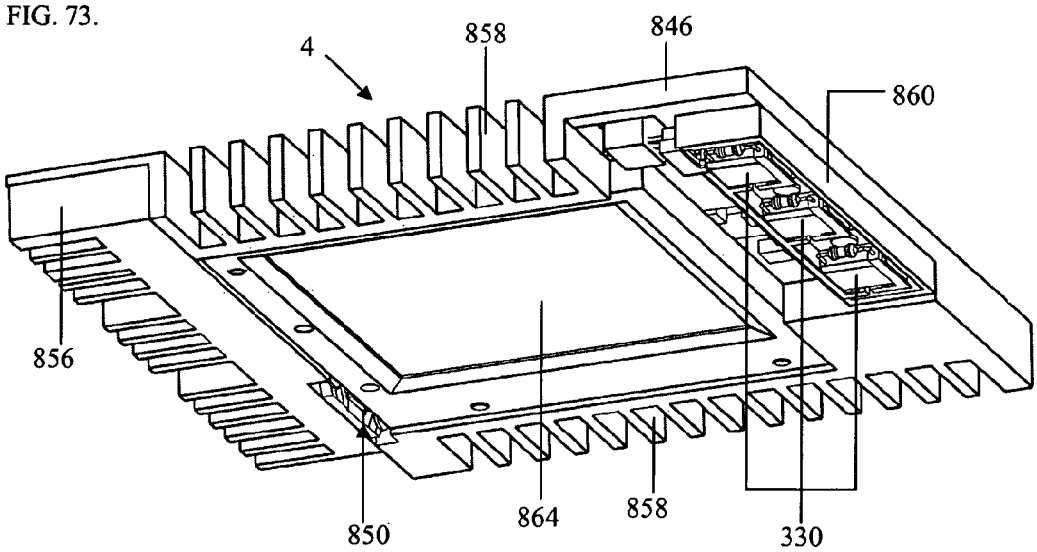
FIG. 73 is a perspective view shown from the light emitting side of the light distributing engine example of FIG. 72.

FIG. 72 is a perspective view shown from the backside of embedding plate 846, illustrating one type of embeddable thin light distributing engine 4 compatible with best mode practice of the present invention. This light distributing engine unit, as illustrated in FIGS. 72-75, is 114 mm square in its overall embedding dimensions, 10.2 mm thick at its thickest point 848, and contains one LED emitter. The associated light-distributing aperture, shown in the underside view of FIG. 73, is 55 mm×55 mm in this particular example. The LED light emitter 850 used in this engine is hidden from view in FIG. 72 under embeddable mounting plate 846, which also includes heat extracting fins 854 above (and registered with) emitter heat sink fins 856, plus auxiliary heat sink fins 858 of its own. The embedded electronic components were described previously, including a local voltage regular circuit 344 arranged generally as in FIGS. 24-25, a current switching circuit 860 similar to that shown in FIGS. 19, 22, 23, 45 and 58 (especially FIG. 58) and the RC-type control signal demodulation circuit illustrated previously in FIGS. 41-44.

FIG. 73 is a perspective view shown from the light emitting side of the light distributing engine example of FIG. 72, illustrating its light distributing aperture 864, a partial bottom view of (4-chip) LED light emitter 850, and the three current switching MOSFET's 330 of current switching circuit 860.

Figure 74:
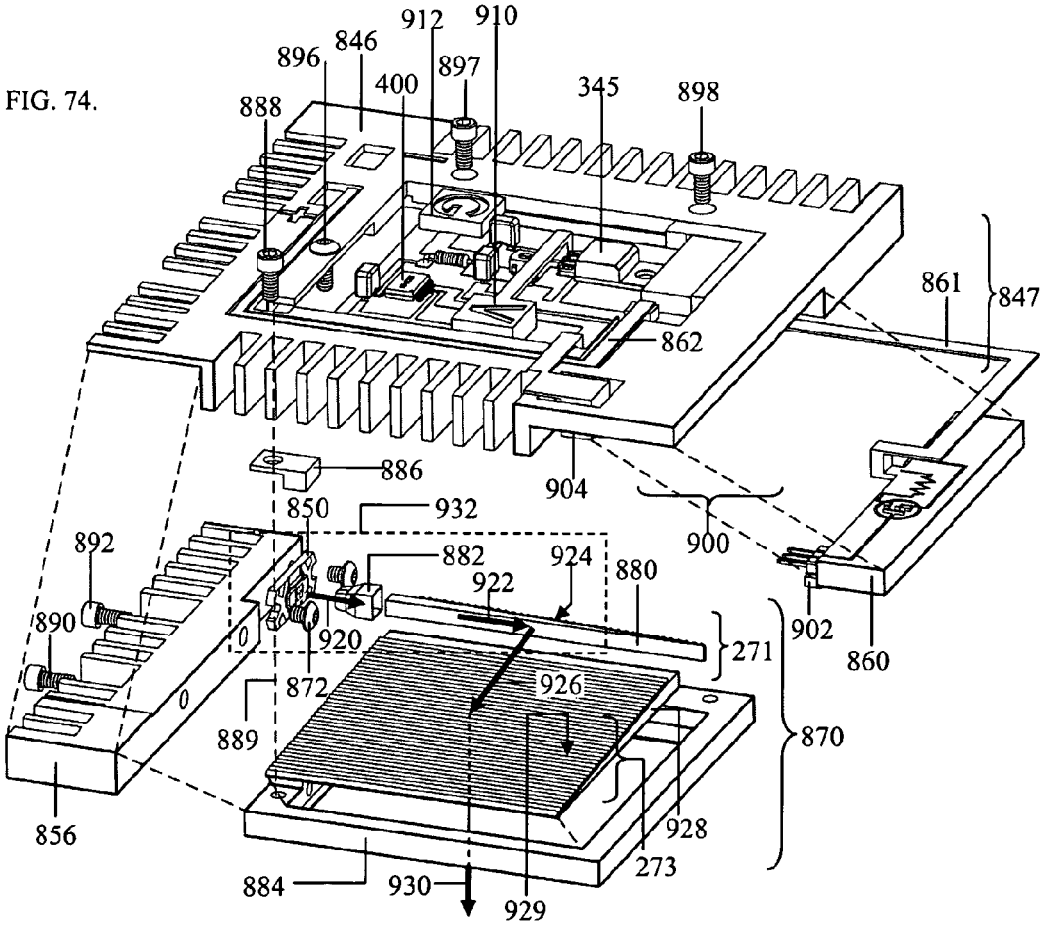
FIG. 74 is an exploded perspective view of the internal construction of the light-distributing engine illustrated in FIGS. 72-73 also showing the engine's internal light flows.

FIG. 74 is an exploded perspective view of the internal construction of the light-distributing engine 4 as illustrated in FIGS. 72-73. The core light generating elements 870 comprise LED light emitter sub-assembly 271 and light distributing optic 273 (as shown mechanistically in FIG. 4C and symbolically in FIGS. 15-16), each of which will be magnified separately in FIGS. 75-76. This aspect of light distributing engine 4 has been described previously in U.S. Provisional Patent Application Ser. No. 61/024,814 (International Stage Patent Application Serial Number PCT/US2009/000575) entitled Thin Illumination System. The light generating sub-system 870 is pre-assembled for example by bolting LED emitter 850 to heat sink 856 with two pan-head screws 872 (and 873, not labeled), installing light distributing optic 273, light pipe 880, and light emitter coupling optic 882 into an appropriately featured plastic (or metal) chassis frame 884, securing them using hold-down clip 886 and 4-40 screw 888 as along guideline 889, and bolting heat sink 856 (e.g., with 4-40 screws 890 and 892) to chassis frame 884. The light generating sub-assembly 870 is then attached to embeddable plate 846 in this example using three screws 896-898. Current switching circuit 860 is attached to embeddable plate 846 along guidelines 900 with control voltage connector 902 (e.g., see 740 in FIG. 58) mating with its counterpart 904 (e.g., see 744 in FIG. 58), and with flex cable 861 passing over screws 897 and 898 before connecting with the negative terminal of LED emitter 850. External DC supply voltage is applied to embedded terminal 910 by an embedded tile circuit strap similar to 600 (and connector tab 617) as shown in FIGS. 48-49, and access to system ground is applied to embedded terminal 912 by an embedded circuit strap similar to 602 in FIG. 48.

FIG. 74 also shows symbolic representation of the light distributing engine's internal light flows. Substantially all output light 920 generated by LED emitter 850 is collected by light emitter coupling optic 882 shown in this example as a hollow reflector element placed just beyond the illustrative emitter's 4 separate LED chips (but optic 882 may also be composed of one or more of a lens, a group of lenses, a refractive reflector, a light pipe section, a hologram, a diffractive film, a reflective polarizer film, and a fluorescent resin). A substantial percentage of the output light from element 882 enters the input face of light pipe 880, and while inside undergoes total internal reflections within it. Then as also described in U.S. Provisional Patent Application Ser. No. 61/024,814 (International Stage Patent Application Serial Number PCT/US2009/000575) entitled Thin Illumination System, a high percentage of light 922 is turned 90-degrees by deliberately planned interactions with micro-facetted surface film 924 and is then extracted uniformly along the running length of pipe 880 and ejected into air as beam 926, which in turn enters the input face of light distributing optic 273. Then also according to U.S. Provisional Patent Application Ser. No. 61/024,814 (International Stage Patent Application Serial Number PCT/US2009/000575) entitled Thin Illumination System, light flow 926 undergoes further total internal reflections within the light guiding plate portion 928 of light distributing optic 273 including its attached facetted film 929 and is turned 90-degrees and extracted into air evenly across the plate's light distributing aperture 864 (as referenced in FIG. 73), thereby providing the light engine's practical source of directional output illumination 930.

Figure 75:
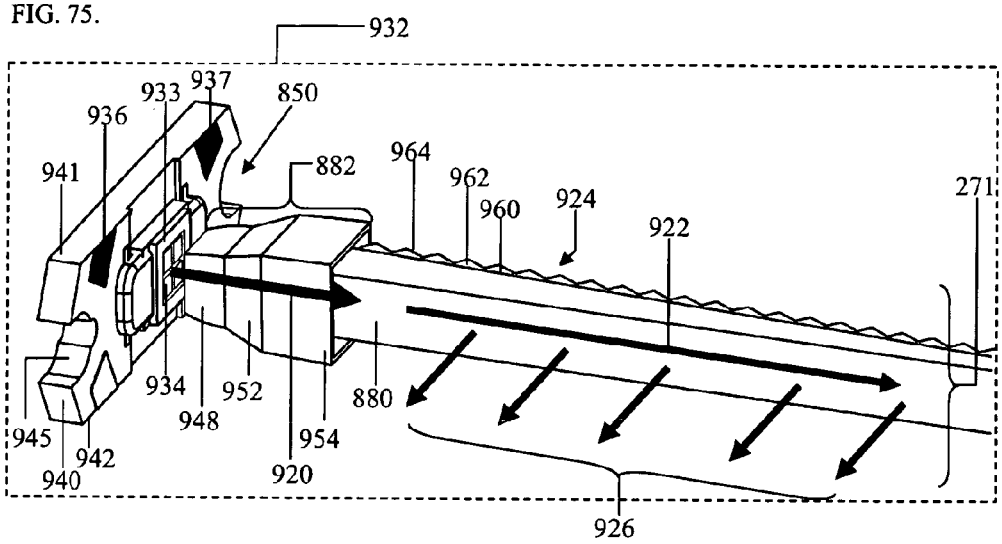
FIG. 75 is a magnified perspective view of a region designated in FIG. 74, providing closer view of the key elements within the engine's three-part LED light emitter sub-system.

FIG. 75 is a magnified perspective view of dotted region 932 as designated in FIG. 74, providing a closer view of the key elements of the engine's three-part LED light emitter subsystem 271 (comprising LED emitter 850, angle transforming coupling optic 882, and light spreading pipe 880 with facetted light spreading layer 924). The preferred LED emitter 850 as shown in this example is a commercially available Osram (Opto Semiconductors) OSTAR™ (e.g., LE W E2A) with four 1 mm square chips 934 arranged in a 2.1 mm×2.1 mm pattern (inside a larger dielectrically-filled cavity surrounding the chips). Other LED chip combinations are as easily accommodated by variations on this design, including Osram's six-chip versions. Positive and negative electrodes 936 and 937 are connected with flex circuit extension 861 and 862 as shown in the topside view of FIG. 72. The current OSTAR™ ceramic package 940 is hexagonally shaped as supplied and has been trimmed to parallel surfaces 941 and 942 without electrical interference to better comply with thinness requirements of the present invention. Mounting holes 945 are used for heat sink attachment, as shown above via low-profile mounting screws 872. Coupling optic 882 in this example has three sequential sections, each having square (or rectangular) cross-section. First section 948, placed only for illustration purposes slightly beyond the four OSTAR™ chips, is used to collect substantially all light emitted by the group of chips, while converting the collected angular distribution by internal reflections to optimize the entry efficiency to tapered light pipe 880. In good practice, coupling optic 882 is in mechanical contact with frame material 933, and sections 952 and 954 surround the 3 mm×3 mm entrance face of light spreading pipe 880 just to facilitate mechanical mounting and positioning.

Optical functionality of the LED light emitter sub-system 271 applied in this example, is provided, as set forth in U.S. Provisional Patent Application Ser. No. 61/024,814 (International Stage Patent Application Serial Number PCT/US2009/000575) entitled Thin Illumination System, by the physical structure and composition of light spreading light pipe 880 and its associated light spreading facetted layer 924. In best practice, pipe 880 is injection molded. All mold tool surfaces are provided a featureless mirror finish. Molding materials are of optical grade, preferably optical grade PMMA (i.e., polymethyl methacrylate) or highest available optical grade polycarbonate to reduce absorption loss. In addition, the corners and edges of light spreading pipe 880 are made as sharply as possible to minimize scattering loss. Facetted layer 924 is attached to the back surface of pipe 880 by means of a thin clear optical coupling medium 960 (e.g., pressure sensitive adhesive). In this form, the facets 962 are made of either PMMA or polycarbonate (e.g., by embossing, casting, or molding) and then coated with high reflectivity enhanced silver (or aluminum) 964. In a related form, metal-coated facetted layer 924 is replaced by a plane reflector, with uncoated facets of an appropriately different geometrical design placed just beyond the front face of pipe 880 (facet vertices facing towards the pipe surface). Light flow 922 in pipe 880, in either form, induces sequential leakages from the pipe itself that on interaction with facets 924 cause sequentially distributed output light 926 in a direction generally perpendicular to the front face of pipe 880.

The light re-distributing system 273 in FIG. 74 operates substantially identically to sub-system 271, just over a larger area using a light spreading light-guiding plate 928 instead of a light spreading pipe, said light guiding plate 928 taking the distributed light from sub-system 271, said light already spread out along the length of face 880, and performing a similar sequential extraction in the direction perpendicular to the front face of pipe 880, with the extracted light being directed downwards along axis 930. Light redistributing system 273 of FIG. 74 works in both aforementioned modes; the mode using a facetted, reflective coated film attached to the back surface of the light guide and the mode using a planar reflector attached to back surface of the light guide with a facetted film disposed just beyond the front surface of the light guide. Additionally, another practical mode of the plate system is identical to the latter mode with the facetted film removed. This results in a general angled pointing direction as set forth in U.S. Provisional Patent Application Ser. No. 61/024,814 (International Stage Patent Application Serial Number PCT/US2009/000575) entitled Thin Illumination System.

Figure 76:
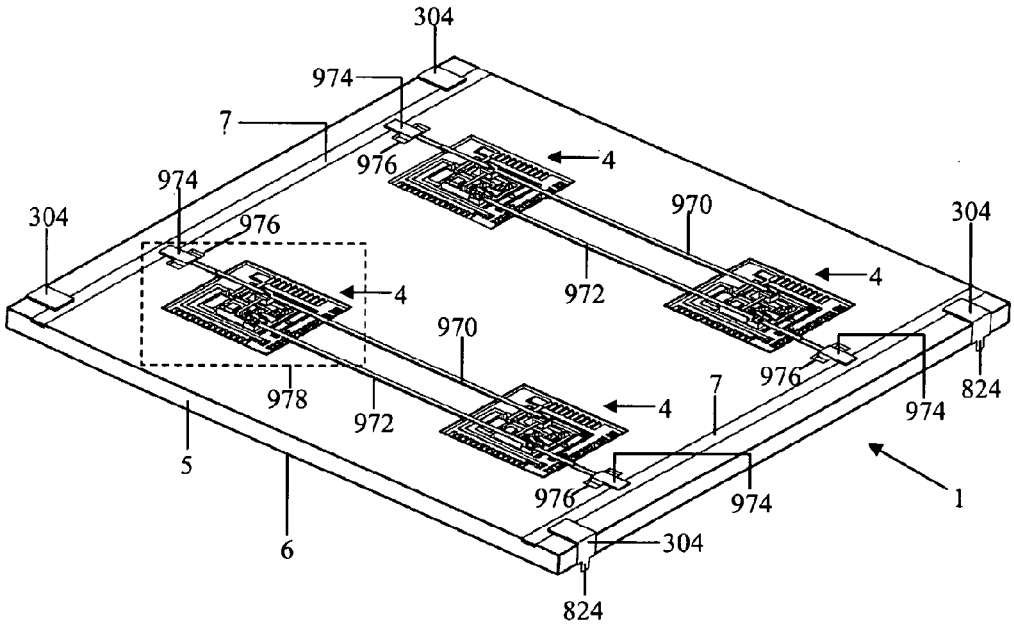
FIG. 76 is a perspective view shown from the backside of the fully embedded tile illumination system 1 according to the present invention that includes four thin profile light distributing engines of the type described in FIGS. 72-75.

FIG. 76 is a perspective view shown from the backside of the fully embedded tile illumination system 1 according to the present invention that includes four thin profile light distributing engines of the type described in FIGS. 72-75. This particular tile illumination system 1 uses the representative 24"×24" tile material 6 of previous examples for consistency. As mentioned earlier, other tile dimensions and comparable building materials are equally applicable, with only minor modifications. This case further embeds four edge connectors 304, each with mounting tabs 824 as illustrated in FIGS. 70-71, voltage access straps 970 and ground access straps 972. Straps 970 and 972 are similar to those shown in FIG. 48 (as 600 and 602) and include embedded connector heads 974 that overlap and provide electrical contact with voltage buss elements 7 (left side for DC voltage, right side for ground). Connector heads 974 are embedded in corresponding tile body cavities 976 as shown.

Figure 77:
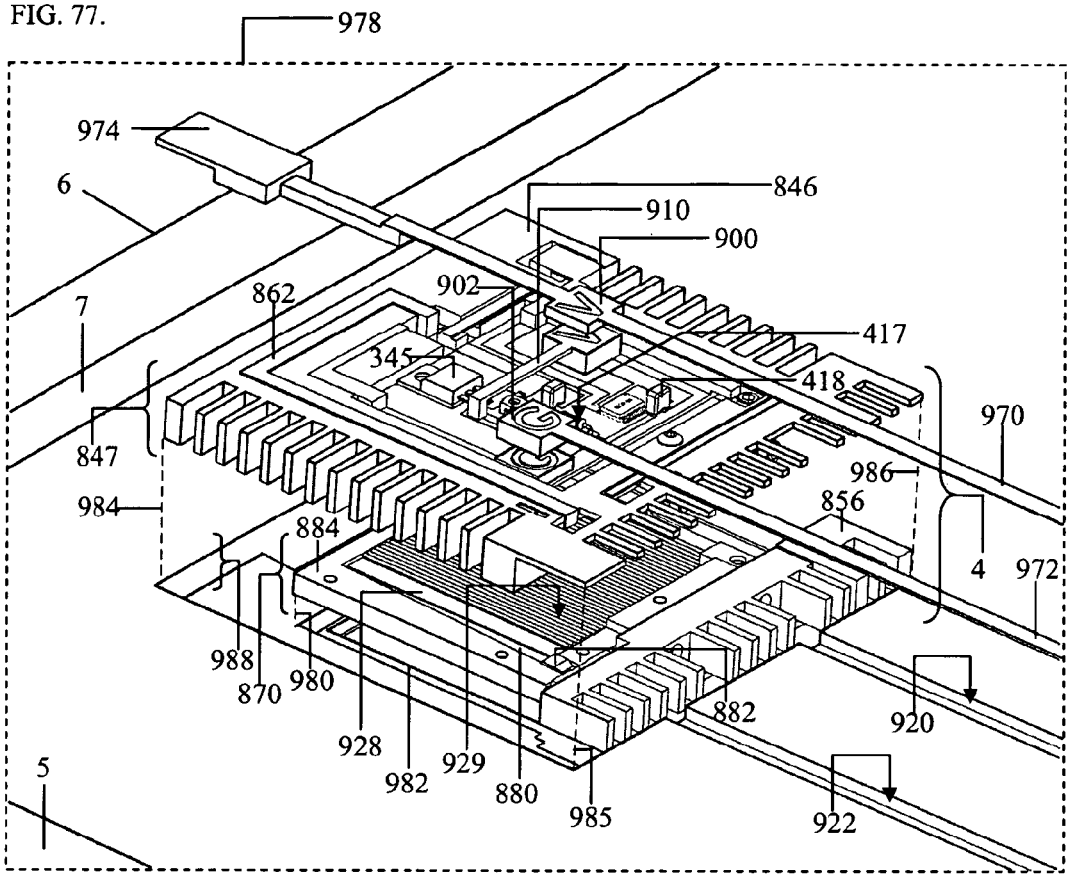
FIG. 77 is a selectively exploded view of a region in the left front corner of the tile illumination system of FIG. 76, whose magnification further clarifies the embedding process for the type of thin-profile light distributing engines described in FIGS. 72-75 and their associated method of embedded electrical interconnection.

FIG. 77 is a selectively exploded view of a dotted region 978 designated in the left front corner of the tile illumination system of FIG. 76, whose magnification further clarifies the embedding process for the type of thin-profile light distributing engines described in FIGS. 72-75 and their associated method of embedded electrical interconnection. Exploded light generating subassembly 870 (as in FIG. 74), ordinarily pre-attached to electronic power plate subassembly 847 (as in FIG. 74), embeds along guideline 980 into cavity detail 982 into body 5 of tile 6. Power plate subassembly 847 embeds along guidelines 984-986 into supporting cavity detail 988. The voltage electrode tab 900 on voltage access strap 970 attaches to its counterpart on voltage bridge connector 910. Similarly, ground electrode tab 902 on ground access strap 972 attaches to its counterpart electrode (marked G) on plate 846. Voltage access strap 970 embeds in corresponding tile body channel 920, and ground access strap 972 embeds in corresponding tile body channel 922.

Figure 78:
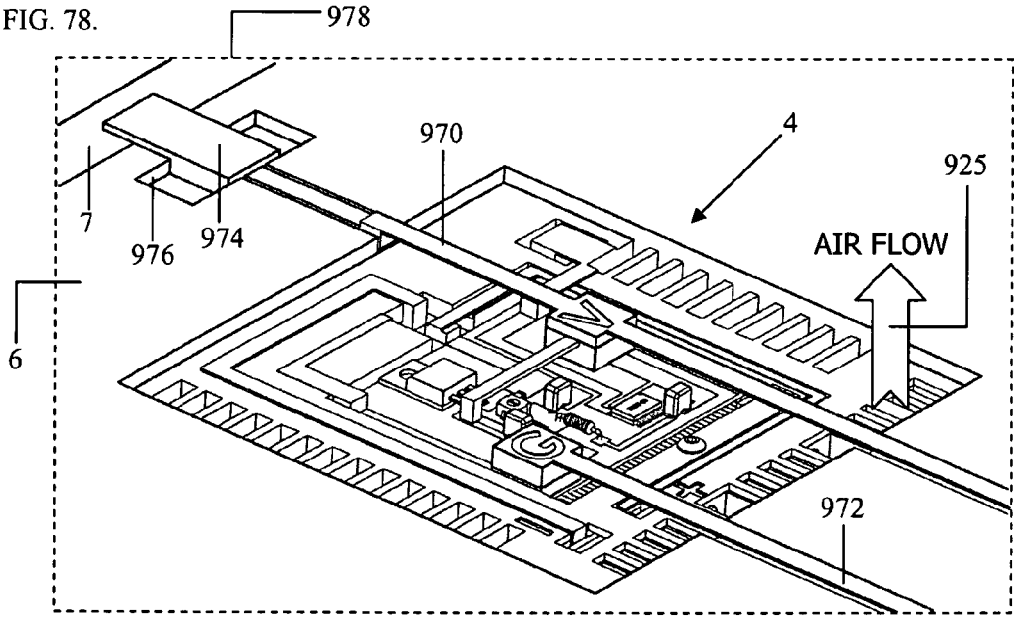
FIG. 78 is the fully embedded example of the exploded detail shown in FIG. 77.

FIG. 78 is the fully embedded example of the exploded detail 978 shown in FIG. 77. An air access slot in body 5 of tile 6 (hidden from view) enables convective airflow 925 from the space beneath tile 6 to the space above it, improving heat extraction from the tile illumination system's heat generating electronic elements (as explained, illustrated and implied in the examples above, e.g., FIGS. 25, 50, 55 and 56). Alternatively to or in conjunction with the air access slot, the cavity in the tile that light engine 4 sits in could be increased in size in the direction of the lower right side, permitting more air to flow into the cavity from above the tile, furthermore flowing into the heat fins from the lower right side. This same approach could be taken on any or all sides.

Figure 79:
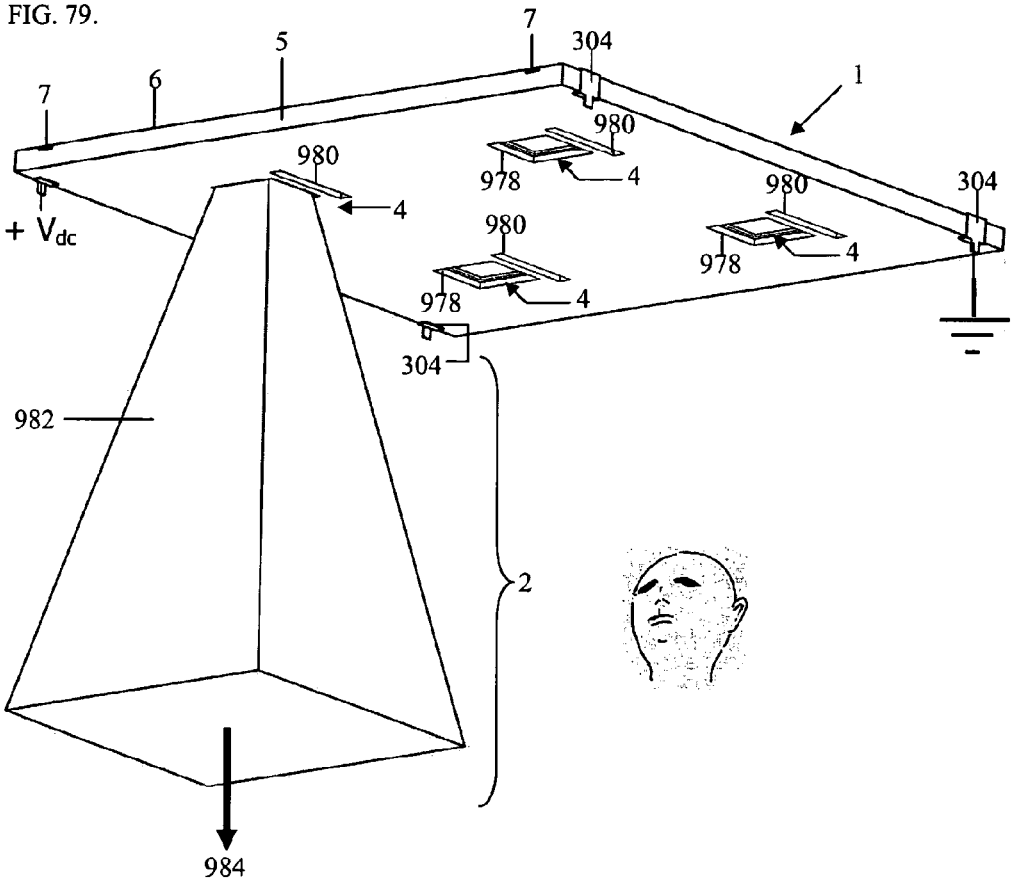
FIG. 79 shows a perspective view from the floor beneath of the electrically activated tile illumination system 1 described in FIGS. 72-78, with an illustrative illuminating beam generated by one of its embedded light distributing engines.

FIG. 79 shows a perspective view from the floor beneath of the electrically activated tile illumination system 1 described in FIGS. 72-78, with an illustrative illuminating beam 982 generated by one of its embedded light distributing engines 4. This perspective view shows DC supply voltage, $V_{dc}$, applied to the system's left hand voltage buss 7, ground access applied to the system's right hand voltage buss 7, and control signals sent from master controller 40 (not shown) signaling the system's left front light distributing engine 4 to operate at full operating power (thereby developing output illumination 2), while signaling the other three embedded light distributing engines to execute off-state conditions (i.e., zero illumination). In the example of FIG. 79, tile apertures are uncovered on their floor side, and thereby expose view of the output apertures of the thin-profile light distributing engines 4 embedded, as described above. Air inlet slots 980 are also uncovered.

Figure 80:
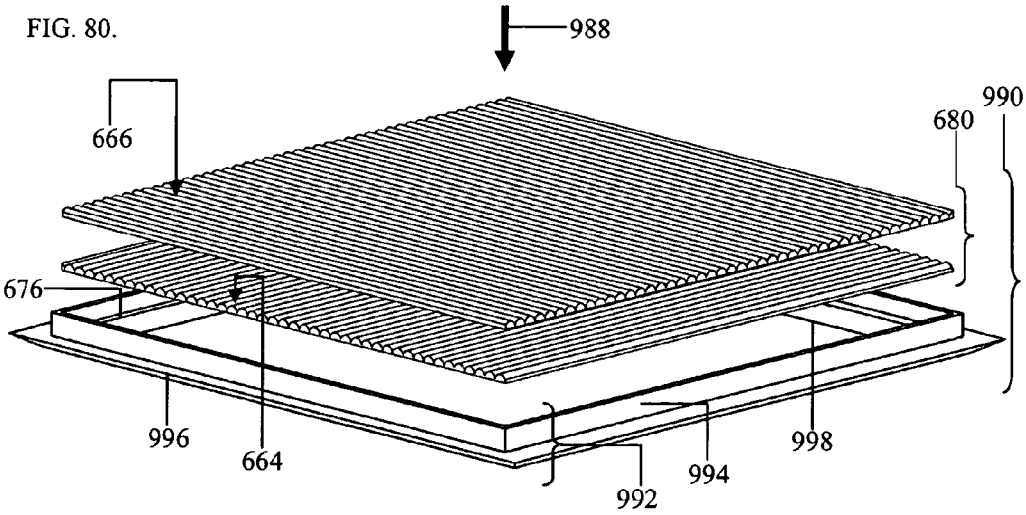
FIG. 80 is an exploded perspective view illustrating the form of one preferable aperture cover suitable for this example of the present invention, including for purposes of illustration, the pair of perpendicularly oriented lenticular lens sheets shown previously in FIG. 53.

The net output beam 982 that is supplied by the thin-profile light distributing engine 4 according to the general structures shown in FIGS. 72-75 above and as set forth in U.S. Provisional Patent Application Ser. No. 61/024,814 (International Stage Patent Application Serial Number PCT/US2009/000575) entitled Thin Illumination System, is a well-collimated beam having square cross-section and nominally +/−5-degrees angular extent in each meridian, as shown in FIG. 80. Beam 982 provides well-organized spot illumination of distant objects along axis 984 and a square illumination field at its destination (e.g., the floor below). As illustrated generally in FIGS. 64-65 above, output beam 982 may be arranged to point in an oblique direction, as to illuminate a wall. Such variation was described in U.S. Provisional Patent Application Ser. No. 61/024,814 (International Stage Patent Application Serial Number PCT/US2009/000575) entitled Thin Illumination System, as being a consequence of the specific design of light distributing optic 273 (FIG. 74) and particularly a consequence of the facet geometry chosen for facetted film 929 on light guiding plate 928.

The narrow cross-section of beam 982, useful in some lighting applications and not in others, is easily widened in one meridian or both meridians to just the degree desired by the addition of a bezel (or fascia) designed to cover the aperture openings in the body 5 of tile 6 as in the example of FIGS. 53-54, with one or two light spreading films (e.g., 664 and 666 of FIG. 53).

FIG. 80 is an exploded perspective view 990 illustrating the form of one preferable aperture cover 992 suitable for this example of the present invention, including for purposes of illustration, the pair 680 of perpendicularly oriented lenticular lens sheets 664 and 666 as shown previously in FIG. 53. Alternatively, a single lenticular lens sheet (or other angle spreading sheets having different orientation) may be used. Other suitable angle spreading materials for this purpose include diffraction gratings, holographic diffusers, microlens diffusers, micro-structured surface diffusers, volume diffusers, and conventional spherical lenticular lens sheets to mention a few. The best modes of angle spreading associated with lenticular lens sheets of any description were correlated with those having parabolically shaped lenticules (cylindrical lens elements) along with their convex parabolic curvature facing the incoming source of light 988, as was described in US Provisional Patent Application Ser. No. 61/024,814 (International Stage Patent Application Serial Number PCT/US2009/000575) entitled Thin Illumination System. Not only do lenticular lens sheets of this type widen the angular extent of the incoming light beam 988, but they also preserve the spatial integrity of the beam's square (or rectangular) pattern (or cross-section). In the example of FIG. 80, a ledge 676 as in FIG. 53 is employed to support the die-cut film sheet 664. Strips of pressure sensitive adhesive (also called PSA) applied to ledge 676 may be used to affix sheet 664. Then sheet 666, when used, may just lay on top. Optionally, sheets 664 and 666 may be welded or heat-staked together at a corner or along an edge. Frame edge 994 is made to fit snugly into aperture opening 978 (FIG. 79), and various fasteners available for this purpose may be used as well. Decorative taper 996 may be applied to the body of bezel 992, or optionally, the bezel itself may be recessed into the body 5 of tile 6 for a more unobtrusive appearance. Illuminating aperture 998 in this example is 62 mm×62 mm.

Figure 81:
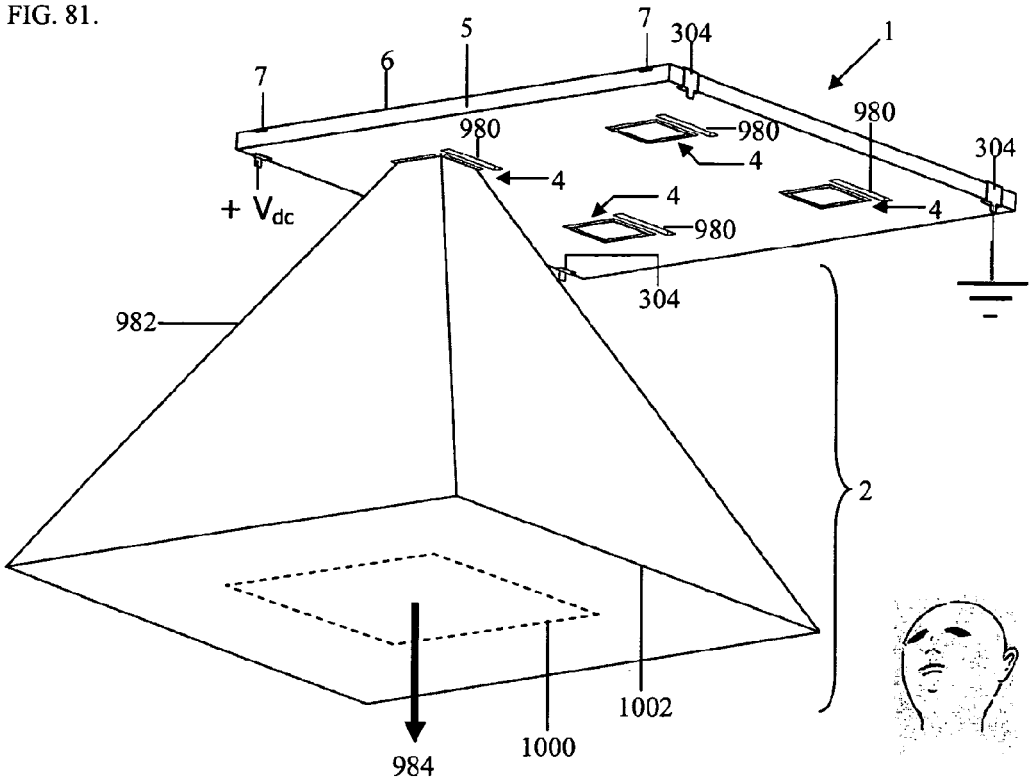
FIG. 81 is a perspective view from the floor beneath the tile system shown in FIG. 79 that illustrates the light spreading effect of the aperture covers as described in FIG. 80 on the illustrative illuminating beam generated by one of the embedded light distributing engines involved.

FIG. 81 is a perspective view from the floor beneath the tile system shown in FIG. 79 that illustrates the light spreading effect of the aperture covers 992 described in FIG. 80 on illustrative illuminating beam 982 generated by one of the embedded light distributing engines 4 involved. In this particular example, each embedded engine aperture cover 992 contains two substantially parabollically-shaped lenticular lens sheets 664 and 666, and only shows the system's front left light distributing engine 4 is switched on (for visual simplicity). According to the present tile illumination system invention, any combination of embedded light distributing engines may be activated, and each at any level of brightness commanded by master controller 40. In this example, two angle-spreading lenticular lens sheets are employed in the aperture cover system 990 involved to spread internally incoming +/−5-degree by +/−5-degree-beam 982 (shown in FIG. 79 and referenced in the present example by dotted cross-section 1000) into output beam 1002 having the +/−30-degree by +/−30-degree angular extent favored in general low-glare overhead flood lighting applications. One interesting variant occurs if the two angle-spreading films purposefully do not cover the entire aperture, which results in a combination of an unmodified +−5-degree beam and a +−30-degree beam, the narrow beam being effectively a square hotspot in the middle of the wider square beam.

And, as described previously, air slots 980 are provided to enable convective airflow between the floor area beneath tile system 1 and the utility (or plenum) space above it, thereby improving the performance of heat sink fins as shown in illustrations above.

Figure 82:
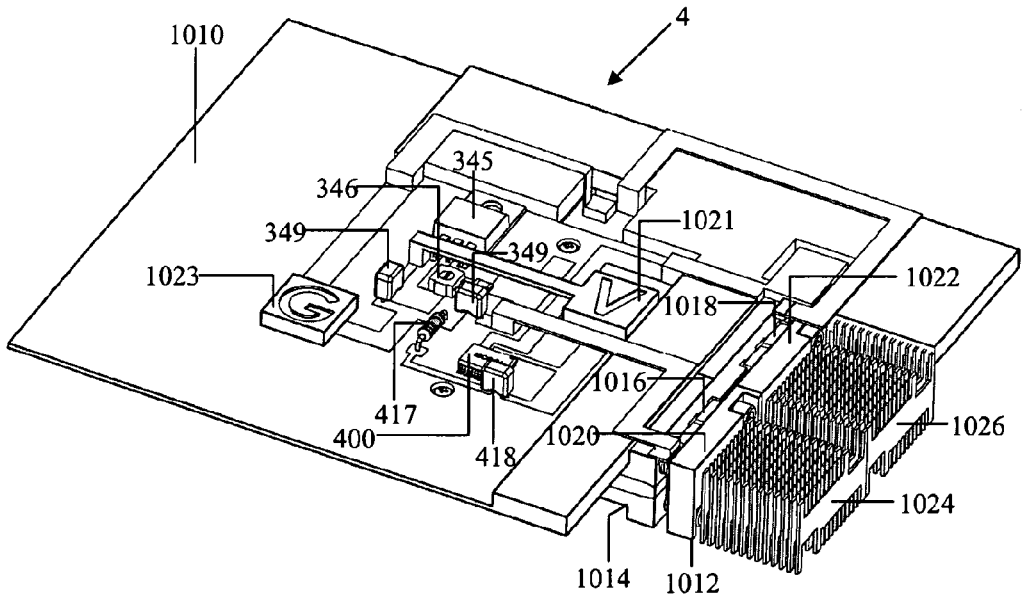
FIG. 82 is a perspective view shown from the backside of the tile embedding plate involved illustrating another type of embeddable thin light distributing engine compatible with best mode practice of the present tile system invention.

FIG. 82 is a perspective view shown from the backside of tile embedding plate 1010, illustrating another type of embeddable thin light distributing engine 4 compatible with best mode practice of the present tile system invention. This particular light distributing engine unit, illustrated more comprehensively in FIGS. 83-88, is 140 mm×100 mm in its overall embedding dimensions, 16 mm thick at its thickest point 1012 (10.4 mm at it's thinnest point 1014), and just as one example, contains two LED emitters 1016 and 1018 (twice that of the engine type illustrated in FIGS. 72-81). Many of the embedded electronic components are familiar from previous illustrations. Each LED emitter 1016 and 1018 are mounted on separate emitter mounting plates 1020 and 1022, each with their own heat fin assembly 1024 and 1026. Embedded DC-supply voltage strap (not illustrated in this view) attaches to voltage terminal 1021, and embedded ground access strap (not illustrated in this view) attaches to ground terminal 1023.

Figure 83:
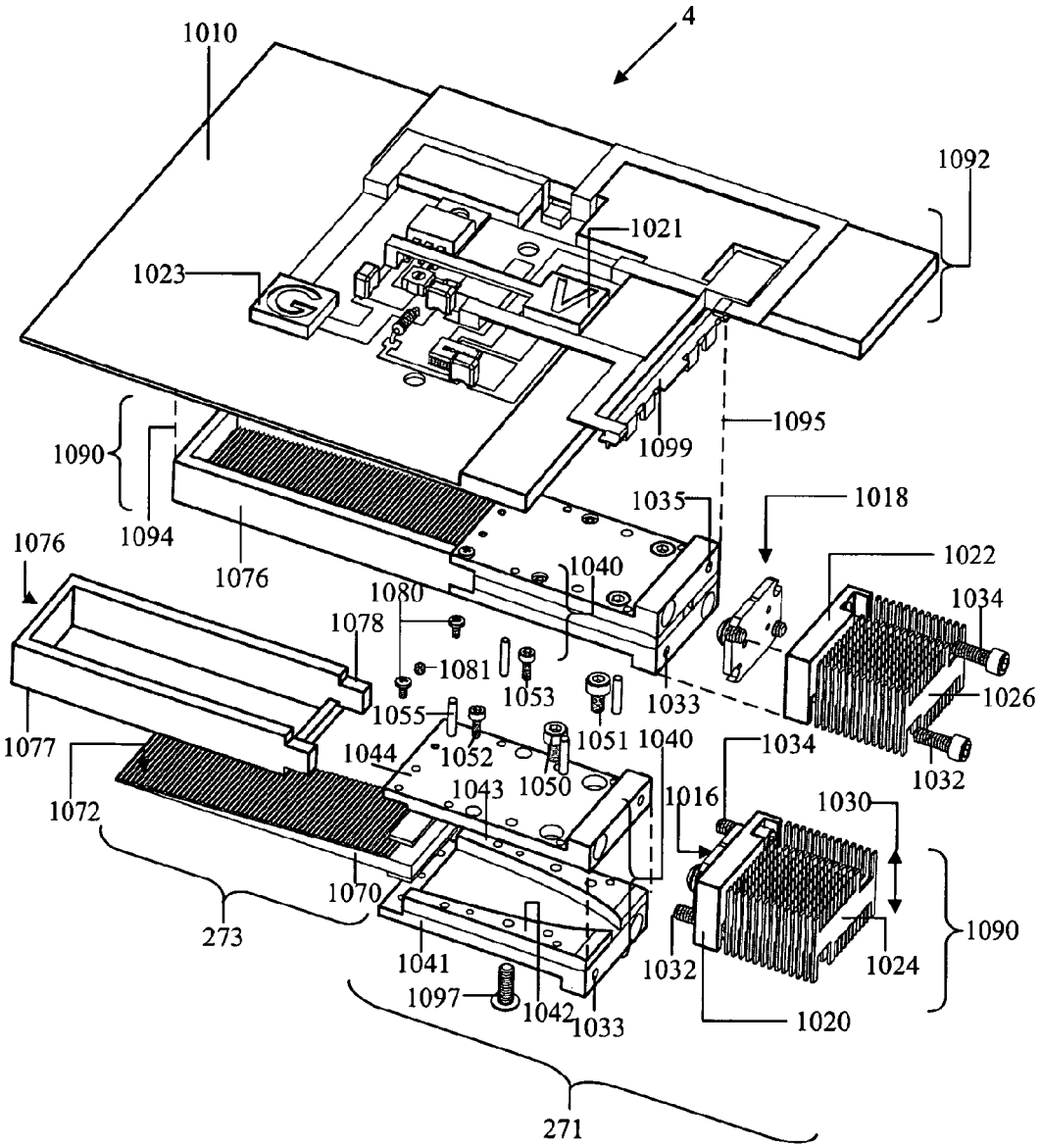
FIG. 83 is an exploded perspective view of the thin-profile light-distributing engine shown fully assembled in FIG. 82, as well as its internally arranged light distributing optic elements.

FIG. 83 is an exploded perspective view of the thin-profile light-distributing engine 4 shown fully assembled in FIG. 82. The two illustrative Osram Opto Semiconductors OSTAR™ LED emitters 1016 and 1018 in the present example are identical to emitter 850 as shown in FIGS. 74-75 in all respects except that they employ a 3×2 array of 1 mm LED chips rather than a 2×2 array of 1 mm chips. Their thickness 1030 (e.g., from surface 841 to 842 in FIG. 75) is limiting this particular engine's thickness, which can be reduced from 16 mm as shown, to about 10 mm using more compact LED emitter packages. It should be noted that in all light distributing engine designs, regardless of slimness of the light distributing optics, embedded electronics, and the LED light emitter package involved, the heat sink should be designed appropriately to effectively remove the wattage of heat produced by the LED emitters that are included. For some high wattage systems the heat sink will be the limiting factor in determining the ultimate compactness and physical thickness of the embedded system.

Figure 85:
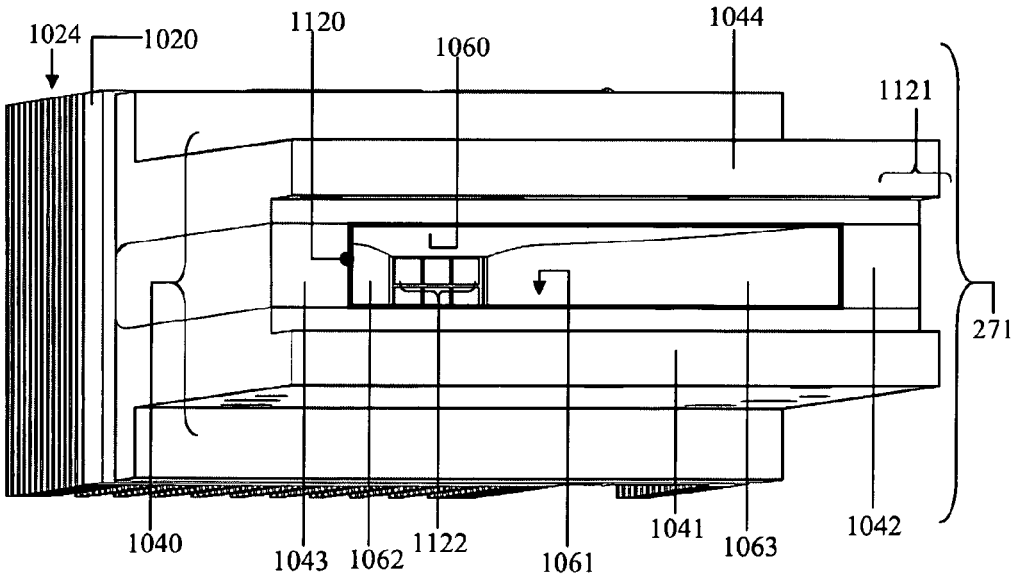
FIG. 85 is a fully assembled perspective view looking into the output aperture of rectangular angle transforming reflector unit used in the LED light emitter portion of the thin light-distributing engine of FIGS. 82-84.

The LED light emitter subsystem 271, as shown in the example of FIG. 83, corresponds to the general engine cross-section shown previously in FIG. 4C, and includes emitter mounting plate 1020 (or 1022), and heat fin element 1024 (or 1026) attached through mounting plate 1020 (or 1022) and through emitter 850 by attachment screws 1032 and 1034 mated with attachment holes 1033 and 1035 on angle transforming reflector unit 1040. Angle transforming reflector unit 1040 in this example comprises four separate parts (1041-1044): bottom 1041, left side 1042, right side 1043 and top 1044), and illustrative subassembly screws 1050-1053. One or more alignment pins 1055 may also be used to assure proper relationship is maintained between the four mathematically-curved reflective surfaces (1060-1063) involved. A more helpful view of LED light emitter subsystem 271 by itself is provided in FIG. 85, illustrating the rectangular relationships and the reflective curvatures involved, as well as the resulting illumination characteristics.

FIG. 83 also illustrates the general composition of light distributing optic 273, comprising tapered light guide plate 1070 and facetted film sheet 1072, attached to the plane surface of plate 1070 in the same manner described above. For this one example, light distributing optic 273 is made geometrically identical to light guide plate 928 and facetted film sheet 929 in longitudinal cross-section. The only salient difference in the present case is that the plate width has been decreased deliberately from the wider (56 mm) format shown for the light distributing engine example of FIG. 74, to the narrower 18.85 mm format employed in the present engine example, FIGS. 83-84. The width of plate 1070 is related to, and in fact controlled by, the associated width of angle transforming reflector 1040, which will be explained further below.

FIG. 83 also provides example of framing member 1076, which surrounds and protects the edges of light guide plate 1070 and facetted film sheet 1072. Framing member 1076 attaches to angle transforming reflector unit 1040 in this example by illustrative tabs 1078 and attachment screws 1080. In a related embodiment of this type of light distributing optic 273, a smooth reflector film is used in place of metal coated facetted reflector sheet 1072 and an uncoated version of facetted film sheet 1072 is attached to (or recessed into) the bottom edge 1077 of framing member 1076, the facet vertices facing (and receiving) light from light guide plate 1070.

FIG. 83 further shows how the core light generating segments 1090 attach to the electronic power control layer 1092 represented by tile embedding plate 1010, as along general guidelines 1094 and 1095, via illustrative attachment screws 1097 as shown (1098 hidden) which mate with corresponding threaded holes in the underside of plate 1010. Electrical power cable 1099 is used to make connection with positive and negative terminals on LED emitters 1016 and 1018 (936 and 937 as shown in FIG. 75).

Figure 84:
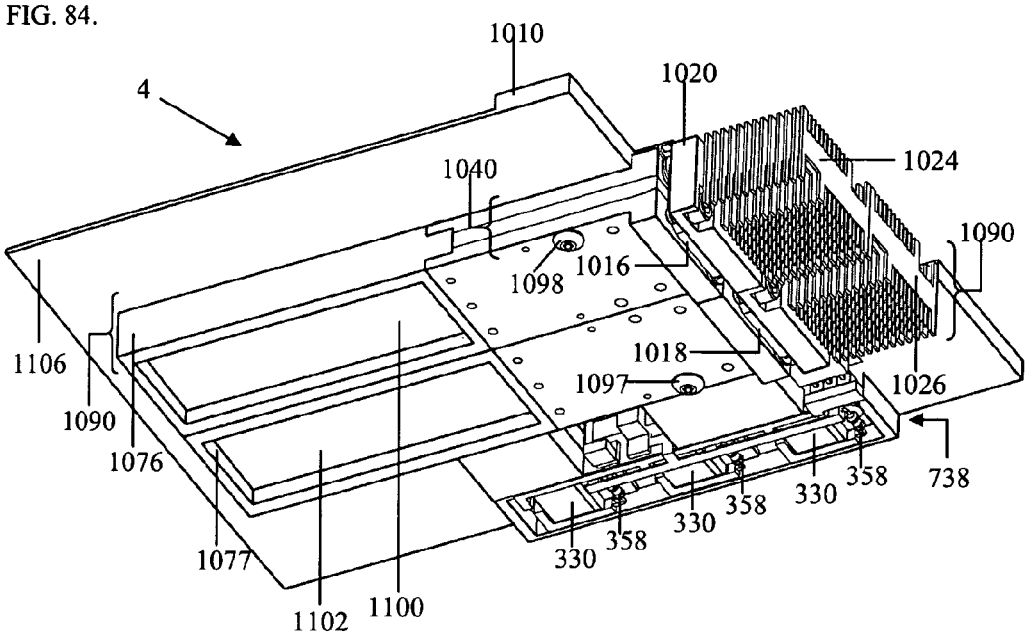
FIG. 84 is a perspective view shown from the floor side of the fully assembled form of the embeddable light-distributing engine of FIGS. 82-83, better illustrating its compactness, slimness, and flexibility.

FIG. 84 is a perspective view shown from the floor side of the fully assembled form of the embeddable light-distributing engine 4 of FIGS. 82-83, better illustrating its compactness, slimness, and flexibility. Light emitting apertures 1100 and 1102 of the two illustrative engines 4, are each 18.8 mm×62 mm in this example, together occupying an overall light distributing aperture area of 43.6 mm×62 mm. Flat type current switching circuit 738 of FIGS. 58-59 (analogous to 388 as in FIGS. 22-23) is used in this example to control the illumination of both LED emitters 1016 and 1018 simultaneously, however, a second switching circuit 738 can easily be added for situations where it is appropriate to control the illumination of adjacent light generating segments 1090 independently. It is equally easy to add additional light generating segments 1090, simply by extending the width of embedding plate 1010 as may be necessary. Bottom-side edge region 1106 of embedding plate 1010 is included to provide adequate bearing surface on which this type of light-distributing engine is embedded into the body 5 of tile 6 according to the present invention.

Figure 87:
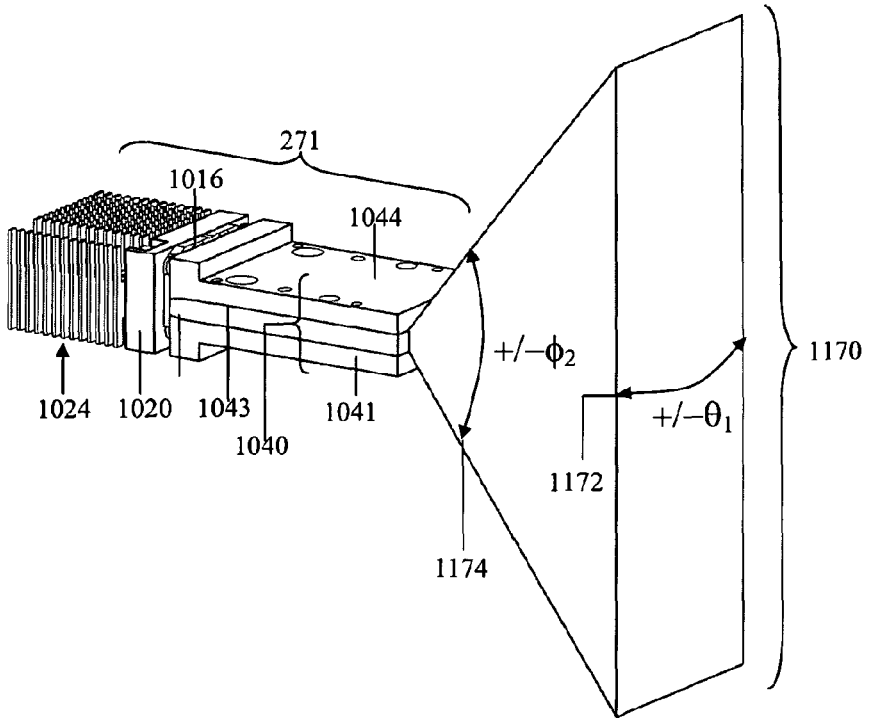
FIG. 87 is a perspective view of the illustrative LED light emitter portion of this example, illustrating the asymmetrical output light of angular extents $+/-\theta_1$ and $+/-\theta_2$ that is produced.

FIGS. 85-87 are provided in sufficient detail to better illustrate the form and optical behavior of this particular type of LED light emitter subassembly 271, taught fundamentally in U.S. Provisional Patent Application Ser. No. 61/024,814 (International Stage Patent Application Serial Number PCT/US2009/000575) entitled Thin Illumination System.

FIG. 85 is a fully assembled perspective view looking into the output aperture of rectangular angle transforming reflector unit 1040 used in the LED light emitter portion 271 of the thin light-distributing engine of FIGS. 82-84, its output aperture highlighted by thick black boarder line 1120. Rectangular angle transforming reflector unit 1040 is used to collect light from the 6 included chips 1122 of LED emitter 1016 (or 1018) in this example and then route that light by the minimum possible number of internal reflections from the unit's four internal side walls (e.g., mathematically-curved reflective surfaces 1060-1063) into the corresponding input aperture of light guide plate 1070 (as shown in FIG. 83). The minimum number of internal reflections, and thereby the highest possible throughput efficiency of light coupling, is achieve by shaping each of the four reflective sidewalls by a function that maintains the etendue-preserving geometric relationship between input aperture size and output aperture size in both meridians (wide and narrow) defined by the fundamentals of the traditional (and well established) Sine Law, as illustrated in U.S. Provisional Patent Application Ser. No. 61/024,814 (International Stage Patent Application Serial Number PCT/US2009/000575) entitled Thin Illumination System, and summarized herein by FIG. 86, equations 7 and 8.

FIG. 86 is schematic a top cross-sectional view of the angle transforming reflector arrangement shown in FIG. 85 along with LED emitter 1016. In this illustration, reflector part 1044 (and its illustrative attachment screws) are removed to reveal the underlying geometrical relationships controlled by equations 7 and 8 (in terms of the reflector element's input aperture width 1126, $d_1$, its ideal output aperture width $D_1$, its ideal length $L_1$, and its ideal output angular extent $+/-\theta_1$), with $+/-\theta_0$ being the effective angular extent of the group of LED chips 1122 in LED emitter 1016 (effectively +/−90-degrees). Similar relationships, equations 9 and 10, govern the orthogonal meridian's ideal geometry $d_2$, $D_2$, $L_2$, and $\theta_2$, but are not illustrated graphically. The symmetrically disposed reflector curves 1062 and 1063 of reflector section 1133 as shown in FIG. 86 are ideal in that their curvatures satisfy the boundary conditions given by equations 7 and 8 at every point. Section 1133 only shows the initial length, $L_{11}$, of an otherwise ideal reflector length $L_1$. Initial length $L_{11}$ is expressed as f $L_1$, where f is a fractional design value typically greater than 0.5 (e.g., f=0.62 in the present example).

$$d_1 \text{ Sin } \theta_0 = D_1 \text{ Sin } \theta_1 \quad (7)$$

$$L_1 = 0.5(d_1 + D_1)/\text{Tan } \theta_1 \quad (8)$$

$$d_2 \text{ Sin } \theta_0 = D_2 \text{ Sin } \theta_2 \quad (9)$$

$$L_2 = 0.5(d_2 + D_2)/\text{Tan } \theta_2 \quad (10)$$

It's usually a reasonable approximation in practice that Sin q0~90-degrees, especially with the LED light emitters used in accordance with the present invention. The ideal reflector lengths L1 and L2 can be expressed more compactly, in this case, as in equations 11 and 12.

$$L_1 = 0.5d_1(\text{Sin } \theta_1 + 1)/(\text{Sin } \theta_1 \text{ Tan } \theta_1) \quad (11)$$

$$L_2 = 0.5d_2(\text{Sin } \theta_2 + 1)/(\text{Sin } \theta_2 \text{ Tan } \theta_2) \quad (12)$$

A unique design attribute of this particular light-distributing engine 4 is that the angular extents of the output illumination 2 in each output meridian ($+/-\theta_1$ and $+/-\theta_2$) are completely independent of each other. The reflector geometry developed in FIG. 86 (i.e., meridian 1) determines the engine's output angular extent ($+/-\theta_1$ or $+/-\theta_{11}$) in only that one meridian. The engine's output angular extent in the other meridian ($+/-\theta_2$) is determined only by the (independent) behavior of the light distributing optic 273 (e.g., tapered light guide plate 1070 and facetted film sheet 1072).

In the present example of FIGS. 82-86, $d_1$=3.6 mm, as set by the size, spacing and surrounding cavity of Osram's three inline 1 mm LED chips (as shown in detail of FIG. 85), $+/-\theta_1$=+/−10.5-degrees by design choice, so $D_1$ (from equation 7) becomes in this case approximately 3.6/Sin(10.5)=19.75 mm, and the ideal reflector length $L_1$ associated with these conditions becomes (from equation 8) 0.5 (3.6+19.75)/Tan(10.5)=63.0 mm. Optical ray trace simulations (using the commercial ray tracing software product ASAP™ Advanced System Analysis Program, versions 2006 and 2008, produced by Breault Research Organization of Tucson, Ariz.) have shown that ideal reflectors of this type (governed the Sine Law equations 7-10) can be trimmed back in length from their ideal, $L_1$, without incurring a significant penalty in their effective angle transforming efficiency (or output beam quality). And, when used in the present light distributing engine arrangement, which preferably deploys angle spreading output aperture films such as have been described previously (e.g., the parabolic lenticular lens sheets shown FIGS. 53, 54 and 80) the tolerance to such deviations in design from ideal dimensions becomes less critical. Accordingly, in the present example, the angle transforming reflector unit (1040) has been reduced in length by 38%, to a total length, $L_{11}$ (as shown in FIG. 86), of 39 mm. As a result, illustrative LED input ray 1142 is reflected from reflector curve 1063 at point 1140 and strikes symmetrically disposed reflector curve 1062 at point 1144, reflecting ideally outwards without an additional reflection as output ray 1146 of LED light emitter subsystem 271, making the intended output angle $\theta_1$ (1130) with reflector axis line 1148.

The small deviation from ideality tolerated with the reflector length reduction as shown in the example of FIG. 86 is indicated by the trajectory differences between LED input ray segments 1150 and 1152 (dotted). The trajectory of ray 1150 (angle $\theta_1$ with axis line 1148) is determined by the ideal (etendue preserving) reflector length $L_1$ and the ideal output aperture width $D_1$, such that by geometry, Tan $\theta_1$=($D_1$/2)/$L_1$, set by choice to 10.5-degrees in the present example. The deviant trajectory of ray 1152, however, is set by the reduce length, $L_{11}$, and the proportionally reduced output aperture width, $D_{11}$, as Tan $\theta_{11}$=($D_{11}$/2)/$L_{11}$. In this example, $L_{11}$=39 mm and $D_{11}$=18.75 mm, so $\theta_{11}$=13.5-degrees, which is only a small degree of angular deviation, and inconsequential to most commercial lighting applications of the present invention. Furthermore, it is only a fraction of the total rays that fall into this deviation.

Whenever more sharply cut-off angular illumination is required using this form of thin-profile light distributing engine 4 (as in FIGS. 82-86), a lesser degree of reflector truncation may be employed.

The angle transforming reflector's design in the orthogonal meridian ($+/-\theta_2$) is made to deliberately pre-condition light for optimum coupling efficiency to the corresponding entrance face of light distributing optic 273 (i.e. light guide plate 1070 and facetted film sheet 1072). Preferable angular conditions for this purpose were shown in U.S. Provisional Patent Application Ser. No. 61/024,814 (International Stage Patent Application Serial Number PCT/US2009/000575) entitled Thin Illumination System, as being between +/−50-degrees and +/−55-degrees (in air) for a 3 mm thick tapered light guide plate having a 3-degree taper-angle made of highest optical grade transparent plastic or glass.

FIG. 87 is a perspective view of the illustrative LED light emitter portion 271 of this example described in FIGS. 82-86, illustrating the asymmetrical output light 1170 that is produced. Angular extent 1172 ($+/-\theta_1$) applies to the horizontal plane of light guide plate 1070, and transfers through the plate substantially unchanged as the light distributing engine's output illumination 2 in that meridian. Angular extent 1174 ($+/-\phi_2$) applies the vertical plane of light guide plate 1070 only as an intermediary step. It is transformed by processing within this meridian of the light distributing optic subsystem to the light distributing engine's narrower output illumination 2 provided in that meridian (e.g., $+/-\theta_2$). The mechanical overhang on reflector parts 1041 and 1044 (1121 as in FIG. 85) has been omitted in this view for visual clarity of output light beam 1170. The purpose of overhang 1121 is only mechanical, proving a firm means of inclusion (and alignment) for light distributing optic 273, via setscrews 1081 as indicated in the exploded details of FIG. 83.

Figure 88:
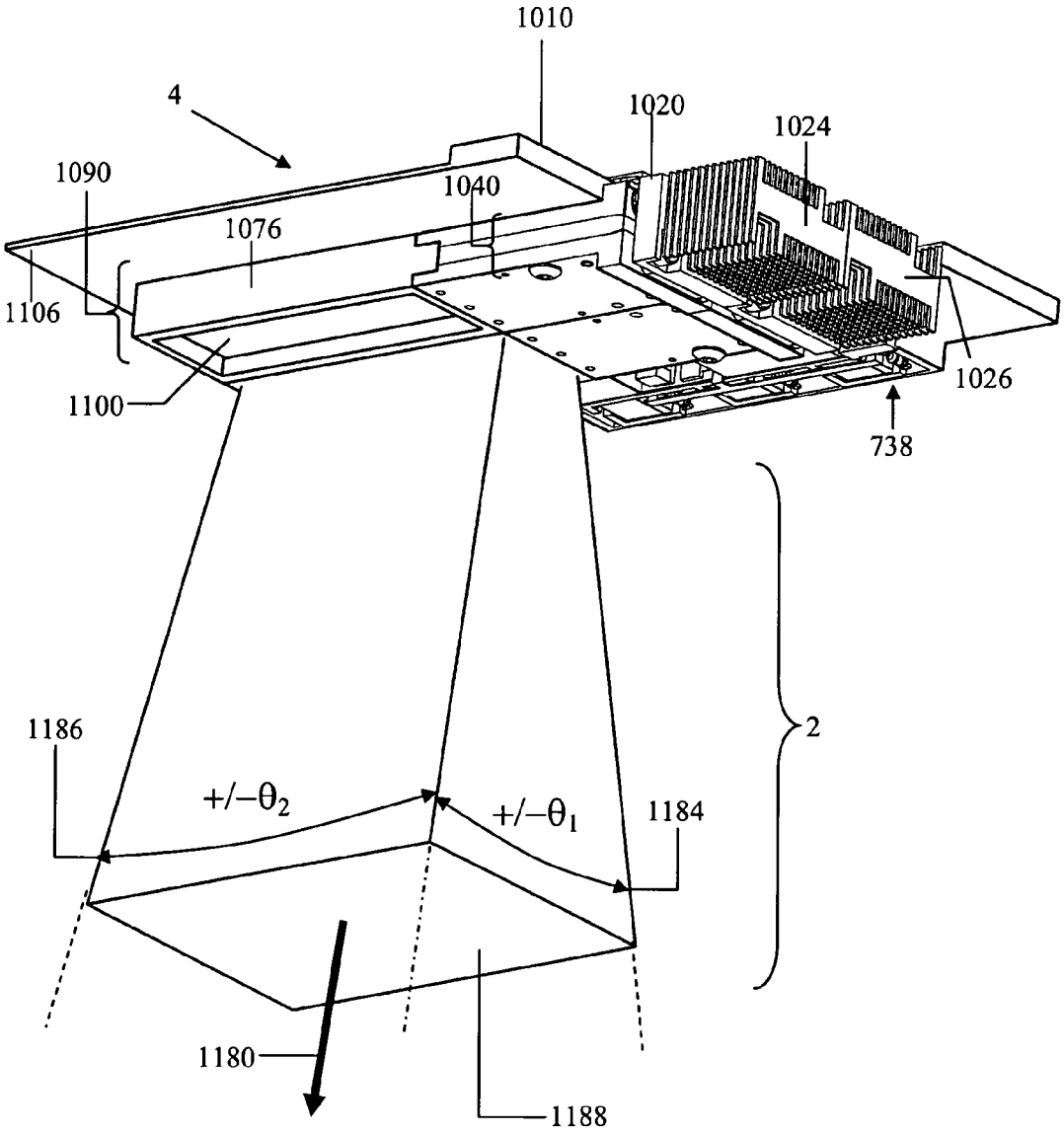
FIG. 88 is a perspective view similar to that of FIG. 84, provided to illustrate a tightly organized +/−10.5-degree by +/−5-degree light output beam producible with this type of light distributing engine.

FIG. 88 is a perspective view similar to that of FIG. 84, provided to illustrate a tightly organized +/−10.5-degree by +/−5-degree light output beam producible with this type of light distributing engine 4. Output illumination 2 is directed along axis 1180 and shown emanating from just a single light-generating segment for purposes of this illustration. The light is reasonably well collimated, with angular extent 1084 ($+/-\theta_1$) being +/−10.5-degrees by way of this example, established by the geometric relations of FIG. 86, and with angular extent 1086 ($+/-\theta_2$) being an intrinsic consequence of the angular transformation imparted by the engine's thin-profile light distributing optic 273. Output illumination 2 from all light generating segments 1090 simultaneously, or from each light generating segment 1090 individually, may be broadened in angular extent by the addition of the light spreading film sheets (e.g., 664 and 666) described above (as in FIGS. 53, 54 and 80), changing the beam-cross-section 1188 from the rectangular form shown, to another wider one.

This ability to modify the illumination's angular extent in separately switchable light generating segments is a unique attribute of this form of thin-profile light distributing engine 4. The capability enables use of a singly embedded light-distributing engine to provide more than one lighting function (as in spot lighting, flood lighting, and wall washing). This mode of operation is provided for when differently designed angle spreading films 664 and 666 (described above in FIGS. 53, 54 and 80) are added to the output aperture of each adjacent light generating segment 1090, as for example, within each framing member 1076, along with the addition of separate current switching circuits 738 for each LED emitter 1016 and 1018 involved.

Even more flexibility is provided when angle spreading films (664 and 666) and the specific internal design of the light distributing optic 273 are combined, as for example in FIGS. 64-65, to enable obliquely directed output illumination from each light-generating segment, in opposing angular directions. In this oblique illuminating mode, the ability to provide wall-washing illumination, as to the opposing walls of a hallway, is enabled. Moreover, by adding a third light generating segment 1090 to provide down-directed (e.g., flood lighting) illumination, three separately controlled lighting functions from a single light distributing engine 4 are enabled (left wall washing, right wall washing and general floor illumination).

Figure 89:
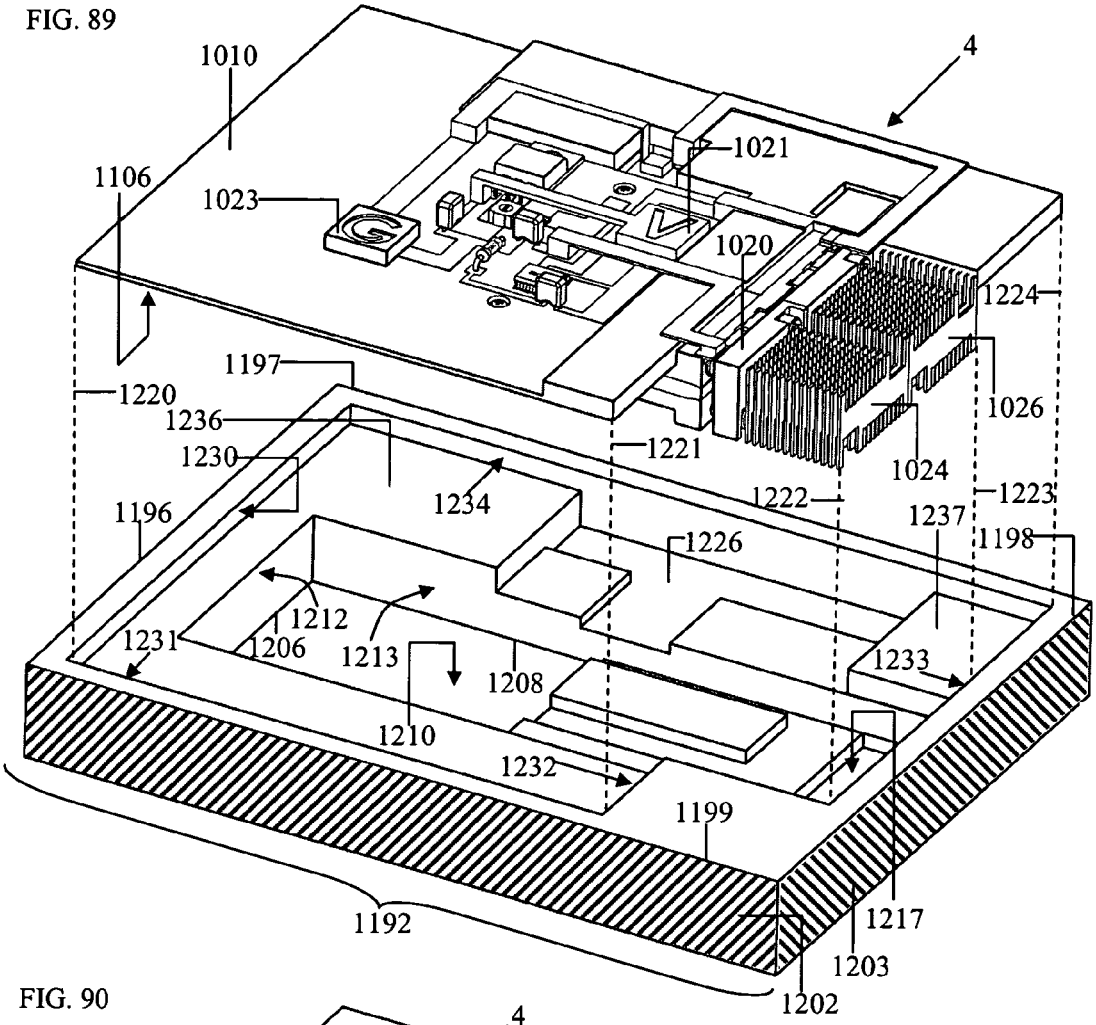
FIG. 89 is an exploded perspective view of the engine-tile embedding process limited (for illustration purposes only) to a localized tile material embedding region immediately surrounding the multi-segment thin-profile light distributing engine form of FIGS. 82-88 according to the present invention.

FIG. 89 is an exploded perspective view of the engine-tile embedding process limited (for illustration purposes only) to a localized tile material embedding region 1192 immediately surrounding the multi-segment thin-profile light-distributing engine 4 form of FIGS. 82-88, according to the present invention. While only two adjacent light generating segments 1090 are illustrated in this example, a similar embedding process is employed regardless of the number of engine segments involved. Tile embedding-region 1192 is bound by edges 1196-1199, including the two visible cross-sectional areas 1202 and 1203 (shown cross-hatched) of tile body 5. Two edges 1206 and 1208 are visible of four-sided rectangular illumination aperture 1210. Sidewalls 1212 and 1213 (with 1214 and 1215 neither marked nor visible) are the embedding nest for the outside surfaces of the framing member 1076 (e.g., FIG. 88) that surround and protect the edges of light guide plate 1070 and faceted film sheet 1072 comprising light distributing optic 273 of the present engine example. Rectangular slot 1217 in the body 5 of tile embedding region 1192 is matched in size to the airflow portion of heat sink fins 1024 and 1026. Slot 1217 is similar in function to earlier tile body slots provided for the same purpose (e.g., 308 in FIGS. 11-14).

Multi-segment thin-profile light distributing engine 4, as shown in FIG. 89, embeds within tile embedding region 1192 (ultimately a constituent part of a larger tile or panel material 6) along dotted guidelines 1220-1224. The engine's current switching electronic circuit 738 is nested in embedding cavity 1226. The engine's embedding plate 1010 is nested against sidewalls 1230-1234, and is supported by tile surface planes 1236 and 1237, which reside at substantially the same elevation.

The localized tile-material embedding region 1192, as another example, may represent a segment of building material (e.g., plaster board, drywall, or other equivalent composite construction material used in the formation of ceilings and walls) pre-embedded in this manner, and later "mudded in," "glued in," or otherwise affixed into place in a substantially seamless manner within a larger sheet or section of the same material as embedding region 1192. In this case, the external DC voltage and ground access connections described above in the example of suspended ceilings are made differently, using low-voltage wires and conventional connectors.

Figure 90:
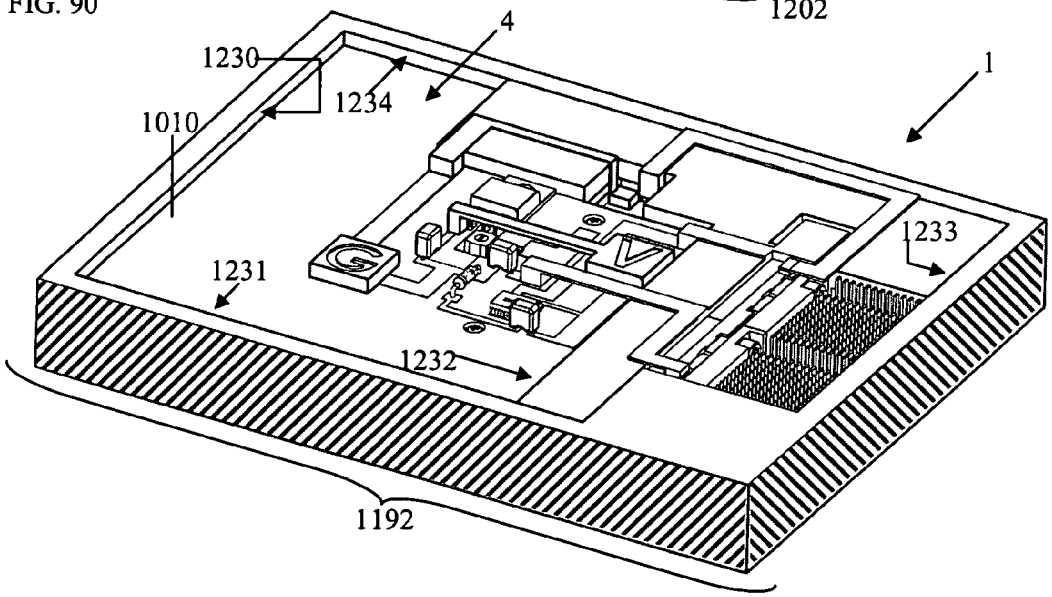
FIG. 90 is the perspective view of FIG. 89 after the engine embedding process has completed, showing the backside of the embedded engine.

FIG. 90 is the perspective view of FIG. 89 after the engine embedding process has completed, showing the backside of the embedded engine.

Figure 91:
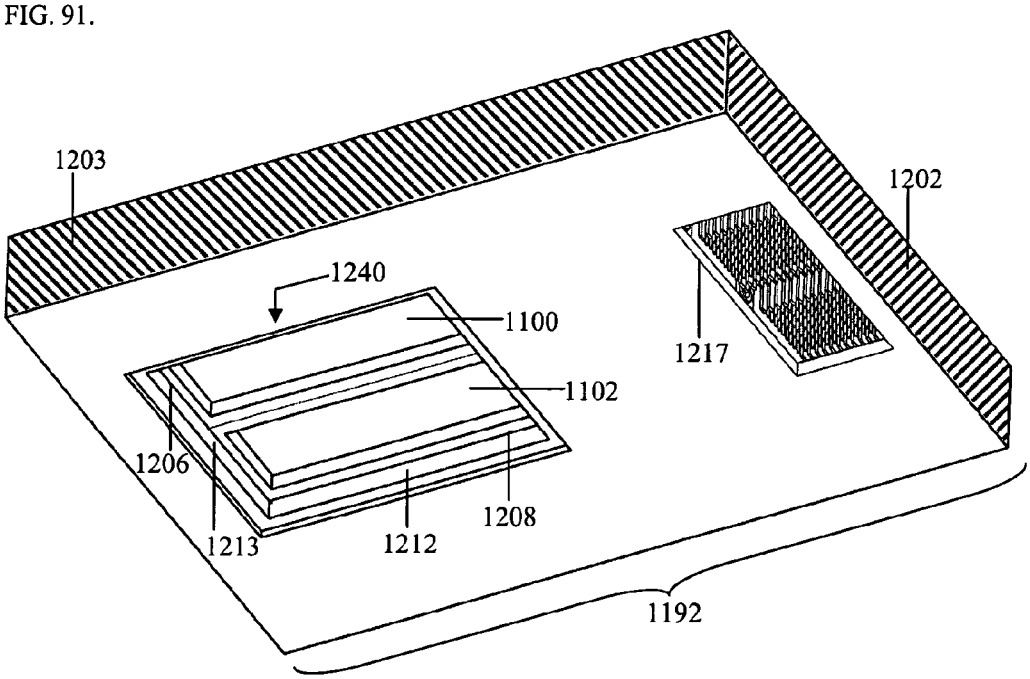
FIG. 91 is a floor side perspective view of the embedding region of the tile illumination system from FIG. 90, tilted to show both illuminating apertures shown previously in FIG. 84 for this multi-segment form of light-distributing engine alone.

FIG. 91 is a floor side perspective view of the embedding region 1192 of tile illumination system 1 as illustrated in FIG. 90, tilted to show both illuminating apertures 1100 and 1102 as shown previously in FIG. 84 for this type of multi-segment light distributing engine alone. Outer illumination aperture opening 1240 and optional airflow slot 1271 are shown without modification, and may each be covered with a flush mounted bezel (or fascia), as was shown for example in FIGS. 53-56 and 80-81, to make their visual appearance more unobtrusive and in the case of 1240, to modify the illuminating characteristics.

Figure 92:
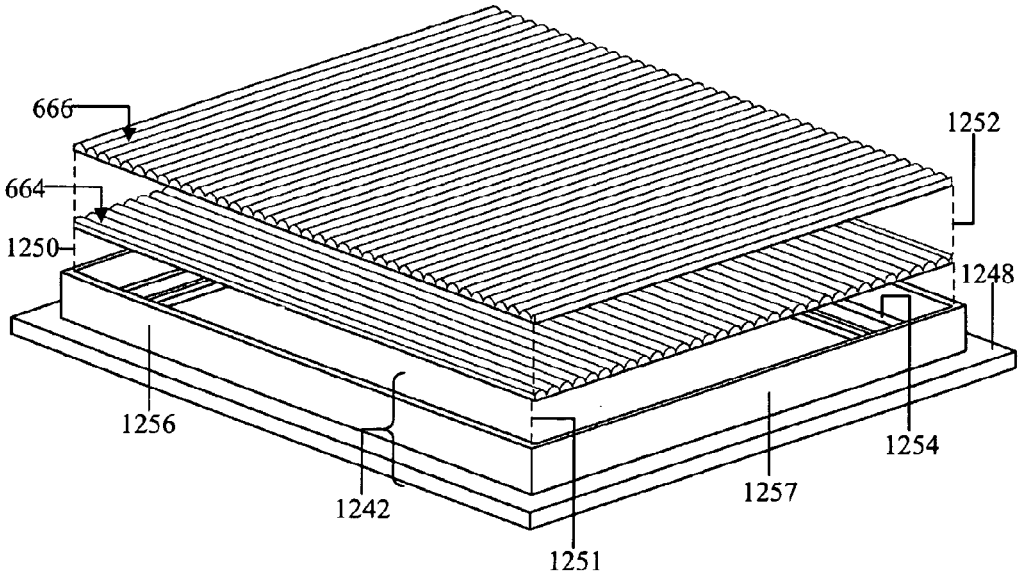
FIG. 92 is an exploded perspective view illustrating a single aperture example of an embeddable aperture covering bezel suited this type of multi-segment light distributing engine 4.

FIG. 92 is an exploded perspective view illustrating a single aperture example of an embeddable aperture covering bezel 1242 suited to this aperture opening 1240 for this type of multi-segment light distributing engine 4. As shown previously in FIGS. 53-56 and 80-81, two light spreading film sheets 664 and 666 are also included in this example to receive light from both illustrative engine apertures 1100 and 1102. Either one, both or neither of the light spreading film sheets 664 or 666 may be installed in accordance with the present invention, as along dotted guidelines 1250-1252. The planeside of light spreading film sheet 664 rests on, and may be physically attached to, supporting rim surface 1254. Bezel nesting surfaces 1256-1259 (only 1256 and 1257 visible) fit snugly into counterpart surfaces (e.g., 1214 and 1215 in FIGS. 89 and 91, not illustrated).

Figure 93:
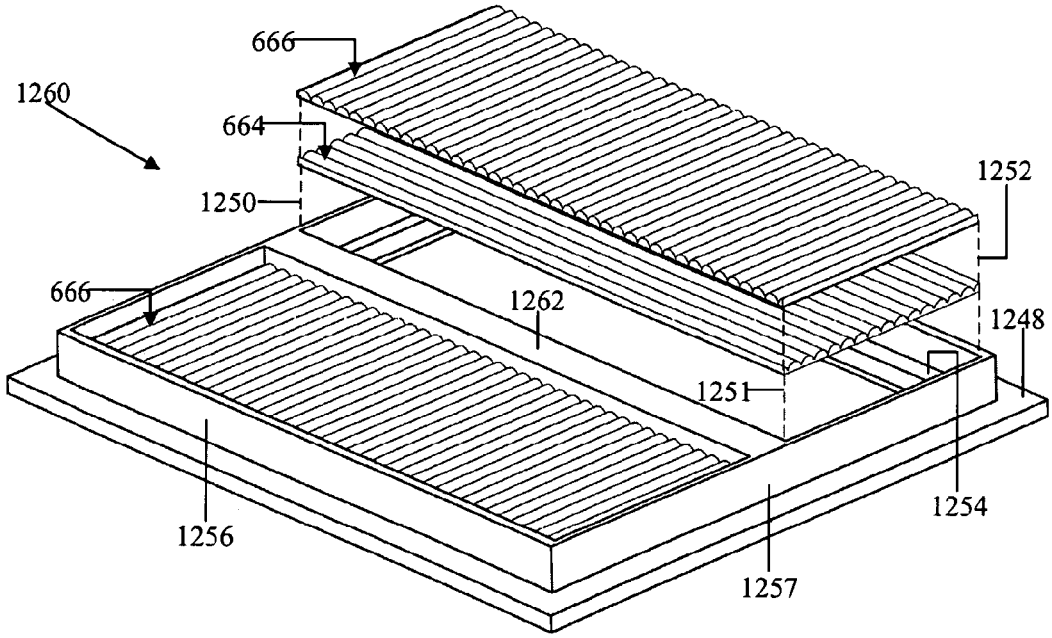
FIG. 93 is a partially exploded perspective view illustrating a segmented aperture covering bezel suited for embedding in the aperture opening of a multi-segment light distributing engine as shown in FIGS. 88-91.

FIG. 93 is a partially exploded perspective view illustrating a segmented aperture covering bezel 1260 suited for embedding in aperture opening 1240 with this type of multi-segment light distributing engine 4. The illustrative design is similar to that of FIG. 92 except for the addition of segment separating bar 1262.

Figure 94:
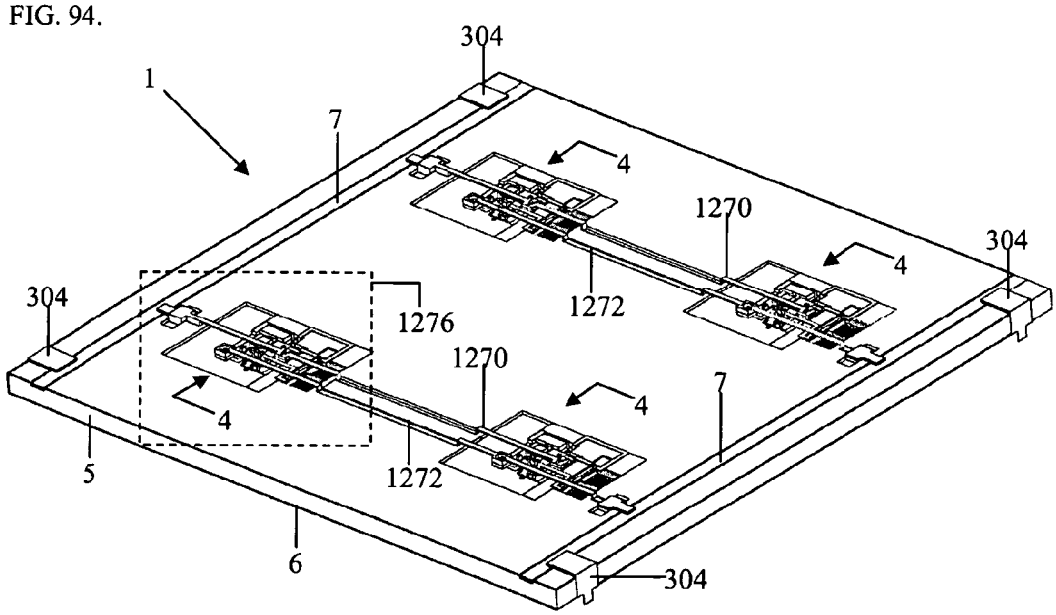
FIG. 94 is a perspective view shown from the backside of the illustrative 24"×24" tile material involved, illustrating the embedding of four two-segment light distributing engines described by the process details of FIGS. 89-91.

FIG. 94 is a perspective view shown from the backside of the illustrative 24"×24" tile material involved, illustrating the embedding of four two-segment light distributing engines described by the process details of FIGS. 89-91, including associated DC voltage strap 1270 and ground access strap 1272.

Figure 95:
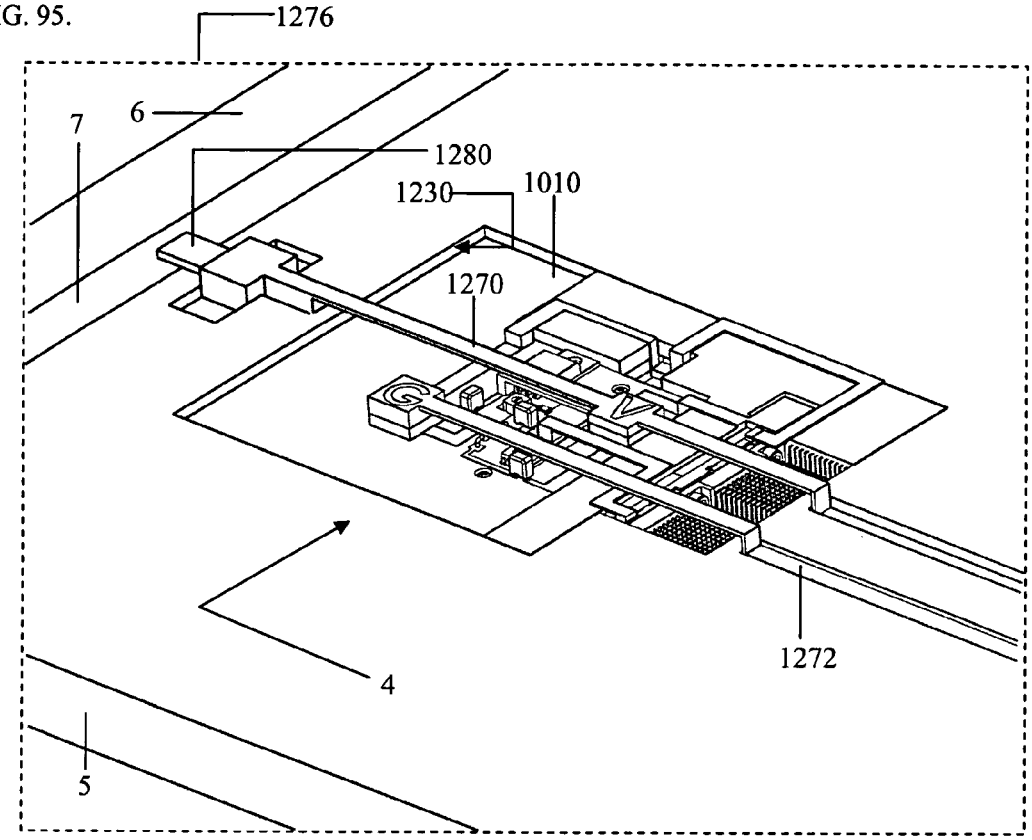
FIG. 95 is a magnified perspective view of front left portion of the tile illumination system shown in FIG. 94, illustrating full tile embedding details including the attachment of the associated DC voltage strap and ground access strap.

FIG. 95 is a magnified perspective view of front left portion 1276 of the tile illumination system 1 shown in FIG. 94, illustrating full tile embedding details including the attachment of both DC voltage strap 1270 and ground access strap 1272. DV voltage connection tab 1280 makes electrical contact with DC voltage buss 7, which is connected to external DC voltage supply 30 (not illustrated) via electrical connectors 304 (e.g., FIG. 94), whether by discrete cables, an electrical conductive T-bar tile suspension member (as in FIGS. 68-71), or some other equally effective means.

The examples of light distributing engine embeddings thus far have emphasized direct engine-tile combinations. While this may be a preferred production mode for many engine embedding situations, it may be preferable in some situations to pre-embed the tile cavities with an intermediary gasket material, especially when tile materials being used are composed of materials whose internal structure is easily abraded. In these cases, a more resilient material (e.g., plastic, plastic/glass composite or metal) is used as a protective edge boundary, which is illustrated in the magnified perspective view of FIG. 96 as an alternative embodiment of the present invention.

Figure 96:
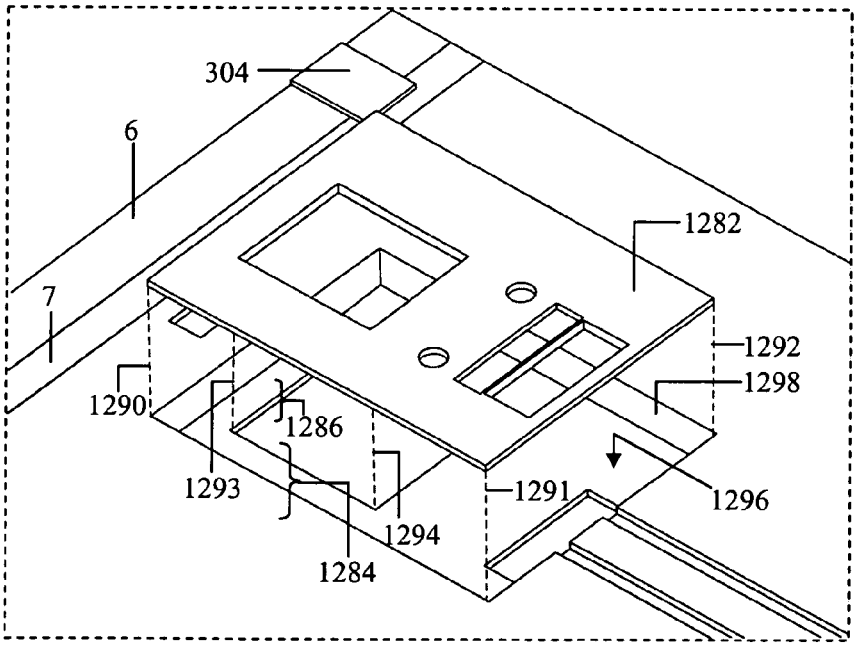
FIG. 96 is an exploded perspective view showing the inclusion of an illustrative tile cavity gasket within a corresponding engine embedding cavity of an illustrative 24"×24" tile, as an interim step prior to embedding the light-distributing engine 4 itself.

FIG. 96 is an exploded perspective view showing the incorporation an illustrative tile cavity gasket 1282 within a corresponding engine embedding cavity 1284 that happens to be located in the upper left hand corner of an illustrative 24"×24" tile 6, as an interim step prior to embedding the light-distributing engine 4 itself. This particular illustrative gasket 1282 is plate-like, with rims (hidden underneath) that fit into and bond against the thinner tile cavity apertures 1286 sealing their edges. Gasket 1282 is introduced along dotted guidelines 1290-1294, and is optionally bonded to cavity floor 1296 (lending additional strength). Another gasket variation (not illustrated) includes four vertical sidewalls to seal against the thicker tile cavity sidewalls 1298.

Figure 97:
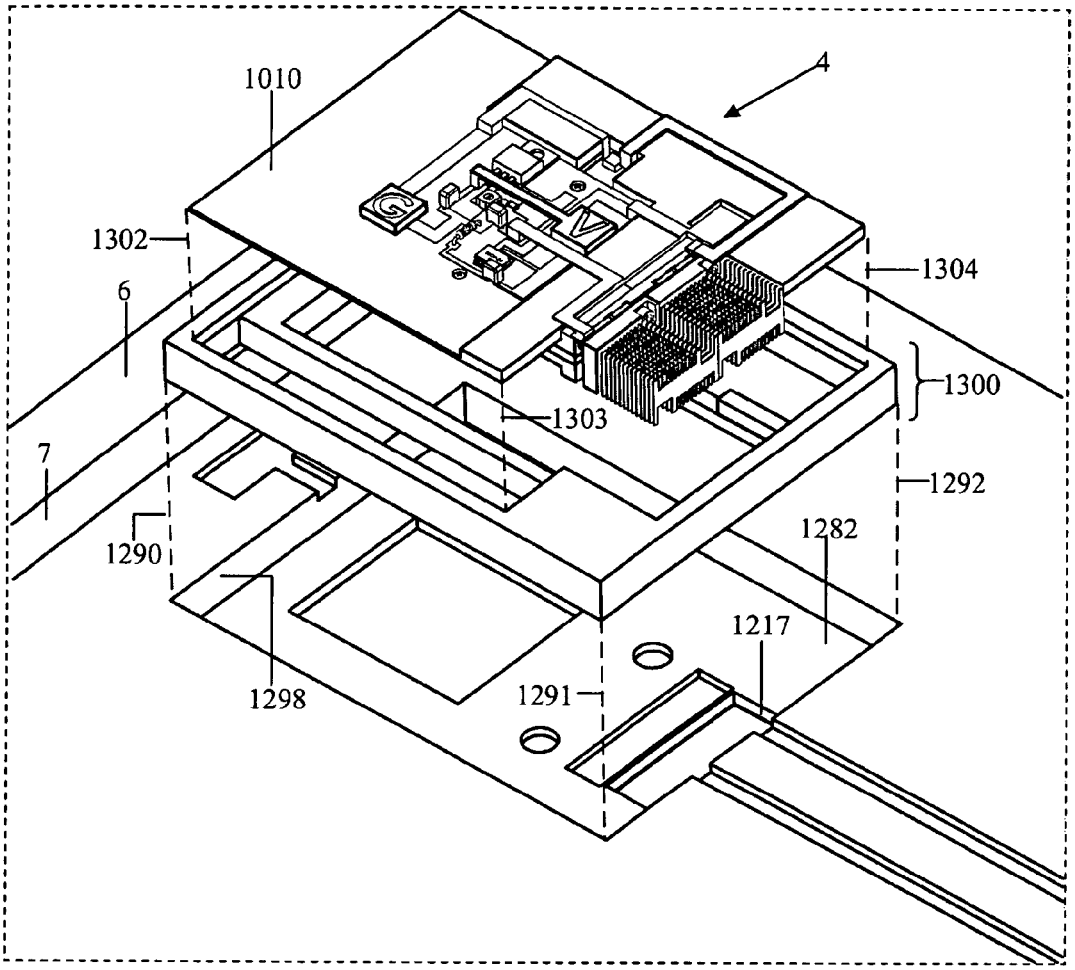
FIG. 97 is an exploded perspective view of the engine embedding cavity of FIG. 96 after embedding (and sealing) the tile cavity gasket just prior to embedding a two-segment light distributing engine and its supporting chassis.

FIG. 97 is an exploded perspective view of the engine embedding cavity of FIG. 96 after embedding (and sealing) the tile cavity gasket 1282, just prior to embedding a two-segment light distributing engine 4 and its supporting chassis 1300 along the same guide lines (i.e., 1290-1292). The two-segment light distributing engine example nests in supporting chassis 1300 following dotted guidelines 1302-1304.

Figure 98:
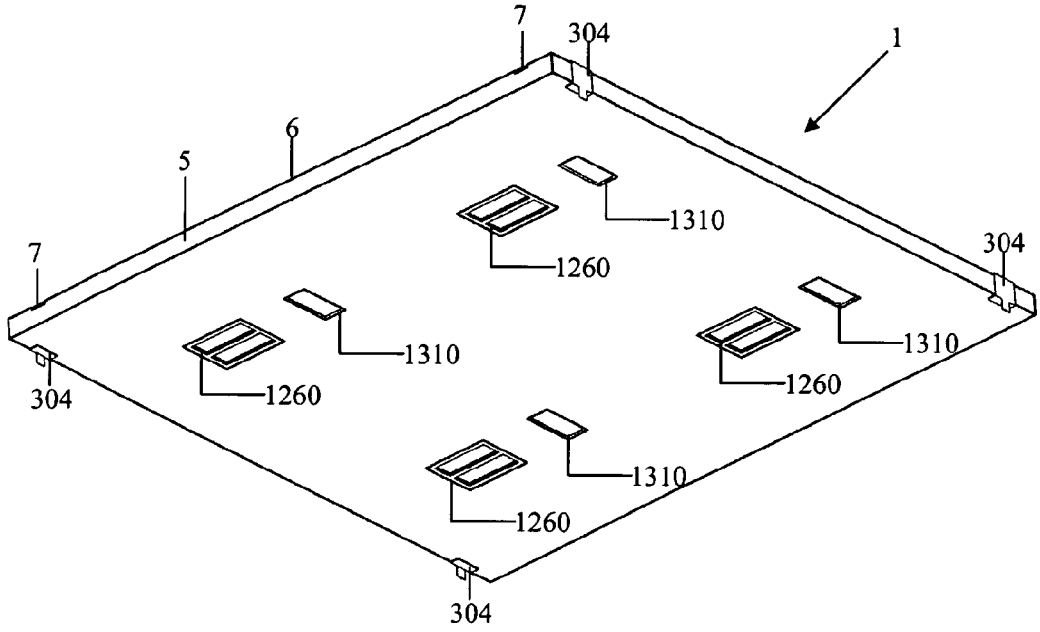
FIG. 98 is a perspective view from the floor beneath of the present tile illuminating system example, that contains four embedded two-segment light distributing engines, each having illustrative output aperture covers of the two-segment bezel style shown in FIG. 93.

FIG. 98 is a perspective view from the floor beneath of the present tile illuminating system example, that contains four embedded two-segment light distributing engines 4, each having illustrative 64 mm×55 mm output aperture covers of the two-segment bezel style 1260 shown in FIG. 93. In this example, optional airflow slots 1217 (with decorative covers 1310) have been provided in the body 5 of tile 6. As mentioned above, in many instances slots such as these are unnecessary for good practice of the present invention, as Venturi airflow within the heat sink fins on the backside of tile 6 can be sufficient. In situations needing higher levels of airflow, a method of turbulent pulsed airflow may be added (e.g., Synjet as manufactured by Nuventix) as part of the sink construction.

Figure 99:
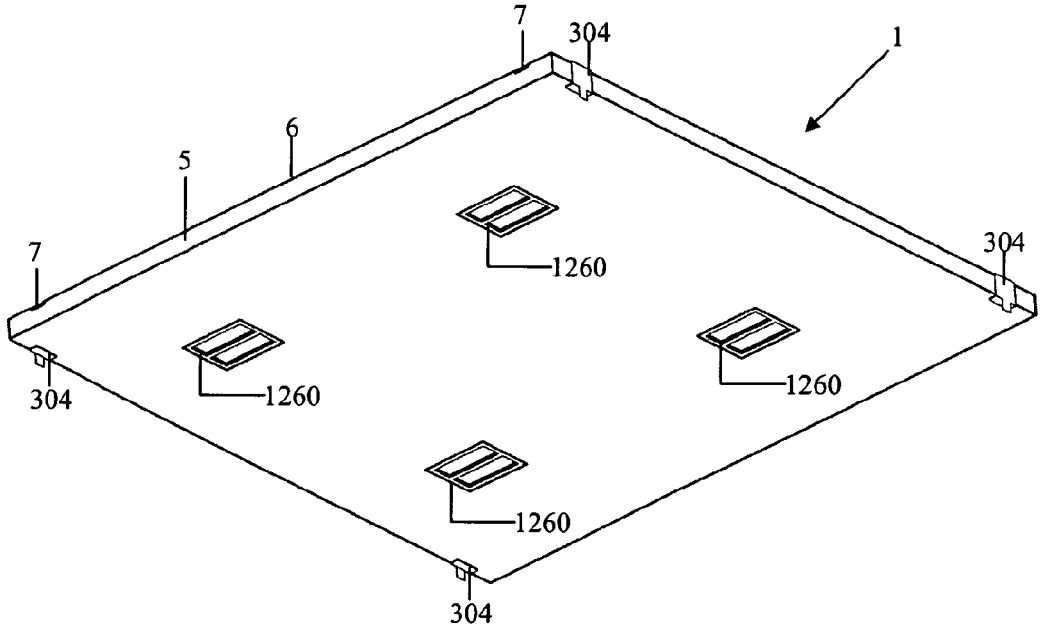

FIG. 99 is a perspective view identical in all respects to that of FIG. 98, except that optional airflow slots 1217 and their decorative covers 1310 have been eliminated from this embodiment of the illustrative tile illumination system 1.

FIG. 100 is a perspective view from the floor beneath of yet another illustrative embodiment of present tile illuminating system invention, this one embedding two separate two-segment light distributing engines 4 of the type illustrated in FIGS. 82-99, both in the proximate center of an illustrative 24"×24" tile 6.

FIG. 101 provides a perspective view from the floor beneath the tile illumination system 1 of FIG. 100, showing one example of its operation, two obliquely directed hallway wall washing beams 1320 and 1322. With external supply voltage, $V_{dc}$, as from a supply source 30 (not illustrated), applied to its left side power connectors 304 and ground access to its right side power connectors 304, this particular two-engine, four-segment tile illuminating system is arranged to produce two differently angled (and differently directed) illuminating beams, 1320 and 1322 (see the more generic example shown in FIGS. 64-65), such as might be well suited to providing wall illumination to the left side and right side walls as in a hallway. Beam 1320, in this example, is directed along axis 1324 (generically 114 as in FIG. 1D) as if to wash a left wall surface (not shown) and beam 1322 is directed as along axis 1326 if to wash a right wall surface (not shown). Such oblique output illumination is a favorable attribute of the thin-profile light distributing engines 4 illustrated herein, and as have been reported with more detail in U.S. Provisional Patent Application Ser. No. 61/024,814 (International Stage Patent Application Serial Number PCT/US2009/000575) entitled Thin Illumination System. Such light distributing engines 4 can be configured to produce beams directed perpendicular to the tile surface (e.g., see illustrative down directed beam 103 in FIG. 1D, as along axis 111), or they can be configured to produce oblique beams 1320 (and 1322) at angles 1330 (and 1332) to the surface normal 111, where $+/-\phi_L$ and $+/-\phi_R$ can be varied substantially between +/−0 and +/−80-degrees (with best results between +/−0 and +/−60 degrees). In this case, the output obliqueness is controlled by design of the tapered light guide plate (e.g., 928 in FIGS. 74 and 1070 in FIG. 83), design of the facetted film sheets (e.g., 929 in FIGS. 74 and 1072 in FIG. 83) being used, by use of a planar reflector in place of the facetted film sheet, by design of the light spreading film sheets installed (one particular illustration given in FIGS. 53, 54 and 80), and by the physical pointing direction the light distributing engine 4, which can be tilted some small amount (up to approximately 15 degrees) without substantially increasing the overall thickness of the tile system 1.

The example of FIGS. 100 and 101 are further provided to emphasize that any number of thin-profile light distributing engines 4 may be distributed within the body 5 of a given tile 6. Moreover, they may be arranged in any geometric distribution within their tile that is deemed effective to the tile's size, the tile's shape and the prevailing lighting requirements. Moreover, each embedded engine 4 may be switched on and off individually, dimmed individually, or operated in any combination of groups by signals received from master controller 40. When suited to the lighting need, tile illumination systems 1 according to the present invention may be embedded with a single light-distributing engine 4 per tile 6. Moreover, each embedded engine 4 can be comprised of multiple light emitting segments.

Furthermore, in another important related embodiment of the present invention, each light emitting segment is independently controllable, such that, for example, one light emitting segment of the engine producing the left pointing light distribution 1320 in FIG. 101 could be off while the other segment was on.

Furthermore, in another important related embodiment of the present invention, each light-emitting segment can perform a different lighting function. For example, the same left pointing distribution 1320 and right pointing distribution 1322 of FIG. 101 could be substantially produced by having a left pointing light emitting segment and a right pointing light emitting segment in each light engine 4, rather than two left pointing segments in one and two right pointing segments in the other. Many multi-functional embedded engines like these are possible, including combinations of multiple pointing directions, multiple light colors, multiple beam widths, and multiple far-field beam patterns.

In addition, the illustrative examples provided are only a few of those possible by good practice of the present invention, and are not meant to be either exhaustive or all-inclusive. For visual convenience, the illustrative examples above have been limited to single 24"×24" tiles. Not only may tile size be varied to include both larger and smaller examples, but groups of tile illuminating systems 1 according to the present invention may be mixed and combined with conventional tiles in larger distributed systems of illuminating and non-illuminating tiles, as introduced generally in FIGS. 2D, 2E, 3B, 3C, and 3M. All such combinations are considered to be within the context of the present invention.

And while the preferred examples of thin-profile light distributing engines 4 as given above are particularly appealing in lighting situations where the maximum possible tile thinness and the most easily adjusted beam diversity play important roles, there are several other useful light distributing engine types pertinent to the present invention as well, each following the vertically-stacked cross-sectional arrangement of FIG. 4A. In this engine class, the LED light emitter layer 271 (which may also be a group of LED light emitters) is deployed just above the light distributing optic layer 273 (e.g., one or more on an optical diffusing cavity, a re-circulating cavity, an optical reflecting cavity, a light guide plate, a reflector, an array of reflectors, a lens, and an array of lenses), while projecting a beam of output illumination substantially along the axis of the vertical stack.

One vertically stacked example is suggested by thin profile back light units (also called "BLU's"), which provide homogeneous rear illumination for modern liquid crystal display ("LCD") panels. While there are many different BLU types to choose from, one preferable example for commercial lighting applications of the present invention is adapted from a direct backlighting form that's being used with the larger format LCD screens used in direct view LCD televisions (TVs).

FIG. 102 A is a schematic side view of a popular side-emitting (or Bat-wing styled) LED emitter used in large format LCD backlighting systems, the Luxeon III 1845 made by Philips LumiLeds. FIG. 102B is a perspective view of the Luxeon LED emitter 1845 shown in the side view of FIG. 102A. The base package 1850 has a 7.3 mm diameter, a top-to-bottom height 1852 of about 6 mm, and a circularly-symmetric light distribution 1860 that is predominately side-emitting with an angular extent of about +/−60-degrees, because of the transparent refractive design of dielectric lens element 1865. DC voltage and access to ground is applied to the internal LED chip (not shown) by means of external electrodes 1868 and 1870, and heat is extracted from the LED chip by means of plane conductor 1872.

A complete LED light emitter 271 compatible with light distributing engines of the present invention is composed illustratively of an electrical circuit plate 1880 with four side-emitting LED emitters 1845 arranged on it, a back-reflecting base plane 1895, and four back-reflecting surrounding sidewalls 1897 as shown illustratively in FIG. 103A. The light redistributing properties of elements 1865, 1897 and 1895 included with the LED emitter's base package 1850 blur the boundary line between what constitutes the LED light emitter portion 271 and the associated light distributing optics 273 portion beyond it, just as it did in the case of the light distributing engine example of FIGS. 74-75. In the present example, however, there is a less concrete line of physical demarcation, and the two portions overlap at their boundary.

FIG. 103A is a perspective view of electrical circuit plate 1880 and four illustrative side-emitting LED emitters 1845 mounted on it, including means for electrical interconnection of the emitters to the remaining elements of an associated light distributing engine 4. Plate 1880 enables electrical connection to embedded electronic elements (not yet illustrated) as they were described above, that respond to signals from a master controller 40 to control the flow of the electrical current within each emitter.

The unfilled central mounting location 1881 on plate 1880 is held in reserve for an additional LED emitter 1845, should additional light output be needed. The interconnection circuitry shown on electrical circuit plate 1880 is just an example of the way in which positive and negative electrodes for each LED emitter 1845 are made flexible to series, parallel or series-parallel connection. Circuit plate 1880 is 4"×4" (e.g., 1890 and 1891), which is similar in scale with the examples provided above.

FIG. 103B is a perspective view of what is considered for illustrative purposes, the LED light emitter portion 271 as used within a vertically stacked light-distributing engine embodiment in accordance with the present tile illumination system invention. Side-emitted light 1860 from each of the LED emitters 1845 intermix and are multiply reflected by interactions with back-reflecting sidewalls 1897 and with back-reflecting base plane 1895, including cutouts 1896 and optionally, light scattering features 1899. Reflecting planes 1895 and 1897 may be generally reflecting as in the prior art, diffusely reflecting, or preferably, specularly reflecting with a superimposed array of circular (or square) light extractors 1899 (as illustrated in the present adaptation) made of a diffusely scattering material (such as for example in a traditional dot-pattern backlight).

FIG. 103C is cross-sectional side view showing the additional secondary optical elements comprising the light distributing optic portion 273 of this vertically stacked light distributing engine 4, collectively suited for embedding within the present tile illuminating system invention 1. The light distributing optics portion 273 of this example, include mid-level dispersing plate 1902 and multi-layer output stack 1906, whose functionalities overlap with those of the back-reflecting plane 1895 and the reflecting sidewalls 1897.

FIG. 103D is a magnified portion of the cross-sectional side view shown in FIG. 103C. The secondary optical elements involved combine with the LED light emitter's re-circulating back-reflectors 1897 and 1895 to contain, re-cycle, and otherwise spread out the side-emission 1860 from, and in between, each emitter 1845 prior to light extraction and output from the light distributing engine as a whole.

FIG. 103C is a cross-sectional side view of this illustrative 18.9 mm thick light distributing engine's vertically stacked architecture, with LED light emitter elements 271 generally at the bottom, and the secondary light distributing optic elements 273 generally positioned just above them (as was shown schematically in FIG. 4A). This view shows the position of transparent light dispersing plate 1902, placed on support ledge 1905 just above emitters 1845. Dispersing plate 1902 is made of a clear optical material such as acrylic (i.e., PMMA), polycarbonate or glass, which has a high reflectivity to the most obliquely incident light rays from the predominately side-emitting LED's 1845. The dispersing plate 1902 may include deliberate haze (i.e., internal scattering media) to amplify its light spreading properties. The plane side of dispersing plate 1902 facing the top of emitters 1845 includes circular reflector films 1903 (specular or diffusive) generally sized and spaced to match the diameter and location of side-emitting lens elements 1865 (FIG. 103B).

The cross-section of FIG. 103C shows that the sidewalls 1897 introduced as a part of FIG. 103B, are further part of a chassis box 1904 whose top includes a multi-layer output stack 1906 elevated a fixed distance 1910 above a dispersing plate 1902, neither illustrated in FIG. 103B. The distance 1910 between dispersing plate and multi-layer output stack 1906 is 9 mm in this example. Multi-layer output stack 1906 is a diffusing sheet (bulk or diffractive type), but it may also include combinations taken from one or two facetted prism sheets, a reflective polarizer sheet, a fluorescent material, and a lens sheet. The collective purpose of such functional combinations included within multi-layer output stack 1906 is to homogenize and otherwise hide visibility of direct emissions from back-reflectors 1895 and 1897 and particularly from light extractors 1899, while providing a means for angular collimation by re-circulation (or re-cycling) of wider angle light as has been well-established in prior art.

FIG. 103D is a magnified view of dotted region 1914 from the cross-section of FIG. 103C. Emitter 1845 is mounted on circuit plate 1880 (FIG. 103A) with side-emitting lens element 1865 protruding through holes 1920 prepared for that purpose in shaded chassis structure 1904 and in back-reflector 1895. In this manner, all side-emitted light (1860, FIG. 102A) from each LED emitter 1845 propagates substantially within the physical air gap arranged between dispersing plate 1902, back-reflector surface 1895 and the lower section (the section below shelf 1905) of reflective sidewalls 1897.

The BLU-based light-distributing engine 4 of FIGS. 103A-103D provides its organized output illumination substantially along axis 111 (which is perpendicular to the plane of output stack 1906) as a substantially homogeneous set of diffusely directional output beams 1921 distinguished from the more sharply-defined output beams 103 illustrated in the examples by their lack of distinct angular extent and by their general inability to concentrate output illumination 2 sufficiently well for general spot lighting applications. The inability to provide sharply defined and tightly collimated output beams is a consequence of the diffusive nature of this type of engine's internal light distributing composition.

FIG. 103D also provides an example of the typical light flow within this light-distributing engine 4. Illustrative side-emitted light ray 1925 first contacts back-reflecting plane 1895 in a specularly-reflection region and reflects as if from a mirror plane as the upward traveling illustrative ray 1928. Ray 1928 strikes the underside of dispersing plate 1902 at 1930 and is substantially reflected as if by a Fresnel reflection from a mirror plane at grazing incidence as illustrative ray 1932. In this example, ray 1932 strikes back-reflecting sidewall 1897 and returns towards back reflecting plane 1895 as ray 1935, but hits one of the light extractors 1899, whereupon is scatters into a hemispherical (or pseudo-hemispherical) angular distribution 1937. A portion of light distribution 1937 is transmitted through dispersing plate 1902 and eventually through multi-layer output stack 1906, becoming part of the output beam 1921 within the general illumination 2 of light distributing engine 4.

This form of light distributing engine 4, along with its power controlling electronics, is embedded in the body 5 of tile 6 with substantially the same process flow as was illustrated above. Yet because of the extra thickness associated with its vertically stacked architecture, (18.9 mm in the present example) the associated power regulating and controlling electronics are embedded either around the engine periphery, or as illustrated in the examples of FIGS. 104-106, to one side. With additional optimization applied to further reduce the engine's thickness and with miniaturizations associated with production quantities of electronic components, embedding the electronic circuitry on the backside of this type of light distributing engine is also a practical option.

FIG. 104 is a perspective view shown from the backside of a 180.4 mm×110 mm×18.8 mm embeddable form of the illustrative vertically stacked light-distributing engine 4 configured in accordance with the present tile illumination system invention. The embedded electronic circuit portion 1940 deployed in this case is similar to the example provided in FIG. 97, and contains all the electronic elements described earlier, now on embedding plate 1941. The light-generating portion 1942 is as set forth in FIGS. 103A-103D. As in the previous examples, the electronic elements in the circuit portion include voltage regulating MOSFET 345, its two nearest capacitors and its associated potentiometer (all unmarked in this view). The circuit portion also contains the illustrative RC demodulation circuit comprising IC 400, resistor 417 and capacitor 418, and illustrative three-branch current controlling circuit 738 (as described above) comprising three pairs of MOSFET 330 and load resistor 358 combinations, each load resistor set as illustrated earlier in FIGS. 19 and 20. The illustrative light-generating segment 1942 is held within chassis frame 1946 either by screws, snap elements, or a press-fit to mention a few of the more likely possibilities. The chassis frame 1946 also provides a tile-embedding rim-surface 1948 to facilitate the tile embedding process. Other features of note visible in this view include heat sink fins 1950 which are in thermal contact with optional heat-spreading plate 1952 that may be applied to the backside of electrical circuit plate 1880. Embedded DC voltage and ground access straps (as shown in previous examples) are applied to engine terminals 1954 ($V_{dc}$) and 1956 (ground) respectively (similar to 1021 and 1023 in earlier examples). The output terminals of the illustrative 4-LED circuit on the front side of electrical circuit plate 1880 are connected internally to positive side electrode 1958 and negative side electrode 1960.

FIG. 105 is an exploded perspective view shown from the floor side of the vertically stacked light-distributing engine 4 illustrated in FIG. 104, revealing the internal relationships between constituent parts. This vertically stacked backlighting type light distributing engine 4 is shown separately in FIGS. 103A-103D and FIG. 104. Electrical circuit plate 1880 attaches to the back of chassis structure 1904 via dotted guidelines 1964-1966 (which pass through chassis frame 1946). Transparent light dispersing plate 1902 installs just inside sidewalls 1897 of chassis structure 1904 along the one dotted guideline 1968 provided. And multi-layer output stack 1906 attaches to rim 1900 (FIG. 103B) of chassis structure 1904 along single dotted guideline 1970.

FIG. 106 is a perspective view showing the tile body details 1972 needed to embed this particular form of light distributing engine 4 in the proximate center 1971 of a 24"×24" tile 6, along with embedding features 1974-1977 for the associated DC voltage and ground access straps. The engine's chassis frame 1946 nests against the sidewalls of tile body 5 created by edge boundaries 1979-1981, and the edge of the engine's heat sink nest against the sidewall associated with edge boundary 1982. Tile body feature 1984 is the resting place for the underside of embedding plate 1941. This light-distributing engine 4 is lowered into place within tile 6 along dotted guidelines 1986-1988.

FIG. 107 is a magnified view 1971 showing the central portion of the tile system 1 as in FIG. 106, but in this case, just after embedding the light-distributing engine 4, its associated DC voltage strap 1990 (in tile channel 1975) and its associated ground access strap 1992 (in tile channel 1977).

FIG. 108 is a perspective view of an illustrative 24"×24" tile illumination system 1 according to FIGS. 102-107, seen from the floor beneath and showing a single 4"×4" illuminating aperture 1994 and its aperture covering multi-layer output stack 1906. Faintly seen through output stack 1906 are the circular reflector films 1903 which reside just above the four included side-emitting lens elements 1865 of FIG. 103B. Also shown are the four edge mounted electrical connectors 304 (and optional T-bar mounting tabs 874, as shown in FIGS. 70-71). As in all examples above, the 24"×24" size of tile 6 is purely illustrative, as is the choice of embedding a single light-distributing engine 4.

FIG. 109 is a perspective view of the tile illumination system of FIG. 108 showing the kind of angularly-diffuse directional illumination that results from applying DC voltage to left side connectors 304 and ground system access to right side electrical connectors 304, combined with receipt of a power "on" signal from the system's master controller 40 (not illustrated). The angular composition of output illumination 2 from the embedded light-distributing engine 4, depends on the properties of its multi-layer output stack 1906, but is typically more global in its illumination properties than the square (or rectangular) cross-sections shown in previous examples (e.g. in FIGS. 1D, 62-79, 81, 88 and 101). The characteristically diffusive illumination typical of this type of light distributing engine 4 is illustrated symbolically in FIG. 109 by the discrete set of beams (1998-2002) shown, each of incrementally wider angular extent (illustratively shown from +/−10-degrees to +/−60-degrees). In reality, the beams themselves are more circular (or elliptical) in cross-section, and are distributed in an angular continuum, from 0-degrees to the widest angle represented. Maximum illumination brightness is center-weighted and projected downwards directly under the tile system 1. Illumination brightness (luminance on the floor beneath) then falls off with widening angle. In situations where the output stack only contains diffusive light spreading (or scattering) layers, the output beam is almost purely Lambertian with illumination covering an angular extent nearly +/−90-degrees in all directions. When, as in this example, the multi-layer output stack 1906 comprises one or more form of angle-limiting means (e.g., facetted film sheets, lens array sheets, and reflective polarizer sheets, to mention a few of the more practical choices) a more directional source of flood lighting is achieved, as shown, (with half the illumination power contained within about +/−30 to +/−45-degrees), at a cost of lower efficiency. Besides the lower efficiency, the primary disadvantage to the illumination character that's developed is its propensity for off angle glare.

The lumen throughput efficiency of this illustrative light-distributing engine 4 is quite reasonable, at approximately 80%, as determined by a realistic optical ray trace simulation using industry standard optical modeling software ASAP™, supplied by Breault Research Organization, Tucson, Ariz. Actual performance, and reliable comparisons with existing commercial lighting standards, depends on the total lumens provided by the emitters selected for use, which is equally true for the examples above. Lumen output depends generally on LED efficacy (lumens/watt) for each color used, the number of watts applied per chip, whether or not a lens element is used, and effectiveness of the thermal management provided by the heat sinks involved.

The efficacy of high-output LED's has been improving rapidly in recent years, and is expected to continue to do so. This limits the value of quantitative performance examples. The present tile system embodiment (e.g., FIGS. 102-109) using the older styled Philips-LumiLeds Luxeon III at ~20 lumens/watt for its four cool-white emitters (70 lumens at 3.7 volt and 1 amp, CCT=5500K) provides 224 lumens of output illumination 2 over +/−90-degrees with a total electrical power input of 14.8 watts. In this circumstance, with one such light-distributing engine deployed per tile system, 2016 lumens of floor illumination are provided at 133 watts when the tile illumination systems are arranged and suspended in a 3×3 group.

Current examples of this embodiment using the Luxeon REBEL, also manufactured by Philips LumiLeds, or the OSTAR (as described above) as manufactured by Osram Opto Semiconductors boost lumens and lumens/watt performance capabilities significantly, with lumens/watt output per LED emitter now pushing above the level of 75 lumens/watt, and max lumen output between 600 and 1000 lumens per individual LED emitter package (though lumen/watt efficiency at max lumen output is poorer than at lower lumen outputs).

Yet another form of the vertically stacked light distribution engine 4 according to the present invention is illustrated in FIGS. 110-116. The purpose of this variation is to provide another configuration capable of tightly organized directional illumination 2, while adhering to the thickness constraints of the present tile illumination system invention. This form employs a polarization assisted means of reflective light spreading rather than the traditional reflecting/scattering cavity and surface mounted emitters 1865 illustrated in the embodiment of FIGS. 103-109 just above. The basic polarization-assisted reflective light spreading method being adapted to the present invention was first introduced for other purposes in U.S. Pat. No. 6,520,643, and later refined for LED illumination in U.S. Pat. No. 7,210,806 and U.S. Pat. No. 7,072,096. An added benefit is that this light spreading approach also provides the option of supplying vertically polarized output illumination to the areas beneath, which has been found to increase the contrast of printed text characters.

FIG. 110A is an exploded perspective view showing the principal working elements of the light generating portions 271 and 273 of another vertically stacked light distributing engine embodiment embeddable in thin building tile materials 6 according to the present invention. The LED light emitter portion 271 is analogous to the example of FIGS. 74-75, and consists of electric circuit plate 2020 (with circuit elements and electrodes 2022 for interconnection with the other current regulating and controlling electronic circuit elements), an LED emitter 2024 similar to the Osram OSTAR™ unit 850 in FIG. 75, and an attached rectangular angle transforming reflector 2026 (similar to section 948 in FIG. 75). The light distributing optic portion 273 in this embodiment includes a structural spacing element 2030, a reflective cavity frame 2040, a partially reflecting aperture mask 2050 and a multi-layered selectively reflecting output plate 2060. Both spacing element 2030 and cavity frame 2040 are made of either conducting or insulating materials that may be coated to adjust their optics properties as required. Spacing element 2030 provides a surface 2032 (that may be either plane as shown, or mathematically concave or convex) whose center portion is maintained at substantially the same elevation as the transforming reflector's output aperture 2028. Spacing element 2030 further includes through hole 2034 in surface 2032 that is shaped to match the geometry of the reflector's output aperture 2028 (square, rectangular or circular) so as to pass substantially all light output flowing through it. Through hole 2034 may further include a film stack cut to fit within its aperture composed of one or more of a quarter-wave phase retardation film, a reflective polarizer and a diffuser). And, spacer sidewalls 2036 may optionally contain airflow slots 2038 that help cool LED emitter 2024. Cavity frame 2040 includes the four reflective sidewalls 2042 shown, and one or more support means 2044 for partially reflecting aperture mask 2050 and multi-layered selectively reflecting output plate 2060 (which in one form includes partially reflecting aperture mask 2050 within its structure).

FIG. 110B is a perspective view showing the completed 18.8 mm thick final assembly of the light-generating portion 1942 of the vertically stacked light-distributing engine embodiment exploded in the perspective view of FIG. 110A. As will be explained further below, output illumination 2 from this engine is +/−30-degrees in both meridians, provided by one design of etendue preserving angle transforming reflector 2026, with tightly organized angular extent. Many other design variations are practical, from engine's whose output illumination 2 may be as narrow as +/−5-degrees in both meridians, to illumination as angularly wide as about +/−45-degrees in both meridians (or any combination in between).

The principal advantage of this type of thin-profile light distributing engine, however, is that it's secondary light distributing optic 273 enlarges the engine's effective output aperture area significantly from that of its bare LED emitter's typically small (e.g., 2.1 mm×2.1 mm) emitting area, to that of the full aperture size of cavity frame 2040, which in this particular example is internally 38.58 mm×38.58 mm. By this means, the engine's aperture ratio is enlarged effectively by a factor of 337, reducing its apparent brightness to human viewers looking upwards from the floor beneath, by a net factor of 84.

This is an important feature of all the large aperture light distributing engine examples of the present invention, and will be explained in more detail further below.

This type of light distributing engine embeds in body 5 of tile 6 according to the present invention exactly as was illustrated in the previous example. One light-generating unit as illustrated in FIGS. 110A-110B, or a group of similar light generating units, are readily combined with associated power regulating and controlling electronics exactly as illustrated in FIGS. 103-105, and then embedded in tile via the process flow of FIGS. 107-108. But unlike the disorganized diffusive illumination provided in the previous example, the beam cross-sections developed are more in line with those illustrated in FIGS. 1D, 62-79, 81, 88 and 101 above, meaning they are more sharply defined.

FIG. 110C is a fully assembled backside perspective view showing an example of an embeddable form of this type of vertically stacked light distributing engine 4, illustratively combining four of the light generating portions shown in FIG. 110B with the voltage regulating, controlling and detecting electronics described in previous examples. As one example of this form, four light generating portions 1942 (FIG. 110A-110B) are arranged in a 2×2 cluster within the 4"×4" chassis frame 1946 of the previous embodiment.

FIG. 110D is a front-side perspective view of the embeddable light-distributing engine 4 of FIG. 110C, in its fully assembled form. The purpose of engine separating chassis 2070 is to retain the four included engines within the main chassis frame 1946. An equally appealing form would group the four light generating portions 1942 in a closer packed array without separating members 2072 and 2073. Another equally preferable choice would be to reduce the interior size of chassis frame 1946 to match the edge lengths of the included elements (e.g., reducing the chassis frame's interior edge length from 4" to 3.27" thereby supporting two 41.58 mm units without need for separating chassis 2070).

FIG. 110E is an exploded perspective view of the embeddable light-distributing engine 4 as shown in FIG. 110C. The constituent parts are assembled along dotted guidelines 2080 and 2081.

FIG. 110F is a perspective view of a tile illumination system including the embedded light-distributing engine of FIGS. 110A-110E, showing both its sharply defined +/−30-degree illumination cone and it's significantly enlarged output aperture. The illumination 2 provided in this particular example, +/−30-degrees, is suited for overhead flood lighting, as in offices and schools. The same beneficial attributes are available, however, at both narrower and wider angular extent.

The illumination 2 provided by this embeddable example is approximately equivalent to that provided by the previous embodiment, as in FIGS. 104-105, but as seen, with considerably better-organized beam quality.

Although various elements of this embodiment have been explained previously in U.S. Pat. Nos. 6,520,643, 7,210,806 and 7,072,096, a thin-profile light distributing engine configuration suitable for embedding as in the present tile illumination system invention has not.

Accordingly the operative mechanisms and operating principles are summarized in FIG. 111A-FIG. 115, which are provided to facilitate both understanding and practice.

FIG. 111A is a schematic cross-sectional side view illustrating the reflective light spreading mechanism underlying another useful type of vertically stacked and embeddable light distributing engine useful to practice of the present invention that establishes the underlying physical relationships between constituent elements. The cross sectional side view of FIG. 111A comprises LED emitter 2022, rectangular transforming reflector 2026, reflector length 2027, polarization-converting reflector element 2102 composed of metallic reflecting plane 2104 and wide-band quarter-wave phase retardation film layer 2106, output polarizing reflector plane 2110 composed of reflective polarizer 2112 and optional metallic reflector array layer 2114, and the (surrounding) 4-sided reflector 2116 (e.g., 2040 in FIGS. 110A and 110B). In the form as shown, reflector elements 2102 and 2110 are plane surfaces, separated by an air-gap G, 2120. In related forms reflector element 2102 may be mathematically curved or slanted towards reflector element 2110, narrowing output collimation angle 2122 ($\theta_1$') or it may be mathematically curved or slanted away from reflector element 2110, widening output collimation angle 2122 ($\theta_1$').

FIG. 111A also illustrates the basic polarization-selective light spreading mechanism by following the path taken by un-polarized illustrative ray 2130, which exits reflector aperture 2028 at point 2132 at the extreme angle, $\theta_1$ (in this example, 30-degrees from system axis 111). Ray 2130 passes through optional metallic (partially) reflecting layer 2114 without redirection, and strikes the surface of reflective polarizer 2112 at point 2134. Reflective polarizer 2112 is typically made of a polymeric dichroic sheet material, e.g., DBEF™, manufactured by 3M under its Vikuiti™ product designation, but may also be made of other reflective polarizer material such as wire-grid type material VersaLight™, manufactured by Meadowlark Optics, or PolarBrite™ wire grid products manufactured by Agoura Technologies. These polarization splitting film materials transmit p-polarized light and reflect s-polarized light very efficiently. Accordingly, ray 2130 splits equally into a transmitted ray 2136 and a specularly reflected ray 2138. Transmitted ray 2136 is p-polarized and becomes part of the +/−30-degree output beam 2 for this particular form of light distributing engine 4. Reflected ray 2138 is s-polarized and redirected back by mirror reflection towards point 2140 on polarization-converting reflector element 2102. Upon reaching point 2140, s-polarized ray 2138 passes through wide-band quarter-wave phase retardation layer 2106. As it does, it is converted to its left hand circularly polarized form and strikes metallic reflecting plane 2104, whereupon it is reflected specularly, and converted to the orthogonal circular polarization state before passing back through wideband quarter-wave phase retardation layer 2106 and converting to p-polarized ray 2144. Ray 2144 heads outwards towards reflector element 2110 at point 2146, which is near the outer boundary 2147 (shown dotted) of surrounding 4-sided reflector 2116. Since ray 2144 has been p-polarized by its reflection from reflector element 2102, it is able to pass through element 2112 with minimal loss, and also become a part of the illustrative +/−30-degree output beam 2 for this particular form of light distributing engine 4.

Without the inclusion of polarization-selective reflector elements 2102 and 2010, all the +/−30-degree light flux output from reflector 2026 (and also from the entire engine) at illustrative point 2132, as one example, would be contained within dotted +/−30-degree region 2150. In this case, and because of the reflecting and polarization-changing actions of the two reciprocating reflector elements 2102 and 2110, +/−30-degree lumens are spread over a wider range, between point 2146 on the left side of output beam 2 and point 2152 on the right side. Geometrically, this is a consequence of the two mirror reflections at points 2134 and 2140 that occur along ray-path 2132-2134-2140-2146. The incremental beam spreading, S, 2155 in FIG. 111A, is determined by air-gap thickness G, 2120, and the half-angle $\theta_1$ of angle transforming reflector 2026, as $S=G \tan \theta_1$. When for example, $\theta_1$=30-degrees and G=7.5 mm, then S=6.93 mm. Without reflective spreading, however, the reflector's output lumens from illustrative point 2132 exist over a much smaller aperture area, 4 $S^2$ $mm^2$. With the reflective spreading mechanism in operation, these same lumens, less minor losses from reflectivity and transmission, spread over a 9× larger aperture area of 36 $S^2$ $mm^2$.

Equivalent (parallel) illustrative rays can be followed from extreme edge points 2160 and 2161 of output aperture 2028 of rectangular angle transforming reflector 2026 of FIG. 111A. The separation distance X between these edge points is $x/\sin \theta_1$ from the Sine Law. Accordingly, the full aperture 2168 for this form of light distributing engine 4 is defined by boundary points 2162 and 2164, thereby increasing the engine's effective aperture area from $(6\ S)^2$ to $(6\ S+x/\sin \theta_1)^2$. With the illustrative angle transforming reflector's input aperture being set at 2.6 mm×2.6 mm, and S being 6.93 mm, the full aperture becomes 46.78 mm×46.78 mm, an area gain over the conventional aperture of 11.4×.

Increasing aperture area by the polarization-selective folding method of FIG. 111A alone only translates at best into a 2× reduction in apparent aperture brightness, as shown by the dotted illumination sight lines 2170-2175 in FIG. 111B, as the apparent brightness from only half the lumens at most is visible from any particular viewpoint. However, in many areas across the output aperture 2168, brightness is lowered beyond a 2× reduction, and this non-uniformity across the aperture can lead to the perception that the central portion of the aperture is uncomfortably bright.

FIG. 111B is a schematic cross-sectional side view of the embeddable light-distributing engine 4 shown in FIG. 111A revealing additional details of the geometric relationships between constituent elements.

FIG. 111B illustrates the first level of light distributing engine brightness reduction (2×) achieved by polarization conversion and reflective folding. The engine cross-section in FIG. 111B is identical to the engine cross-section in FIG. 111A, except for the addition of sight lines 2170-2175 and illustrative output rays 2180-2187. In addition, some of the object references shown in FIG. 111A have been removed from FIG. 111B for clarity of viewing, but remain present in principle. Illustrative p-polarized output rays 2136 and 2180-2183 (representing substantially one half the emitted lumens) project back towards the real output aperture 2028 of reflector 2026 from whence they came. Whenever a viewer stares along these ray paths, it is at most the apparent brightness representing half the unpolarized lumens emanating from aperture 2028 that is perceived. This represents at least a 2× brightness reduction, but that reduction tends to be non-uniform across the entire output aperture 2168. Similarly, whenever a viewer stares along the s-to-p polarization-converted ray paths 2184-2187, it is the apparent brightness of the virtual image 2195 of aperture 2028 that is perceived (representing the other half of the emitted lumens less any losses that occur along the optical path). This also represents a 2× brightness reduction. Virtual image 2195 contains the converted s-polarized lumens emanating from aperture 2028. Neglecting material losses, and the small fraction of rays reflected back into etendue preserving angle transforming reflector 2026, the apparent brightness of apertures 2028 and virtual image 2195 are substantially equal and given by the expression $LUM/(x/\sin \theta_1)^2$ in units of lumens/square feet. Viewable brightness becomes 6.36 MNits for illustrative values $\theta_1$=30-degrees and x=2.6 mm (8.73E-03 ft), with total input lumens, LUM, being about 300 and reflector transmission efficiency being about 90%.

More significant brightness reductions as well as uniformity improvements are possible when mechanisms are added that extend the 2× dilution in direct view back to the output aperture of reflector 2028. Rather than using the indiscriminate scattering mechanism added to the previous embodiment (which defeats the sharp cutoff characteristics of the rectangular angle transforming reflector 2026 being used), the present embodiment adds additional specular reflectors that will be seen to disperse light further without corresponding change in angular extent.

One way this can be done is by adding a partially reflecting layer 2114 just inside the engine's output aperture whose reflecting and transmitting pattern increases the degree of light spreading with minimal loss. The reflective portion of layer 2114 cuts down on the number of lumens in both polarizations that can be viewed directly by deflecting them elsewhere.

The general behavior underlying this approach is illustrated looking first at the number of lumens of directly transmitted p-polarized light from output aperture 2028 of reflector 2026 in the light distributing engine structure of FIGS. 111A-B. Engine aperture 2168 is 46.8 mm×46.8 mm in this example, air gap 2120 is 7.5 mm, and partial reflecting layer 2114 is made with a 13.86 mm×13.86 mm core having roughly 80% reflectivity and 20% transmissivity. In this case element 2114 is aligned centrally in the engine's output aperture (as between reference points 2190 and 2192 in FIG. 111B). While partially reflecting layer 2114 is drawn across the entire aperture 2168, it may only physically span a portion of the aperture.

FIGS. 112A-112F illustrate a series of symbolically represented near field and far-field light distributions from this reduced aperture brightness light distributing engine configuration of FIGS. 111A-111B developed originally by computer ray trace simulation. The patterns are shown in their higher contrast symbolic form to help simplify their visual interpretation. FIG. 112A is the near field pattern for p-polarized light with 100% transmission, FIG. 112B is the near field pattern for p-polarized light of this engine with 80% reflection by its partially reflecting output layer 2114, FIG. 112C is the p-polarized far field pattern with 100% transmission, and FIG. 112D is the p-polarized far field illumination pattern of the engine with 80% reflection by its partially reflecting output layer 2114.

The near-field pattern of FIG. 112A shows the typical square cross-section p-polarized light distribution 3002 from the output vicinity of illustrative (+/−30-degree) angle transforming reflector 2026. FIG. 112B shows the near field change that results when the 80% reflecting, 20% transmitting reflector element 2114 is present in dotted region 3004 (FIG. 112B). The incident lumens in square p-polarized light distribution 3002 drops to 26% of the incident lumen level after passing through the reflector element 2014 and reflective polarizer 2012 (assumed 97% transmitting). The multiplicity of reflections from reflector element 2014 and polarization-converting reflector element 2012 cause the complexities seen (near field brightness dip 3006 and a ring of slightly elevated brightness 3008). Light spreading continues into ring 3010 expanding the overall near field light distribution area approximately 4× from that of 3002 in FIG. 112A.

The corresponding far field light distributions are given in FIGS. 112C-112D, looking on a 2 m by 2 m plane surface positioned a distance of 4 feet (1.2 m) below the light distributing engine's aperture 2168. Notice that despite the inherent non-uniformities occurring in the reflector-dispersed near field light pattern shown in FIG. 112B, the corresponding far field light pattern 3014 (FIG. 112D) is practically identical to ideal far-field light pattern 3012 that results without any reflective dispersion (FIG. 112C). The only essential difference in the two patterns is a small brightness dip 3016 (FIG. 112D) caused by the assumed recycling inefficiency (0.5) of light back-reflected directly into aperture 2028 of angle transforming reflector 2026, and the reflective attenuation of low angle light. The higher the actual reflector's recycling efficiency, the smaller the axial dip in far-field brightness. Whenever further adjustment is necessary, a few pinholes may be added to the central portion of reflective polarizer 2112.

This simple example continues for reflectively dispersed s-polarized light in FIGS. 112E-112F.

FIG. 112E shows the p-polarized near-field light pattern from the internally reflected and converted s-polarized light, with 80% net reflection exhibited by its partially reflecting output layer. This conversion is illustrated in the side view of FIG. 111B (e.g., see illustrative ray 2138), where s-polarized rays are completely redirected by the action of reflective polarizer 2112, and only become part of the near-field output light pattern 3020 after they've been fully converted to p-polarization.

FIG. 112F shows the p-polarized far-field light pattern associated with reflectively converted s-polarized light 3022, when 80% net reflection is exhibited by the engine's partially reflecting output layer. The far field illumination pattern of FIG. 112F due to converted s-polarized light is practically identical to that of the reflectively dispersed p-polarized light shown in the far field illumination pattern of FIG. 112D. The converted s-polarized far field pattern shows a similar brightness dip 3024, also due to the angle transforming reflector's recycling inefficiency (equally evident in the near field result of FIG. 112E as 3021). Consequently, the combined output result from far-field beam patterns 3014, 3016, 3022 and 3024 for this simple example has approximately the same look and +/−30-degree field coverage as either considered separately.

The physical design of partial reflecting layer 2114 in terms of the percentage of open spaces to reflecting spaces, the shape of the open spaces, and the spatial distribution of open (or reflecting) spaces can be used to achieve almost any desired light distribution pattern, whether in the near or far fields, and is a particular appealing feature of the associated light distributing engine 4 within the context of the present invention.

FIG. 113A-B shows two particular examples of the central portion 3030 of the partially reflecting light spreading layer 2114 useful to the light-distributing engine 4 of FIGS. 111A-B.

A first example of central portion 3030 of partial reflecting layer 2114 is illustrated in FIG. 113A, along with a dotted representation of larger light distributing engine aperture 2168. Additional reflective elements may be added to the outer region 3032 as well, as required, depending on the degree of dispersion deemed necessary. In this example, central portion 3030 includes an evenly spaced array of square through holes 3034 (optionally circular through holes) in an otherwise highly reflective mirror coating 3036. Central portion 3030 as shown is 13.86 mm×13.86 mm in size and contains 144 through holes 3034, each being 0.5 mm×0.5 mm (although a larger number of smaller through holes may be preferred in practice). The basic principle behind the through holes (whatever their shape and distribution) is that the total through hole area divided by the total area of central portion 3030 is to be approximately equal to the reduced transmission being considered. Central transmission is reduced to 0.2 in this example, which corresponds approximately to $(144)(0.5^2)(13.86^2)$. When these through holes are 0.15 mm square, their number is increased to 1600 and the appropriate array is therefore 40×40. All unpolarized light rays from aperture 2028 of angle transforming reflector 2026 strike this portion of element 2114 before reaching reflective polarizer 2112 beneath it, and are either reflected or transmitted depending on which region (3034 or 3036) is encountered.

A second example, with greater ability to address non-uniformity in the output aperture 2168, is given in FIG. 113B for central portion 3030, showing a deliberately uneven distribution of a larger number (421) of smaller (0.2 mm×0.2 mm) through holes 3034, using a mathematically-controlled through hole density that's made preferentially greater towards the edges and corners of region 3030 than within its interior. In this particular example of many, through hole density is varied by a normalized form of the function $(SPC)*(i^p)$, where SPC is the otherwise even spacing between through hole centers over the length of distribution (0.683 mm for the 0.2 mm through holes in this 13.86 mm region), i is a sequence of integers starting with 0, 1, 2 . . . up to the number of through holes applicable to each half of the pattern, and p is a power for varying the spacing, p=1 corresponding to no variance, p<1 corresponding to decreasing spacing, and p>1 corresponding to increasing (and p is a power for varying the spacing, e.g., p=1 corresponding to no variance, p<1 corresponding to decreasing spacing, and p>1 corresponding to increasing spacing.)

FIG. 114A is a schematic cross-sectional view showing why there is a potential brightness reduction associated with the vertically-stacked light distributing engine of FIGS. 111A-111B when its partially reflecting light spreading output layer 2114 is modified with a mixture of metallic reflection (region 3036) and transmission (pin holes 3034) in its central region 3030.

FIG. 114B provides magnified detail of a small region of illustrative reflection in the schematic cross-sectional side view of FIG. 114A. Without reflective regions 3036, illustrative un-polarized rays like 2130 pass right through layer 2114 and undergo polarization splitting immediately on hitting the active reflective polarizing layers 3042 on the clear surface of substrate layer 3044 of reflective polarizer 2112. In such cases, viewers of a sufficiently sized bundle of p-polarized rays like 2136 see directly back to the p-polarized brightness of the source aperture 2028 from which they came. When an un-polarized ray similar to 2130, such as 3048, first strikes a part of reflective region 3036, as in detail 3040 FIG. 114B, a mirror reflection occurs about surface normal 3050, creating an un-polarized ray trajectory 3052 (rather than an s-polarized one, as in the case of 2138) passing through clear substrate layer 3037 of partial reflecting layer 2114. When un-polarized ray 3052 reaches the otherwise polarization-converting reflector element 2102 in the vicinity of 2140, it passes through quarter-wave phase retardation layer 2106 without effect and reflects specularly from metallic reflecting plane 2104 without polarization change, leaving region 2140 as un-polarized as it arrived, in form of un-polarized ray 3054. By this highly dispersed path, initial source ray 3048 delays polarization splitting until it reaches region 2146 as ray segment 3054, which is practically at the extreme edge of the light distributing engine's output aperture 2168. Provided un-polarized ray 3054 then passes through a clear portion of the partial reflecting layer's outer region 3032 (as in FIGS. 113A-113B), it divides into transmitted p-polarized ray 3056 (which is no longer visible within directly viewed light along system axis 111), and s-polarized ray 3058 (shown dotted) that is mirror reflected by reflective polarizer 2112 towards the metallically or dielectrically reflective sidewall 2116. The polarization state of linearly polarized rays remains unchanged on metallic (or dielectric) reflection. Accordingly, s-polarized ray segment 3060 is reflected towards polarization-converting reflector element 2102 at point 3062, whereupon it's converted to p-polarized ray segment 3064, and reflected back towards output layers 2114 and 2112 in the vicinity of point 3066, along direction line 3068. Since point 3066 lies just inside the outer region 3032 of partial reflecting layer-2114, its most likely that ray 3064 transmits through reflective polarizer 2112, becoming part of p-polarized output beam 2. The direction of ray 3066 lies along line 3068, and points away from the original source aperture 2028, which in and of itself entails a reduced apparent brightness.

If ray 3064 had reached a reflective portion 3036 within partial reflecting layer 2114, several more reflections would occur before re-conversion to a transmitted p-polarized output ray. These additional reflections, if involved, would only serve to increase spatial mixing within the vertically stacked light-distributing engine 4 of this embodiment, and thereby further decrease apparent aperture brightness.

The action of the un-polarized reflections at partial reflecting layer 2114 causes angular redirections similar to those occurring along illustrative ray path 3048-3052-3054-3058-3060-3064 in FIG. 114A. Similar angular redirections may be encouraged when making output aperture 2168 smaller than otherwise indicated by the geometrical relations in FIG. 111A. Reducing the size of output aperture 2168 moves sidewalls 2116 inwards, and in doing so cause p-converted rays like 2144 in FIG. 111A to strike sidewall 2116 prior to reaching the output layers 2114 and 2112.

Other mechanisms can be added to those described above that further reduce the net aperture brightness, while also softening the sharpness of angular cutoff characteristic of etendue-preserving rectangular angle transforming reflectors 2026. The reflective surfaces of sidewalls 2116 (and optionally the surface of metal reflecting plane 2114) may be given a diffusive haze. Similarly, substrate layers 3037 and 3044 (FIG. 114B) may be given a diffusive haze, whether by surface roughening, by a diffusive coating or by the addition of second phase scattering particles.

FIG. 115 shows a bottom-side view of the various output aperture regions in this version of the vertically stacked light-distributing engine illustrated in FIGS. 111A-111B, including an evenly spaced square-pinhole version of the central portion 3032 of partial reflecting output layer 2114. The effective aperture 3004 for directly transmitted p-polarized lumens within which the central portion of partial reflecting layer 2114 is placed, has been dotted, and is 13.86 mm×13.86 mm when adjacent to reflective polarizer 2112 in the present example. Edge length 3070 of aperture 3004 is 2 S. Aperture 3004 in this example represents only about 9% of engine aperture 2168. Some of the reflective region 3036 of partial reflecting layer 2114 has been removed, 3071, making it easier to see elements lying underneath. The angle transforming reflector's input aperture includes for illustration purposes a 2×2 grouping of LED chips 3072. Also visible in the bottom view of FIG. 115 are the angle transforming reflector's mathematically shaped and metallically reflecting sidewalls 3074, the engine's reflecting sidewalls 2116, and the engine's polarization converting reflector element 2102, in this bottom view beneath partial reflecting layer 2114 a distance G, 2120 (as in FIG. 111A). Output aperture 2028 of reflector 2026 has edge length X, 3078 (equaling x/Sin $\theta_1$ by the Sine Law), with x being the RAT reflector's input edge length 3080.

All previous examples of embeddable light distributing engines according to the present invention, including the previous one in FIGS. 103-115, applied significant effort to consciously expand the size (i.e., area) of the engine's illuminating aperture so as to reduce it's apparent brightness (also called aperture brightness). The viewable brightness of today's most powerful LED emitter's can be extremely hazardous for direct human vision and most conventional LED optics do not sufficiently reduce the brightness to allow their safe use in general overhead lighting. As important as it is to remedy this danger for practical application in general overhead lighting, there are many situations where even inadvertent direct view of the overhead light source is physically prevented. One example of this circumstance is the overhead lighting of department store and museum display windows. Human viewers in this viewing situation are blocked physically by the display window surface itself, even from accidentally invading the cone of overhead illumination. Another example of this circumstance is obliquely angled overhead spot lighting of wall surfaces (and objects on wall surfaces), especially in physical situations when human viewers facing the lighted wall are outside the cone of overhead illumination.

Preferable light distributing engines 4 for such applications include those whose light distributing optic 273 is limited principally to the type of rectangular angle transforming reflectors used in previous examples (e.g., reflector 882 in FIGS. 74-75, reflector 1040 in FIGS. 83-88, and reflector 2026 in FIGS. 100A and 110E). The rectangular angle transforming reflectors of this type may also be combined with other optics for the purpose of further modifying the output distribution, but need not be combined with any optics for the purpose of reducing aperture brightness.

The desirable behavior of such rectangular (and optionally circular) angle transforming reflectors (hereinafter referred to as RATS and CATS; e.g., RAT for rectangular angle transforming reflector, and CAT for circular angle transforming reflector) is their ability to produce sharply defined output beams having square, rectangular or circular, far-field cross-sections depending on the reflector's design.

FIG. 116 is a cross-sectional side view of an illustratively generalized rectangular angle-transforming (RAT) reflector 3100 (2026 in previous embodiments) complimenting the geometric description provided in FIG. 86. The cross-sectional view in FIG. 116 shows the implicit geometrical relationships existent for one meridian between input aperture width 3102 ($d_1$), ideal output aperture width 3104 ($D_1$), ideal reflector length 3106 ($L_1$), truncated reflector length 3108 ($L_{11}$), truncated reflector aperture width 3110 ($D_{11}$) and reflector symmetric sidewall profiles 3112 and 3114 (e.g., 3112 being the symmetric mirror of 3114 above dotted mirror axis 3113). Reflector sidewalls 3112 and 3114 are shaped according to these geometric boundary conditions of ideal length 3106, width 3102 and ideal width 3104, so that the slope at every point of curvature 3116 substantially satisfies equations 7-12 above, and gives rise to the sharply defined cone 3118 of directional output illumination 3122 angularly limited to ideal angular extent, +/−$\theta_1$ (half-angle 3120, $\theta_1$) indicated by the illustrative ray paths 3124-3134. It is also shown in FIG. 116 that the upper portion 3136 of RAT (or CAT) reflector 3100 can be truncated along dotted cut-line 3138 (as in the example of FIG. 86) by the amount $L_1$-$L_{11}$ without a significant deviation from otherwise ideal performance. This capacity of reflector 3100 to tolerate foreshortening is illustrated by the behavior of ray path 3140, which escapes truncated aperture width 3110 at point 3142. The deviation from angular ideality 3144 ($\Delta\in$) caused by rays similar to 3140 is approximated by the angle between rays 3129 and ray 3146 (parallel to ray 3140). Provided sidewall profile 3112 is slowly varying and governed by equations 7-12, as at point 3142 in the present example, $D_{11}$~$D_1$, and the expression for $\Delta\in$ is as given in equations 13 and 14 for $\Delta\in_t$ and $\Delta\in_2$ (the deviations in the two meridians of the RAT).

$$\Delta\in_1 \sim \mathrm{Tan}^{-1}[0.5(D_1+d_1)/L_{11}]-\mathrm{Tan}^{-1}[0.5(D_1+d_1)/L_1] \quad (13)$$

$$\Delta\in_2 \sim \mathrm{Tan}^{-1}[0.5(D_2+d_2)/L_{22}]-\mathrm{Tan}^{-1}[0.5(D_2+d_2)/L_2] \quad (14)$$

For a CAT, there would need be only be one equivalent equation as the deviation would be circularly symmetric around its optical axis.

RAT reflector 3100 as shown in FIG. 116 has been illustrated with a 1.2 mm square input aperture 3102, a 2.4 mm square output aperture 3104, a 3.117 mm ideal length 3106 and because of this, a +/−30-degree angular output cone 3118 with square angular cross-section. If this particular illustrative reflector 3100 is truncated in length by 33% so that $L_{11}$=0.67$L_1$, $\Delta\in$ by equation 13 is only about 10-degrees, and the beam's far-field illumination pattern remains substantially square. When reflector 3100 is designed for a +/−12-degree angular output cone and truncated in length by the same 33%, $\Delta\in$ is 5.6-degrees. In each case the angular expansion is about 50%, and in each case much of the light remains in the narrower designed-for cone, useful in cases where the narrower designed-for cone is used to spot light a particular size rectangular or circular area.

Accordingly, whatever RAT (or CAT) reflector geometry is deployed, its truncation length $L_{11}$ may be applied judiciously to impart a deliberate degree of angular softening on the otherwise sharply defined angular cone 3122 produced by such etendue-preserving reflector types (governed by equations 7-12). Moreover, when additional angular spreading is required, the angle spreading systems illustrated in FIGS. 53, 54 and 80 may be combined with reflector 3100 (whether ideal in length or truncated) as an additional embodiment of light distributing optic 273 according to the present invention, as will be illustrated by the following examples.

FIG. 117 is a perspective top view of a realistic quad-section RAT reflector 3150 pertinent to the present invention, each reflecting section 3152-3155 having the same geometric form, and effective sidewall curvature, as the +/−30-degree RAT reflector from the generalized example of FIG. 116. Each of the four input apertures 3160 are 1.2 mm square, each of the four output apertures 3162 are 2.4 mm square, and the separation distance between each input aperture and output aperture 3164 is 3.11 mm, which is also ideal length ($L_1$) 3106 prescribed by equations 7-12 for these conditions. The center-to-center separation between reflector sections in this example is 2.7 mm, allowing 0.3 mm wall-space 3166 (G) between output apertures. An overhang feature 3168 is provided in this example, to illustrate at least one possible mounting means.

The one-piece quad-section RAT reflector as illustrated in FIG. 117, is formed preferably using a high temperature polymeric material or polymer composite (e.g., Ultem™, PPA or PES) as by injection molding, compression molding, or casting, or a metal (e.g., nickel) as by electroforming. In either case, a high-reflectivity metal coating (e.g., enhanced and protected silver or aluminum) is applied to all interior sidewalls (i.e., opposing sidewalls 3170 and 3172), whether by vapor deposition (e.g., sputtering) or by an electrochemical process.

The single reflector section, as illustrated previously in FIGS. 110A, 110E, 111A and 111B, may be used with four 1 mm LED chips packed closely together as is present commercial practice, but the ideal reflector will be deeper. The single +/−30-degree RAT reflector section for a 2×2 array of 1 mm LED chips as in the previous examples is 6.2 mm in total length, which while twice as thick is still acceptably thin for the tile illumination system applications of the present invention. Narrower angle RAT reflectors are better deployed using the multi-sectioned approach illustrated in FIG. 117 to assure they still fit substantially within the body thickness of tile 6.

FIG. 118 is a perspective view showing one practical example integrating an illustrative quad-sectioned RAT reflector 3150 with a modified version of Osram's standard four-chip OSTAR™ LED emitter 3176. Instead of mounting four 1 mm LED chips nearly touching each other, as is done commercially by manufacturers such as Osram Opto Semiconductor, the same four chips are spaced further apart in the present example, to match the center-to-center spacing of the corresponding reflector sections 3152-3155 as illustrated in FIG. 117. Two mounting blocks 3178 and 3180 are attached to the OSTAR™ emitter's substrate 3182, providing nesting surfaces for overhang 3168 on quad-sectioned RAT reflector 3150.

The example of FIG. 118 is just one example. Other forms of LED emitter are just as suited to practical integration with RAT reflectors similar to the examples herein.

FIG. 119 is an exploded perspective view illustrating a complete light-generating portion 3186 of yet another embeddable vertically stacked light distributing engine 4 in accordance with the present tile illumination system invention. In this example, LED light emitter 271 is the illustratively modified four-chip OSTAR™ emitter version 3176 introduced in FIG. 118 with its four deliberately separated LED chips 3188 visible, attached by screws 3190 and 3091 to illustrative 1"×1" heat-conducting circuit board 3194 (with optional heat-conducting element 3195). The associated light distributing optic 273 in this example comprises quad-sectioned RAT reflector 3150, illustrative emitter mounting blocks 3178 and 3180, optional diffusing window 3196, and illustrative 1"×1" chassis frame 3198 with 30-degree beveled output aperture 3200. In this illustrative example, chassis frame 3198 provides a mounting surface for the edges of optional diffusing window 3196 brought together along guidelines 3201 and 3202, while attaching to circuit board 3194 along dotted guidelines 3203-3204. The method of chassis frame attachment illustrated are pegs 3205-3208 which are either pressed or heat staked into corresponding holes 3209-3212 in circuit board 3194. Attachment alternatives include gluing, screws and other common mechanical fastening methods. Optional diffusing window 3196 is a stack comprising one or more of a clear transparent material, a transparent material with scattering centers to providing haze, a surface diffuser, a volume diffuser, a holographic diffuser, and a lens sheet. The "diffusing" window could instead, or additionally, be a light redirecting window, including such elements as lens sheets that perform focusing, splitting, and/or bending.

FIG. 120A is a perspective view of the fully assembled form of the illustrative vertically stacked RAT reflector-based light generating module 3186 illustrated in FIG. 119, as within a light distributing engine 4 of the present invention. This illustrative element is 1" square and 17.7 mm thick, conforming to the geometrical needs of the present tile system invention.

FIG. 120B is a perspective view showing the sharply defined output beam 3220 produced along axis 111 by the vertically stacked light-generating module 3186 illustrated in FIG. 120A when DC voltage is applied. In this example, DC voltage is applied to an electrode on circuit board 3194 connected to the positive side of the included LED chips 3188, and an access to ground is connected to the negative side. Beam 3220, as shown in FIG. 120B, has a square cross-section and an angular extent substantially +/−30-degrees x +/−30-degrees as provided by the included quad-sectioned RAT reflector 3150 described above, and as transmitted by optional diffusing window 3196 and beveled output aperture 3200 of chassis frame 3198. In other situations, the design of optional diffusing window 3196 may be selected to widen the angular extent of the output beam 3220 deliberately. In still other situations the angular extent of output beam 3220 may be widened by changing the design dimensions of one or more RAT reflector sections of RAT reflector 3150 according to equations 7-12 above, foreshortened reflector length 3164 (see FIG. 117) also as described above, or both.

This form of light generating module 3186, while smaller in external size than the comparable light generating portions of previous light distributing engine examples (as in the FIGS. 103-107 and FIGS. 110A-110E), may still be integrated with associated power regulating and controlling electronics in a similar manner to those previous examples, equally suited to embedding within standard building material bodies, as in a ceilings, walls or floors.

FIG. 121A is a perspective backside of one embeddable light distributing engine 4 of the present vertically stacked form illustratively incorporating four light generating modules 3186 in a linear fashion with the same embedded electronic circuit portion 1940 (and embedding plate 1941) of previous examples (e.g., FIGS. 110C and 110D). The present example adopts a proportionally smaller chassis frame 3230 to accommodate the smaller light generating modules involved, and their illustratively associated heat sink fins 3232 (one per light generating module or one for the group of light generating modules). Provisions are made internally to assure good thermal contact between each LED emitter 3176 and heat sink fins 3232. The four included light generating portions 3186 are mounted on an electric circuit plate 3234 (similar to 1952 above), whose circuit layer interconnect the four modules and provide interconnection pads for contact with electronic circuit portion 1940 via electrodes 1958 and 1960. The overall size of this particular embeddable engine is 129.6 mm×109.95 mm×18.7 mm (i.e., about 5"×4"×¾"), but its effective illumination aperture is considerably smaller at 94.4 mm×18.2 mm (i.e., about 4"×¾").

FIG. 121B is a perspective view as seen from the floor beneath of the embeddable light-distributing engine 4 of the form shown in FIG. 121A. The optional diffusing (of light redirecting) windows 3196 are presented in transparent form to aid visibility of underlying elements in each module.

FIG. 122A is an exploded backside perspective view of a tile illuminating system 1 illustrating the embedding details 3290 needed to nest this smaller form of light distributing engine 4 in the proximate center (dotted region 3300) of a tile-based building material, illustratively a 24"×24" ceiling tile 6. Embedding features 3301-3306 are also included for the associated DC voltage and ground access straps 3308 and 3310. Embedding feature 3303 is the resting surface for embedding plate 1941 of electronic circuit portion 1940. Embedding feature 3304 is the slot through which light passes from the output apertures of the so-embedded light-distributing engine 4. The embedding process illustrated in this case is nearly identical to that shown for the tile illuminating system embodiment of FIG. 106, with the engine embedded along dotted guidelines 3320-3322, and the interconnection straps along dotted guidelines 3324-3327. The inclusion of airflow slots within the body 5 of tile 6 in the vicinity of one or both sets of heat sink fins (1950 and 3230) is optional. And, as in all previous examples of the present invention, the number of light distributing engines 4 embedded within a single tile element (only illustratively a 24"×24" tile unit in the included examples) depends on the amount of light and the distribution of illumination required.

FIG. 122B is a magnified view of the embedding region 3300 shown in the perspective view of FIG. 122A, to be sure the illustrative embedding process is properly visualized for this more compact type of embeddable light distributing engine FIG. 123A is a perspective view from the floor beneath showing the 4"×¾" illuminating aperture of the +/−30-degree tile illumination system of FIGS. 122A-122B incorporating the single vertically stacked light distributing engine of FIGS. 121A-121B. This example employs a single RAT reflector-based light distributing engine 4 comprising four separate light generating modules 3186 as described in FIGS. 117-122. Edge connectors 304 are shown, for illustration purposes only, with optional T-bar suspension system connecting tabs 874 (as were described in FIG. 3H and FIGS. 68-71. Embedded tiles according to the present invention may be other comparable building materials, and may comprise other means of electrical connection.

FIG. 123B is the perspective view of the illumination provided by the tile illumination system 1 of FIG. 123A when supplied with DC voltage, and when co-embedded electronic circuit portion 1940 receives an on-state control signal from the system's master controller 40 (not illustrated). There are four spatially overlapping flood-lighting beams 3350-3353, in this particular example, one from each of the four embedded light generating modules 3186, and each having the +/−30-degree×+/−30-degree angular extents expected in the present example. (Alternatively, each light-generating module 3186 may be controlled independently in applications that favor doing so.) When this particular illumination system 1 is installed at height 3356, 9 feet (108 inches) above the floor beneath, the resulting illumination pattern 3358 is substantially square with cross-sectional dimensions 128.4 inches along edge 3360 and 125.7 inches along edge 3362. The minor dimensional difference is due to the rectangular aspect ratio of this particular 25.4 mm×94.43 mm illuminating aperture 3330 (as shown in FIG. 123A), and the one meridian beam overlap illustrated.

The present light distributing engine embodiment of FIGS. 116-123, as a consequence of its underlying etendue-preserving RAT reflectors 3150, has the advantage of achieving the highest possible optical efficiency of all thin-profile light distributing engine examples of the present invention that have been provided. With a suitably high reflectivity (i.e., enhanced silver) coating provided on the RAT reflector's internal sidewalls 3112 and 3114 (as in FIG. 116) a total output efficiency of better than 96% has been simulated by optical ray tracing and confirmed by measurement of the laboratory performance of actual prototypes. Even when an optional diffusing window 3196 is added, the total optical throughput efficiency of light generating modules 3186 can still be higher than 90%. Consequently, when using four-chip OSTAR™-like LED emitters 3176, the present one engine system can provide more than 2000 field lumens of cool-white CCT (correlated color temperature) illumination 2. The total illumination is increased easily by including additional light generating portions 3186. Furthermore, the total output performance of this embodiment, as with all other embodiments of the present invention whose output depends in part on the starting performance of the LED emitters being used, will increase in total illumination capability as LED performance increases over time. LED performance has been increasing dramatically for the past several years and will likely continue to do so for several more.

The example provided above suits the many floodlighting needs served by well-defined +/−30-degree illuminating beams. Yet, the same embodiment extends to narrower-angle task lighting applications as well, using a narrower-angle RAT (or CAT) reflector 3150. One example of this variation is provided in FIGS. 124A-124B.

FIG. 124A is a side-by-side comparison of the ideal cross-sections of a +/−30-degree RAT reflector 3150 with that of a +/−12-degree RAT reflector 3360, both for the illustrative case of a 1.2 mm input aperture 3102. The +/−12-degree RAT reflector 3360 has an ideal length 3362, $L_1$ (12)=16.4 mm, and an ideal output aperture 3364, $D_1$ (12)=5.77 mm. The +/−30-degree RAT reflector 3150 has an ideal length 3106 as above, $L_1$ (30)=3.11 mm, and an ideal output aperture 3104, $D_1$ (30)=2.4 mm. Despite its more than 5× greater length, there is still just enough room in light generating module 3186 of the present example for reflector 3360 to be used without significant truncation. Yet, this wouldn't be the case without implementing the quad-sectioned arrangement illustrated. The spacing between the four LED chips (e.g., 3188 in FIG. 119), however, is made necessarily wider. This requirement is easily accommodated via a simple revision of the OSTAR™ type LED emitter package of the previous examples.

FIG. 124B is a perspective view showing the basic internal thin-walled form 3361 of the quad-sectioned version of +/−12-degree RAT reflector 3360. Alternatively, the four reflective elements 3364-3367 may each be a solid transparent dielectric material of analogous shape, whose exterior boundary surfaces support favorable conditions for total internal reflection FIG. 125A is an exploded perspective view illustrating one molded plastic (or electroformed metal) quad-sectioned RAT reflector part 3370 having +/−12-degree output (formed monolithically in this example) along with counterpart LED emitter 3380. The reflector's 16 interior sidewalls 3372 are made with a mirror finish and are coated after formation with a high reflectivity metal film (e.g., enhanced silver or aluminum) as described above. Reflector element 3370 is mated in this example with a four-chip LED emitter 3380 along guidelines 3382-3385. Three of the four 1 mm LED chips, 3388-3390, are visible, and have been arranged with the appropriate center-to-center spacing 3392 shown, matching the separation distance between the reflector's input apertures (not shown). Illustrative LED emitter 3380, as just one of the preferable emitter examples possible, is fashioned after the design of current commercial OSTAR™ models shown above, as made by Osram Opto Semiconductor. In this prototype illustration, the mounting plate 3400 and mounting frame 3402 have been enlarged to match the molded exterior of reflector 3370. In addition, electrodes (e.g., 3404 shown) have been positioned closer to the edges of substrate 3406, and the protection diode 3408, moved more conveniently as well. Provision is made, but not shown in this view, for internal interconnection of electrodes 3389 with other circuit elements (e.g., whether by conductive vias, wire bonds, soldered wires, or soldered flex circuits).

One practical means for reflector-emitter attachment is illustrated by the example of FIG. 125A as well. Mounting legs 3410 are formed on opposing sides of reflector 3370, along with through holes for symmetric pan screws 3414, each of which passes along guideline 3383 (and its hidden counterpart) through corresponding through hole 3416 in emitter substrate 3406 to match a threaded receiving hole on the actual mounting layer.

FIG. 125B shows a slightly different perspective view from the output end of the assembled form of the light distributing engine example given in FIG. 125A. The four illustrative LED chips, 3389-3391, are shown centered within the corresponding four input apertures of quad-sectioned RAT reflector 3370.

As the reflectors of this form get deeper (geometry and shape derived from equations 7-14 above), it may be more practical to form them in multiple parts or stages, either horizontally, vertically or both. Multi-part versions of the RAT reflectors illustrated herein are assembled from individual elements that when joined to each other, form the whole. As one example, its may be easier to coat the internal sidewalls 3372 of a deep four-sided reflector element if it is bisected (either in half or across its diagonal) and each half coated prior to assembly. As another example, the portions of the reflector nearest the high flux density of the LED chips themselves may be made preferably of a metal rather than even a temperature resistant plastic, so as to improve the resistance to long term exposure to the associated light levels, while reflector portions further from the LED may be made of plastic rather than metal for purposes of cost-saving. While multi-part or multi-stage reflectors may be utilized in practical commercial embodiments of the present invention, for simplicity of illustration, reflector 3370 is illustrated only as a monolithic part.

FIG. 125C is an exploded perspective view illustrating one embeddable +/−12-degree light-generating module subassembly example 3450, analogous in form to that shown in FIG. 119 for the shorter +/−30-degree version. The module 3450 comprises, in addition illustrative LED emitter 3380 and quad-sectioned RAT reflector 3370 (with visible quad-sectioned input apertures 3371), an illustrative 1"×1" heat-conducting circuit board 3454 with threaded attachment means 3455, illustrative 1"×1" chassis frame 3456 with illustrative mounting pegs 3458, heat sink fins 3460, output frame (or fascia) 3462 with optional light spreading film sheets 3464 and 3466 plus internal film retention frame 3468. Chassis frame 3456 is similar to the example shown in FIG. 119, except for its different provisions for an output frame 3462.

The subassembly of module 3450 proceeds as previously illustrated for the similar construction in FIG. 119, with LED emitter 3380 bonded (and interconnected) to circuit board 3454 along dotted guideline 3470, quad-sectioned RAT reflector 3350 mounted to emitter 3380 as shown in FIG. 125A along dotted guideline 3382, and then tightened into place to enable good thermal contact between LED emitter 3380 and circuit board 3454 by means of pressure from illustrative attachment means 3414 and 3455. Alignment between LED chips 3388-3391 (not shown) and the RAT reflectors quad-sectioned input apertures 3371 is made visually before tightening. Following this step, chassis frame pegs (e.g., 3458) are inserted along dotted guideline (e.g., 3303) into retention holes (e.g., 3209) provided on circuit board 3454, and heat sink fins 3460 are attached to the side surfaces of chassis frame 3456. The attachment of output frame 3462 along dotted guidelines 3472-3473 is optional, as is the inclusion within its retention frame 3468 of one or more light spreading film sheets such as the lenticular types 3464 and 3464 shown. The use of output frame 3462 with some form of included film stack 3480 (providing the diffusive, lighting scattering, light spreading or light redirecting functions discussed earlier) provides additional flexibility in tailoring the light generating module's illumination quality, and does so in this example, module 3450 by module 3450. When used, the die-cut film sheets 3480 are installed along dotted guidelines 3476 and 3477.

The present +/−12-degree RAT reflector with 1.2 mm input aperture edge lengths 3102 is truncated slightly (~3 mm or 20%) from its ideal 16.4 mm length 3362 as shown in FIG. 119 not only to better facilitate its embedding in the present tile system invention, but as discussed earlier, to soften the sharpness of its angular cutoff. Such a small length change has been found to have little noticeable effect on general shape and uniformity of the reflector's substantially square +/−12-degree far-field beam pattern. Rather than the sharply defined brightness cutoff characteristic of full-length RAT reflectors, however, the 20% reflector length reduction applied in the present example provides a softened roll-off preferred in some lighting applications (+/−2.5-degrees, as approximated by equations 13-14).

FIG. 125D is a perspective view of the single +/−12-degree light generating module 3450 of FIG. 125C after subassembly, with the exception of output frame 3462, which remains in exploded view for visual clarity of the quad-sectioned output aperture of RAT reflector 3370.

FIG. 126A is a backside perspective view of an embeddable light distributing engine embodiment formed according to the requirements of the present tile illumination system invention incorporating four +/−12-degree light generating modules 3450 containing the quad-sectioned RAT reflector of FIGS. 125A-125B, along with the elements of associated electronic voltage control 1940 as have been illustrated in previous examples. The four light generating modules 3450 are fit into exactly the same embeddable chassis frame 3230 introduced in the example of FIGS. 120A-120B, and are both retained electrically interconnected as a group by circuit plate 3490. As in previous examples, engine is activated when a DC voltage, $V_{dc}$, as from external system supply 30 (shown earlier), is applied to positive engine electrode 1954, and ground access to electrode 1956. Output illumination 2 from one or more of the engine's light generating modules 3450 is then emitted at a designated output level depending on the particular demodulated control signal that's received from the system's master controller 40 (shown earlier).

FIG. 126B is a floor side perspective view of the embeddable light distributing engine embodiment 4 of FIG. 126A. Optional light spreading film stack 3480 (FIG. 125C) has been removed to provide clear view of the four quad-sectioned RAT-reflector output apertures.

FIG. 126C provides another floor side perspective view of the embeddable four-segment light-distributing engine 4 of FIG. 126B, showing only as one example, two of its four light generating modules 3450 switched on, and illustratively different illuminating beams developed by each of them. This particular example is provided to illustrate the angular flexibility of this multi-segment light-distributing engine 4. When the present engine is embedded in the body of a tile material 6, as shown in previous examples, and is operating as part of a tile illuminating system 1 in accordance with the present invention, a more common mode of operation would have all four light emitting modules 3450 providing collective illumination 2 simultaneously of the same angular extent (as was illustrated previously in the example of FIG. 123B). The capability to arrange a different beam pattern (square, rectangular, circular or elliptical) for each light-generating module in the engine enables the collective (overlapping) illumination from each engine to be tailored to satisfy a wide range of illuminating needs.

Front beam 3494 in the example of FIG. 126C is the output illumination provided by the first light-generating module 3450 in the four-element group of modules, which illustratively contains no light spreading film stack 3480 within its output frame. Accordingly, the +/−12-degree×+/12-degree light cone 3494 that's emitted has a square cross-section 3496 and edge boundary dimensions 3498 and 3500 in the two beam meridians that are dependent on their elevation 3502. The elevation shown is 250 mm (9.8 inches), which is much closer to the illumination source than would be preferable in practical application. The beam's prevailing edge dimensions 3498 and 3500 at this elevation are about 120 mm×120 mm (4.7"×4.7"), as determined by geometrical equations 15 and 16, with $X_{BEAM}$ representing edge dimension 3498, $Y_{BEAM}$ representing edge dimension 3500, and H representing elevation 3502.

$$X_{BEAM} \sim 2D_1 + 2(H \operatorname{Tan} \theta_1) \quad (15)$$

$$Y_{BEAM} \sim 2D_2 + 2(H \operatorname{Tan} \theta_2) \quad (16)$$

Rear beam 3510 in the example of FIG. 126C is emitting from the fourth or last light-generating module 3450 in engine 4, and results from the use of only one light spreading film sheet (i.e., the lower lenticular film 3464 shown in FIG. 125C). This +/−30-degree light spreading illustration is just one example of the many spreading angles possible with the lenticular light spreading method. With only one light spreading film 3464 at work, beam 3510 has a +/−30-degree×+/12-degree light cone emitted with rectangular (rather than square) cross-section 3512 and with associated edge boundary dimensions 3514 and 3516 in the two beam meridians, 300 mm×120 mm at the 250 mm elevation illustrated.

This advantageous rectangular light spreading behavior stems from the unique behavior of parabollically shaped lenticular lens elements introduced in U.S. Provisional Patent Application Ser. No. 61/024,814 (International Stage Patent Application Serial Number PCT/US2009/000575) entitled Thin Illumination System. Advantageous use within the present invention was also considered in the earlier examples of FIGS. 52-55 and FIGS. 80-81. When the vertices of the lens sheet's parabollically shaped lens elements (also called lenticules) are pointing towards reasonably collimated incoming light (e.g., angular extent less than about +/−15-degrees), transmitted light spreads only in the meridian orthogonal to the sheet's cylindrical axes with a full spreading angle $\phi$ (i.e., 20) according to equations 17 and 18 for film sheets made of polymethyl methacrylate (acrylic), n=1.4935809, and polycarbonate, n=1.59 respectively. SAG, in equations 17 and 18, represents the vertex height and PER represents the base width of each lenticule in the associated lens sheet.

$$\phi = 172.24[SAG/PER]^{0.38} - 48.5 \quad (17)$$

$$\phi = 203.15\,[SAG/PER]^{0.45} - 46.66 \quad (18)$$

When lenticule SAG is 50 microns, and lenticule PER is 166 microns, (SAG/PER) is about 0.3, and total beam angle $\phi$ according to equation 17 is 60.5-degrees and corresponds to the +/−30-degree angular extent shown.

FIG. 126D is a planar view looking directly upwards at the line of four output apertures associated with light generating portion 3450 on the bottom side of the embeddable light-distributing engine 4 of FIG. 126C as seen from the plane being illuminated 250 mm beneath. The separation distance 3520 (ΔY) between the beam centers 3522 and 3524 (for beams 3494 and 3510 respectively) in the present example, is $(P)(6D_2)$=76.2 mm, where P is a geometric expansion factor (2.2 in the present example) that accounts for space taken up by wall thickness of the quad-sectioned RAT reflectors and those of the module chassis materials themselves.

FIG. 126E is the same planar view as in FIG. 126D, but seen from a distance ten times further below, as from a floor surface 9-feet beneath (i.e., 2743.2 mm) the ceiling mounted engine. This view assumes the light distributing engine example of FIGS. 126C-126D is embedded in a 9-foot high ceiling system made in accordance with the present tile illumination system invention. While the two resulting illumination beams 3494 and 3510 of the present example still have the same functional separation distance of 76.2 mm (3 inches), the corresponding illumination patterns on the floor surface beneath are large enough at this elevation to become nearly overlapping. At 9-feet (i.e., 2743.2 mm), illustrative +/−12-degree×+/−12-degree square beam 3494 has cross-sectional dimensions $X'_{BEAM1}=Y'_{BEAM2}$=1180.67 mm (3.87-feet) and +/12-degree×+/30-degree rectangular beam 3510, cross-sectional dimensions $X'_{BEAM1}$=3182.07 mm (10.44-feet) and $Y'_{BEAM2}$=1180.67 mm (3.87-feet).

FIG. 126F is the computer simulated 1180 mm×1180 mm far field beam pattern 3540 produced by beam 3494 on a simulated 4 meter×2 meter floor surface 9-feet below by the +/−12-degree×+/−12-degree illuminating beam 3494 from one quad-sectioned RAT reflector 3370 within the embeddable light-distributing engine of FIG. 126C. Despite the 20% truncation of quad-sectioned RAT reflector 3370 field pattern 3540 is almost ideal, with only a slight softening at the edges.

FIG. 126G is the computer simulated 3200 mm×1180 mm far field beam pattern 3546 produced by when the quad-sectioned RAT reflector in the system of FIG. 126F has been combined as described above with a single parabollically-shaped lenticular film sheet 3464 designed and oriented to spread light +/−30-degrees as shown in FIGS. 126C-126D. The slight fall-off in brightness uniformity towards the opposing ends of the light widened light distribution is a consequence of the +/−12-degree width of the incoming light. Higher spatial uniformity over the full horizontal field may be achieved when desired by using a RAT reflector 3370 with reduced angular extent.

The field patterns illustrated in FIGS. 126F-126D were obtained from the simulated performance of a realistically modeled counterpart to the quad-sectioned light-generating module 3450 described in FIGS. 125A-125D using the commercial ray tracing software product ASAP™ Advanced System Analysis Program, versions 2006 and 2008, produced by Breault Research Organization of Tucson, Ariz.

LED emitters 3176 used in good practice of the present invention may include any number and geometrical distribution of LED chips 3188, whether the effectively white emitting phosphor-coated blue LED's included in the OSTAR™ examples above, whether mixtures of red, green, blue, amber and white LED's as in other OSTAR™ emitter types, or whether completely different LED emitter designs such as those with a phosphor-loaded resin filled cavity. The LED chips 3388-3391 as in FIG. 125A may be contained within a single framed support plate 3400 as shown, or may be contained in individual packages mounted on a similar support plate.

For consistency of illustration, all the embedded tile illumination system examples of the present invention thus far have been illustrated using one or more 24"×24" tile material, such as those that might be used traditionally in a suspended ceiling. The tile material used in accordance with the present invention may just as usefully include ceiling materials other than those suspended in T-bar suspension systems, such as traditional drywall, and with a wide range of comparably thin-profile building materials as may be used in walls and floors.

One additional reason for dwelling on embedded tile illumination system examples of the present invention well suited to suspended ceiling systems is the potential for significant environmental and economic impact that is associated with them. Not only does the integrated tile illumination system 1 of the present invention reduce ceiling weight, and thereby reduce danger from falling lighting fixtures during seismic catastrophes, but the combination of embedded ceiling tile elements brought together prior to job site delivery significantly reduces the labor of lighting system installation.

Examples of the process steps associated with the manufacturing paths for embedded tile illumination systems of the present invention were summarized in FIGS. 8-10 above. Examples of the installation process steps for an entire ceiling system for the present invention, compared to traditional installation process steps, are shown in FIG. 127 and discussed below. Examples of the top-level process flow, from design to installation, of conventional practice and of the present invention are shown in FIG. 128A and FIG. 128B, respectively, and discussed further below.

FIG. 127 presents a side-by-side comparison of the flows associated with the traditional overhead lighting system installation process (left side branch 3600) and one possible flow associated with the simplified installation process enabled by pre-manufactured tile illumination systems of the present invention (right hand branch 3602) and in this case, primarily their application with ceiling tile suspension systems according to the present invention capable of electric power delivery, as introduced above by the examples of FIGS. 3A-3C, 3F-3H, and 68-71.

The traditional overhead lighting system installation process is typified by the left hand flow diagram branch 3600 of FIG. 127, for the ubiquitously recessed 2'×2' and 2'×4' fluorescent troffers (as were shown earlier in FIGS. 2B-2E). Office buildings under construction are pre-wired by the electrical trade with high-voltage AC conduits 3604, and a T-bar tile suspension system grid (as was illustrated earlier) is installed wall-to-wall by the finish carpentry trade 3606. Ordinary ceiling tile panels in taped bundles are delivered to the job site separately, as are the individually packaged 35 lb troffers, in delivery step 3608. A mechanical assembly worker installs the delivered troffers in specified suspension grid locations, supporting the weight of each individual troffer not by the tile suspension system itself, but rather by installing a secondary mechanical suspension means from the building's structural ceiling 3610. The electrical trade returns to connect the high voltage wiring to the installed troffers, a process 3612 that generally is performed by trained electricians. The finish carpentry trade then returns to lay in the passive ceiling tiles in suspension grid locations unoccupied by fluorescent troffers, and to install any decorative trim pieces needed at the troffer grid locations 3614. The same process flow applies to the installation of recessed can lighting fixtures, as in FIGS. 2A, 2C-2E, and to combinations of equivalently conventional lighting fixtures.

The simplified installation process enabled by pre-manufactured tile illumination systems of the present invention is illustrated by the right hand process flow 3602 of FIG. 127. In this case, a DC powered T-bar tile suspension system grid (as was illustrated in FIGS. 3E-3H and FIGS. 68-71) is installed wall-to-wall, by the finish carpentry trade, just as in the conventional case, using standard practice 3620. The electrical trade then connects low voltage DC and ground wires to only the periphery of the DC powered suspension grid 3622 in this special case, which is a much less time-consuming process that the installation of high-voltage AC conduits 3604. Bundles of conventional ceiling tile and bundles of lighting integrated ceiling tile are delivered to the job site in step 3624. Since the tiles with embedded lighting, control and interconnection means according to the present invention are about the same thickness (and weight) as standard tiles, the associated delivery process 3624 can be much more efficient than the conventional one, 3608. The two delivery steps are surrounded by dotted line 3623. The finish carpentry trade, following blue print specifications provided by building contractor and architect, installs both types of tile in specified locations 3626. In building situations where a standard tile suspension system is installed in step 3622, interconnection of the low-voltage cabling to connectors pre-installed on the embedded tiles is straightforward enough so that the connections may be made by non-electricians who simply snap pre-installed connectors together. Alternatively, the electrical trade can make the snap-in connections when it returns to the job site to conduct system programming and the installation of switching and control functions.

While the left and right hand process flows 3600 and 3602 in FIG. 127 involve almost the same number of steps, the pre-manufactured tile illumination systems 3624 of integrated system 3602 as represented by the present invention arrive at the job site ready to be installed basically by a single construction trade, whereas the traditional system 3600 requires more significant job site preparation 3604, a more substantial delivery burden 3608, and trained electricians to electrically connect the lighting fixtures involved 3612. Whereas tiles in integrated lighting system 3602, whether plain or embedded, are dropped into the grid or suspending superstructure 3626 (and if not connected immediately on contact with the grid, then simply plugged into the pre-laid low voltage DC power lines 3622). Alternatively, the ceiling tile installation, of both conventional tiles and lighting integrated tiles minus their light-distributing engines, can be accomplished through a single shipment and installation phase (as in the example of FIGS. 46-52 above). Then, in a single operation after all construction is completed, the electrical trade (and possibly the carpentry trade) 3626 can snap the light-distributing engines into the tile (e.g., FIG. 51), snap in the power connections, and program the switching and control functions. In current practice flows 3600, several separate visits by the electrical trade are required during various phases of the construction process.

FIG. 128A presents a top-level process flow, from design to end use, associated with traditional ceiling and overhead lighting systems. Ceiling materials, luminaires (i.e., lighting fixtures such as fluorescent troffers, recessed cans or track mounted elements), and their associated control electronics are each processed along separate branches 3700, 3710 and 3720 through the steps of design (3701, 3711 and 3721), manufacturing (3702, 3712 and 3722) assembly (in the cases of the multi-part luminaires of 3713 and control electronics of 3723), and installation (3704*m* 3715 and 3725), before finally serving together as a programmable and useable ceiling and illumination system in 3730.

FIG. 128B shows, for comparison, an analogous top-level process flow enabled by the cohesively designed 3800 embedded tile illumination systems 1 of the present invention. In this case, the entire manufacturing and installation process is systems oriented from start to finish, beginning with the globally planned design step 3800 of an embedded tile illumination system that incorporates all of the necessary system elements including ceiling materials (e.g., a section of drywall or a ceiling tile), the embeddable thin luminaires as the thin-profile light distributing engines 4 introduced above, and their associated control electronics 1940 (e.g. sensor circuits, power regulation circuits, and application specific integrated circuits as described above). After the integrated design step 3800, the manufacturing of the individual tile illumination system components as specified is performed preferably along multiple manufacturing paths (i.e., a manufacturing vendor for each part or similar group of parts) 3801, -3803, just as in the conventional flow of FIG. 128A (as in 3702, 3712 and 3722). The primary difference, however, is that unlike the conventional process flow of FIG. 128A, the integrated process flow of FIG. 128B brings forth all component manufacturing sub-steps within a cohesive and overarching manufacturing specification 3800 to achieve finished embedded (tile illumination) systems ready for installation and use on site. The manufactured components are combined according to plan in a single bill of materials that drives final assembly and test 3804. Finished goods are delivered 3805 to the job sites requiring them, along with the other conventional building materials that are involved, and installed 3806.

The traditional practice is to separately design building materials, luminaires, and the control electronics associated with them is illustrated in FIG. 128A by the first step in each of the three separate branches 3700, 3710 and 3720. For traditional systems, the ceiling materials of branch 3700 (such as gypsum ceiling tiles or drywall panels) are designed first with mainly structural, thermal, and acoustic performance being the predominate motivators. No consideration is given in conventional steps 3701 or 3702 to their use with lighting fixtures, luminaires or the wiring of electrical power. Luminaires within branch 3710 are designed independently 3711 along their own development paths to work with existing building materials and building material support systems. Recessed cans, as one example, are designed 3711 to fit through hand-cut holes cut in the conventional ceiling tiles or drywall being used, with access holes cut manually at the site of ceiling installation, and with suspending wires attached to the building structure above 3715. Fluorescent troffers, as another example, are designed 3711 to fit either within holes cut in drywall or as replacements for plain ceiling tiles, fitting into standard-sized spaces (such as 2'×2' and 2'×4') in the associated suspension lattices 3715. And, as in the case of recessed cans, the bulky fluorescent troffers, despite their pre-positioning in the existing ceiling tile suspension lattice, often require additional suspension means attached to the structural ceiling above 3715. Control electronics of branch 3702, needed to power, switch and adjust illumination level (if feasible) of the luminaires if branch 3710 (e.g., switches and dimmers), are also designed independently 3721, but with the goal of working with the existing luminaries, as well as with the prevailing high voltage AC power delivery infrastructures available in the buildings using them. The design of building materials 3701, luminaires 3711, and control electronics 3721 in the traditional system of FIG. 128A are each performed by substantially distinct design trades (i.e., distinct industries, business entities, or specialists), often with minimal if any synergistic collaboration. This approach allows the trades to work independently, but at the expense of increased material costs, increased cost due to inefficiency, and increased cost due to lengthy construction schedules.

The design practice associated with embedded (tile illumination) systems 1 of the present invention, however, is distinguished from conventional practice by the complete design coordination involved, from the building material, tile, board, or panel, to material integration with embedded luminaires, control electronics and interconnecting means) by a single (embedded illumination system) design trade, as represented in the uppermost box 3800 of FIG. 128B, or else by the collaboration of ceiling material, luminaire, and control electronic design trades under the direction of an embedded system design trade. While the root chemical composition of the building materials used may remain the same as other ceiling materials in common usage today, they may also have modified form factors, shapes and compositions, conducive to the new overhead lighting applications they enable, including features such as recesses and holes tailored to fit with the complimentarily designed form factors of specific luminaires and specific control electronics, such as were illustrated in FIGS. 32-33, and throughout the examples that followed 3801. This complimentary design objective 3800 (of the to-be integrated parts) leads to more desirable tile illumination system performance attributes such thinness (minimizing utility (or plenum) space above the ceiling) and low weight (minimizing need of weight supporting infrastructure).

As noted previously, the manufacturing of individual tile illumination system components may, after the design step 3800, be performed along multiple paths embodied in dotted process block 3810, similar to that in the conventional flow of FIG. 128A incorporating 3702, 3712 and 3722. For example, a ceiling tile company may be contracted to manufacture a particular ceiling tile design, an LED emitter may be purchased from an LED manufacturing company, a plastic light guiding optic may be contracted to an injection molder, and so on, until all of the parts specified by design 3800 have an associated supplier. After all parts are manufactured and supplied on the coordinated bill of materials defined in step 3800, the manufactured parts 3801, 3802 and 3803 are assembled 3804 into the embedded system preferably before transportation 3805 to the site of the end user (i.e. the job site), such as anticipated in FIG. 128B, or in special cases, afterwards. Alternatively, some assembly, such as the embedding electronic control elements into the ceiling materials and/or into the luminaires, can occur before transportation, while other steps, such as the snapping luminaires into the ceiling materials, can occur at the job site. Regardless, the end result is an integrated system consisting of ceiling material, luminaires, and control electronics (including any control relevant feedback elements such as sensors) that is ready to be installed (3806) at the job site, whether, for example, as an embedded tile illumination system to be placed into a suspended lattice, or, as another example, as an embedded lighting-in-drywall-panel system to be affixed to existing ceiling struts.

Assembling 3804 the system prior to installation 3806, as in FIG. 128B, enables more cost efficient transportation (fewer shipments to the job site) and time/cost efficient installation (fewer installation steps). This was discussed above and shown in the side-by-side process flow comparison of FIG. 127. For example, a tile with embedded light distributing engines (or thin luminaires) of the present invention along with power controlling electronics and means for electrical connections (i.e., an electrically active tile) can be transported in the same shipment 3805 as passive tiles, and installed into the ceiling support structure at the same time as and by the same ceiling installation trade as the passive tiles 3806, with electrical power connection of the active tiles to be performed (or at least checked) by an electrical trade. Furthermore, if the system is lightweight and thin, as are all of those systems described herein, shipping and installation time/costs may be further reduced over those of the traditional process, as shipping costs are usually proportional to both weight and size of shipment and installation time/costs are often higher for heavier materials requiring additional structural reinforcement.

In both traditional embodiments and the embodiments of the present invention, the job site is assumed to be pre-wired for convenient access to electrical power by the electrical trade and pre-installed with ceiling support structure (such as a suspended lattice receptive to ceiling tiles or as struts receptive to drywall affixation) by a ceiling or general construction trade. However, if the embedded tile illumination systems of the present invention are powered by low voltage DC, as all of the systems described herein, installation times and costs may be reduced by the lack of need for heavy high-voltage AC conduit, as is required for approved high voltage power transmission by the legal codes in many countries, including the United States. These upfront installation times/costs may be further reduced if the ceiling structure consists of a DC electrified ceiling lattice, such as described previously and illustrated for example in FIGS. 3A-H, where pre-wiring power connection points only need be laid to certain points of the lattice structure and not directly to each active tile.

Furthermore, the systems described herein, both due to their lack of need for cumbersome AC conduit and due to the embedding of key components into ceiling materials prior to installation as in FIG. 128B, enable easier, quicker, and more cost-effective installation of larger numbers of controllable luminaires (also light distributing engines and groups of light distributing engines) at the job site. Larger numbers of installed luminaires in turn enable larger number of lighting functions (e.g. as illustrated in FIGS. 1D and 101), increased light coverage to minimize dim or shadowed areas, and more power saving options due to increased flexibility to have only essential lights on at essential brightness.

It should be noted that the top level process flow of FIG. 128B and the associated detailed description herein illustrate several changes from and advantages over the traditional top level flow of FIG. 128A and its associated description. Each of those changes independently, and in any combination, are objects of the present invention.

The present invention contemplates methods, systems and program products on any machine-readable media for accomplishing its operations. The embodiments of the present invention may be implemented using an existing computer processor, or by a special purpose computer processor incorporated for this or another purpose or by a hardwired system.

As described above, many of the embodiments include program products comprising machine-readable media for carrying or having machine-executable instructions or data structures stored thereon. Such machine-readable media can be any available media which can be accessed by a general purpose or special purpose computer or other machine with a processor. By way of example, such machine-readable media can comprise RAM, ROM, PROM, EPROM, EEPROM, CD-ROM or other optical disk storage, magnetic disk storage or other magnetic storage devices, or any other medium which can be used to carry or store desired program code in the form of machine-executable instructions or data structures and which can be accessed by a general purpose or special purpose computer or other machine with a processor. When information is transferred or provided over a network or another communications connection (either hardwired, wireless, or a combination of hardwired or wireless) to a machine, the machine properly views the connection as a machine-readable medium. Thus, any such connection can properly be termed a machine-readable medium. Combinations of the above are also included within the scope of machine-readable media. Machine-executable instructions comprise, for example, instructions and data which cause a general purpose computer, special purpose computer, or special purpose processing machines to perform a certain function or group of functions.

Embodiments may be described in the general context of method steps which may be implemented by a program product including machine-executable instructions, such as program code, for example in the form of program modules executed by machines in networked environments. Generally, program modules include routines, programs, objects, components, data structures, etc. that perform particular tasks or implement particular abstract data types. Machine-executable instructions, associated data structures, and program modules represent examples of program code for executing steps of the methods disclosed herein. The particular sequence of executable instructions (or associated data structures) represent examples of corresponding acts for implementing the functions described in such steps.

Many of the embodiments described herein may be practiced in a networked environment using logical connections to one or more remote computers having processors. Logical connections may include a local area network (LAN) and a wide area network (WAN) that are presented here by way of example and not limitation. Such networking environments are commonplace in office-wide or enterprise-wide computer networks, intranets and the Internet and may use a wide variety of different communication protocols. Those skilled in the art can appreciate that such network computing environments can typically encompass many types of computer system configurations, including personal computers, hand-held devices, multi-processor systems, microprocessor-based or programmable consumer electronics, network PCs, mini-computers, mainframe computers, and the like. Embodiments of the invention may also be practiced in distributed computing environments where tasks are performed by local and remote processing devices that are linked (either by hard-wired links, wireless links, or by a combination of hardwired or wireless links) through a communications network. In a distributed computing environment, program modules may be located in both local and remote memory storage devices.

An exemplary system for implementing the overall system or various portions thereof may include a general purpose computing device in the form of a computer, including a processing unit, a system memory, and a system bus that couples various system components including the system memory to the processing unit. The system memory may include read only memory (ROM) and random access memory (RAM). The computer may also include a magnetic hard disk drive for reading from and writing to a magnetic hard disk, a magnetic disk drive for reading from or writing to a removable magnetic disk, and an optical disk drive for reading from or writing to a removable optical disk such as a CD-ROM or other optical media. The drives and their associated machine-readable media provide nonvolatile storage of machine-executable instructions, data structures, program modules and other data for the computer.

The foregoing description of embodiments of the invention has been presented for purposes of illustration and description. It is not intended to be exhaustive or to limit the invention to the precise form disclosed, and modifications and variations are possible in light of the above teachings or may be acquired from practice of the invention. The embodiments were chosen and described in order to explain the principals of the invention and its practical application to enable one skilled in the art to utilize the invention in various embodiments and with various modifications as are suited to the particular use contemplated.

What is claimed is:

1. A ceiling lighting system comprising:

a ceiling tile having one or more recesses extending at least partially through ceiling tile, the ceiling tile having an aperture opening;

a light distributing engine including a light emitter, a heat sink, and light distributing optics, the light distributing optics collecting the light from the light emitter and redirecting the light into a directional beam of output illumination, wherein an output aperture of the light distributing engine is aligned with the aperture opening of the ceiling tile so that the directional beam of output illumination is substantially transmitted to the space below the ceiling tile;

an electronic circuit configured to transmit and control electrical currents passing to and from the light distributing engine, the electronic circuit including a voltage regulation circuit, an electric current control circuit, and a control signaling circuit, the electric voltage regulation circuit providing regulated DC voltage levels for the electric current control circuit and the control signaling circuit, the control signaling circuit including a control signal receiver circuit arranged to receive and process control signals broadcast by a master controller outputting control instructions to the electric current control circuit, and the control signaling circuit further including a control signal transmitter circuit arranged to broadcast informational signals at regular time intervals to the master controller corresponding to first electrical signals;

one or more on-tile power transfer elements associated with the electronic circuit, wherein the light distributing engine, and the electronic circuit are substantially disposed within the ceiling tile, thereby requiring little or no plenum space above the ceiling tile, and wherein the one or more power transfer elements are at least partially embedded into the one or more recesses of the ceiling tile and in electrical contact with one or more electrical power access terminals on the electronic circuit and on the light distributing engine; and one or more affixation elements, the one or more affixation elements used to affix the electronic circuit, the one or more on-tile power transfer elements, the one or more electrical power access terminals, and the light distributing engine to each other and/or to the one or more recesses of the ceiling tile.

2. The ceiling lighting system of claim 1, further comprising:

supply-to-tile power delivery elements which enable high efficiency transmission of electrical current flow to and from the one or more power transfer elements embedded in the body of the ceiling tile; and a master controller including a means of receiving the first electrical signals, a means of processing the first electrical signals, and a means of broadcasting second electrical signals that provide control instructions transmitted to the electronic circuit to set the level of the electrical currents passed to and from the light distributing engine to which the electronic circuit is connected.

3. The ceiling lighting system of claim 2, wherein the supply-to-tile power delivery elements are electrically connected with electrical power input and electrical power output terminals on the light distributing engine embedded in the ceiling tile.

4. The ceiling lighting system of claim 2, wherein the supply-to-tile power delivery elements are electric cables terminating in electric connectors that plug directly into electric sockets for the electric cables embedded in the ceiling tile, the ceiling tile further comprising electric socket recesses set apart from the one or more recesses that the light distributing engine is embedded in.

5. The ceiling lighting system of claim 1, wherein the electric current control circuit broadcasts as part of the informational signals, a unique digital address for the light distributing engine.

6. The ceiling lighting system of claim 5, wherein the master controller prefaces each broadcast of the control signals with a reference state corresponding to the digital address of the light distributing engine such that the control signaling circuit receiving the control signals is able to recognize the digital address of the light distributing engine connected to it, and can thereby process only those parts of the control signals received from the master controller directed to the digital address of the light distributing engine to which it is connected.

7. The ceiling lighting system of claim 1, wherein the control signal transmitter circuit broadcasts at regular time intervals the informational signals including a digital group address for the light distributing engine, the group address representing the assignment of the light distributing engine to a particular grouping of light distributing engines.

8. The ceiling lighting system of claim 1, wherein the control signal transmitter circuit broadcasts at the regular time intervals the information signals including an operating current level for the light distributing engine.

9. The ceiling lighting system of claim 1, wherein the control signal transmitter circuit broadcasts at the regular time intervals the information signals including an operating brightness level for the light distributing engine.

10. The ceiling lighting system of claim 1, wherein the control signal transmitter circuit broadcasts at the regular time intervals the information signals including an operating current level for each separately operating portion of the light distributing engine for producing a directional beam of output illumination having an angular extent.

11. The ceiling lighting system of claim 1, wherein the control signaling circuit broadcasts informational signals at the regular time intervals as a direct response to requests for information included, in the control signals received from the master controller.

12. The ceiling lighting system of claim 1, wherein the electric voltage regulation circuit is connected to the light distributing engine and is embedded in the same recess as the light distributing engine to which it is connected.

13. The ceiling lighting system of claim 1, wherein the electric current control circuit is connected to the light distributing engine and is substantially embedded in the same recess as the light distributing engine to which it is connected, and unembedded portions of the electronic circuit, comprising the electric voltage regulation circuit and the control signaling circuit, are embedded in a spatially different location within the ceiling tile.

14. The ceiling lighting system of claim 1, wherein the electric current control circuit is connected to the light distributing engine and is substantially embedded in the same recess as the light distributing engine to which it is connected, and unembedded portions of the electronic circuit, comprising the electric voltage regulation circuit and the control signaling circuit, are embedded in the recess occupied by the light distributing engine.

15. The ceiling lighting system of claim 1, wherein the electronic circuit is connected to the light distributing engine within the ceiling tile and is embedded in the same recess as the light distributing engine to which it is connected.

16. The ceiling lighting system of claim 1, wherein the electronic circuit is connected to the light distributing engine within the ceiling tile and is embedded in a spatially different location than the light distributing engine.

17. The ceiling lighting system of claim 1, wherein the master controller produces second electrical signals that broadcast the control instructions to the electronic circuit, wherein the electronic circuit thereby receives, processes and acts upon the control instructions by supplying a level of electrical current to the light distributing engine occupying the one or more recesses.

18. The ceiling lighting system of claim 17, wherein the control instructions include:

commands addressed separately to the light distributing engine whose output light level is to be in an "off state" corresponding to the level of electrical currents being substantially zero;

further commands addressed separately to the light distributing engine whose output light level is to be in an "on state" corresponding to the level of electrical currents being greater than zero; and commands addressed separately to the light distributing engine whose output light level is to be an intermediary state between the "off state" and the "on state."

19. The ceiling lighting system of claim 1, wherein the master controller receives the first electrical signals from a signaling device selected from a group of signaling devices including an electrical switch, a keyboard, a keypad, a remote control emitting a light beam, a remote control emitting a radio frequency signal, a motion detector, an electronic message received via network connection, an electronic message received from a microprocessor, and the informational signals as broadcasts by the control signal circuit.

20. The ceiling lighting system of claim 1, wherein the light emitter of the light distributing engine has flat primary light emitting output apertures configured to emit light substantially into a solid angle of $2\pi$ steradians or less, where emitted light is substantially axially symmetric about an average pointing direction that is perpendicular to the plane of the output apertures.

21. The ceiling lighting system of claim 20, wherein the flat primary light emitting output apertures of the light emitter are oriented substantially perpendicular to output apertures of the corresponding the light distributing engine, the light distributing optics within the light distributing engine being separable into a first optical group and a second optical group, such that each optical group causes the average pointing direction of the light to change, the first optical group being configured to substantially collect the light from the light emitter and causing a first change to the pointing direction of substantially ninety degrees within a plane parallel to the plane of the output aperture of the light distributing engine, and the second optical group being configured to substantially collect the light from the first optical group and causing a second change to the pointing direction of greater than zero degrees and less than one hundred eighty degrees in a plane perpendicular to the plane of the output aperture of the light distributing engine, the second change resulting in an ultimate pointing direction of an output light distribution, the output light distribution exiting the output aperture of the light distributing engine.

22. The ceiling lighting system of claim 21, wherein the first optical group allows light to traverse a significant length along the original pointing direction while turning the light either continuously or in several discrete packets, such that the turned light spans a significantly larger extent in the dimension parallel to the original pointing direction of the light than either dimension of the original source, thereby having significantly lower average illuminance than the illuminance of the source.

23. The ceiling lighting system of claim 21, wherein the second optical group is configured such that the light traverses a significant length along the pointing direction the light had upon entering the second optical group, while turning it either continuously or in several discrete packets, such that the turned light spans a significantly larger extent in the dimension parallel to the pointing direction light had upon entering the second optical group than either dimension of the original source, thereby having significantly lower average illuminance than the illuminance of the source.

24. The ceiling lighting system of claim 23, wherein the second optical group comprises:

a light collecting and collimating optic with input aperture sized and positioned such that substantially all light emitted from the output aperture of the first optical group is collected;

a light guiding optic receiving the light from the light collecting and collimating optic, with means of extraction along its length, its length being oriented along the pointing direction of the collected light;

an optical turning structure spanning a length of an extraction region of the light guiding optic, such that substantially all of the extracted light is turned; and light retaining reflectors to prevent almost all of the light from escaping from any area other than the output aperture of the second optical group.

25. The ceiling lighting system of claim 24, wherein the light collecting and collimating optic is an input end of the light guiding optic.

26. The ceiling lighting system of claim 24, wherein the light guiding optic is a rectangular light guide plate with a facetted side, the facetted side configured to turn the light by total internal refraction, directing the light through a body of the light guide plate and out a side opposing the facetted side, the facetted side thereby serving as both a principle means of extraction and as an optical turning structure.

27. The ceiling lighting system of claim 24, wherein the light guiding optic is a light guide plate that narrows in one dimension along its length, the dimension being substantially parallel to the pointing direction of the output aperture of second optical group, such that the specified output side of the light guide plate disposed toward the output aperture of the light distributing engine and an opposing side converge toward each other along a length of the plate such that the light guide plate terminates in an edge significantly narrower than the input edge, forming a triangular or trapezoidal cross section in one orientation, the narrowing of the light guide plate resulting in a fractional TIR failure along its length which serves as a means of extraction.

28. The ceiling lighting system of claim 27, wherein the light guide plate is bounded by air on both its specified output side and the opposing side, such that light escapes substantially equally out of both surfaces via total internal reflection failure, further comprising a specularly reflective surface disposed to opposing side of the plate, such that the light exiting the opposing side hits the reflector and re-enters the light guide plate, such that substantially all light is ultimately extracted out the specified output side.

29. The ceiling lighting system of claim 27, wherein the optical turning structure is a facetted surface of a light transmitting film that is disposed on the specified output side of the light guide plate, the film having its facetted surface disposed toward the plate and a flat surface displaced away from plate, the facetted surface configured to turn the light by means of first refraction and then total internal reflection.

30. The ceiling lighting system of claim 27, wherein the optical turning structure is a facetted surface of a light transmitting film, the facetted surface coated with reflective material and the facetted surface disposed away from the light guide plate, the film having a flat transparent surface disposed toward the light guide plate, the flat surface optically coupled to the light guide plate via a low index or fraction media, the low index media having low index relative to both an index of the film and an index of the plate, the low index media causing substantially all total internal reflection failure to occur first on the opposing side of the plate, such that substantially all of the light travels through the low index media and into the film, where the light hits the reflective facetted surface of the film and turns, traveling back through the low index media, through the light guide plate, and exits out the specified output side of the light guide plate.

31. The ceiling lighting system of claim 21, wherein the first optical group comprises:

a light collecting and collimating optic with an input aperture sized and positioned such that substantially all light emitted by the light emitter is collected;

a light guiding optic receiving the light from the light collecting and collimating optic, with means of extraction along its length, its length being oriented along the pointing direction of the collected light;

an optical turning structure spanning the length of an extraction region of the light guiding optic, such that substantially all of the extracted light is turned; and light retaining reflectors positioned to prevent any significant amount of light from escaping from any area other than the output aperture of the first optical group.

32. The ceiling lighting system of claim 31, wherein the light collecting and collimating optic is an etendué preserving reflector with a light collecting input aperture whose edge dimensions are $x_1$ by $x_1$ if square; whose edge dimensions are $x_1$ and $y_1$ if rectangular, and whose diameter is d1 if circular, all closely matching the size and shape of the flat primary light emitting output aperture of the light emitter, and with a light transmitting output aperture closely matching a corresponding light receiving input aperture of the light guiding optic, the light transmitting output aperture's edge dimensions are $X_1$ by $X_1$ if square, $X_1$ by $Y_1$ if rectangular and $D_1$ if circular, reflective sidewalls between the etendue preserving reflector's light collecting input aperture and the light transmitting output aperture, governed by satisfying the Sin Law at every point, which for the square, rectangular and circular apertures involved are $x_1 \sim X_1 \sin\theta_1$, $y_1 \sim Y_1 \sin\theta_2$, and $d_1 \sim D_1 \sin\theta_1$, when the light collecting input aperture receives the light substantially within +/−90-degrees, and the light transmitting output aperture emits a light beam having a square cone $+/-\theta_1$ by $+/-\theta_1$ when both the light collecting input aperture and the light transmitting output apertures are square, $+/-\theta_1$ by $+/-\theta_2$ when one of the light collecting input aperture and the light transmitting output aperture is rectangular, and $+/-\theta_1$ when both the light collecting input aperture and light transmitting output aperture are circular.

33. The ceiling lighting system of claim 31, wherein the light collecting and collimating optic is an input end of the light guiding optic.

34. The ceiling lighting system of claim 31, wherein the light guiding optic is a rectangular light pipe with a facetted microstructure on one side, the facetted microstructure configured to turn light by total internal refraction, directing light through a body of the light pipe and out an opposing side of the light pipe, the facetted microstructure thereby serving as both a principle means of extraction and as an optical turning structure.

35. The ceiling lighting system of claim 31, wherein the light guiding optic is a four-sided light pipe formed by a transparent dielectric media that narrows in one dimension along its length, the dimension being substantially parallel to the pointing direction of the light after turning, such that a specified output side of the light pipe disposed toward the second optical group and the opposing side converge toward each other along a length of the pipe such that the light pipe terminates in an edge significantly narrower than the input edge, forming a triangular or trapezoidal cross section in one orientation, the narrowing of the light pipe resulting in a fractional TIR failure along its length which serves as a means of light extraction into a dielectric medium surrounding or immersing the light pipe.

36. The ceiling lighting system of claim 35, wherein the light pipe is bounded by air on both its specified output side and the opposing side, such that light escapes substantially equally out of both opposing surfaces of the light pipe via total internal reflection failure, and further comprising a specularly reflective surface disposed to the opposing side of the pipe, such that light exiting the opposing side hits the reflective surface and re-enters the light pipe, such that substantially all light is ultimately extracted out the specified output side.

37. The ceiling lighting system of claim 35, wherein the optical turning structure is a facetted surface of a light transmitting film that is disposed to the specified output side of the light pipe, the film having its facetted surface disposed toward the light pipe and a flat surface displaced away from the light pipe, the facetted surface configured to turn light by means of first refraction and then total internal reflection.

38. The ceiling lighting system of claim 35, wherein the optical turning structure is a facetted surface of a light transmitting film, the facetted surface coated with reflective material and disposed away from light pipe, the film having a flat transparent surface disposed toward the light pipe, the flat surface optically coupled to the light pipe via a low index or fraction media, the low index media having low index relative to both an index of the film and an index of the light pipe, the low index media causing substantially all total internal reflection failure to occur first on the opposing side of the light pipe, such that substantially all of the light travels through the low index media and into the film, where the light hits the reflective facetted surface of the film and turns, traveling back through the low index media, through the light pipe, and exits out the specified output side of the light pipe.

39. The ceiling lighting system of claim 20, wherein the output apertures of the light emitter are oriented substantially perpendicular to ultimate output apertures of the light distributing engine, the light distributing optics being separable into a first optical group and a second optical group, the first optical group being disposed to collect light output from the source and preserving the original pointing direction of the light, the second optical group being disposed to collect the light from the first optical group and causing a change to the pointing direction of greater than zero degrees and less than one hundred eighty degrees in a plane perpendicular to a plane defined by the output aperture of the light distributing engine, this second change resulting in an ultimate pointing direction of the light distribution that exits the output aperture of the light distributing engine.

40. The ceiling lighting system of claim 20, wherein the output apertures of the light emitter are oriented substantially parallel to an ultimate output aperture of the light distributing engine, the light distributing optics substantially preserving an original pointing direction of the light.

41. The ceiling lighting system of claim 1, wherein the light emitter is a semiconductor or organic light emitting diode (LED).

42. The ceiling lighting system of claim 1, wherein the light emitter is a fluorescent emitting device or micro plasma emitting device.

43. A ceiling lighting system comprising:

a drywall sheet having one or more recesses extending at least partially through the drywall sheet;

a light distributing engine including a light emitter and light distributing optics, the light distributing optics collecting light from the light emitter and directing the light into a directional light distribution such that an output aperture of the light distributing engine is aligned with one of the one or more recesses so that the directional light distribution is substantially transmitted to a space below the drywall sheet;

an electronic circuit;

one or more electrical power connection elements, wherein the light distributing engine, the electronic circuit, and the one or more electrical power connection elements are substantially disposed within the drywall sheet, thereby requiring little or no plenum space above the drywall sheet;

one or more affixation elements, the one or more affixation elements used to affix the light distributing engine, the electronic circuit, and the one or more electrical power connection elements directly or indirectly to the drywall sheet;

supply-to-sheet power transmitting elements which transmit power from a low voltage DC power supply to on-sheet power input elements embedded in the drywall sheet, on-sheet power transmitting elements transferring power from the on-sheet power input elements to on-sheet embedded electronic circuits and the on-sheet embedded light distributing engine; and a master controller, comprising one or more user input devices, further comprising receivers that collect broadcasted signals and information from sensor circuits and electronic control circuits embedded in the drywall sheets, one or more computer implemented methods to interpret user inputs as well as the broadcasted signals and information, and a means of broadcasting lighting commands, the lighting commands instructing embedded integrated control circuits regarding power distribution to the light distributing engine on the drywall sheet.

44. The ceiling lighting system of claim 43, further comprising ceiling joists and drywall fasteners, the drywall sheet affixed to the ceiling joists by the drywall fasteners.

45. The ceiling lighting system of claim 43, wherein the embedding of the light distributing engine, electronic circuit, and the one or more affixation elements into the drywall sheet results in fully assembled tile system units that can be subsequently transported as one unit, installed into a ceiling as one unit, and connected to a power supply as one unit, the one unit requiring little or no plenum space above it.

* * * * *